US009475992B2

(12) United States Patent
Etter

(10) Patent No.: US 9,475,992 B2
(45) Date of Patent: Oct. 25, 2016

(54) PRODUCTION AND USE OF A PREMIUM FUEL GRADE PETROLEUM COKE

(76) Inventor: Roger G. Etter, Cardington, OH (US)

( * ) Notice: Subject to any disclaimer, the term of this patent is extended or adjusted under 35 U.S.C. 154(b) by 1862 days.

(21) Appl. No.: 11/178,932

(22) Filed: Jul. 11, 2005

(65) Prior Publication Data

US 2006/0032788 A1 Feb. 16, 2006

Related U.S. Application Data

(63) Continuation of application No. 10/027,677, filed on Dec. 20, 2001, now abandoned, which is a continuation-in-part of application No. 09/556,132, filed on Apr. 21, 2000, now abandoned, and a continuation-in-part of application No. 09/763,282, filed on Feb. 20, 2001, now abandoned.

(30) Foreign Application Priority Data

Aug. 20, 1999 (WO) ..... PCT/US99/19091

(51) Int. Cl.

| | |
|---|---|
| ***C10B 57/06*** | (2006.01) |
| ***C10B 55/00*** | (2006.01) |
| ***C10B 57/00*** | (2006.01) |
| ***C10G 9/00*** | (2006.01) |
| ***C10L 5/00*** | (2006.01) |

(Continued)

(52) U.S. Cl.

CPC ..... *C10B 57/06* (2013.01); *C10B 55/00* (2013.01); *C10B 57/005* (2013.01); *C10G 9/005* (2013.01);

(Continued)

(58) Field of Classification Search

None

See application file for complete search history.

(56) References Cited

U.S. PATENT DOCUMENTS 1,831,719 A 11/1931 Pelzer
1,873,024 A 8/1932 Pelzer (Continued)

FOREIGN PATENT DOCUMENTS

DE 19540780 5/1996
DE 19540780 A1 5/1996

(Continued)

OTHER PUBLICATIONS

W.R. Grace & Co.-Conn., Guide to Fluid Catalytic Cracking Part Two, copyright 1996, 98 pages.

(Continued)

*Primary Examiner* — Tam M Nguyen

(57) ABSTRACT

A premium "fuel-grade" petroleum coke is produced by modifying petroleum coking technology. Coking process parameters are controlled to consistently produce petroleum coke within a predetermined range for volatile combustible material (VCM) content. The invention includes a process of producing a coke fuel, the method comprising steps: (a) obtaining a coke precursor material derived from crude oil and having a volatile organic component; and (b) subjecting the coke precursor material to a thermal cracking process for sufficient time and at sufficient temperature and under sufficient pressure so as to produce a coke product having volatile combustible materials (VCMs) present in an amount in the range of from about 13% to about 50% by weight. Most preferably, the volatile combustible materials in the coke product typically may be in the range of from about 15% to about 30% by weight. The present invention also provides methods for (1) altering the coke crystalline structure, (2) improving the quality of the coke VCM, and (3) reducing the concentration of coke contaminants. Fuels made from the inventive coke product and methods of producing energy through the combustion of such fuels are also included. Finally, novel environmental control techniques are developed to take optimal advantage of the unique characteristics of this upgraded petroleum coke.

19 Claims, 12 Drawing Sheets

(51) Int. Cl.

| | |
|---|---|
| ***C10L 9/00*** | (2006.01) |
| ***C10L 9/02*** | (2006.01) |
| ***C10L 9/04*** | (2006.01) |
| ***C10L 9/10*** | (2006.01) |

(52) U.S. Cl.

CPC .. *C10L 5/00* (2013.01); *C10L 9/00* (2013.01); *C10L 9/02* (2013.01); *C10L 9/04* (2013.01); *C10L 9/10* (2013.01)

(56) References Cited

U.S. PATENT DOCUMENTS

| | | | | |
|---|---|---|---|---|
| RE20,011 | E | 6/1936 | Pelzer | 202/15 |
| 2,881,130 | A | 4/1959 | Pfeiffer et al. | 208/127 |
| 2,888,393 | A | 5/1959 | Ballard | |
| 2,888,395 | A | 5/1959 | Henny | |
| 2,905,622 | A | 9/1959 | McCarthy | |
| 2,922,755 | A | 1/1960 | Hackley, Jr. | 208/39 |
| 3,382,084 | A | 5/1968 | Folkin et al. | 106/284 |
| 3,617,480 | A | 11/1971 | Keel | 208/50 |
| 3,619,413 | A | 11/1971 | Folkins | |
| 3,661,543 | A | 5/1972 | Saxton | 8/206 |
| 3,684,697 | A | 8/1972 | Gamson | 208/131 |
| 3,702,516 | A | 11/1972 | Luckenbach | 48/206 |
| 3,702,816 | A | 11/1972 | Buchmann et al. | 208/50 |
| 3,759,676 | A | 9/1973 | Lahn | 8/206 |
| 3,775,290 | A | 11/1973 | Peterson et al. | 208/50 |
| 3,775,294 | A | 11/1973 | Peterson et al. | 208/89 |
| 3,816,084 | A | 6/1974 | Moser, Jr. et al. | 5/72 |
| 3,842,165 | A | 10/1974 | Grindstaff et al. | 423/448 |
| 3,852,047 | A | 12/1974 | Schlinger et al. | 44/24 |
| 3,896,023 | A | 7/1975 | Ozaki et al. | 208/46 |
| 3,917,564 | A | 11/1975 | Meyers | 208/131 |
| 3,932,587 | A | 1/1976 | Grantham et al. | 423/242 |
| 3,960,701 | A | 6/1976 | Schroeder | 208/8 |
| 4,043,898 | A | 8/1977 | Kegler | 208/50 |
| 4,049,538 | A | 9/1977 | Hayashi et al. | 208/50 |
| 4,055,484 | A | 10/1977 | Blaser et al. | 208/127 |
| 4,096,097 | A | 6/1978 | Yan | 2/510 |
| 4,100,035 | A | 7/1978 | Smith | 7/78 |
| 4,178,229 | A | 12/1979 | McConaghy et al. | 208/50 |
| 4,188,277 | A | 2/1980 | Martin | 204/190 |
| 4,198,380 | A | 4/1980 | Kohl | 23/242 |
| 4,202,868 | A | 5/1980 | Hayashi et al. | 252/510 |
| 4,214,979 | A | 7/1980 | Nakanishi | |
| 4,269,696 | A | 5/1981 | Metrailer | 208/120 |
| 4,291,008 | A | 9/1981 | Hsu et al. | 423/461 |
| 4,295,956 | A | 10/1981 | Metrailer | 208/127 |
| 4,302,324 | A | 11/1981 | Chen et al. | 208/131 |
| 4,312,742 | A | 1/1982 | Hayashi | 208/50 |
| 4,326,853 | A | 4/1982 | Sze et al. | 44/1 F |
| 4,334,980 | A | 6/1982 | Hsu | |
| 4,358,366 | A | 11/1982 | Alford | |
| 4,364,741 | A | 12/1982 | Villa | 44/51 |
| 4,369,171 | A | 1/1983 | Grindstaff et al. | 423/461 |
| 4,388,152 | A | 6/1983 | Wasson et al. | 201/6 |
| 4,394,250 | A | 7/1983 | Grossberg | |
| 4,399,024 | A | 8/1983 | Fukui | |
| 4,406,872 | A | 9/1983 | Kapner et al. | 423/461 |
| 4,441,887 | A | 4/1984 | Funk | 4/51 |
| 4,443,415 | A | 4/1984 | Queneau et al. | 423/68 |
| 4,447,259 | A | 5/1984 | Funk | 44/51 |
| 4,455,219 | A | 6/1984 | Janssen et al. | 208/131 |
| 4,466,883 | A | 8/1984 | Eickemeyer | |
| 4,478,602 | A | 10/1984 | Kelley et al. | 44/51 |
| 4,479,804 | A | 10/1984 | Chen et al. | 44/1 SR |
| 4,481,101 | A | 11/1984 | Yan | 8/50 |
| 4,490,171 | A | 12/1984 | Suzuki et al. | 75/42 |
| 4,498,976 | A | 2/1985 | Degnan et al. | |
| 4,518,486 | A | 5/1985 | Jansma | 208/131 |
| 4,519,898 | A | 5/1985 | Allan | 208/131 |
| 4,521,277 | A | 6/1985 | Calderon et al. | 196/46 |
| 4,534,951 | A | 8/1985 | Kortovich et al. | 423/448 |
| 4,547,284 | A | 10/1985 | Sze et al. | 208/50 |
| 4,551,232 | A | 11/1985 | Calderon et al. | 208/92 |
| 4,631,025 | A | 12/1986 | Casper et al. | 432/15 |
| 4,666,585 | A | 5/1987 | Figgins et al. | 208/131 |
| 4,797,197 | A | 1/1989 | Mallari | 208/131 |
| 4,828,680 | A | 5/1989 | Green et al. | 208/120 |
| 4,853,106 | A | 8/1989 | Grove et al. | 208/131 |
| 4,874,505 | A | 10/1989 | Bartilucci et al. | 208/131 |
| 4,895,636 | A | 1/1990 | Chen et al. | 208/113 |
| 5,007,987 | A | 4/1991 | Block et al. | 201/17 |
| 5,009,767 | A | 4/1991 | Bartilucci et al. | 208/85 |
| 5,015,362 | A | 5/1991 | Chin | 8/121 |
| 5,034,030 | A | 7/1991 | Miller et al. | 55/96 |
| 5,110,448 | A | 5/1992 | Adams et al. | 208/131 |
| 5,114,564 | A | 5/1992 | Goyal | 208/131 |
| 5,114,566 | A | 5/1992 | Naeger et al. | 208/289 |
| 5,165,902 | A | 11/1992 | Bortz et al. | 423/235 |
| 5,174,891 | A | 12/1992 | Becraft | |
| 5,215,557 | A | 6/1993 | Johnson et al. | 55/122 |
| 5,246,680 | A | 9/1993 | Pikkujäamsä | 423/244.07 |
| 5,258,115 | A | 11/1993 | Heck et al. | 208/131 |
| 5,259,864 | A | 11/1993 | Greenwalt | 75/445 |
| 5,277,795 | A | 1/1994 | Thornhill et al. | 208/251 |
| 5,339,755 | A | 8/1994 | Smith | 110/345 |
| 5,350,503 | A | 9/1994 | Freymeyer et al. | 208/131 |
| 5,439,658 | A | 8/1995 | Johnson et al. | 423/243.07 |
| 5,470,556 | A | 11/1995 | Samish | 423/243.08 |
| 5,490,918 | A | 2/1996 | Meek | 8/131 |
| 5,496,729 | A | 3/1996 | Monticello | 435/282 |
| 5,529,599 | A | 6/1996 | Calderon | 75/10.63 |
| 5,591,326 | A | 1/1997 | Shih | 8/251 R |
| 5,635,149 | A | 6/1997 | Klingspor et al. | 423/243.08 |
| 5,651,948 | A | 7/1997 | Myers et al. | 423/244.07 |
| 5,954,949 | A | 9/1999 | Ohsol et al. | 208/131 |
| 6,024,863 | A | 2/2000 | LeCours et al. | 208/131 |
| 6,056,882 | A | 5/2000 | Scalliet | 210/708 |
| 6,168,709 | B1 | 1/2001 | Etter | |
| 6,169,054 | B1 | 1/2001 | Pereira | |
| 6,251,307 | B1 | 6/2001 | Lecours et al. | |
| 7,037,408 | B2 | 5/2006 | Wilborn | |
| 7,438,786 | B2 | 10/2008 | Malsbury | |
| 7,727,382 | B2 | 6/2010 | Sparks | |
| 8,206,574 | B2 | 6/2012 | Etter | |
| 8,361,310 | B2 | 1/2013 | Etter | |
| 8,372,264 | B2 | 2/2013 | Etter | |
| 8,372,265 | B2 | 2/2013 | Etter | |
| 8,394,257 | B2 | 3/2013 | Etter | |
| 2001/0006156 | A1 | 7/2001 | Pereira et al. | |
| 2002/0179493 | A1 | 12/2002 | Etter | |
| 2004/0118746 | A1* | 6/2004 | Wilborn et al. | 208/131 |
| 2004/0173504 | A1* | 9/2004 | Klasnich et al. | 208/131 |
| 2004/0238408 | A1* | 12/2004 | Malsbury | 208/131 |
| 2005/0263439 | A1 | 12/2005 | Stark | |
| 2006/0060506 | A1 | 3/2006 | Siskin et al. | |
| 2009/0145810 | A1 | 6/2009 | Etter | |
| 2009/0152165 | A1 | 6/2009 | Etter | |
| 2009/0209799 | A1 | 8/2009 | Etter | |
| 2010/0170827 | A1 | 7/2010 | Etter | |
| 2010/0326880 | A1 | 12/2010 | Chakka | |
| 2011/0044881 | A1 | 2/2011 | Stansberry | |
| 2012/0269685 | A1 | 10/2012 | Etter | |
| 2013/0213858 | A1 | 8/2013 | Etter | |
| 2013/0213859 | A1 | 8/2013 | Etter | |
| 2014/0048445 | A1 | 2/2014 | Etter | |
| 2014/0061097 | A1 | 3/2014 | Etter | |
| 2014/0082999 | A1 | 3/2014 | Faegh | |
| 2014/0097124 | A1 | 4/2014 | Etter | |

FOREIGN PATENT DOCUMENTS

| | | |
|---|---|---|
| WO | WO9520637 | 8/1995 |
| WO | WO/2009/103088 | 8/2009 |
| WO | WO2014175978 | 10/2014 |

OTHER PUBLICATIONS

Ellis, Paul J. and Paul A. Christopher, Tutorial: Delayed Coking Fundamentals, Great Lakes Carbon Corporation, Prepared for presentation at the AIChE 1998 Spring National Meeting Mar. 8-12, 1998, 20 pages.

(56) References Cited

OTHER PUBLICATIONS

Fletcher, Peter, Delayed Coking, *Chem. Engineer*, Sep./Oct. 1983, 21-23.
Janssen et al., Improved Coking Design Can Up Liquid Yields, *Oil & Gas J.* (Jun. 25, 1984) 79-83.
Lieberman, Norman, Shot Coke: It's Origins and Prevention, Oil & Gas J. (Jul. 8, 1985) 45-46.
Lieberman, Norman, Good Operating Techniques Improve Coker Yield, Increase Gas-Oil Production, Oil & Gas J. (Mar. 10, 1986) 53-54.
Lieberman, Norman, Procedure Reduces Coke Cutting Time for Large Drums, Gas & Oil J. (Nov. 24, 1986) 85-86.
Barnett, Jack, Desalters Can Remove More Than Salts and Sediment, Oil & Gas J. (Apr. 11, 1988) 43-49.
Archuletta et al., Cooperative Corrosion Control and Treatment Program Proves Effective, Gas & Oil J. (Aug. 6, 1990) 60-68.
Elliott, John, Design Operation Factors Can Up Coker Liquid Yields, Gas & Oil J. (Feb. 4, 1991) 41-44.
Filtration Method Efficiently Desalts Crude In Commercial Test, Gas & Oil J. (May 17, 1993) 59-60.
Bansal et al., Improve Your Coking Process, Hydrocarbon Processing (Feb. 1994) 63-66.
Stefani, A., Debottleneck Delayed Cokers For Greater Profitability, Hydorcarbon Processing (Jun. 1996) 99-103.
Harris, J.R., Use Desalting For FCC Feedstocks, Hydrocarbon Processing (Aug. 1996) 63-68.
Dickenson, et al., Refiner Options for Converting and Utilizing Heavy Fuel Oil, Hydrocarbon Processing (Feb. 1997) 57-62.
Auxilary Equipment, Corrosion Focus of Refining Meeting, Oil & Gas J. (Apr. 4, 1994).
Wagoner et al., Burning Profiles for Solid Fuels, Amer. Soc. Mech. Eng. (Aug. 7, 1967) 1-8.
Reid, William, Ash Chemistry And Its Effect in Broiler Furnaces, Elec. Power Res. Inst. (Dec. 2, 1980) 1-13.
Burning Petroleum Coke: Boiler/Complex FGD or Fluid-Bed Combustor?, (Jul. 7, 1983).
Lieberman, Norman, Time for Coking Cycle Can Be Routinely Halved, Oil & Gas J. (Aug. 29, 1983) 39-44.
Delayed Coking, Hydrocarbon Processing (Sep. 1984) 113.
Kronenberger et al., Troubleshooting the Refinery Desalter Operation, Materials Performance (Jul. 1986) 9-17.
Muzio et al., Dry Sorbent Emission Control Technologies, JAPC Assoc. (May 1987) 642-654.
Deepwater Fires 100% Coke, Sells All FGD Gypsoum Product, Power (Oct. 1988).
Lieberman, Norman, Frequently Asked Questions on Coke Quality Answered, Oil & Gas J. (Mar. 27, 1989) 67-69.
Makansi, Jason, Clean Air Act Amendments: The Engineering Response, Power (Jun. 1991) 11-60.
Herzog et al., Feasibility, Modeling and Economics of Sequestering Power Plant $CO_2$ Emissions in the Deep Ocean, Envior, Progress vol. 10 (Feb. 1991) 64-74.
Elliott, J.D., Maximize Distillate Liquid Products, Hydrocarbon Proc. (Jan. 1992) 75-80.
Sulfur Dioxide Control, Steam 40 (1992) Chapter 35.
Fuel Ash Effects on Boiler Design and Operation, Steam 40 (1992) Chapter 20(pp. 1-28).
Sources of Chemical Energy, Steam 40 (1992) Chapter 8.
Burners and Combustion Systems for Pulverized Coal, Steam 40 (1992) Chapter 13.
Kent, James, Handbook of Industrial Chemistry, Published by Van Norstrand Reinhold (1992).
Rittenhouse, R.C., Action Builds On The Road To CAA Compliance (Part II), Power Eng. (Jun. 1992) 43-50.
Batra et al, Desing Process Equipment for Corrosion Control, Chem. Eng. Prog. (May 1993) 68-76.
Livengood et al., FG Technologies for Combined Control of $SO_2$ and $NO_x$, Power Eng. (Jan. 1994) 38-42.
Torrens et al., Electric Utility Response to the Clean Air Act Amendments, Power Eng. (Jan. 1994) 43-47.
Coke Quality, Oil & Gas J. (May 2, 1994) 114-115.
Wolsky et al, $CO_2$ Capture From the Flue Gas of Conventional Fossil-Fuel-Fired Power Plants, Envr. Progress vol. 13 (Aug. 1994) 214-219.
Chue et al., Comparison of Activated Carbon and Zeolite 13X for $CO_2$ Recovery From Flue Gas by Pressure Swing Adsorption, Amer. Chem. Soc. (1995) 591-598.
Akai et al., Performance Evaluation of Fossil Power Plant With $CO_2$ Recovery and Sequestering System, Energy Conyers. Mgmt. vol. 36 Nos. 6-9(1995) 801-804.
Coking/Catalytic Cracking/Catalytic Reforming, HydroCarbon Processing (Oct. 1996).
Refining 1996, HydroCarbon (Nov. 1996).
U.S. Department of Energy, DOE Techline Fossil Energy, New Research Focuses on Reducing Energy Consumption, Improving Environmental Performance of Refinery Coking Process, 2 pp., (Apr. 22, 1999).
Laredo et al., Identification of Naphthenic Acids and Other Corrosivity-Related Characteristics in Crude Oil and Vacuum Gas Oils from a Mexican Refinery, Energy & Fuels (2004, No. 18, 1687-1694).
Wang et al., Removal of naphthenic acids from a vacuum fraction oil with an ammonia solution of ethylene glycol, Fuel, (2006, No. 85, 2489-2493).

* cited by examiner

PRODUCTION AND USE OF A PREMIUM FUEL GRADE PETROLEUM COKE

This application is a continuation of U.S. application Ser. No. 10/027,677, filed Dec. 20, 2001 now abandoned, which is a continuation-in-part of U.S. application Ser. No. 09/556,132, filed Apr. 21, 2000 now abandoned, which claimed the benefit of International Application No. PCT/US99/19091, filed Aug. 20, 1999, which claimed the benefit of U.S. application Ser. No. 09/137,283, filed Aug. 20, 1998, now U.S. Pat. No. 6,168,709. U.S. application Ser. No. 10/027,677, filed Dec. 20, 2001, is also a continuation-in-part of U.S. application Ser. No. 09/763,282, filed Feb. 20, 2001 now abandoned, which claimed the benefit of International Application No. PCT/US99/19091, filed Aug. 20, 1999, which claimed the benefit of U.S. application Ser. No. 09/137,283, filed Aug. 20, 1998, now U.S. Pat. No. 6,168,709.

The entirety of each of the above priority documents is hereby incorporated by reference.

BACKGROUND OF THE INVENTION

1. Field of the Invention

This invention relates generally to the field of petroleum coking processes, and more specifically to modifications of petroleum coking processes for the production of a premium-quality, "fuel-grade" petroleum coke. This invention also relates generally to the use of this new formulation of petroleum coke for the production of energy, and more specifically to modifications in conventional, solid-fuel furnaces and environmental control systems to take optimal advantage of its unique properties.

2. Description of Prior Art

Since initial efforts to refine crude oil in the U.S. during the late 1800s, the search for an appropriate use for the heaviest fractions of crude oil (i.e. the "bottom of the barrel") has been a perplexing problem. Initially, many refineries received little to no value from the heaviest fractions of crude oil. Some were noted to simply discard the "bottom of the barrel." Over time, some of the heavy crude oil fractions were used in asphalt products and residual fuel oils. However, the demand for these products was not sufficient to consume increasing production.

As demand for transportation fuels (e.g. gasoline, diesel, and aviation fuels) increased in the early 1900s, thermal cracking processes were developed to convert the heavy crude oil fractions into lighter products. These refinery processes evolved into the modern coking processes that predominate the technology currently used to upgrade the heaviest fractions of the crude oil. These processes typically reduce the quantity of heavy oil fractions, but still produce unwanted by-products (e.g. petroleum coke) with marginal value.

A. Production of Petroleum Coke: Coking Processes

In general, modern coking processes employ high-severity, thermal decomposition (or "cracking") to maximize the conversion of very heavy, low-value residuum feeds to lower boiling hydrocarbon products. Coker feedstocks typically consist of non-volatile, asphaltic and aromatic materials with "theoretical" boiling points exceeding 1000° F. at atmospheric pressure. The boiling points are "theoretical" because these materials coke or crack from thermal decomposition before they reach such temperatures.

Coking feedstocks normally consist of refinery process streams which cannot economically be further distilled, catalytically cracked, or otherwise processed to make fuel-grade blend streams. Typically, these materials are not suitable for catalytic operations because of catalyst fouling and/or deactivation by ash and metals. Common coking feedstocks include atmospheric distillation residuum, vacuum distillation residuum, catalytic cracker residual oils, hydrocracker residual oils, and residual oils from other refinery units. Consequently, coking feedstocks vary substantially among refineries. Their composition and quantity primarily depend on (1) the input crude oil blend, (2) refinery processing equipment, and (3) the optimized operation plan for any particular refinery. In addition, contaminant compounds, which occur naturally in the crude oil, generally have relatively high boiling points and relatively complex molecular structures. Consequently, these contaminant compounds, containing sulfur and heavy metals, tend to concentrate in these residua. Many of the worst process streams in the refinery have become coker feedstock, and their contaminants usually end up in the petroleum coke by-product. For this reason, the coking processes have often been labeled as the "garbage can" of the refinery.

There are three major types of modern coking processes currently used in refineries to convert the heavy crude oil fractions into lighter hydrocarbons and petroleum coke: Delayed Coking, Fluid Coking™, and Flexicoking™. In all three of these coking processes, the petroleum coke is considered a by-product that is tolerated in the interest of more complete conversion of refinery residues to lighter hydrocarbon compounds, referred to as "cracked liquids" throughout this discussion. These cracked liquids range from pentanes to complex hydrocarbons with boiling ranges typically between 350 and 950° F. The heavier cracked liquids (e.g. gas oils) are commonly used as feedstocks for further refinery processing that transforms them into transportation fuel blend stocks.

The delayed coking process has evolved with many improvements since the mid-1930s. Essentially, delayed coking is a semi-continuous process in which the heavy feedstock is heated to a high temperature (between 900° F. and 1000° F.) and transferred to large coking drums. Sufficient residence time is provided in the coking drums to allow the thermal cracking and coking reactions to proceed to completion. The heavy residua feed is thermally cracked in the drum to produce lighter hydrocarbons and solid, petroleum coke. One of the initial patents for this technology (U.S. Pat. No. 1,831,719) discloses "The hot vapor mixture from the vapor phase cracking operation is, with advantage, introduced into the coking receptacle before its temperature falls below 950° F., or better 1050° F., and usually it is, with advantage, introduced into the coking receptacle at the maximum possible temperature." The "maximum possible temperature" in the coke drum favors the cracking of the heavy residua, but is limited by the initiation of coking in the heater and downstream feed lines, as well as excessive cracking of hydrocarbon vapors to gases (butane and lighter). When other operational variables are held constant, the "maximum possible temperature" normally minimizes the volatile material remaining in the petroleum coke by-product. In delayed coking, the lower limit of volatile material in the petroleum coke is usually determined by the coke hardness. That is, petroleum coke with <8 wt. % volatile materials is normally so hard that the drilling time in the decoking cycle is extended beyond reason. Various petroleum coke uses have specifications that require the volatile content of the petroleum coke by-product to be <12%. Consequently, the volatile material in the petroleum coke by-product typically has a target range of 8-12 wt. %. Prior art in the delayed coking process, including recent developments, has attempted to maximize the production of cracked liquids with less coke production. In this manner, the prior art of delayed coking has attempted to minimize coke yield and the amount of volatile materials it contains.

Fluid Coking™, developed since the late 1950s, is a continuous coking process that uses fluidized solids to increase the conversion of coking feedstocks to cracked liquids, and further reduce the volatile content of the product coke. In Fluid Coking™, the coking feedstock blend is sprayed into a fluidized bed of hot, fine coke particles in the reactor. Since the heat for the endothermic cracking reactions is supplied locally by these hot particles, this permits the cracking and coking reactions to be conducted at higher temperatures (about 480-565° C. or 900-1050° F.) and shorter contact times than in delayed coking. Roughly 15-25% of the coke is burned in an adjacent burner vessel in order to create the hot coke nuclei to contact the feed in the reactor vessel, and satisfy the process heat requirements. The Fluid Coking™ technology effectively removes the lower limit of volatile content in the petroleum coke, associated with delayed coking. The volatile content of the petroleum coke produced by the Fluid Coking™ technology is typically minimized (or reduced), within the range of 4-10 wt. %. Consequently, the quantity of petroleum coke, produced by a given feedstock, and its volatile content are significantly reduced in the Fluid Coking™ technology (vs. delayed coking).

Flexicoking™ is an improvement of the Fluid Coking™ process, in which a third major vessel is added to gasify the product coke. A coking reactor, a heater (vs. burner) vessel, and a gasifier are integrated into a common fluidized-solids circulating system. The "cold coke" from the reactor is partially devolatilized in the heater vessel. In the gasifier, over 95% of the gross product coke is gasified to produce either low heating-value fuel gas or synthesis gas to make liquid fuels or chemicals. In this manner, the net coke yield is substantially reduced. The purge coke (~5% of the product coke) from the Flexicoking™ process normally contains about 99% of the feed metals and has a volatile content of 2-7 wt. %.

Through the years, improvements in the coking processes have been substantially devoted to increasing the yield and recovery of cracked liquids and decreasing the coke yield. Thus, the content of volatile material in the resulting petroleum coke has been continually decreased, where possible. Various patents disclose improvements to the delayed coking process that include, but are not limited to, (1) coker designs that reduce drum pressures (e.g. 25 to 15 psig), (2) coker designs to provide virtually no recycle, and (3) periodic onstream spalling of heaters to increase firing capabilities and run length at higher heater outlet temperatures. These technology advances have been implemented in an effort to maximize the cracked liquid yields of the delayed coker and reduce petroleum coke yields and volatile content.

Other modifications of these coking processes introduce various wastes for disposal. Several patents disclose various means to inject certain types of oily sludges. Other prior art uses these coking processes for the disposal of used lubricating oils. Additional patents disclose the use of these coking processes for the disposal of other wastes. In general, these patents discuss the potential limited impact on the coke yield and volatile content, and promote other means to negate any increases. Also, these waste disposal techniques often increase the ash content of the coke and can introduce additional, undesirable impurities, such as sodium. Consequently, the objectives of these patents are to reuse or dispose of these wastes rather than enhance the petroleum coke properties.

B. Uses of Petroleum Coke

The uses of the petroleum coke by-products from these coking processes depend primarily on its (1) physical properties and (2) chemical composition (i.e. degree of contamination). The physical properties (density, crystalline structure, etc.) of the petroleum coke by-product are determined by various factors, including coking feedstock blend, coking process and operation, and volatile content of the coke. The chemical composition and degree of contamination of the petroleum coke is primarily determined by the composition of the coking feedstock blend. That is, most of the contaminant compounds (e.g. sulfur, nitrogen, and various metals) in the petroleum coke by-product come from heavy, complex chemical structures in the coking feedstocks, which normally come from the refinery's crude oil blend. Conversely, the contaminants in the refinery's crude oil blend ultimately concentrate in the petroleum coke. Consequently, light, sweet crudes generally have less contaminants and allow the production of higher value petroleum coke by-products. However, crude oils are becoming increasingly heavy and sour, increasing the production of low-grade petroleum coke.

Premium and intermediate grades of petroleum cokes have low to moderate levels of sulfur (e.g. 0.5-2.5%) and heavy metals (vanadium, nickel, etc.). These grades of coke have various uses as electrodes and metallurgical carbon in the production of aluminum and steel. In some applications, the raw petroleum coke is further processed by calcining to remove volatile material and increase the coke density. Petroleum coke that cannot meet the required specifications of these higher-value markets is classified as "fuel-grade" petroleum coke. As such, this poorest grade of petroleum coke typically has high concentrations of sulfur (2.5-5+ wt. %) and/or heavy metals, including vanadium and nickel.

"Fuel-grade" petroleum coke is actually a misnomer. The traditional "fuel-grade" petroleum coke actually performs very poorly as a fuel. First of all, traditional "fuel-grade" petroleum coke cannot sustain self-combustion due to its poor fuel properties and combustion characteristics. Secondly, its high sulfur content (e.g., >2.5 wt. %) creates substantial environmental problems, particularly in the United States. Thirdly, high concentrations of certain metals can be precursors for post-combustion, liquid salts that deposit on heat transfer surfaces, reducing efficiency and/or causing accelerated corrosion. Finally, high concentrations of sulfur and/or metals can detrimentally effect product quality, when used as fuel directly in chemical processes (e.g. concrete kilns). Consequently, traditional "fuel-grade" petroleum coke can only be used in conventional furnaces when combined with other fuels (often requiring separate fuel processing and management systems). Alternatively, specially designed combustion systems, that are cumbersome and expensive, can use this coke as fuel. Until these deficiencies are addressed, the traditional "fuel-grade" petroleum coke will continue to be a very low value product. In fact, traditional "fuel-grade" petroleum coke could be classified as a hazardous waste in the United States, if its value continues its downward trend and refiners receive no sales value as a product. In this scenario, costs of hazardous waste disposal could dramatically reduce refinery profitability, and cause the shutdown of many refineries across the United States.

Numerous technologies were apparently developed to modify coking feedstocks and produce petroleum coke of sufficient quality for non-fuel uses of higher value. Many patents disclose various technologies for removing or diluting certain undesirable contaminants in the petroleum coke. As such, they go far beyond the degree of decontamination that is required for petroleum coke used as a fuel. Accordingly, simpler approaches that are less expensive and less complicated are desirable for the lower level of decontamination required for petroleum coke used as a fuel.

Various combustion technologies have been developed to overcome the deficiencies in "fuel-grade" coke, but no prior art successfully addresses these problems by upgrading the coke via the coking process. The prior art has failed to upgrade the quality of "fuel-grade" petroleum coke sufficiently to use in conventional, solid-fuel combustion systems (e.g. high heat capacity furnaces with suspension burners firing pulverized fuel, such as coal). Specially designed combustion systems (noted above) include fluidized bed combustion, pyrolysis/gasification systems, and low heat capacity furnaces (i.e. without heat absorption surfaces). In general, these systems are cumbersome, expensive, and have significant problems in scaling size upward. Several patents also disclose technologies to grind and stabilize coke/oil mixtures for use in conventional combustion systems. However, the quality of the traditional petroleum coke used in these fuel mixtures normally limits (1) the particle size distribution of the solids and (2) the degree of combustion (i.e. carbon burnout).

In summary, prior art does not address the major problems associated with traditional "fuel-grade" petroleum coke:

1. There remains a major need to produce "fuel-grade" petroleum coke that is able to sustain self-combustion with acceptable combustion efficiencies.
2. Secondly, no known prior art satisfactorily resolves the problems associated with the formation of sticky, corrosive salts in the combustion process, due to certain contaminants in the petroleum coke.
3. Finally, prior art does exist for the desulfurization and demetallization of petroleum coke, but it is complicated and expensive. Simpler approaches are needed for the lower level of decontamination required for petroleum coke used as a fuel.

OBJECTS AND ADVANTAGES OF THE INVENTION

Accordingly, it is one object of the present invention to provide a petroleum coke fuel that is able to (1) sustain self-combustion with acceptable combustion efficiencies, (2) sufficiently reduce the corrosive ash deposits harmful to the combustion system, and/or (3) reduce the need for complicated and expensive coke decontamination processes and environmental control systems, including elaborate pollution control equipment in the combustion system. Other objects and advantages of the present invention will be readily apparent from the following descriptions of the drawings and exemplary embodiments.

The present invention successfully addresses the problems associated with traditional "fuel-grade" petroleum coke, which other technologies have failed to do. This invention provides the following unique features that produce new and unexpected results:

1) Modifications in the coking process provide the ability to control the quantity and quality of volatile combustible material (% VCM) in the petroleum coke. Acceptable levels of porous, combustible carbon residue in the product coke (related to the crystalline structure of the coke) are also assured by these and further modifications. Consequently, the present invention produces a petroleum coke that is capable of self-combustion. That is, the upgraded petroleum coke can be successfully burned in conventional, solid-fuel furnace systems without auxiliary fuel or the need to mix with other fuels.
2) Process modifications reduce quantities of certain salt and metal contaminants to acceptable levels in the petroleum coke. These modifications address potentially problematic combustion products (sticky, corrosive salts) that deposit on downstream heat exchange and pollution control equipment.
3) Combustion process modifications address high sulfur levels in the petroleum coke that are environmentally prohibitive. Complicated and expensive desulfurization technologies of the prior art are not required for petroleum coke decontamination. These modest combustion process modifications offer a simpler approach to the control of sulfur oxide and particulate emissions. Similar process modifications (further embodiments of this invention) can provide the opportunity to reduce other flue gas emissions, including nitrogen oxides, carbon dioxide, air toxics, etc. In this manner, the optimal reductions in particulates, sulfur oxides, and other undesirable flue gas components can be achieved.

1. Utility of the Invention

The present invention provides a superior "fuel-grade" petroleum coke for many solid-fuel and/or chemical feedstock applications while improving overall operations, maintenance, and profitability in the oil refinery.

The present invention provides the means to control the concentrations of volatile combustible material, crystalline structure, and undesirable contaminants in a manner that produces a premium, fuel-grade petroleum coke. This upgraded petroleum coke has qualities that make it superior to the traditional "fuel-grade" petroleum coke, various types of coals, and other solid fuels. In most solid fuel applications, these improved characteristics provide potential users better combustion, higher energy efficiency, substantially improved pollution control, and significantly lower operating and maintenance costs. Alternatively, this premium fuel-grade coke can be partially oxidized via gasification processes to provide chemical feedstocks or low-quality, gaseous fuels.

The present invention produces a high-value product from the "bottom of the barrel" for many refineries. The present invention is also less sensitive (compared to prior art) to undesirable contaminants in the crude oil mixture being processed by a typical refinery. Consequently, the present invention improves the flexibility to process various crudes, including low-cost crudes, that are heavy, sour and/or contain high levels of metals or asphaltenes. As the world supplies of light, sweet crude decreases, this benefit has greater utility, since much greater quantities of "fuel-grade" coke will be produced from the remaining heavy, sour crude oils. In addition, the process modifications of this invention are expected to (1) improve operation and maintenance of the coker process, (2) potentially increase coker and refinery throughput, and (3) improve other refinery operations. All of these factors potentially improve the overall refinery profitability.

Further objects and advantages of this invention will become apparent from consideration of the drawings and ensuing descriptions.

SUMMARY OF THE INVENTION

It has been discovered that an upgraded petroleum coke can have much better fuel properties and combustion characteristics than coals with significantly higher (or comparable) levels of volatile combustible materials (VCM). In addition, the unique characteristics of this upgraded petroleum coke create the opportunity for applications of novel environmental control technologies to meet or exceed environmental requirements. Surprisingly, these novel and unexpected results can be produced with modest modifications to the existing coking processes and combustion systems. However, both the production and use of this new formulation of petroleum coke are contrary to conventional wisdom and current trends in the petroleum coking processes and solid fuel combustion systems.

1. Coking Processes

Conventional wisdom and current trends in the petroleum coking processes focus on coking designs and operations that (1) maximize the production and recovery of cracked liquid hydrocarbons and (2) minimize the level of volatile combustible material in the resulting coke. In contrast, the modified coking process of the present invention gives priority to producing a petroleum coke with consistently higher volatile combustible material of sufficient quality for self-combustion. This modified process also promotes a coke crystalline structure that is more conducive to good combustion. In many cases, low-level decontamination of the petroleum coke to acceptable levels is also achieved to eliminate (or reduce) the formation of corrosive ash deposits in the combustion process. Surprisingly, the present invention, in all its embodiments, can produce a premium, "fuel-grade" petroleum coke, capable of self-combustion with superior fuel properties and combustion characteristics, while decreasing cracked liquid conversion efficiency by <10% (preferably <1%). The present invention discusses various means to offset (or limit) the loss of cracked liquid yield. In certain situations, the present invention can upgrade the petroleum coke fuel, while actually increasing overall cracked liquids production, due to potential increases in coker and/or refinery throughput.

In general terms, the invention includes a process of producing a coke fuel, the method comprising steps: (a) obtaining a coke precursor material derived from crude oil, and having a volatile organic component; and (b) subjecting the coke precursor material to a thermal cracking process for sufficient time and at sufficient temperature and under sufficient pressure so as to produce a coke product having a volatile combustible material (VCM) present in an amount in the range of from about 13% to about 50% by weight. Most preferably, the volatile combustible material in the coke product typically may be in the range of from about 15% to about 30% by weight. The thermal cracking process of the present invention may include a process selected from the group consisting of delayed coking processes and Fluid Coking™ processes. As used herein, "volatile combustible material" (VCM) is defined by ASTM Method D 3175. In the present invention, all the VCM is contained in the coke precursor material derived from crude oil or added to the coking process; as contrasted with any substantial volatile organic component (e.g. fuel oil) that has been added to a coke product after the coking process is complete.

In some cases, a consistently higher VCM level will be all that is necessary to provide petroleum coke capable of self-combustion. Process controls of the prior art typically minimize VCM in the by-product petroleum coke. That is, coking units in the prior art typically have operational setpoints to produce by-product petroleum coke with VCM levels below 12%. In contrast, the present invention discusses various means to increase and consistently maintain higher coke VCM levels for various coking processes, including delayed and Fluid Coking™ processes. A "minimum acceptable" VCM specification (e.g. >15% VCM) is discussed as an exemplary means of maintaining product quality.

In many cases, altering the petroleum coke crystalline structure will also be required to produce petroleum coke capable of self-combustion. In most (but not all) cases, altering the crystalline structure will enhance combustion characteristics and reduce the "minimum-acceptable" VCM specification. The present invention discusses various means to promote favorable coke crystalline structure. In an exemplary embodiment, the coker process changes that increase and consistently maintain the desired VCM level also promote greater production of the more desirable sponge coke (vs. shot coke or needle coke). That is, the organic compounds, creating the higher VCM in the coke, are expected to alter the coke formation mechanisms (i.e. thermal vs. asphaltic coke) to favor sponge coke production. The sponge coke crystalline structure is preferable due to higher porosity and softness, which greatly improve its combustion characteristics. Further embodiments are provided to inhibit the formation of undesirable dense, spherical coke, called "shot coke." Consequently, the present invention promotes sponge coke crystalline structure that favors good combustion and maintains acceptable levels of shot coke. A "minimum-acceptable" sponge coke specification is discussed as one means of maintaining coke crystalline quality. That is, process control methods will consistently achieve a coke crystalline structure that preferably contains 40-100% sponge coke (vs. shot coke); most preferably 60-100% sponge coke (vs. shot coke). Alternatively, a "maximum-acceptable" shot coke specification or a specification for average coke density (e.g. gm/cc) can provide alternative measures for process control of a particular coker design and feedstock.

In other cases, the addition of higher quality VCM (e.g. VCM with boiling points of about 250-850° F. and heating values of 16-20,000 Btu/lb) may be necessary to produce petroleum coke capable of self-combustion. Alternatively, higher quality VCM in the petroleum coke can be used to reduce the overall VCM specification (i.e. minimum-acceptable VCM). The present invention discusses various means to add higher quality VCM within the coking process, and achieve uniform integration within the coke. In this manner, a softer coke crystalline structure with higher porosity is maintained, while further improving the upgraded coke's combustion characteristics.

In many (but not all) cases, low-level decontamination of the petroleum coke may be necessary to assure acceptable levels of sulfur, sodium, and other metals for the combustion process. In an exemplary embodiment, the coke precursor material is subjected to an efficient desalting process prior to the thermal cracking process to reduce the concentration of certain undesirable contaminants in the upgraded petroleum coke. An exemplary desalting method uses three stages of conventional, refinery desalting processes. Alternatively, filtration, catalytic, and other efficient desalting methods can be used. Any of these desalting processes will remove various contaminants to various degrees. However, sodium is the contaminant of primary concern to prevent problematic ash products (e.g. sticky, corrosive salts) from the combustion of most "fuel-grade" petroleum coke. The coke precursor material preferably will contain less than 15 ppm by weight sodium, and most preferably less than 5 ppm by weight sodium. Further embodiments of the present invention describe other means for achieving sodium, sulfur, and metals decontamination objectives noted above. Desulfurization and demetallization embodiments are discussed as alternatives to enhance environmental control options and also improve the prevention of problematic ash products.

2. Solid Fuel Combustion Systems

Conventional wisdom and current trends of solid-fuel combustion systems are moving toward further use of traditional, "fuel-grade" petroleum coke as (1) a periodic "spiking" fuel, (2) continual use in coal/coke fuel blends, or (3) primary fuel in complex, specially designed combustion systems. In the first two cases, traditional petroleum coke typically makes up less than 20% of the blend and often requires a separate fuel preparation system. In contrast, the present invention produces a Premium "Fuel-Grade" Petroleum Coke that has great value as a replacement for various solid fuels, including numerous coals. The primary use is expected to be a direct replacement of various coals in existing coal-fired boilers (utility, industrial, or otherwise). That is, the present invention includes a new formulation of coke product made in accordance with a process according to the present invention, in all of its embodiments. The present invention also includes a method for producing energy, the method comprising generally combusting a fuel, the fuel comprising coke, the coke comprising volatile combustible material (VCM) in an amount in the range from about 13% to about 50% by weight. Preferably, the volatile combustible material in the coke is in the range from about 15% to about 30% by weight.

A method of the present invention also includes a method of producing energy using a fuel that comprises mixtures of the upgraded coke of the present invention, and other fuels, including coke and solid fuels (e.g. coal), or coke and liquid fuels (e.g. fuel oil), or coke and gaseous fuels (e.g. natural gas) or any combination of these; and preferably consisting essentially of the upgraded coke of the present invention as described herein. Where the coke is mixed with coal, it may be preferred that the weight ratio of coke to coal in said mixture be greater than about 1:4. Alternatively, the method of producing energy in accordance with the present invention may feature a heat release rate of the coke in such a fuel mixture greater than 20%. However, it may be preferred that the fuel comprises the upgraded coke including volatile combustible material in an amount in the range from about 13% to about 50% by weight, most preferably in the range of about 15% to about 30% by weight. Consequently, the method of the present invention allows for the achievement of optimal combustion properties while also allowing the control of costs.

Conventional wisdom and current trends of environmental controls for solid-fuel combustion systems is moving toward (1) low-sulfur energy sources (solid-fuels and otherwise), (2) extensive system modifications to add complex, expensive environmental controls, and (3) repowering conversions to alternative energy technologies with lower environmental emissions. Many coal-fired, utility boilers have been switched to low-sulfur coal to comply with the first phase of acid rain control provisions under the Clean Air Act Amendments of 1990. Complex, expensive environmental controls and repowering options are being evaluated for compliance in Phase 2.

In contrast, the method of the present invention may optionally and preferably include a method for producing energy, as described, and a method for removing sulfur oxides and/or other undesirable components from its flue gas. The present invention uses novel techniques to burn the premium, "fuel-grade" petroleum coke with higher sulfur content and obtain lower sulfur oxide emissions. The unique properties of the upgraded petroleum coke allow it to be used as the primary fuel in existing, pulverized coal boilers. In most cases, use of the upgraded petroleum coke as the primary fuel, unleashes >90% of the capacity in the existing particulate control device (PCD), due to its much lower ash content. In these applications, the existing particulate control devices can be readily converted to emissions control systems that provide sufficient control of sulfur oxides (SOx), carbon dioxide, nitrogen oxides (NOx), air toxics, and/or other undesirable flue gas components. The method for removing undesirable components (1) converts the undesirable components to collectible particulates upstream of the existing PCD and (2) collects such particulates in the existing particulate control device. That is, the method of the present invention for producing energy further includes a method for removing undesirable flue gas components. This method generally comprises (1) an injection of conversion reagents with sufficient mixing and sufficient residence time at sufficient temperature to convert undesirable flue gas components to collectible particulates upstream of a particulate control device (PCD) and (2) collecting said particulates in particulate control device, said particulate control device includes, but is not limited to, a PCD process selected from the group consisting of electrostatic precipitators (dry or wet), filtration, cyclones, and conventional wet scrubbers.

In one embodiment, the unreacted conversion reagents of this flue gas conversion process can be effectively recycled to increase reagent utilization and performance. The recycle rate preferably exceeds 5% by weight of the collected flyash. This level of reagent recycle is a unique feature of this flue gas conversion process, due to the fuel properties and combustion characteristics of the upgraded coke.

In another embodiment, the spent flue gas conversion reagents can be regenerated and reused. The regeneration rate can exceed 70% by weight of the collected flyash, and preferably less than 30% of the collected fly ash is disposed as a purge (or blowdown) stream, containing high concentrations of impurities. The regeneration method includes, but is not limited to, a process selected from the group of hydration, precipitation, and other unit operations. The purge stream can be used as a resource for valuable metals, which are extracted and purified. This type of reagent regeneration can (1) substantially decrease reagent make-up requirements and costs, (2) dramatically reduce flyash disposal and costs, (3) reduce $CO_2$ emissions, (4) create a resource for valuable metals, and (5) provide the means to economically improve the flue gas conversion process via the use of more reactive reagents. The regeneration of conversion reagents is a unique feature of this flue gas conversion process, due to the fuel properties and the combustion characteristics of the upgraded coke.

For SOx removal, the flue gas conversion process of the present invention is similar to dry sorbent injection and dry scrubber technologies, but has novel improvements due to the unique properties of the upgraded petroleum coke of the present invention. In addition to the recycling and regeneration of reagents noted above, these novel improvements include increased reagent reactivity, improved reagent utilization, shorter residence times, and greater opportunity for salable products. All of these improvements over the prior art increase SOx removal efficiencies and reduce costs.

The present invention also discusses embodiments to integrate and/or optimize various environmental control techniques. The flue gas conversion process may be used in coordination with traditional wet or dry SOx scrubbing systems to improve or optimize control of various undesirable flue gas components. Also, upgraded cokes with low sulfur content (e.g. sweet crude feedstocks, coker feedstock desulfurization, etc.) can provide greater flexibility in the use of the available PCD capacity (i.e. other than SOx). Furthermore, the integration of activated coke technology is also discussed for the combined control of SOx, NOx, carbon dioxide and air toxics.

In the practical application of the present invention, the optimal combination of methods and embodiments will vary significantly. That is, site-specific, design and operational parameters of the particular coking process and refinery must be properly considered. These factors include (but should not be limited to) coker design, coker feedstocks, and effects of other refinery operations. In addition, site-specific, design and operational parameters of the particular solid-fuel combustion system and its environmental controls must be properly considered. These factors include (but should not be limited to) combustion system design, current fuel characteristics, design of environmental controls, and environmental requirements. Consequently, case-by-case analyses (often including pilot plant tests) are required to address site-specific differences in the optimal application of the present invention. The present invention discusses methods to optimize the production and use of the upgraded petroleum coke for each particular application.

DETAILED DESCRIPTION OF THE EXEMPLARY EMBODIMENT(S)

In view of the foregoing summary, the following presents a detailed description of the exemplary embodiments of the present invention, currently considered the best mode of practicing the present invention. The discussion of the exemplary embodiments is divided into two major subjects: (1) the production of premium "fuel-grade" petroleum coke in a modified delayed coking process, and (2) the use of this petroleum coke in conventional, pulverized-coal (PC) utility boilers. Example 1 is provided at the end of this discussion to illustrate an exemplary embodiment of the present invention.

1. Production of Premium "Fuel-Grade" Petroleum Coke: Modified Delayed Coking Process The discussion of the production of premium, "fuel-grade" petroleum coke in a modified delayed coking process is divided into the following topics: (a) traditional delayed coking: process description, (b) process control of the prior art, (c) coke formation mechanisms and various crystalline structures, (d) volatile combustible materials (VCM) in the petroleum coke, (e) process control of the present invention (VCM and crystalline structure), (f) low-level decontamination of coker feedstocks: 3-stage desalting operation, and (g) impacts of the present invention on refinery operations.

A. Traditional Delayed Coking: Process Description

Figure 1:
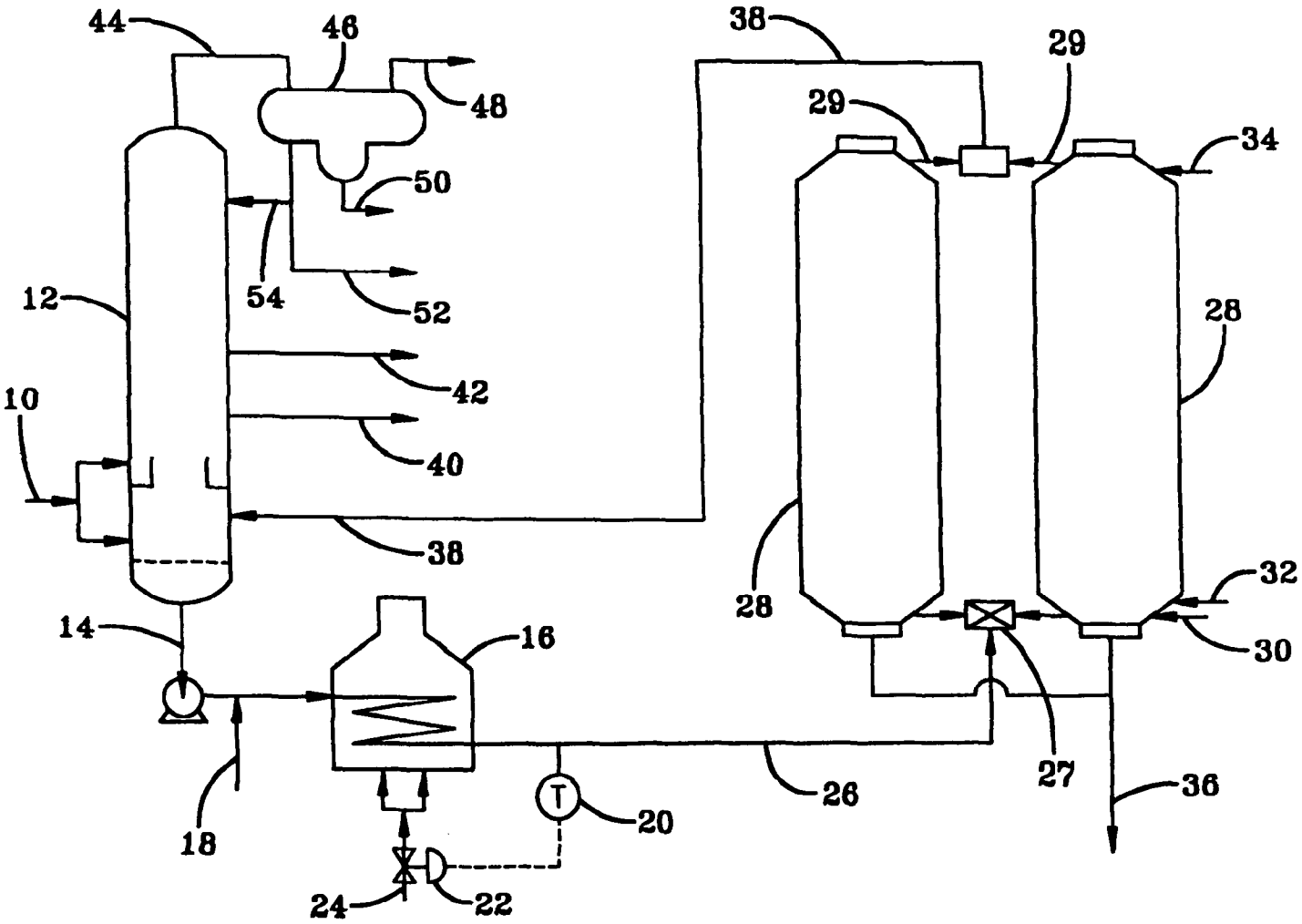
FIG. 1 shows a basic process flow diagram for key elements of a traditional delayed coking process.

FIG. 1 is a basic process flow diagram for the traditional delayed coking process of the prior art. The delayed coking process equipment for the present invention is essentially the same, but the operation, as discussed below, is substantially different. Delayed coking is a semi-continuous process with parallel coking drums that alternate between coking and decoking cycles.

In the coking cycle, coker feedstock is heated and transferred to the coke drum until full. Hot residua feed 10 is introduced into the bottom of a coker fractionator 12, where it combines with condensed recycle. This mixture 14 is pumped through a coker heater 16, where the desired coking temperature (normally between 900° F. and 950° F.) is achieved, causing partial vaporization and mild cracking. Steam or boiler feedwater 18 is often injected into the heater tubes to prevent the coking of feed in the furnace. Typically, the heater outlet temperature is controlled by a temperature gauge 20 that sends a signal to a control valve 22 to regulate the amount of fuel 24 to the heater. A vapor-liquid mixture 26 exits the heater, and a control valve 27 diverts it to a coking drum 28. Sufficient residence time is provided in the coking drum to allow the thermal cracking and coking reactions to proceed to completion. By design, the coking reactions are "delayed" until the heater charge reaches the coke drums. In this manner, the vapor-liquid mixture is thermally cracked in the drum to produce lighter hydrocarbons, which vaporize and exit the coke drum. The drum vapor line temperature 29 (i.e. temperature of the vapors leaving the coke drum) is the measured parameter used to represent the average drum temperature. Petroleum coke and some residuals (e.g. cracked hydrocarbons) remain in the coke drum. When the coking drum is sufficiently full of coke, the coking cycle ends. The heater outlet charge is then switched from the first coke drum to a parallel coke drum to initiate its coking cycle. Meanwhile, the decoking cycle begins in the first coke drum.

In the decoking cycle, the contents of the coking drum are cooled down, remaining volatile hydrocarbons are removed, the coke is drilled from the drum, and the coking drum is prepared for the next coking cycle. Cooling the coke normally occurs in three distinct stages. In the first stage, the coke is cooled and stripped by steam or other stripping media 30 to economically maximize the removal of recoverable hydrocarbons entrained or otherwise remaining in the coke. In the second stage of cooling, water or other cooling media 32 is injected to reduce the drum temperature while avoiding thermal shock to the coke drum. Vaporized water from this cooling media further promotes the removal of additional vaporizable hydrocarbons. In the final cooling stage, the drum is quenched by water or other quenching media 34 to rapidly lower the drum temperatures to conditions favorable for safe coke removal. After the quenching is complete, the bottom and top heads of the drum are removed. The petroleum coke 36 is then cut, typically by hydraulic water jet, and removed from the drum. After coke removal, the drumheads are replaced, the drum is preheated, and otherwise readied for the next coking cycle.

Lighter hydrocarbons 38 are vaporized, removed overhead from the coking drums, and transferred to a coker fractionator 12, where they are separated and recovered. Coker heavy gas oil (HGO) 40 and coker light gas oil (LGO) 42 are drawn off the fractionator at the desired boiling temperature ranges: HGO: roughly 650-870° F.; LGO: roughly 400-650° F. The fractionator overhead stream, coker wet gas 44, goes to a separator 46, where it is separated into dry gas 48, water 50, and unstable naphtha 52. A reflux fraction 54 is often returned to the fractionator.

In general, delayed coking is an endothermic reaction with the furnace supplying the necessary heat to complete the coking reaction in the coke drum. The exact mechanism of delayed coking is so complex that it is not possible to determine all the various chemical reactions that occur, but three distinct steps take place:

1. Partial vaporization and mild cracking of the feed as it passes through the furnace
2. Cracking of the vapor as it passes through the coke drum
3. Successive cracking and polymerization of the heavy liquid trapped in the drum until it is converted to vapor and coke B. Process Control of the Prior Art In traditional delayed coking, the optimal coker operating conditions have evolved through the years, based on much experience and a better understanding of the delayed coking process. Operating conditions have normally been set to maximize (or increase) the efficiency of feedstock conversion to cracked liquid products, including light and heavy coker gas oils. More recently, however, the cokers in some refineries have been changed to maximize (or increase) coker throughput. In both types of operation, the quality of the byproduct petroleum coke is a relatively minor concern. In "fuel-grade" coke operations, either mode of operation detrimentally affects the fuel properties and combustion characteristics of the coke, particularly VCM content and crystalline structure.

In general, the target operating conditions in a traditional delayed coker depend on the composition of the coker feedstocks, other refinery operations, and coker design. Relative to other refinery processes, the delayed coker operating conditions are heavily dependent on the feedstock blends, which vary greatly among refineries (due to varying crude blends and processing scenarios). The desired coker products and their required specifications also depend greatly on other process operations in the particular refinery. That is, downstream processing of the coker liquid products typically upgrades them to transportation fuel components. The target operating conditions are normally established by linear programming (LP) models that optimize the particular refinery's operations. These LP models typically use empirical data generated by a series of coker pilot plant studies. In turn, each pilot plant study is designed to simulate the particular refinery's coker design. Appropriate operating conditions are determined for a particular feedstock blend and particular product specifications set by the downstream processing requirements. The series of pilot plant studies are typically designed to produce empirical data for operating conditions with variations in feedstock blends and liquid product specification requirements. Consequently, the coker designs and target operating conditions vary significantly among refineries.

In common operational modes, various operational variables are monitored and controlled to achieve the desired delayed coker operation. The primary independent variables are feed quality, heater outlet temperature, coke drum pressure, and fractionator hat temperature. The primary dependent variables are the recycle ratio, the coking cycle time and the drum vapor line temperature. The following target control ranges are normally maintained during the coking cycle for these primary operating conditions:

1. Heater outlet temperatures in the range of about 900° F. to about 950° F.,

2. Coke drum pressure in the range of about 15 psig to 100 psig: typically 20-30 psig,
3. Hat Temperature in the range of 650-720° F.: typically 670 to 700° F.,
4. Recycle Ratio in the range of 0-100%; typically 10-20%,
5. Coking cycle time in the range of about 15 to 24 hours; typically 18-24 hours, and a
6. Drum Vapor Line Temperature 50 to 100° F. less than the heater outlet temperature: range 825 to 880° F.; typically 830 to 860° F.

These traditional operating variables have primarily been used to control the quality of the cracked liquids and various yields of products, with minor attention to controlling the respective composition of the by-product petroleum coke. Throughout this discussion, "cracked liquids" refers to hydrocarbon products of the coking process that have 5 or more carbon atoms. They typically have boiling ranges between 97 and 870° F., and are liquids at standard conditions. Most of these hydrocarbon products are valuable transportation fuel blending components or feedstocks for further refinery processing. Consequently, cracked liquids are normally the primary objective of the coking process.

Since the mid-1930s, better understanding of the delayed coking process and technological advances have continually maximized (or increased) the efficiency of feedstock conversion. Feedstock conversion is often cited as liquid yield (i.e. barrel of cracked liquid product per barrel of feed). Increasing the yield of cracked liquids is generally accomplished by changing the operating conditions to affect (1) the balance between cracking and coking reactions and/or (2) the vaporization and recovery of the cracked liquid products. Though the specific operating conditions vary among refineries, the following rules of thumb have been noted as guidelines for reductions in coke yield, and associated increases in the yield of cracked liquids:

1. Each 10° F. increase in coke-drum vapor line temperature reduces coke yield on feed by 0.8 wt. % and increases gas and distillates by 1.1 volume % on feed
2. Each 8 psi reduction in the coke drum pressure reduces the coke yield on feed by 1.0 wt. % and increases liquid yield by 1.3 volume % on feed
3. Reducing the recycle by 10 vol. % on feed reduces the coke yield by 1.2 wt. % on feed and increases the liquid plus gas yield by 1.0 vol. % on feed
4. Reducing the virgin gas oil content of the coker feed by 10% reduces coke yield by 1.5 wt. %

Technology advances have also been implemented in the effort to maximize the liquid yields of the delayed coker. These include, but are not limited to, (1) coker designs to reduce drum pressure to 15 psig, (2) coker designs to provide virtually no recycle, and (3) periodic onstream spalling of heaters to increase firing capabilities and run length at higher heater outlet temperatures.

Over the past ten years, some refineries have switched coker operating conditions to maximize (or increase) the coker throughput, instead of maximum efficiency of feedstock conversion to cracked liquids. Due to processing heavier crude blends, refineries often reach a limit in coking throughput that limits (or bottlenecks) the refinery throughput. In order to eliminate this bottleneck, refiners often change the coker operating conditions to maximize (or increase) coker throughput in one of two ways:

1. If the coker is fractionator (or vapor) limited, increase the drum pressure (e.g., 20 to 25 psig.)
2. If the coker is drum (or coke make) limited, reduce coking cycle time (e.g., 20 to 16 hours)

Both of these operational changes increase the coker throughput. Though either type of higher throughput operation reduces the efficiency of feedstock conversion to cracked liquids (i.e. per barrel of feed basis), it often maximizes (or increases) the overall quantity (i.e. barrels) of cracked liquids produced. These operational changes also tend to increase coke yield and coke VCM, as noted previously. However, any increase in drum pressure or decrease in coker cycle time is usually accompanied by a commensurate increase in heater outlet and drum vapor line temperatures to offset (or limit) any increases in coke yield or VCM.

The current trend in delayed coking includes capital improvements to the original coker design to eliminate bottlenecks and maximize (or increase) both coker liquid yields and coker throughput, to the extent possible. Limits on coke heaters, coke drums, and fractionators are removed by employing equipment modifications that incorporate technology advancements. These modifications will normally address the refinery's projected coker feedstock composition and quantity. The timing of these modifications is likely to depend on many factors, including (1) justification via the loss of cracked liquids to increased coke yields, and (2) the refinery's capital investment criteria (e.g., alternative projects and higher operational risk factors, such as increased environmental regulations).

In both types of process control in the prior art, the VCM content of the byproduct coke is used mostly as a post-mortem gauge of successful operation, NOT as an essential operational variable. The coke VCM is measured after the batch operation is complete. Pilot plant studies are used to predict the coke VCM for a particular set of operating conditions, feedstock, and coker design. However, the scaled-up commercial operation may stray from target VCM levels, due to less than ideal conditions. If needed, adjustments in operating conditions are usually made based on experience for future coking batches. Typically, the target operating range for coke VCM in delayed coking is 8-12 wt. %. If the coke VCM is lower than 8 wt. %, the coke is usually too hard to cut from the drum within the normal decoking cycle time. A coke VCM greater than 12 wt. % is normally considered poor conversion efficiency. Also, some grades of anode and needle coke have a maximum VCM product specification (typically <12 wt. %) that assures proper density characteristics. Accordingly, the normal operating conditions for both maximum conversion and maximum throughput modes are continually modified to achieve the lowest possible coke VCM in the long-term, with acceptable coker operation. Consequently, the process control options of the prior art detrimentally impact the fuel properties and combustion characteristics of "fuel-grade" coke. That is, the coke VCM content and/or crystalline structure of the by-product coke are not normally sufficient to sustain self-combustion.

Delayed coker process controls of the prior art (i.e. maximum conversion and/or maximum throughput) also tend to promote the production of undesirable coke crystalline structure. These operating conditions typically promote the formation of shot coke, particularly for heavy feedstocks. In some refineries, sponge coke can predominate shot coke. However, the sponge coke in this shot/sponge coke blend will tend to have low porosity due to its low VCM. This latter outcome is more likely with the operating conditions that maximize coker throughput. In either operational mode of the prior art, the byproduct coke tends to have crystalline structures of shot coke and/or sponge coke with low porosity and low VCM. As discussed later, these crystalline structures are not desirable for good combustion characteristics.

In conclusion, the operating conditions of the prior art give first priority to maximizing the efficiency of feedstock conversion to cracked liquid products or maximizing coker throughput. In either case, the petroleum coke is a byproduct that is tolerated in the interest of the maximum production of cracked liquid hydrocarbons, barrel per barrel of feed or total barrels. The VCM content and crystalline structure of the resultant coke is a relatively minor concern (by comparison), especially for "fuel-grade" petroleum coke. As such, the process control of the prior art is not conducive to produce a high-quality, "fuel-grade" coke.

C. Coke Formation Mechanisms and Various Crystalline Structures

Coking processes, in general, are high-severity, thermal cracking (or destructive distillation) operations to convert petroleum residua into distillates, hydrocarbon gases, and coke. The residua feed is typically heated to temperatures exceeding 900° F. Thermal decomposition of the high-molecular, hydrocarbon structures takes place in both the liquid and gaseous phases. The breaking of chemical bonds in the liquid phase typically produces lighter hydrocarbon compounds that vaporize below the drum temperature (e.g. <870° F.). The remaining liquids (normally complex hydrocarbon structures with highly aromatic content) polymerize to form coke. Thermal decomposition will continue in the gaseous phase (producing lighter and lighter compounds) until there is not sufficient activation energy to initiate the endothermic cracking reaction. The cracking and coking reactions occur simultaneously, and their degrees of completion primarily depend on the temperature, residence time, and pressure in the reaction system. The remainder of this discussion primarily focuses on the thermal cracking of the liquid phase and the subsequent formation of coke.

The formation of coke in the delayed coking process occurs primarily by two independent coking mechanisms: Thermal Coke and Asphaltic Coke. The thermal coking mechanism is caused by an endothermic reaction: the condensation and polymerization of aromatic compounds contained in the petroleum residue of the coker feed. This thermal coke mechanism is substantially reduced by operating conditions (e.g. higher operating temperatures) that increase the production of cracked liquid hydrocarbons. The asphaltic coke mechanism is initiated as solutizing oils are removed by thermal cracking and aromatic cross-linkage from the coker charge. The large asphaltene and resin molecules precipitate out of solution to form a solid without much change in structure. The asphaltic coke mechanism (1) is a physical change with no heat of reaction, (2) is not affected by modified coker operating conditions, and (3) is purely a function of the asphaltene and resin content in the coker feedstock. The relative degrees of these two coking mechanisms have been noted to determine the crystalline structure of the delayed coke.

Petroleum coke from a delayed coker has three major types of crystalline structure: needle coke, sponge coke, and shot coke. Needle coke is formed via virtually all thermal coke mechanism: >95% of the coke from the condensation and polymerization of aromatics contained in a low-asphaltene coker feedstock (e.g. FCC slurry oil). Sponge coke and shot coke are formed by combinations of thermal and asphaltic coking mechanisms. When the ratio (R) of asphaltic coke to thermal coke falls below a certain level, sponge coke is formed. Conversely, when R exceeds a certain level, shot coke is formed. This ratio R is difficult to measure. Furthermore, the boundary between shot coke and sponge coke is not definite, but fuzzy, and is expected to vary with coker feedstocks. In fact, the combination of shot coke and sponge coke has been noted to form in the same coking cycle due to temperature variations across the coke drum. However, limited plant data suggest the crossover point for shot (vs. sponge) coke formation is roughly R>0.7-1.5; preferably 0.8 to 1.2.

D. Volatile Combustible Materials (VCM) in the Petroleum Coke

Many in the oil refining industry surprisingly believe that virtually all of the volatile material in the petroleum coke is valuable, cracked liquids trapped in the coke. This mistaken belief apparently occurs due to a major difference in the definition of "volatile materials" for the oil refining industry versus combustion science. The oil refining industry commonly refers to non-volatile, asphaltic and aromatic materials, contained in the coker feedstocks, as 1000 plus materials, which have "theoretical" boiling points exceeding 1000° F. at atmospheric pressure. The boiling points are "theoretical" because these materials crack or coke from thermal decomposition before they reach such temperatures. As such, the oil refining industry considers materials with boiling points <1000° F. as "volatile materials." In contrast, combustion science (via ASTM Test Method D-3175) defines volatile combustible materials (VCM) as the weight percent of the fuel that is vaporized at temperatures less than 950° C. (1742° F.). Therefore, materials that are vaporized between 1000° F. and 1742° F. are considered volatile materials by combustion science, but not by the oil refining industry, in general. Consequently, the VCM in the petroleum coke is expected to be a combination of:

(1) unreacted coker feedstocks that vaporize between residua BP Cutpoints (e.g. 1000° F.) and 1742° F.;
(2) cracked components that vaporize between drum temperature (e.g. 870° F.) and 1742° F.; and
(3) cracked components that vaporize below drum temperature (e.g. 870° F.) trapped in the coke.

Since steam stripping of the porous petroleum coke is typically conducted for 1 to 3 hours in the decoking cycle, the VCM of traditional coke is expected to consist mostly of (1) and (2). However, under certain conditions, the coke VCM may have weak chemical bonds to the coke that prevent steam stripping. The activation energies required to break these weak chemical bonds can be provided by the initial phases of combustion or ASTM Method D 3175. Note: The drum temperatures for the cracked components of (2) and (3) need to be adjusted for drum pressures to determine comparable boiling points at equivalent conditions. Throughout this patent application, "volatile combustible materials" or "VCM" will refer to volatile combustible materials as defined by the American Society for Testing and Materials (ASTM) Method D 3175. This method stipulates a temperature of 950+/−20° C. for seven minutes for volatile matter content determinations.

The VCM in the coke from a delayed coker is primarily a function of (1) feed properties, (2) drum pressure, (3) drum residence time, (4) drum temperature, and (5) the level of steam stripping in the decoking cycle. Though these parameters are noted to affect the VCM content of the petroleum coke, the current operating variables have no direct relationship with coke VCM. The specific impacts of these parameters are very dependent on the feedstock composition and coker design, and vary among refineries. Based on years of experience, general rules of thumb regarding VCM impacts have been developed and are provided below.

1. With operating conditions held constant, a decrease in feedstock gravity typically decreases the coke VCM. The properties of the coker feedstocks play a major role in determining the petroleum coke's VCM content. As noted above, the coke's volatile combustible materials consist of certain cracked components, as well as unreacted feedstock components in the coke drum. Consequently, the coke VCM is dependent on the various types/qualities of the organic compounds in the feedstock and the relative quantities of these feedstock components.
2. With other operating conditions held constant, a reduction in coke drum pressure has been noted to decrease coke VCM for a given feedstock. The coke drum pressure significantly affects the coke VCM. A reduction in coke drum pressure increases the vaporization of heavier cracked liquids or unreacted feedstocks. Thus, the coke VCM is effectively decreased by the release of these compounds that would otherwise remain with the coke. However, the degree of coke VCM reduction is not easy to quantify and predict for a specified level of pressure change.
3. Reductions in cycle time have been noted to increase the coke VCM. The drum residence time significantly affects the VCM in the petroleum coke. As the coking cycle time decreases, the drum fill rate increases, and the residence time for thermal cracking and coking mechanisms decreases. Consequently, the reactions are less complete, leaving more unreacted or partially reacted feedstock on the coke as volatile combustible material.
4. With other operating conditions held constant, an increase in the drum vapor line temperature is noted to decrease the coke VCM for a given feedstock. The drum temperature is a major factor in determining the VCM in the petroleum coke. The local temperatures in the drum determine the degrees of thermal cracking and coking of the feedstock components. The temperature of the vapors leaving the drum during the coking cycle (i.e. drum vapor line temperature) is often used as the measured parameter to represent the average coke drum temperature. This temperature is typically 50-100° F. lower than the heater outlet temperature. The temperature difference is primarily due to a combination of heat losses: (1) the endothermic reactions of the thermal cracking and coking mechanisms, (2) vaporization energy of the cracked components, and (3) drum heat loss. Since the asphaltic coking mechanism is a physical change with no heat of reaction, the drum vapor line temperature (e.g. 870° F.) will likely differ significantly for various feedstocks. That is, different proportions of thermal coke and asphaltic coke mechanisms will impact the drum vapor line temperature differently. For a given feedstock, a higher drum vapor line temperature will cause greater cracking reactions and/or vaporize heavier cracked components, reducing the coke VCM. The drum vapor line temperature is normally controlled by the heater outlet temperature and the amount of condensed recycle.
5. The steam-stripping step of the decoking cycle is noted to decrease the coke VCM. The steam stripping during the decoking cycle has less significant impact on the coke VCM. For example, omitting the "big steam" step (the initial 0.5-1 hour of the decoking cycle) will leave slightly more wax-tailing-type material on the coke. Again, the coke VCM, under certain conditions, may have weak chemical bonds to the coke that prevent steam stripping.

E. Process Control of the Present Invention

The primary improvements of the present invention are modifications to the operating conditions of the delayed coking process, in a manner that is not suggested by prior art. In fact, these changes in operating conditions are contradictory to the teachings and current trends in the prior art. As noted previously, the operating conditions of the prior art give first priority to maximizing the efficiency of feedstock conversion to cracked liquid products or maximizing coker throughput. In contrast, the operating conditions of the present invention give first priority to increase and consistently maintain the concentration of volatile combustible material (VCM) in the resulting petroleum coke to 13-50 weight % VCM (preferably 15-30% VCM). Second priority is given to consistently provide a minimum-acceptable level of sponge coke in the product coke. The third priority is THEN given to maximize coker throughput and/or the conversion of coker feedstock blend to cracked liquid products. In many cases, the reduction of cracked liquids yield is expected to be <5% due to optimization of embodiments of the present invention that reduce the overall VCM increase and/or minimum sponge coke, required for acceptable combustion. In some cases, implementation of the present invention can actually increase overall cracked liquids production via increased coke throughput capacity. The operating conditions required to achieve the objectives of the present invention were surprisingly modest, yet specific, relative changes from the prior art.

As discussed previously, delayed coker operating conditions vary greatly among refineries, due to various coker feedstocks, coker designs, and other refinery operations. Therefore, specific operating conditions (i.e. absolute values) for various refinery applications are not completely possible for the present invention. However, specific changes relative to existing operating conditions provide specific methods of operational change to achieve the desired objectives.

(1) Increased Vcm in Delayed Coke:

Modifications in the delayed coker operating conditions are necessary to achieve the production of a premium, "fuel-grade" petroleum coke. These modifications increase and consistently maintain the quantity and quality of VCM content in the petroleum coke at a specified level. This new product specification for coke VCM should be the minimum level that achieves a stable combustion during various operating/load conditions for the end-user in its particular combustion system. The VCM product specification is expected to be in the target range of 13-50 weight percent (preferably 15-30 wt. %). From the refiner's perspective, the increase in VCM should be minimized and would preferably come from feedstock and/or cracked components that are vaporized between 1000° F. and 1742° F. These components are less valuable to the refiner and could conceivably include unreacted feedstock and residual compounds after thermal cracking, as noted above. From a combustion perspective, a certain amount of the VCM increase should come from higher quality VCM components that vaporize <1000° F. (preferably <850° F.) to help initiate combustion of the coke. In fact, each combustion system will likely have an optimal blend of volatile components (i.e. >1000° F. vs. <1000° F.) that minimize the overall VCM specification. Thus, the ideal modifications to operational variables would achieve this optimal blend of volatile components that minimize the overall VCM increase in the petroleum coke, and provide narrow VCM target range for quality control.

As noted above, many operational variables indirectly affect the coke VCM. As such, the selection of the appropriate modifications in the delayed coker operating conditions is not straightforward. In many cases, changes in the feedstock gravity and reductions in coker cycle time tend to increase the coke VCM, but provide limited change in VCM quality. Increases in drum pressure tend to increase the quality and quantity of coke VCM, but can be difficult to control coke VCM within a narrow target range. The reduced steam stripping in the decoking cycle has been noted to have limited effect on coke VCM content. However, reduced coke drum temperatures tend to increase and maintain both the quality and quantity of coke VCM. Reduced coke drum temperatures can decrease the cracking reactions, increasing unreacted feedstock and partially cracked components. In most cases, it provides a lower vaporization temperature in the coke drum, leaving lighter cracked or unreacted hydrocarbon components (i.e. higher quality VCM) integrated in the coke. In addition, the coke VCM content can be more predictable via reduced drum temperatures (vs. other operational variables). As such, coke VCM content can be readily controlled within a specified range. Furthermore, reduced coke drum temperatures have the added benefit of improving the coke crystalline structure (See below). Consequently, reduced coke drum temperatures was selected as an exemplary means of increasing coke VCM to achieve the objectives of the present invention.

Based on this analysis, a simple and exemplary means of increasing and maintaining the volatile content of the coke (i.e. to a consistent level between 13 and 50 wt. % VCM) would result from a reduction of the average drum temperature by 5-80° F. (preferably 5-40° F.). That is, a reduction in average coke drum temperature from current operating conditions that produce 8-12 wt. % VCM for a given coker design and feed quality. In general, an average drum vapor line temperature of 770 to 850° F. can provide VCM levels of 15-30% for many cokers and their respective feedstocks. However, as noted earlier, coker feedstocks vary considerably among refineries, and can attain 15-30% VCM outside of this temperature range. In these situations, the relative temperature drop from the existing average drum temperature is expected to be similar. This lower drum temperature would sufficiently reduce the cracking and coking reactions to produce the desirable increase in VCM in the petroleum coke for many existing refineries. While it is believed this result is primarily due to (1) reductions in cracking reactions and (2) increases in unreacted coker feedstock and partially cracked liquids remaining with the resultant petroleum coke, the present invention should not be bound by this.

The simplest means to achieve the lower average drum temperature is to decrease the heater outlet temperature, accordingly. That is, the heater outlet temperature is the primary independent variable that can be controlled to achieve lower average drum temperature. Changing the set point for the temperature controller 22 can reduce the fuel rate, and lower the heater outlet temperature to the desired level. However, as noted above, there is no direct relationship between the heater outlet temperature, the average drum temperature, and VCM in the resulting petroleum coke. More specifically, the volatile content of the coke significantly depends on the composition of the coker feed and the relative impacts of the competing cracking and coking reactions on its components. Thus, the VCM varies significantly due to the different compositions in various coker feedstock blends. Consequently, the optimal heater outlet temperature (to consistently produce the desirable VCM content in the coke) is expected to require the development of empirical data in pilot plant studies for different coker designs and coker feedstocks. Ideally, this new empirical data would not only address the impact of various crude oil mixtures processed in the refinery, but also evaluate the impact of other refinery operations. This type of temperature control is analogous to other coker process controls.

Regardless of the types of volatile components, the VCM increase will usually create additional porosity of the residual carbon in the combustion process. That is, the vaporization of these components in the combustion process create greater voids and, thus, more oxidation reaction sites in the residual carbon. In addition, a VCM increase and the associated porosity increase are also expected to further decrease the hardness of the coke. In many cases, the softer petroleum coke can be ground to smaller particle size distribution at the same or less energy in the current pulverization equipment. Consequently, both greater porosity and lower hardness provide better combustion characteristics, and reduce the overall VCM specification required to achieve acceptable combustion.

(2) Acceptable Delayed Coke Crystalline Structure: Sponge coke is the most desirable crystalline structure for fuel-grade petroleum coke. Needle coke is too dense for good combustion properties. Shot coke is spherical in shape, and is usually denser and harder than sponge coke. These characteristics make shot coke difficult to grind to a desired particle size distribution and more difficult to burn, particularly its carbon residue. Sponge coke, on the other hand, has a high porosity that increases with VCM. This high porosity makes sponge coke much softer; easier to drill from the coke drum and easier than other cokes (and most coals) to grind to the desired particle size distribution for optimal combustion characteristics. The high porosity of sponge coke (vs. most coals) also provides a greater (or comparable) density of oxidation reaction sites in the carbon residue after the initial combustion. This combustion characteristic promotes better carbon burnout, which translates to shorter residence time requirements, lower burnout temperature requirements, and higher combustion efficiency.

Consequently, the second priority of the present invention's process control is to consistently maintain levels of sponge coke above a "minimum-acceptable" specification. As noted previously, the sponge coke crystalline structure has higher porosity and lower hardness (discussed below) than shot or needle coke. These qualities are more conducive to good combustion characteristics. Ideally, the entire coke product would be sponge coke crystalline structure with higher VCM (e.g. 15-30 wt. %). This high-VCM sponge coke has significantly greater porosity and lower hardness than traditional sponge coke crystalline structure with lower VCM (e.g. 8-12% wt. %). However, with the high level of asphaltenes and resins in modern, heavy coker feedstocks, this ideal may be difficult to achieve. Even so, the ratio of asphaltic to thermal coking mechanisms must be reduced sufficiently to consistently provide at least the minimum acceptable level of sponge coke for good combustion by the end-user. Since the degree of the asphaltic coking mechanism is primarily a function of coker feedstock, an increase in the thermal coking mechanism will likely achieve the desired result.

In an exemplary embodiment, the decrease in heater outlet temperature lowers the average drum temperature to increase coke VCM (See above). This lower drum temperature favors the thermal coking mechanism and promotes the formation of high porosity sponge coke (versus shot coke). In this manner, the lower drum temperature of an exemplary embodiment is expected to increase the degree of thermal coking mechanism sufficiently to reduce shot coke to acceptable levels. The new product specification for "minimum-acceptable" sponge coke should be the minimum sponge coke required to achieve a stable combustion during various operating/load conditions for the end-user in its particular combustion system. It should be noted that a low "acceptable" sponge coke specification may be caused by or require a higher VCM specification. Consequently, the sponge coke and VCM specifications can be optimized for each application relative to the particular refinery and coke end-user (as set forth herein). The "minimum-acceptable" sponge coke product specification is expected to be in the target range of 40-100 weight percent (preferably 60-100%), for combustion systems designed for bituminous coals.

Alternatively, a "maximum-acceptable" shot coke specification or a specification for average coke density (gm/cc) can provide other product quality measures for process control of a particular coker design and feedstock. A "maximum-acceptable" shot coke specification has the reverse logic of the above discussion. Consequently, a new product specification for "maximum-acceptable" shot coke should be the maximum shot coke that achieves a stable combustion during various operating/load conditions for the end-user in its particular combustion system. A "maximum-acceptable" shot coke product specification is expected to be in the target range of 0-60 weight percent (preferably 5-30%), for combustion systems designed for bituminous coals. Similarly, a product specification for average coke density could be developed to provide coke quality control. That is, the desirable high VCM sponge coke (e.g. 0.75-0.85 gm/cc) has a significantly different density than shot coke (e.g. 0.9-1.0 gm/cc) or needle coke. Consequently, the maximum average coke density specification would likely reflect the composition of the upgraded petroleum coke for the "minimum-acceptable" sponge coke or the "maximum-acceptable" shot coke specifications.

F. Low-Level Decontamination of Coker Feedstocks; Desalting Operations

As noted previously, the combustion of petroleum cokes containing high concentrations of sulfur, sodium, and some heavy metals (e.g. vanadium and nickel) has caused great apprehension due to potential slagging and corrosion of the firebox and downstream equipment. However, the effects of petroleum coke's high metals content in combustion and heat transfer equipment is not well understood or defined. The amount of slag formation on tubes (and associated corrosion) depends on the ultimate composition of the ash resulting from competing oxidation reactions. An analysis of potential ash constituents from the combustion of these petroleum cokes (See Table 1) indicates that compounds with melting points <2500° F. predominantly contain sodium (e.g. various sodium sulfates and various sodium vanadates). Only four major compounds without sodium are in this class: vanadium pentoxide, nickel sulfate, aluminum sulfate, and ferric sulfate. However, the lower oxides of these metals (i.e. V, Ni, Al, and Fe) can be predominant (e.g. in a limited oxidation environment) and have melting points in excess of 2850° F. Also, ferric sulfate and certain sodium sulfates decompose at a temperature near their melting points. Based on this analysis, the primary element that forms compounds with detrimental firebox effects is sodium. Thus, as long as the sodium content of the coke remains low, the high vanadium, nickel, and aluminum contents do not appear to create significant ash fusion and associated corrosion. Even with higher sodium levels in the crude, improvements in desalter operations can provide the needed control.

TABLE 1

MELTING POINTS OF PETROLEUM COKE ASH CONSTITUENTS

| CHEMICAL COMPOUND | | MELTING POINT. ° F. |
|---|---|---|
| CALCIUM OXIDE | $CaO$ | 4662 |
| NICKEL OXIDE | $NiO$ | 3795 |
| ALUMINUM OXIDE | $Al_2O_3$ | 3720 |
| -VANADIUM TRIOXIDE | $V_2O_3$ | 3580 |
| -VANADIUM TETROXIDE | $V_2O_4$ | 3580 |
| SILICON DIOXIDE | $SiO_2$ | 3130 |
| FERRIC OXIDE | $Fe_2O_3$ | 2850 |
| CALCIUM SULFATE | $CaSO_4$ | 2640 |
| *SODIUM SULFATE | $Na_2SO_4$ | 1625 |
| *-SODIUM ORTHOVANADATE | $3\text{-}Na_2O.V_2O_5$ | 1560 |
| NICKEL SULFATE | $NiSO_4$ | 1545 |
| ALUMINUM SULFATE | $Al_2(SO_4)_3$ | 1420 |
| -VANADIUM PENTOXIDE | $V_2O_5$ | 1275 |
| *-SODIUM PYROVANADATE | $2\text{-}Na_2O.V_2O_5$ | 1185 |
| *-SODIUM METAVANADATE | $Na_2O.V_2O_5$ ($NaVO_3$) | 1165 |
| *-SODIUM VANADYLVANADATES | $Na_2O.V_2O_4.V_2O_5$ | 1160 |
| *SODIUM FERRIC SULFATE | $Na_3Fe(SO_4)_3$ | 1000 |
| *-SODIUM VANADYLVANADATES | $5\text{-}Na_2O.V_2O_4.11\text{-}V_2O_5$ | 995 |
| FERRIC SULFATE | $Fe_2(SO_4)_3$ | 895[a] |
| *SODIUM PYROSULFATE | $Na_2S_2O_7$ | 750[a] |
| *SODIUM BISULFATE | $NaHSO_4$ | 480[a] |

*SODIUM COMPOUNDS
-VANADIUM COMPOUNDS
[a]DECOMPOSES AT A TEMPERATURE AROUND THE MELTING POINT

Traditional desalting operations in oil refineries are primarily designed to remove various water-soluble impurities and suspended solids that are usually present in the crude oils from contamination in the ground or in transportation. The prior art of desalting focuses on the removal of salts in a manner that substantially reduces corrosion, plugging, and catalyst poisoning or fouling in downstream processing equipment. Most, if not all, oil refineries have desalting operations. One to two stages of desalting units in series are typically used to pretreat the crude oils prior to the atmospheric crude oil distillation columns. A third desalter stage can be added for vacuum distillation residuals and other coker feedstocks, where undesirable components normally concentrate. One stage is common, two stages are typical, but few installations use three. The additional stages can increase reliability and obtain additional reduction in the salt (and thus sodium) content of the crude oil and downstream products. For example, typical salt contents of crude oil range from 260-300 g/100 $m^3$ or roughly 40 pounds per thousand barrels (ptb) of crude. The first stage can be designed and operated to reduce the salt content by >90% to <4.0 ptb (significantly <15 ppm sodium content). Two-stage desalter operations can be designed and operated to reduce the salt content by >99% to <0.2 ptb (significantly <5 ppm sodium content). Finally, a third stage desalter can be designed and operated to reduce the sodium content of typical vacuum residuals to <1.5 ptb (or <5 ppm sodium). This level typically translates to <25 ppm (or <0.05 lb./Ton) of sodium in the petroleum coke. Consequently, current desalting technology is capable of sufficiently reducing sodium in the petroleum coke to levels that inhibit (and substantially reduce) sodium compounds that cause ash problems in combustion systems. Furthermore, the additional stages also provide incremental reductions in other metals (Vanadium, Nickel, etc.) and particulates that promote the precipitation of shot coke.

The present invention does not claim novel desalting technology, but provides a novel application of such technology to eliminate (or substantially reduce) potential ash problems associated with the combustion of petroleum coke. Therefore, further description of readily available desalting technologies was not deemed appropriate, at this time. However, modifications to existing, desalter operations may be required to achieve acceptable sodium levels in the petroleum coke. That is, the actual performance of the current desalter operation at specific refineries depends on various design factors and operating conditions. In the past, the increased investment cost for multiple stages was usually justified by reducing the problems in downstream processing equipment (corrosion, plugging, & catalyst poisoning or fouling); not sodium levels for petroleum coke combustion. Consequently, the installed desalting technologies may not be currently designed and/or operated to accomplish this objective.

An exemplary embodiment of the present invention uses three desalting stages to pretreat the crude oil (stages 1 and 2) and coker feedstock components (stage 3). The 3-stage desalting system:

(1) minimizes or substantially reduces the concentration of sodium in the resultant pet coke, (2) promotes additional removal of other metals: Vanadium, Nickel, Aluminum, etc., and/or (3) provides greater reduction in particulates that promote the precipitation of shot coke.

Trace quantities of acid, caustic, and other chemical or biological additives can be injected into any or all stages to promote removal of specific undesirable compounds. For example, trace quantities of acid can be added to the water wash in the first stage to promote additional removal of sodium, other alkali and alkaline earth metals, and heavy metal compounds in the crude oil. Trace quantities of caustic can be added to the water wash in the second stage to promote additional removal of sulfur compounds in the crude oil. However, sodium compounds, such as sodium hydroxide, should not be used, and reintroduce higher levels of sodium. Trace quantities of other chemical additives can be added to the water wash in the third stage to promote removal of other compounds of concern. However, since our primary goal is the removal of sodium and other metals, trace quantities of acid in all three stages can be desirable to maximize their reduction.

G. Impacts of the Present Invention on Refinery Operations

The above embodiment of the present invention may cause additional positive impacts on various refinery operations. First of all, the reduced drum temperature (and associated decrease in heater outlet temperature) can normally improve the delayed coker's operation & maintenance and the quality of its cracked liquid products. Secondly, any reduction of shot coke crystalline structure can substantially reduce coker operational problems, as well as improving combustion characteristics. Thirdly, the 3-stage desalting operation improves the operation and maintenance of the coker and other refinery operations. Finally, all of these operational changes can also provide greater flexibility in debottlenecking options for increasing the coker and/or refinery throughput capacities. Most of these advantages lead to higher coker throughput and/or lower operating and maintenance costs in long-term.

The reduced average drum temperature of the exemplary embodiment not only increases the coke VCM to the desired level, but also provides other advantages in the coker operation. First, the lower drum temperature favors thermal coke formation and promotes higher porosity sponge coke. This upgraded petroleum coke is substantially softer than the traditional petroleum coke due to its higher VCM, higher porosity, and acceptable levels of shot coke. Therefore, drilling of this softer petroleum coke in the decoking cycle is less cumbersome, reducing decoking time and associated maintenance. Secondly, a lower drum vapor line temperature also reduces vapor limits without increasing drum pressure and operating costs. In addition, the lower vapor velocities from the coke drums normally decrease the entrainment of coke fines to the fractionator in the coking cycle. Thirdly, lowering the heater outlet temperature to achieve the lower drum temperature can increase the drum fill rate, reducing drum limits and coking cycle time. Finally, the reduced outlet temperature of the coker heater reduces the severity of the delayed coker operation, and consequently improves the coker operation and maintenance. This coker operational change decreases the energy consumption and cost for each barrel processed. The lower outlet temperature also reduces the potential for coking in the heater, onstream spalling, and its subsequent failure. Reducing these factors usually increases heater run life, which is a primary factor in coker run life. Also, the lower target outlet temperature typically increases coker heater throughput capacity for a given heater and feedstock. As such, the reduced outlet temperature provides a greater opportunity for an increased drum fill rate, reducing drum limits and coking cycle time. Reduction in both coking and decoking cycles can lead to increased coker throughput.

The reduced heater outlet temperature is also expected to improve the quality of the cracked liquid products. The subsequent thermal cracking is less severe and creates less olefinic components in the gas oils. The olefinic components tend to be unstable and form gum or sediments. As such, they are undesirable in downstream processing (e.g. catalytic cracking). In addition, the less severe cracking normally decreases the end point and carbon residue of the heavy coker gas oil. The heavy residuum in the coker heavy gas oil can create problems in downstream processing equipment. For example, the heavy residuum in the feed of fluid catalytic cracking units (FCCUs) often turns into coke on catalyst, which can occupy the reaction sites of the catalyst, decreasing catalyst activity and process conversion (or efficiency). In addition, increasing the coke on catalyst normally increases the severity of catalyst regeneration. In turn, severe catalyst regeneration typically increases catalyst attrition, particulate emissions, and catalyst make-up requirements. Consequently, an exemplary embodiment of the present invention can avoid these problems, improving downstream operations and product quality.

Improved coke crystalline structure often reduces operation and maintenance in delayed coker. Besides improving coke grindability and combustion, reducing the production of shot coke to acceptable levels improves coker operation and reduces safety hazards. Shot coke contributes significantly to the following problems: (1) Plugging the bottom coke nozzle; inhibiting proper cooling steam, quench water, and drainage; increasing coking cycle, (2) Channeling of quench water; creating coke drum hot zones and dangerous conditions during cutting, and (3) Coke pouring out of the drum; endangering cutting crew. Consequently, reductions in the shot coke alleviate these operational problems. In addition, the softer sponge coke with the higher VCM is less likely to produce coke fines from the decoking operation. In turn, less coke fines reduces erosion of the coke cutting nozzles.

The 3-stage desalting operation can improve the operation and maintenance of the delayed coker and other refinery operations. Sodium levels >15-30 ppm in the coker feedstocks are known to accelerate heater coking. The efficient desalting normally (1) inhibits coking in the heater, (2) decreases the need for onstream spalling, and (3) increases coker heater run life. Efficient removal of certain particulates also inhibits the formation of shot coke. Most importantly, high efficiency desalting substantially decreases corrosion in atmospheric and vacuum crude distillation units and other downstream operations.

Finally, all of these operational changes can also provide greater flexibility in coker and refinery debottlenecking options. As coker feedstocks change over time, coker throughput (and often refinery throughput) is limited by the particular coker design. Major design limitations are alleviated:

(1) Heater (or Temperature) Limited: Reduced heater outlet temperature (as noted above) provides the opportunity to safely increase heater capacity with reduced heater coking and online spalling, while increasing heater (and potentially coker) run life(s)

(2) Fractionator (or Vapors) Limited: Reduced severity in thermal cracking will reduce the cracked vapors per barrel going to the fractionator; potentially increasing coker capacity (3) Coke Drum (or Coke Make) Limited: Increased drum fill rate and decreased cutting time can be used to reduce coking and decoking cycles to increase coker throughput (4) Sour Crude Processing: High efficiency desalting reduces corrosion in various refinery processes and increases the refinery's tolerance of higher crude sulfur levels (5) Heavy Crude Processing: Decreased cycle time can increase coker throughput capacity, even with increased coke yield (e.g. 2 hr ~10-15%) and allow heavier crude residua content Since the coker is often the bottleneck in the crude throughput of many refineries, debottlenecking the coker can also translate into increased refinery throughput. In addition, factors (4) and (5) provide greater flexibility in crude blends and the ability to process inexpensive heavy, sour crudes. Thus, the overall changes in coker operation are expected to include optimization of various coking parameters, crude blends, and other refinery operations, and maximization of coker and refinery throughputs.

2. Use of Premium "Fuel-Grade" Petroleum Coke: Conventional Utility Boilers

An exemplary use of this new formulation of petroleum coke is the replacement of most types of coals in conventional, pulverized-coal (PC) boilers, utility, industrial, and otherwise. As noted above, the upgraded petroleum coke of the present invention has fuel characteristics that are superior to many coals, which are currently used in conventional PC utility boilers. The discussion of this exemplary embodiment includes (a) a basic description of a conventional PC utility boiler system with traditional particulate control devices, (b) the combustion process of the prior art, (c) the combustion process of the present invention and its improvements, (d) the environmental controls of the prior art, and (e) the environmental controls of the present invention and their impacts. Finally, an example is provided, at the end of this discussion, to illustrate the principles and advantages of the exemplary embodiments of the present invention.

When appropriate, comparisons are made to typical bituminous coals, only for the sake of examples. Similar comparisons exist for other coals, as well. The most important improvements in the use of the upgraded petroleum coke are the abilities to maintain stable combustion without auxiliary fuels and substantially reduce environmental emissions. In particular, only modest modifications are required to substantially reduce emissions of sulfur oxides, while burning a fuel with significantly higher (or comparable) sulfur content in the fuel.

A. Conventional, Pulverized-Coal (PC) Utility Boiler; Process Description

As defined here, conventional, pulverized-coal utility boilers include (but are not limited to) various coal combustion systems used by power utilities to produce steam and subsequently electricity via steam turbines. Typically, the coal combustion system employs horizontally-fired coal burners that produce intense flames in a high heat capacity furnace. A high heat capacity furnace has tremendous capacity to absorb the intense heat released by the combustion of the coal. The most common type of high heat capacity furnace is lined with tubes filled with water, often called a water-wall furnace. The horizontally-fired burners are normally suspension burners, which convey fine, pulverized coal particles via air (i.e. suspended by air) to the combustion zone. Pulverized coal (PC) is usually provided to the burners by a single, fuel processing/management system, which pulverizes, classifies, and regulates the flow of the coal. Pulverization to the desirable particle size distribution of coal particles is key to achieving good combustion characteristics. Also, the coal combustion system normally includes additional flue gas heat exchange, sootblowing equipment, and various temperature controls to optimize efficient use of energy.

Figure 2:
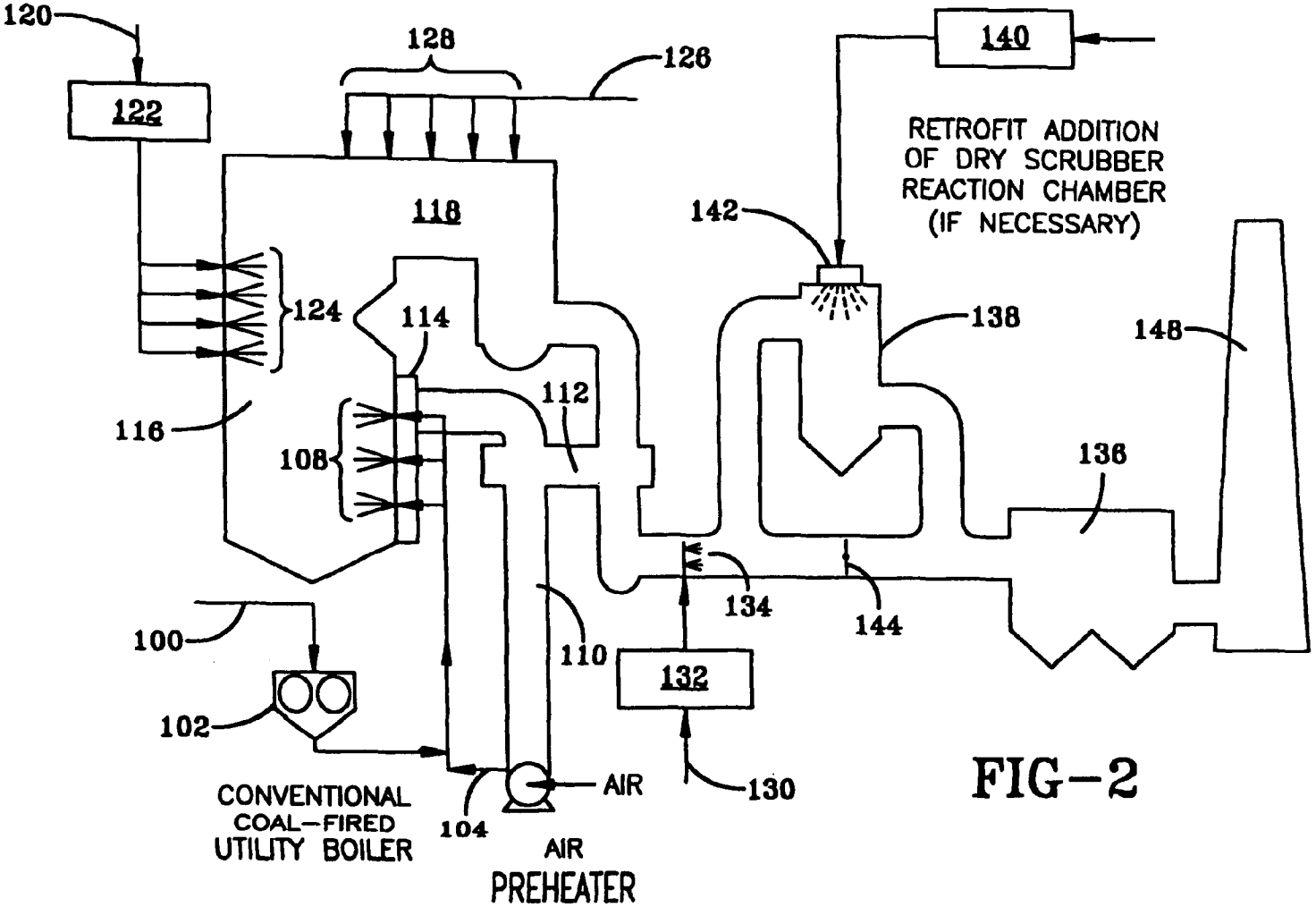
FIG. 2 shows a basic process flow diagram for a conventional, coal-fired utility boiler with traditional particulate control device (PCD): Baghouse, electrostatic precipitator (ESP), or other. In this case, the combustion system has been modified to include reaction vessel(s) and/or reagent injection system(s) for control of undesirable flue gas components.

In an exemplary embodiment of the present invention, a conventional, pulverized-coal utility boiler with a traditional particulate control device is modified to convert sulfur oxides to dry particulates upstream of the existing particulate control device(s). The prior art has been modified to achieve this objective with Option 1: a retrofit addition of flue gas conversion reaction chamber(s) and reagent injection system(s) and/or Option 2: dry reagent injection system(s) in the combustion system. FIG. 2 shows a basic process flow diagram for this modified system burning a pulverized solid fuel as the primary fuel. Auxiliary fuel, such as natural gas or oil, is used for start-up, low-load, and upset operating conditions. The solid fuel 100 is introduced into the fuel processing system 102, where it is pulverized and classified to obtain the desired particle size distribution. A portion of combustion air (primary air) 104 is used to suspend and convey the solid-fuel particles to horizontally-fired burners 108. Most of the combustion air (secondary air) 110 passes through an air preheater 112, where heat is transferred from the flue gas to the air. The heated combustion air (up to 600° F.) is distributed to the burners via an air plenum 114. The combustion air is mixed with the solid fuel in a turbulent zone with sufficient temperature and residence time to initiate and complete combustion in intense flames. The intense flames transfer heat to water-filled tubes in the high heat capacity furnace 116 primarily via radiant heat transfer. The resulting flue gas passes through the convection section 118 of the boiler, where heat is also transferred to water-filled tubes primarily via convective heat transfer. At the entrance to the convection section 118, certain dry reagents can be mixed with the flue gas to convert undesirable flue gas components (e.g. sulfur oxides) to dry particulates (i.e. exemplary embodiment: option 2). The sorbents 120 pass through a reagent preparation system 122 and are introduced into the flue gas via a reagent injection system 124. Steam or air 126 is normally injected through sootblowing equipment 128 to keep convection tubes clean of ash deposits from the fuel and formed in the combustion process. The flue gas then passes through the air preheater 112, supplying heat to the combustion air.

The cooled flue gas then proceeds to the air pollution control section of the utility boiler system. At the exit of the air preheater, certain dry reagents can be mixed with the flue gas to convert undesirable flue gas components (e.g. sulfur oxides) to dry particulates (exemplary embodiment: option 2). The reagents 130 pass through a reagent preparation system 132 and are introduced into the flue gas via a reagent injection system 134. The existing particulate control device 136 (ESP, baghouse, etc.) has been retrofitted with the addition of a reaction chamber 138 (the exemplary embodiment: option 1). Certain reagents (e.g. lime slurry) can be prepared in a reagent preparation system 140. The reagent is dispersed into the flue gas through a special injection system 142. Sufficient mixing and residence time are provided in the reaction chamber to convert most of the undesirable flue gas components (e.g. sulfur oxides) to collectible particulates. These particulates are then collected in the existing particulate control device 136. A bypass damper 144 is installed in the original flue gas duct to bypass (100% open) the retrofit, flue gas conversion system, when necessary. The clean flue gas then exits the stack 148.

B. Combustion Process of the Prior Art

The conventional, PC-fired utility boiler system, described above, can successfully burn a wide variety of solid fuels. Various types of coal are burned in such systems throughout the United States and internationally. Bituminous, sub-bituminous, and lignite coals are commonly used in this type of combustion system. Low volatile, solid fuels (such as traditional petroleum coke, anthracite coals, and low-volatile bituminous coals) typically cannot be used as the primary fuel in these types of boilers. These solid fuels often require non-conventional types of combustion systems, including cyclone furnaces, fluidized bed combustors, or down-fired burners into a low heat capacity furnace (e.g. refractory lined). The design of each conventional, PC-fired combustion system, though, varies greatly and depends on (1) each coal's respective fuel properties and combustion characteristics, and (2) the quantity and quality of steam required.

The integrated design of a conventional, PC-fired utility boiler and associated systems is a complex engineering effort. Various design and operational factors must be given proper consideration. These design and operational factors include (but are not limited to) the following:

- Fuel Properties: VCM, ash content, moisture content, char quality, particle size distribution (PSD), carbon/hydrogen ratio, oxygen content, adiabatic flame temperature, burning profiles, etc.
- Combustion Characteristics: flame stability, flame temperature, flame turbulence, flame residence time, excess air, air preheat (primary & secondary air), carbon burnout, combustion efficiency, etc.
- Burner Design: size, number, flame shape, fuel/air mixing, pressure drop, low emissions, etc.
- Furnace Design: size, shape, refractory & heat transfer properties, tube layout & metallurgy, etc.
- Steam System Design: water & steam quality, tube number & spacings, sootblowing, etc.
- Fuel Preparation System: pulverizer capacity & energy/grinding characteristics, in/out PSDs, etc.

Engineers skilled in the art typically use complex computer models to optimize the integrated design, based on substantial combustion experience and various design factors (including those noted above). Therefore, the remaining discussion about the combustion prior art will be limited to fuel property considerations that significantly affect the fuel decisions for new boilers and fuel switching in existing boilers. Though this discussion is primarily focused on various coals to simplify explanation, the principles involved apply to other solid fuels as well.

Numerous references discuss the combustion science related to burning solid fuels. Many provide theories of combustion and the relative impacts of various fuel properties, including ash content, moisture content, char quality, and particle size. These issues are discussed in the present invention, where it is relevant. However, two other fuel properties, that are not universally discussed, are key to accurately describe the present invention. Both fuel properties, grindability indexes and burning profiles, are important factors in the evaluation of potential fuel substitutions in conventional, PC-fired combustion systems.

(1) Grindability Index:

A fine particle size distribution of coal from the pulverizer is a critical parameter in achieving good combustion efficiency. That is, for a given coal, smaller coal particles normally require less residence time and/or lower temperatures to provide good char burnout and less unburned carbon. The ability to pulverize the coal to finer particle size distributions is related to the coal's hardness. However, a grindability index provides a more comprehensive comparison of the overall grindability of various coals.

Babcock & Wilcox developed one type of grindability index test, called the Hardgrove Grindability Index (HGI). This laboratory procedure, ASTM Method D 409, is an empirical measure of the relative ease with which coal can be pulverized. The HGI has been used for the past 30 years to evaluate the grindability of coals. The method involves grinding 50 grams of air-dried test coal (16×30 mesh or 1.18 mm×600 um) in a small ball-and-race mill. The mill is operated for 60 revolutions and the quantity of material that passes through a 200 mesh (75 micron) screen is measured. From a calibration curve relating −200 mesh (−75 micron) material to the grindability of standard samples supplied by the U.S. Department of Energy, the Hardgrove Grindability Index (HGI) is determined for the test coal. The higher the HGI, the more easily the coal can be pulverized to fine particle size distributions. Pulverizer manufacturers have developed correlations relating HGI to pulverizer capacity at desired levels of fineness.

(2) Burning Profiles:

As noted above, many fuel properties need proper consideration in the integrated design of a solid-fuel combustion system. One of the most comprehensive evaluations of the overall combustibility of a solid fuel is the burning profile. One type of burning profile test was developed by Babcock & Wilcox. This laboratory procedure measures the entire course of combustion for a tested fuel, from ignition to completion of burning.

Figure 3:
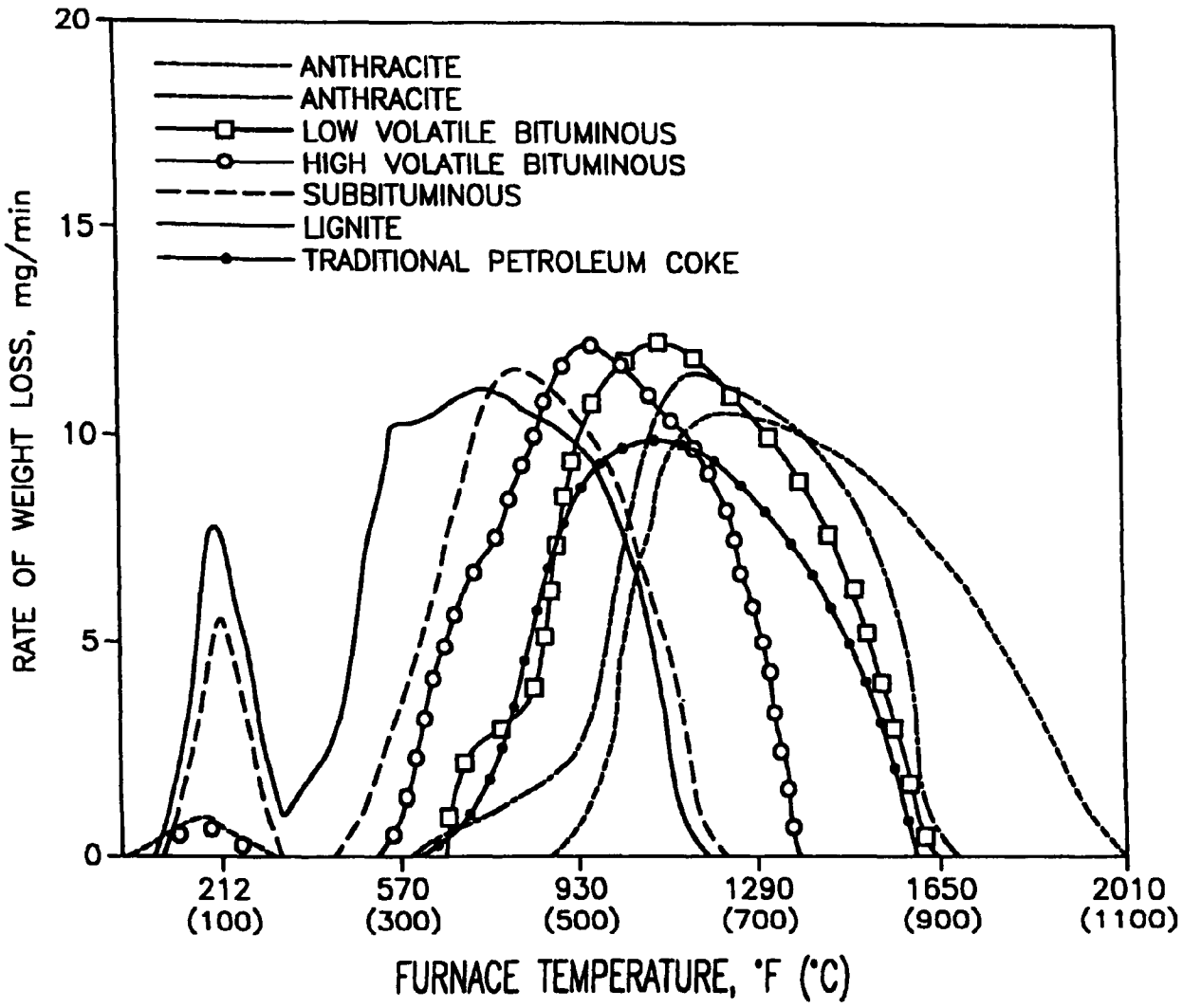
FIG. 3 shows comparisons of burning profiles for existing coals and traditional petroleum coke.

The B&W procedure, described by Wagoner and Duzy, uses derivative thermogravimetry, in which a fuel is oxidized under controlled conditions. A 300 mg sample with a particle size less than 60 mesh (250 microns) is heated at a fixed rate (27° F. per minute: 68 to 2012° F.) in a stream of air. Weight change (mg/min) is measured continuously. The graphical presentation of these data (mg/min vs. temperature) provides a more complete picture of the entire combustion process, through examination of the solid fuel's oxidation rates. For example, FIG. 3 shows the burning profiles representing each classification of coal. The height of each oxidation peak is proportional to the intensity of the oxidation reactions and flame. The area under each peak is noted to be approximately proportional to the amount of combustible material in the sample and/or the total heat liberated. In general, bituminous, sub-bituminous, and lignite coals have greater oxidation rates at lower temperatures than anthracite coals. This indicates easier ignition and burning. Such fuels would be expected to burn more completely in the lower part of the furnace. Profiles that extend into very high temperature ranges, such as anthracite coal, indicate slow burning fuels for which longer residence times in high temperature zones are necessary for efficient combustion. Thus, the maximum temperature on the burning profile helps determine the requirement for furnace residence time at high temperature to obtain a low unburned carbon loss, and thus higher combustion efficiency.

Burning profiles are very repeatable for the same operating conditions and test furnace. However, the same solid fuel will show a different burning profile for changes in heat transfer rates, sample size, particle size distribution, air flow rate, etc. Consequently, the burning profiles provide a good qualitative comparison of relative burning properties for solid fuels, but can be limited to combustion with identical or very similar conditions.

A major shortcoming of the B&W burning profile test procedure is the preparation of the various fuel samples at a specified particle size distribution. The fuel sample is ground to less than No. 60 Sieve (~250 microns) and care is specified to produce a minimum of fines. In contrast, various coals are pulverized to 60-90% through 200 Sieve (~74 microns) for various combustion applications. As discussed previously, the particle size distribution has a substantial impact on a solid fuel's oxidation rate. Consequently, a modified test procedure is desirable to reflect relative differences in HGI and the grindability characteristics for various fuels. For example, the burning profile test procedure can be modified to prepare fuel samples with a constant grinding energy, yet minimize the generation of fines. For testing purposes, the fuel samples would still have a particle size distribution that is much larger than the commercial facility. In this manner, the relative combustion impacts of fuel grindability and resultant particle size distribution can be incorporated into the burning profile.

(3) Fuel Substitution:

Burning profiles can be effectively used to evaluate the potential substitution of one solid fuel for another. Coals with similar burning profiles have been noted to behave similarly in large furnaces of equivalent design and operation. Thus, comparison of the burning profile of an unknown solid fuel to that of a solid fuel that has proven performance can provide useful information to predict design (e.g. furnace & burners) and operating conditions (e.g. excess air and burner settings). Furthermore, comparison of the burning profiles for an alternative solid fuel and a solid fuel with proven performance in a particular furnace design can provide a preliminary evaluation of the ability to substitute one fuel for another in a particular combustion system.

Similar burning profiles provide a higher degree of confidence in the ability to substitute one solid fuel for another. However, a perfect match of burning profiles is not necessary, and can be undesirable. For example, the first peak in the burning profile of coals with high moisture is the evaporation of the coal's water content. Providing a substitute solid fuel with this burning profile characteristic can be undesirable due to the detrimental combustion effects of moisture. Also, very volatile fuels may be undesirable due to concerns of premature ignition and excessive flame intensity. Furthermore, a low temperature peak from low-quality volatiles (e.g. carbon monoxide) can be less desirable due to its effects that cause lower heating value and higher fuel usage. Consequently, the comparison of burning profiles is a preliminary evaluation, which requires further optimization of basic fuel properties and combustion characteristics.

Optimal ignition and char burnout are key properties in achieving a successful solid fuel switch. Optimal ignition characteristics would provide self-combustion in a conventional PC boiler without auxiliary fuel, while avoiding premature ignition, excessive flame intensity, or lower heating value. Optimal char burnout would provide high combustion efficiencies (i.e. insignificant unburned carbon) at sufficiently low temperatures and residence times to complete combustion in the lower furnace, while avoiding excessive flame intensity.

Finally, derating the boiler's capacity and reducing efficiency are major concerns of fuel switching. As such, switching an existing solid fuel to a higher quality fuel is often preferable to switching to a lower quality fuel. For example, most of the western U.S. low sulfur coals are sub-bituminous rank that have higher moisture, comparable ash, and lower quality volatiles than bituminous coals being replaced. Consequently, their lower heating values (and capacity derating effect) limit their application to partial substitution or boilers with low load factors. However, in certain situations, the reduction in sulfur oxides emissions is more important than the ability to maintain high load factors.

C. Combustion Process of the Present Invention

The new formulation of petroleum coke of the present invention has an unexpected ability to burn successfully, even with relatively low VCM content. The combustion of this upgraded coke is compared to traditional delayed coke and most coals. Its superior fuel properties and combustion characteristics are discussed, including ash/moisture effects, char quality (particle size, porosity, etc.), ignition/residence time issues, and burning profiles. Finally, superior characteristics of the upgraded petroleum coke are then discussed for each of the following subsystems of the conventional PC utility boiler: fuel processing, combustion, and heat transfer.

(1) Combustion Quality of Traditional Petroleum Coke

A burning profile representing a traditional petroleum coke was added to FIG. 3 for comparison to burning profiles of various types of coal. In general, this traditional petroleum coke has a burner profile similar to low-volatile, bituminous coal. Other traditional petroleum cokes (e.g. shot and Fluid coke) have burner profiles more similar to anthracite coals. In either case, the similar burner profiles show why traditional petroleum cokes require low heat capacity furnaces commonly used for these coals (e.g. cyclone furnaces). As such, traditional petroleum coke can only be considered for direct fuel substitution in special furnaces capable of firing these hard-to-burn coals.

Further analysis of this traditional petroleum coke's burning profile demonstrates even poorer combustion characteristics than these "similar" coals. First, the initial ignition temperature (~600-650° F.) is comparable to low-volatile bituminous and high-volatile anthracite coals, but significantly higher than high volatile bituminous, subbituminous, and lignite coals. This higher initial temperature of weight loss in the burning profile is caused by the low-quality, volatile content of the traditional petroleum coke. Secondly, the maximum rate of weight loss (oxidation peak) for this traditional petroleum coke is ~10-20% lower than most coals. This lower oxidation peak can be attributed to the coke's lower quality/quantity of VCM (11.7 wt. % VCM) and poor char quality (e.g. shot coke). That is, the coke's devolatilization and char burnout are not as rapid, creating lower oxidation intensity. Thirdly, the area under the curve is significantly smaller than the coal's, indicating the total sample did not oxidize. With complete combustion, the traditional petroleum coke would be expected to have a larger area under the curve, representing relatively greater proportion of combustible material due to its much higher heating value and lower ash/moisture contents. This unburned carbon can be caused by several factors, including the coke's lower quality/quantity of VCM and poor char quality. Finally, the completion of combustion occurs at approximately 1550-1600° F. This undesirable, combustion completion temperature is again comparable to low-volatile bituminous and high-volatile anthracite. Profiles that extend into these high temperature ranges indicate slow-burning fuels, which require longer residence times in high temperature zones for efficient combustion.

In conclusion, this burning profile analysis indicates the production of a petroleum coke that sustains self-combustion may require more than simply an increase in coke VCM. Substantial coke combustion experience of the inventor further supports this conclusion. Various coke/oil slurries that simply add VCM external to the coking process have been attempted with limited success. The oil provides a high quantity of high-quality VCM. However, this method does not change the poor char quality. Similarly, a higher quantity of low quality VCM is normally not sufficient to initiate and sustain self-combustion without a substantial change in the coke's char quality.

(2) Combustion of Upgraded Versus Traditional Petroleum Coke:

The new formulation of petroleum coke in the present invention has substantially better fuel properties and combustion characteristics than the traditional "fuel-grade" petroleum coke. The primary difference is the ability to initiate and sustain self-combustion in a conventional, high heat capacity furnace without the use of auxiliary fuels, except for start-up. For example, the upgraded coke, unlike traditional coke, can be effectively burned in a conventional, pulverized-coal boiler. The superior combustion characteristics result from 3 primary changes in the new formulation of the exemplary embodiment:

(1) Increased quantity and quality of VCM: improves ignition and char burnout,
(2) Improved char quality of the modified sponge coke: higher porosity and reactivity, and
(3) Softer coke: ability to pulverize to a smaller particle size with same or less energy input.

The combined effect is expected to have the following impact on the petroleum coke's burning profile: (1) move the burning profile curve to the left (i.e. lower ignition and combustion completion temperatures), (2) increase maximum rate of weight loss (or peak flame intensity), and (3) increase the area under the curve (increase proportion of combustible material oxidized). These factors improve the ignition, char burnout characteristics, flame quality, and combustion efficiency.

Further embodiments of this invention provide additional means to increase the quality and quantity of the volatile combustible materials in the upgraded petroleum coke. These other embodiments provide options to improve further the combustion characteristics of the upgraded petroleum coke. With these additional embodiments, the upgraded petroleum coke is expected to initiate and complete combustion at lower temperatures and require lower combustion residence times. Consequently, the burning profiles of the upgraded coke are expected to move further to the left.

(3) Combustion of Upgraded Petroleum Coke Versus Most Coals:

The fuel properties and combustion characteristics of petroleum coke are improved sufficiently by the present invention to replace most coal fuels (e.g. in conventional, PC utility boilers). An exemplary embodiment of the present invention is expected to improve petroleum coke sufficiently to directly replace many high volatile bituminous, subbituminous, and lignite coals. In cases where direct replacement is not possible, the improved qualities are sufficient to replace these coals with modest to moderate modifications in the design and/or operation of the combustion system (i.e. burners, furnace, etc.).

a. Superior Fuel Properties: The premium, "fuel-grade" petroleum coke typically has better combustion characteristics than most coals due to more desirable fuel properties. The primary coke fuel properties affecting combustion characteristics include the following: lower ash, lower moisture content, lower grindability hardness, greater fuel consistency, and significantly higher (or comparable) porosity of the residual carbon. Tables 2-A and 2-B provide comparison of key differences in fuel properties, combustion characteristics, and environmental performance for traditional petroleum cokes, upgraded petroleum cokes of the present invention (i.e. OptiFuel™) and many examples of various types of coal. Compared to most coals, the upgraded petroleum coke typically has 90+% lower ash content, 75-90+% lower moisture content, and 10-250+% higher heating values. The fuel rate is typically decreased by 10-40+%. The significantly lower fuel rate can decrease the total quantity of undesirable components (e.g. sulfur), even with higher component contents (wt. % in pet coke vs. coal). Sulfur, nitrogen, and carbon contents of the upgraded coke are normally comparable or higher. The VCM content is typically lower for comparable combustion characteristics (e.g. burning profile) and fuel use applications.

b. Improved Combustion Characteristics: The superior fuel properties of the upgraded petroleum coke from the present invention provide improved (or comparable) combustion characteristics relative to most coals. More desirable combustion characteristics are expected to include (but are not limited to) (1) superior ash and moisture combustion effects, (2) increased residence time, (3) better (or comparable) char quality & burnout, and (4) improved combustion stability with lower excess air rates.

1. Superior Ash and Moisture Combustion Effects: The lower ash and moisture contents of the upgraded petroleum coke affect a variety of combustion characteristics. Ash and moisture absorb heat in the combustion process. This increases the required ignition temperature and reduces the flame temperature (adiabatic and actual). Also, high ash and moisture contents substantially reduce the heat content (Btu/pound) of the fuel and require more pounds of fuel for a given heat release rate in the combustion system. Consequently, lower ash and moisture contents of the upgraded petroleum coke increases flame temperature and heating value and reduces required ignition temperature and fuel rates.

2. Increased Residence Time: The lower fuel rates and associated reduction in air rates normally increase operating capacities in an existing boiler for the pulverizer, fan, and boiler systems. In addition, the lower fuel and air rates can significantly increase the residence time in the existing boiler system, usually improving combustion efficiency (e.g. carbon-burnout), boiler efficiency (e.g. better heat transfer), and environmental control efficiency (e.g. reduced ESP velocity: Q/A). In most cases, upgraded coke also decreases flue gas flow, system pressure-drop, and associated auxiliary power.
3. Better Char Quality and Burnout: The high porosity, sponge coke of the present invention provides better char quality that favors superior carbon burnout to most coals. The higher porosity provides more accessible combustion reaction sites, and promotes more complete carbon burnout. As discussed below, the significantly lower hardness (HGI=80-120+) allows more flexibility in grinding the coke to a much finer particle size distribution at lower grinding energies. The finer particle size of the fuel promotes more efficient and complete combustion, particularly for a low VCM fuel.
4. Improved Combustion Stability with Lower Excess Air: The upgraded petroleum coke is produced by a chemical process that provides less variability in composition and combustion characteristics than coal(s) from different veins in the same mine or even different mines. That is, the upgraded petroleum coke of the present invention has more uniform fuel properties and combustion characteristics. This fuel consistency normally improves flame stability and decreases excess air requirements for similar load variations.
5. Catalytic Oxidation Effects: The metals content of petroleum coke (upgraded or traditional) often contains higher levels of heavy metals, such as vanadium and nickel. These metals can provide a positive benefit as an oxidation catalyst to improve combustion characteristics and efficiency.

All these factors give the upgraded petroleum coke firing capabilities and combustion characteristics that are superior (or comparable) to coals with significantly higher VCM content. High quality VCM, high porosity sponge coke, and finer particle size distribution of the upgraded coke fuel are primary features of the present invention that reduce the overall VCM requirement relative to various coals. Low ash and moisture content are also contributing factors. In conclusion, the fuel qualities of the upgraded petroleum coke are expected to promote (1) a more uniform and stable flame, (2) acceptable combustion at lower excess air operation, and (3) better char burn-out characteristics than most coals, over a wide range of operating conditions.

As noted above, additional embodiments of this invention provide additional options to increase the quality and quantity of the volatile combustible materials in the upgraded petroleum coke. That is, high quality VCM (e.g. BP Range: 350-750° F. & heating value: 16-20,000+ btu/lb) can be integrated into the petroleum coke crystalline structure. In this manner, the burning profile of the upgraded coke can be adjusted to optimize desirable combustion characteristics for replacing solid fuels in a particular combustion system (See: Optimal Fuel Embodiment). This can be accomplished by matching the burning profile of the existing solid fuel or achieving other desirable burning profile characteristics. For example, production of an upgraded petroleum coke with optimal ignition and char burnout characteristics can also be achieved. Again, in cases where direct replacement is not possible, the improved qualities are sufficient to replace these coals with modest to moderate modifications in the design and/or operation of the combustion system (i.e. burners, furnace, etc.).

(4) Combustion of Upgraded Petroleum Coke Vs. Low Sulfur Coals:

Most low-sulfur coals referred to in this section are actually a subset of the previous section (i.e. most coals). Consequently, the comparison of fuel properties and combustion characteristics are still valid in this section. However, low-sulfur subbituminous coals are a special subset of "Most Coals" that warrants further discussion, due to their current use as fuel alternatives to comply with U.S. environmental laws.

Many PC utility boilers in the United States are being switched from bituminous coal to subbituminous, low-sulfur coal to comply with EPA regulations caused by the CAAA of 1990. The subbituminous, low sulfur coal typically has comparable ash contents, higher moisture contents and lower heating values (vs. bituminous coal). The fuel rate is typically increased by 20-40+%. The substantially higher fuel rate usually increases the ash quantity, even with lower ash content (wt. %). Consequently, a fuel switch to this low-sulfur coal normally requires boiler derating (operating with lower capacity), pulverizer derating, and mitigating problems with particulate emissions. Other problems often include increases in air requirements, flue gas flow, system pressure-drop, and associated auxiliary power. Most of these factors lead to decreased combustion, boiler, and environmental control efficiencies.

In contrast, a fuel switch to the upgraded petroleum coke of the present invention will have the opposite impact on most of these factors. Table 2-A shows that the upgraded petroleum coke (vs. bituminous coal) typically has 95+% lower ash content, 5-30+% lower moisture content, and 10-25%% higher heating values. The fuel rate is typically decreased by 10-20+%. The significantly lower fuel rate usually decreases the overall sulfur quantity, even with higher sulfur content (wt. %). Consequently, a fuel switch to the upgraded coke increases operating capacities for the pulverizer, fans, boiler, and environmental control systems. Decreases in air requirements, flue gas flow, system pressure-drop, and associated auxiliary power can often lead to increased combustion, boiler, and environmental control efficiencies, as well. In conclusion, fuel switching from most coals (including low sulfur, subbituminous coals) to the upgraded petroleum coke of the present invention can significantly improve the various subsystems of the conventional, PC utility boiler: fuel processing, combustion and heat transfer.

TABLE 2-A

Fuel Properties and Combustion Characteristics
Petroluem Cokes Vs. Various Coals

| PETROLUEM COKES VS. COALS<br>Fuel Properties/Combustion Characteristics<br>Projected Low NOx Operation/XSAir | | Traditional Pet Cokes Hi Btu/Lb | Projected OptiFuel ™ Deslfrd 80% | OptiFuel ™ Options Reg/Dslfrd | Anthracite Low/Med Volatile | Bituminous Low/Med Volatile |
|---|---|---|---|---|---|---|
| Fuel Properties | | | 23% VCM | 15-30% VCM | | |
| Volatile Matter: VCM | Wt. % | 10.4 | 23.4 | 15-30 | 1.7-10.6 | 16.6-23.4 |
| Fixed Carbon | Wt. % | 89.0 | 76.1 | 69-85 | 67.2-84.1 | 64.9-77.3 |
| Moisture | Wt. % | 0.26 | 0.24 | 0.23-0.25 | 2.0-7.7 | 1.0-2.9 |
| Ash | Wt. % | 0.33 | 0.30 | 0.30-0.32 | 9.7-20.2 | 5.1-10.3 |
| C/H Ratio | Wt. % | 24.0 | 18.1 | 16-22 | 33.0-86.0 | 18.0-28.0 |
| Sulfur | Wt. % | 4.6 | 3.96 | 0.55-4.4 | 0.6-0.8 | 0.7-2.2 |
| Nitrogen | Wt. % | 1.7 | 1.45 | 1.0-1.6 | 0.2-0.9 | 1.2-1.5 |
| Oxygen | Wt. % | 0.7 | 0.63 | 0.60-0.64 | 0.25-2.3 | 2.9-3.5 |
| Hardgrove Grind. Index | Wt. % | 50-60 | >100 | 100-120+ | | |
| Combustion Characteristics | | | | | | |
| HHV, as Received | MBtu/Lb | 15.3 | 15.9 | 15.4-16.5 | 11.9-12.9 | 13.7-14.7 |
| Increase Due to OptiFuel ™ | Col2 vs Coal | 3.6% | | | 22-33% | 12-15% |
| Oxidation Initiation Temp. | ° F. | ~750 | ~550 | 450-650 | 600-950 | 600-800 |
| Oxidation Completion Temp. | ° F. | ~1600 | ~1300 | 1150-1450 | 1600-2050 | 1550-1700 |
| Pulverized: % <200 Mesh | Wt. % | >80 | >90 | >90 | >80 | 70-75 |
| Excess Air | Mole % | 25.0% | 15 | 15 | 30 | 25 |
| Unburned Carbon | Wt. % | 5.0% | 0.8 | 0.8 | 2.0 | 1.5 |
| Boiler Impacts | | | | | | |
| Comb. Air To Burners (wet) | Lb/MMBtu | 895 | 861 | 858-864 | 939-994 | 905-937 |
| Combustion Air (Wet) | MLb/Hr | 839 | 785 | 784-785 | 853-909 | 820-862 |
| Change Due to OptiFuel ™ | Col2 vs Coal | −6.4% | | | −8 to −14% | −4.3 to −9.0% |
| Wet Flue Gas Flow Rate | MMoles/Hr | 30.6 | 28.7 | 28.5-28.7 | 31.6-33.8 | 29.7-31.5 |
| Change Due to OptiFuel ™ | Col2 vs Coal | −6.5% | | | −9 to −15% | −3.7 to −9.1% |
| Boiler Efficiency/Basic Model | % | 85.4 | 87.8 | 87.5-88.1 | 87.5-88.6 | 87.0-88.5 |
| Change Due to OptiFuel ™ | Col2 vs Coal | 2.7% | | | −1.0 to +0.3% | 0.6 to +0.9% |
| Heat Input From Fuel | MMBtu/Hr | 937 | 912.0 | 908-915 | 903-914 | 904-920 |
| Fuel Rate | MLb/Hr | 0.61 | 56.0 | 57-59 | 70-77 | 61-67 |
| Change Due to OptiFuel ™ | Col2 vs Coal | −6.1% | | | −17 to −25% | −13 to −6.1% |

| PETROLUEM COKES VS. COALS<br>Fuel Properties/Combustion Characteristics<br>Projected Low NOx Operation/XSAir | | Bituminous High Volatile | Subbituminous High Volatile | Lignite Med/High Volatile |
|---|---|---|---|---|
| Fuel Properties | | | | |
| Volatile Matter: VCM | Wt. % | 27.5-40.0 | 30.5-32.7 | 18.2-29.1 |
| Fixed Carbon | Wt. % | 37.1-481 | 32.8-46.7 | 8.6-32.2 |
| Moisture | Wt. % | 1.5-17.6 | 14.1-31.0 | 14.2-37.0 |
| Ash | Wt. % | 3.3-13.1 | 3.7-7.0 | 4.2-59.0 |
| C/H Ratio | Wt. % | 14.0-15.9 | 14.0-14.4 | 8.0-14.1 |
| Sulfur | Wt. % | 0.7-4.0 | 0.3-0.6 | 0.4-1.0 |
| Nitrogen | Wt. % | 0.8-1.5 | 0.7-0.8 | 0.3-0.8 |
| Oxygen | Wt. % | 4.9-11.0 | 12.6-13.4 | 7.3-13.0 |
| Hardgrove Grind. Index | Wt. % | | | |
| Combustion Characteristics | | | | |
| HHV, as Received | MBtu/Lb | 10.3-14.5 | 8.3-11.1 | 2.7-7.3 |
| Increase Due to OptiFuel ™ | Col2 vs Coal | 9-53% | 42-90% | 120-480% |
| Oxidation Initiation Temp. | ° F. | 450-650 | 350-550 | 250-450 |
| Oxidation Completion Temp. | ° F. | 1300-1450 | 1150-1300 | 1100-1250 |
| Pulverized: % <200 Mesh | Wt. % | 65-70 | 60.0 | 60 |
| Excess Air | Mole % | 20 | 20 | 20 |
| Unburned Carbon | Wt. % | 1.0 | 1.0 | 1.0 |
| Boiler Impacts | | | | |
| Comb. Air To Burners (wet) | Lb/MMBtu | 826-924 | 837-885 | 859-952 |
| Combustion Air (Wet) | MLb/Hr | 769-856 | 781-848 | 852-1021 |
| Change Due to OptiFuel ™ | Col2 vs Coal | −8.3 to +2.0% | −7.4 to +0.5% | +8.0 to +23% |
| Wet Flue Gas Flow Rate | MMoles/Hr | 29.1-31.8 | 29.7-33.0 | 34.7-42.4 |
| Change Due to OptiFuel ™ | Col2 vs Coal | −10 to −1.4% | −13.1--3.4% | +17 to +32% |
| Boiler Efficiency/Basic Model | % | 84.8-87.1 | 82.6-85.7 | 73.8-80.7 |
| Change Due to OptiFuel ™ | Col2 vs Coal | +0.8 to +3.5% | +2.3 to +6.3% | +8.7 to +19% |
| Heat Input From Fuel | MMBtu/Hr | 919-944 | 933-969 | 991-103 |
| Fuel Rate | MLb/Hr | 64-92 | 84-116 | 137-391 |
| Change Due to OptiFuel ™ | Col2 vs Coal | −37 to −9.2% | −51 to −31% | −85 to −58% |

TABLE 2-B

Environmental Performance
Petroleum Cokes Vs. Various Coals

| PETROLEUM COKES Vs. COALS Environmental Performance Projected Low NOx Operation/XSAir | | Traditional Pet Cokes Hi Btu/Lb | Projected OptiFuel ™ Deslfrd 80% | OptiFuel ™ Options Reg/Dslfrd | Anthracite Low/Med Volatile | Bituminous Low/Med Volatile |
|---|---|---|---|---|---|---|
| Fuel Properties | | | 23% VCM | 15-30% VCM | | |
| HHV, as Received | Mbtu/Lb | 15.3 | 15.9 | 15.4-16.5 | 11.9-12.9 | 13.7-14.1 |
| Sulfur | Wt. % | 4.6 | 2.0 | 0.5-4.4 | 0.6-0.8 | 1.5-2.2 |
| Nitrogen | Wt. % | 1.7 | 1.0 | 0.7-1.6 | 0.2-0.9 | 1.2-1.5 |
| Uncontrolled Emissions | | | | | | |
| Ash Particulates | Lb/MMBtu | 0.22 | 0.19 | 0.18-0.21 | 7.6-17.0 | 4.7-7.5 |
| Decrease Due to OptiFuel ™ | Col2 vs Coal | 10.9% | >90% | | 97.5-98.9% | 95.9-97.4% |
| Sulfur Oxides: SOx | Lb/MMBtu | 6.0 | 2.5 | 0.7-5.6 | 0.9-1.2 | 2.2-2.5 |
| Change Due to OptiFuel ™ | Col2 vs Coal | −58.4% | | | 175-107% | 0-13% |
| NOx: If Total Conversion | Lb/MMBtu | 3.6 | 2.1 | 2.1-3.4 | 0.4-2.5 | 2.9-3.6 |
| Change Due to OptiFuel ™ | Col2 vs Coal | −41.2% | −5 to −50% | | −16 to +425% | −28 to −42% |
| Carbon Dioxide: $CO_2$ | Lb/MMBtu | 213 | 206 | 201-211 | 221-240 | 204-211 |
| Change Due to OptiFuel ™ | Col2 vs Coal | − 3.3% | 0 to −10% | | −7 to −14% | −3 to +1% |
| Control Efficiencies Read. | | | | | | |
| Part. <0.03 Lb/MMBtu | Wt. % | 86.13 | 84.44 | 83.3-85.6 | 99.6-99.8 | 99.4-99.6 |
| $SO_2$ <1.2 Lb/MMBtu | Wt. % | 79.9 | 51.7 | −42 to +79 | −29.3 to +0.7 | 45.0-62.4 |
| APC Assumptions | | | | | | |
| ESP Efficiencies | Wt. % | For Fly Ash | 99.50% | 99.50% | 99.5% | 99.5% |
| Environmental Performance | | For Sorbent | 99.95% | | | |
| SOx Removed w/Combustion | Lb/MMBtu | 0.0 | 1.2 | 0.0 | 0.0 | 0.0 |
| Controlled SOx | Lb/MMBtu | 5.97 | 1.2 | 0.7-5.6 | 0.9-1.2 | 2.2-2.5 |
| Change Due to OptiFuel ™ | Col2 vs Coal | −79% | −1.2 | | 0 to +33% | −45 to −52% |
| Particulates | Lb/MMBtu | 0.018 | 0.0044 | .0043-.0045 | .042-.068 | .027-.041 |
| Decrease Due to OptiFuel ™ | Col2 vs Coal | 78% | >90% | | 91 to 95% | 84-89% |
| Ash for Disposal/Reuse | | | | | | |
| Fly Ash Collected | MT/D | 41 | 10 | 9.6-9.7 | 90-191 | 59-89 |
| Decrease Due to OptiFuel ™ | Col2 vs Coal | 77% | −70 to −99% | | 89-95% | 83-89% |

| PETROLEUM COKES Vs. COALS Environmental Performance Projected Low NOx Operation/XSAir | | Bituminous High Volatile | Subbituminous High Volatile | Lignite Med/High Volatile |
|---|---|---|---|---|
| Fuel Properties | | | | |
| HHV, as Received | Mbtu/Lb | 10.3-14.5 | 8.32-11.14 | 2.74-7.26 |
| Sulfur | Wt. % | 0.7-4.0 | 0.3-0.6 | 0.4-1.0 |
| Nitrogen | Wt. % | 0.8-1.5 | 0.7-0.8 | 0.3-0.8 |
| Uncontrolled Emissions | | | | |
| Ash Particulates | Lb/MMBtu | 2.3-10.1 | 4.0-6.3 | 5.8-215.4 |
| Decrease Due to OptiFuel ™ | Col2 vs Coal | 91.6 to 96.1% | 95.2-96.9% | 96.7-99.9% |
| Sulfur Oxides: SOx | Lb/MMBtu | 1.0-6.9 | 0.6-1.3 | 1.1-7.5 |
| Change Due to OptiFuel ™ | Col2 vs Coal | −64 to +148% | 91-313% | −67 to +125% |
| NOx: If Total Conversion | Lb/MMBtu | 2.6-4.0 | 2.2-3.0 | 2.2-3.4 |
| Change Due to OptiFuel ™ | Col2 vs Coal | −19 to −48% | −5 to −30% | −5 to −38% |
| Carbon Dioxide: $CO_2$ | Lb/MMBtu | 192-212 | 199-213 | 208-218 |
| Change Due to OptiFuel ™ | Col2 vs Coal | −3 to +7% | −3 to +3% | −1 to −6% |
| Control Efficiencies Read. | | | | |
| Part. <0.03 Lb/MMBtu | Wt. % | 98.7-99.7 | 99.2-99.5 | 99.5-99.9 |
| $SO_2$ <1.2 Lb/MMBtu | Wt. % | −24.1 to +82.6 | −108 to +9.2 | −8.8 to +84.0 |
| APC Assumptions | | | | |
| ESP Efficiencies | Wt. % | 99.5% | 99.5% | 99.5% |
| Environmental Performance | | | | |
| SOx Removed w/Combustion | Lb/MMBtu | 0.0 | 0.0 | 0.0 |
| Controlled SOx | Lb/MMBtu | 1.0-6.9 | 0.6-1.3 | 1.1-7.5 |
| Change Due to OptiFuel ™ | Col2 vs Coal | −83 to +20% | −8 to +100% | −84 to +9% |
| Particulates | Lb/MMBtu | .015-.054 | .023-.035 | .032-1.06 |
| Decrease Due to OptiFuel ™ | Col2 vs Coal | 70 to 92% | 81 to 87% | 86 to 99.6% |
| Ash for Disposal/Reuse | | | | |
| Fly Ash Collected | MT/D | 33-120 | 53-78 | 77-2780 |
| Decrease Due to OptiFuel ™ | Col2 vs Coal | 70-92% | 81-87% | 87-99.6% |

(5) Fuel Processing Improvements:

The higher VCM, lower ash content, and lower hardness of the upgraded petroleum coke greatly reduce the fuels handling challenges and equipment wear. First, the upgraded petroleum coke has the capability of being the only fuel required, allowing the use of one fuel processing and management system, existing or otherwise. In contrast, the prior art for combustion of traditional, fuel-grade petroleum coke in a utility boiler requires a coke/coal blend, which often required separate fuel processing systems for the coal and petroleum coke, respectively. Secondly, the upgraded petroleum coke has dramatically lower ash content (0.1-1.0 wt. %) and moisture content (0.5-4.0 wt. %) than most coals (Ash=5-70 wt. % & Moisture=5 to >50 wt. %). The lower ash and moisture contents give the upgraded petroleum coke a substantially higher heating value: (13.0-15.5 MBtu/lb) than most coals (10.5-13.0 MBtu/lb). Consequently, the conventional utility boiler requires substantially less tons of the upgraded petroleum coke for a given heat release rate. Thirdly, the upgraded coke of this invention also is dramatically softer than most bituminous coals, as indicated by its lower HGI of 80-120+, compared to 20-80+ of typical bituminous coals and <60 for traditional petroleum cokes. Consequently, the existing pulverization equipment can normally grind the upgraded coke to a much finer particle size distribution, at the same level of grinding energy. For example, 60-80% through 200 mesh is typical for various ranks of coals (lignite to anthracite). The upgraded petroleum coke can usually achieve 85-95+% through 200 mesh with less (or comparable) grinding energy. This very fine particle size distribution further improves its combustion characteristics. Alternatively, the upgraded coke could be ground to the same particle size distribution (or any point in between) with a lower grinding energy and cost. Both the reduced fuel rate (e.g. Tons/hour) and the lower hardness (softer material) are expected to substantially reduce erosion, equipment wear, and operating & maintenance costs in the fuel processing and combustion systems.

(6) Combustion Improvements:

As discussed previously, the upgraded petroleum coke provides superior fuel properties and improved combustion characteristics relative to traditional petroleum coke and most coals. The fuel properties of the upgraded coke are superior to traditional coke due to (1) increased quantity and quality of VCM (improves ignition and char burnout), (2) improved char quality of the modified sponge coke (higher porosity and reactivity), and (3) softer coke (ability to pulverize to a smaller particle size). The fuel properties of the upgraded coke also provide improved combustion characteristics relative to most coals: (1) superior ash and moisture combustion effects, (2) increased residence time, (3) better char quality and burnout, (4) improved combustion stability with lower excess air, and (5) catalytic oxidation effects.

(7) Heat Exchange Improvements:

In most cases, the premium, fuel-grade petroleum coke is expected to have better heat transfer characteristics and overall thermal efficiency. In operating conditions with more uniform and stable flames, the upgraded petroleum coke is expected to provide better radiant heat transfer characteristics. The much lower ash also dramatically reduces the fouling of heat transfer surfaces and the need for sootblowing of convective heat exchange surfaces. The better heat transfer characteristics, reduced fouling, combustion with lower excess air, and better (or comparable) carbon burnout provide greater thermal efficiency for a combustion system fired with the upgraded petroleum coke. Low ash fusion temperatures are not expected to create heat exchange problems due to the low-level decontamination to remove sodium and vanadium from the petroleum coke to acceptable levels.

D. Environmental Controls of the Prior Art

Various technologies currently exist for particulate control and removal of undesirable pollutants, primarily sulfur oxides SOx. The present invention does not claim these technologies separately, but provides improvements and novel combinations of these technologies in applications of the present invention, particularly in retrofit applications.

(1) Particulate Control Device (PCD) Fundamentals:

Particulate emissions from solid-fuel combustion come from noncombustible, ash forming mineral matter in the fuel. Additional particulates are unburned carbon residues from incomplete combustion of the fuel. Though solid particulates from solid-fuel combustion primarily range in size from 1-100 microns, finer particulates less than 10 microns are the focus of recent environmental concerns. "Bottom ash" refers to larger, heavier particulates that are collected in hoppers beneath the furnace of the combustion facility. "Flyash" refers to finer ash that is entrained in the flue gas and is collected in heat exchange/air preheater hoppers and various types of particulate control equipment. Traditional particulate control devices (PCDs) for conventional, solid-fuel combustion systems include (but are not limited to) electrostatic precipitators (ESPs), various types of filtering systems, mechanical collectors, and wet scrubber systems.

a. Electrostatic Precipitators (ESP): A wide variety of ESP technologies has evolved through the years, including dry and wet versions. The electrostatic precipitator electrically charges the particulates in the flue gas to collect and remove them. The ESP is comprised of a series of parallel vertical plates through which the flue gas passes. Centered between the plates are charging electrodes which provide the electric field. The negatively charged particles are attracted toward the grounded (positive) collection plates and migrate across the gas flow. The charging electrodes and collection plates are periodically cleaned by rapping these components and dislodging sheets of agglomerated particles that fall into large hoppers. ESPs have low pressure drops due to their simple design characteristics. ESP collection efficiencies can be expected to be 95-99+% of the inlet dust loading. Overall ESP performance depends on various design and operational factors, including (but not limited to) flyash loading, particle resistivity, particle drift velocity, electric field strength, and the ratio of plate surface area to flue gas flow. Lower sulfur concentrations in the flue gas can lead to lower ESP collection efficiency due to their effects on particle resistivity. ESPs are available in a broad range of sizes for utility and industrial applications.

b. Fabric Filters: Various types of filtering systems have evolved as well. The more popular types include numerous tubular (or bag) filters in parallel flow arrangements, and have been commonly referred to as baghouses. Baghouse systems usually have multiple compartments with each compartment containing hundreds to thousands of bag filters. The baghouse, or fabric filter, collects the dry particulates as the cooled flue gas passes through the porous filter material that separates the particulate from the flue gas. Agglomerated layers of particulates (commonly called filtercake) accumulate on the filter material. This filtercake increasingly restricts the gas flow, until the filter media is cleaned. Different baghouse technologies have a variety of designs to continually clean the filtering media in temporarily inactive compartments: pulse jet, reverse air, shaker and deflation. Fabric filters have significantly higher pressure drops than ESPs due to the filter media and filtercake. However, power usage of fabric filters and ESPs tend to be similar because the additional fan power needed to overcome the increased pressure drop in fabric filters is approximately equal to the power consumed in the ESP transformer rectifier sets. Fabric filter collection efficiency can be expected to be 95-99+%. Fabric filters are substantially more effective than ESPs in the removal of particulates less than 2 microns. Overall performance depends on various design and operational factors, including (but not limited to) flyash loading, gas-to-cloth ratio, pressure drop control, and type/porosity of filter material. Fabric filters are considered to be more sensitive to operational upsets or various load swings than ESPs due to maximum temperature and stress limitations of the filter material. Finally, fabric filters have the potential for enhancing SOx capture in installations downstream of SOx dry scrubbing or dry sorbent injection systems (via longer reagent exposure & reaction residence times in the filter cake).

c. Mechanical Collectors: Mechanical dust collectors, often called cyclones or multiclones, have been used extensively to remove large particles from a flue gas stream. The cyclonic flow of gas within the collector and the centrifugal force on the particles drive the larger particles out of the flue gas. Cyclones are low cost, simple, compact and rugged devices. However, conventional cyclones are limited to collection efficiencies of about 90% and are poor at collecting the smallest particulates (<10 microns). Improvements in small particulate collection require substantially higher pressure drops and associated costs. Consequently, mechanical collectors had been widely used on small combustion facilities when less stringent particulate emission limits applied.

d. Wet Scrubbers: Finally, various wet scrubber systems have evolved to control particulate and other emissions, including sulfur oxides. Wet scrubbing technologies for combined particulate and SOx control typically employ high pressure drop, turbulent mixing devices (e.g. venturi scrubbers) with downstream separation. However, the high energy consumption of this type of wet scrubber made them impractical for use with larger combustion facilities, particularly modern, utility boilers. Pressure drops of 10-72 inches of water are necessary for >85% removal of particulates down to 0.5-1.0 microns. In contrast, only 0.5-1.5 inches of water are required to achieve >85% collection of particles >10 microns in gravity spray towers. These low pressure-drop, wet scrubbers can achieve some ash particulate control, but are primarily used for the control of sulfur oxides. Particulate sulfur compounds formed in this process are collected in liquid film or droplets.

(2) Sulfur Oxides (Sox) Control Fundamentals:

A variety of SOx control technologies are in use and others are in various stages of development. Commercialized flue gas desulfurization (FGD) processes for solid-fuel, combustion facilities include (but are not limited to) wet, semi-dry (spray dry adsorption), and completely dry (dry sorbent injection) systems. In all three of these system types, alkaline reagent(s) (i.e. compounds of alkali or alkaline earth metals) reacts with the sulfur oxides to form collectible sulfur compounds. Wet scrubber systems normally have upstream particulate control devices (PCDs) to remove any flyash prior to SOx removal, and collects its sulfur products in a liquid film. In contrast, sulfur products from the spray dry adsorption and dry sorbent injection systems are usually collected together with the flyash in downstream PCDs.

a. Wet scrubbers: Wet FGD systems have been the dominant worldwide technology for the control of SOx from utility power plants. In the wet scrubbing process, alkaline sorbent slurry is contacted with the flue gas in a reactor vessel. The most popular wet scrubber reactor is the spray tower design where the average superficial gas velocity is less than the design gas velocity at maximum load. Flue gas enters the scrubber module at a temperature of 250-350° F., and is evaporatively cooled to its adiabatic saturation temperature by the slurry spray. The slurry consists of water mixed with an alkaline sorbent: usually limestone, lime, magnesium promoted lime, or sodium carbonate. Spray nozzles are used to control the mixing of slurry with the flue gas. Sulfur dioxide is absorbed by the liquid droplets and chemically converted to calcium sulfite and calcium sulfate. These wet scrubber reactions usually take place in the pH range of 5.5-7.0. The sulfur compounds formed in this process are collected in the liquid film and deposited in the reaction tank at the base of the scrubber. Forced oxidation is often used in the reaction tank to oxidize the collected calcium sulfite to calcium sulfate, which precipitates from the ionic solution. If the calcium sulfate has sufficient purity, it can be used as commercial gypsum (e.g. wallboard manufacture). Unreacted reagents (dissolved in the ionic solution) are recirculated in the sorbent slurry, increasing sorbent utilization.

Many factors determine the number of gas phase transfer units (Ng) and SOx removal efficiencies. These factors include slurry spray rate, slurry droplet size, spatial distributions, gas phase residence time, liquid residence time, wall effects, and gas flow distribution. In general, wet scrubbing is a highly efficient $SO_2$ control technology with removal levels >90% at stoichiometric calcium/sulfur (Ca/S) ratios close to 1.0. Primary advantages of this reliable, established technology include (1) high utilization of sorbents and (2) the ability to produce usable products: gypsum or sulfuric acid. The major disadvantages of wet scrubbing are (1) complexity of operation, (2) limited control of sulfur trioxide ($SO_3$), (3) potential scaling and corrosion problems, and (4) wet disposal products that typically require dewatering, stabilization, and/or fixation.

b. Dry Scrubbers: Dry scrubbing (sometimes referred to as spray absorption, spray drying, or semi-wet scrubbing) is the principal alternative to wet scrubbing for SOx control on solid-fuel combustion systems. Dry scrubbing involves spraying a highly atomized slurry or aqueous solution of alkaline reagent into the hot flue gas to absorb $SO_2$. Various alkaline reagents have been used in dry scrubbers, but the predominant reagent used is slaked lime, which behaves like highly reactive limestone. The quantity of water in the atomized spray is limited so that it completely evaporates in suspension. $SO_2$ absorption takes place primarily while the spray is evaporating. The dry scrubber reactions usually take place in the pH range of 10-12.5. Apparently, this high alkalinity contributes to the dry scrubber's effective removal of sulfur trioxide ($SO_3$) from the flue gas. The dry scrubber is noted to quench the inlet flue gas to a temperature below the dew point for $SO_3$. Tests have indicated that virtually all $SO_3$ is absorbed and neutralized in the spray dry absorber. That is, condensed sulfuric acid allegedly reacts with the alkaline sorbent to form a collectible salt.

SOx dry scrubbers are designed to achieve the appropriate reaction conditions for the specific alkaline reagent used: temperature zone, mixing, residence time, and moisture. Dry scrubbers are normally sized for a certain gas-phase residence time (typically 8-12 seconds), which depends on the degree of atomization and the design approach temperature. The approach temperature is the difference between the adiabatic saturation temperature and the temperature of flue gas leaving the dry scrubber. Dry scrubbers are typically located immediately downstream of the air preheater (flue gas temperatures 250-350° F.), and upstream of the particulate control device. The slurry spray adiabatically cools the flue gas. Consequently, the flue gas temperature leaving the dry scrubber may be too low for proper operation of the particulate control device. In these instances, the gases may require heating before entering the PCD (fabric filter or ESP). An electrostatic precipitator (ESP) is more forgiving of temperature variation but the baghouse has the advantage of being a better SOx-lime reactor.

Dry scrubber performance is primarily dependent upon reagent stoichiometry and approach temperature. SOx removal efficiencies of 85-95% can be achieved with stoichiometric Ca/S ratios of 1.2-1.6 with solids recycle. The primary advantages of dry scrubbing over wet scrubbing include (1) dry waste products, (2) greater $SO_3$ control, and (3) less costly construction materials. Major disadvantages include (1) high sorbent utilization rates, and (2) potential reheating requirements. The high sorbent utilization rates have limited dry scrubber applications to units burning low-sulfur fuel. Dry scrubbers can increase particulate loading to PCDs and waste disposal by 2-4 times.

c. Dry Sorbent Injection: Furnace sorbent injection has been developed over the past 20-25 years. Dry sorbent technologies do not use reaction chambers, but pneumatically inject alkaline reagents directly into the flue gas at the location of appropriate temperatures for the desired reactions. These dry sorbent technologies rely on the combustion system to provide the mixing and residence time necessary to achieve high conversion levels. These systems cost less, but provide less SOx reduction capabilities. They can also increase particulate loading to PCDs and waste disposal by 3-5 times due to low sorbent utilization efficiency. Three major types of dry sorbent injection appear promising:

1. Furnace Injection of Calcium-Based Sorbents: Limestone, dolomite, or hydrated lime readily reacts with SOx in the temperature range of 2000-2300° F. Normally, the injection point for these sorbents is near the nose of the boiler. Using these sorbents, 30-65% SOx removal is achievable with stoichiometric calcium/sulfur (Ca/S) ratios of 2.
2. Economizer Inlet and/or Post-Furnace Injection of Calcium Hydroxide: hydrated calcium hydroxide ($Ca(OH)_2$) favorably reacts with SOx in the temperature range of 840-1020° F. Injection of this sorbent at the economizer inlet of many boilers can achieve 40-80% SOx capture with Ca/S=2. Alternatively, this sorbent can be injected immediately downstream of the air heater with an associated humidification system that increases relative humidity, approaching the saturation temperature. With an approach temperature of <50° F., SOx capture of 50-55% can be achieved with Ca/S=2. Since the sulfite formation is very fast (<250 milliseconds) and the reaction window is approximately 212° F. wide, the process is compatible with high quench rates (typically 932-1112° F./sec) through economizers.
3. Post-Furnace Injection of Sodium-Based Sorbents: Trona and nacholite (naturally occurring forms of sodium carbonate and bicarbonates) react with SOx at air heater exit temperatures (250-350° F.). A relatively simple injection system is placed between the air heater and baghouse. SOx reactions take place in the flue ahead of the baghouse and on the surface of the fabric filter. However, sodium carbonates have been observed to catalyze the oxidation of nitric oxide (NO) to nitrogen dioxide ($NO_2$), which creates a visible, brown stack plume. SOx removal efficiencies for nacholite are 70-80+% with sodium/sulfur ratio=1 (i.e. NSR=normalized stoichiometric ratio); Trona has demonstrated 45-70% removal with NSR Na/S=1. In both sorbents, lower overall removal efficiencies are achieved with ESPs vs. fabric filters.

d. Other SOx Control Technologies: Many other technologies are being evaluated for their potential commercial application to address SOx control and acid rain legislation/regulations. Considerable activity is being devoted the development of a technology that effectively controls both sulfur oxides and nitrogen oxides, with high removal efficiencies and operational reliability. One such technology is particularly relevant to the present invention: activated coke beds for SOx and NOx control. The activated coke can adsorb $SO_2$, and catalyze the reduction of NOx by ammonia. Regeneration of the spent coke at high temperature produces a concentrated $SO_2$ stream that can be further processed to yield a salable by-product, such as sulfuric acid. Such systems have been commercially applied in Japan and Germany, where $SO_2$ removals of 90-99+% and NOx removals of 50-80+% have been reported. However, most experience has been with low- to medium-sulfur systems. There is some question regarding process suitability for high-sulfur applications because of high coke consumption.

e. Retrofit Applications: Various types of dry scrubbing and dry sorbent injection systems have been demonstrated on retrofit utility boiler applications with baghouses or electrostatic precipitators. These retrofit applications have usually added reaction chamber(s) and/or injection system(s) upstream of existing particulate control devices (PCDs) without significant increases in the PCD capacity. That is, the PCD is not only required to control ash particulates, but also handle the increased load of dry particulates resulting from the conversion of sulfur oxides. These dry particulates normally consist of ionic salts; spent sorbent and unreacted sorbent. Typically, these salts are relatively large and easier to collect than ash particulates. However, the combined load (Mlb/Hr.) can be more than 200% of the original design. Consequently, this type of dry scrubber retrofit can be limited by (1) ash particulate inhibition of reagent reactivity and (2) capacity limiting effect on PCD collection efficiency. Even so, numerous dry scrubber retrofits have demonstrated SOx removal efficiencies between 85 and 90% with some sacrifice in particulate emissions. Similarly, dry sorbent injection technologies have been demonstrated on retrofit systems to achieve 40-70% with sacrifices in particulate emissions. In general, these relatively low capital-cost alternatives can effectively reduce sulfur oxide emissions. However, environmental regulations for particulate emissions can be prohibitive for their use as long-term solutions.

(3) Nitrogen Oxides (NOx) Control Fundamentals:

Nitrogen oxides emissions are formed in the combustion process by two mechanisms: (1) Fuel NOx: oxidation of fuel-bound nitrogen during fuel devolatilization and char burnout, and (2) Thermal NOx: high-temperature oxidation of the nitrogen in the air. Typically, more than 75% of the NOx formed during conventional PC firing (i.e. w/o Low NOx Burners) is fuel NOx. Even though fuel NOx is a major factor, only 20-30% of the fuel-bound nitrogen is actually converted to NOx in uncontrolled conditions. Both NOx formation mechanisms are promoted by rapid fuel-air mixing, which produces high volumetric heat release rates, high peak flame temperatures, and excess available oxygen.

However, thermal NOx is far more sensitive to high flame temperatures, particularly >2200° F. The potential reduction of nitrogen oxides (NOx) emissions is site specific and depends on various combustion design and operational factors.

a. Combustion Modifications: Low NOx burners, staged combustion, flue gas recirculation, and reburning are various types of combustion modifications used to control the rate of fuel-air mixing, reduce oxygen availability in the initial combustion zone, and decrease peak flame temperatures. These combustion techniques can be used separately or in combination to reduce thermal and fuel NOx. NOx reductions from these methods typically range from 20 to over 60%. Low NOx burners slow and control the rate of fuel-air mixing, thereby reducing oxygen availability and peak flame temperatures in the ignition and primary combustion zones. Staged combustion uses low excess air levels in the primary combustion zone with the remaining (overfire) air added higher in the furnace to complete combustion. Flue gas recirculation reduces oxygen concentrations and combustion temperatures by recirculating some of the flue gas to the furnace without increasing total net gas mass flow. In reburning, 75-80% of the furnace fuel input is burned in Cyclone furnaces with minimum excess air. The remaining fuel (gas, oil, or coal) is added to the furnace above the primary combustion zone. This secondary combustion zone is operated substoichiometrically to generate hydrocarbon radicals which reduce NOx formed in the Cyclone to molecular nitrogen ($N_2$). The combustion process is then completed by adding the balance of the combustion air through overfire air ports in a final burnout zone in the top of the furnace.

b. Selective Non-Catalytic Reduction (SNCR): In SNCR, ammonia or other compounds (e.g. urea) that thermally decompose to ammonia are injected downstream of the combustion zone in a temperature region of 1400 to 2000° F. If injected at the optimum temperature, the NOx in the flue gas reacts with the ammonia to produce molecular nitrogen ($N_2$) and water. Without base-load operation, locating ammonia injection system(s) at the optimal temperature is somewhat difficult due to temperature variations with load swings and operational upsets. The injection of hydrogen, cyanuric acid, or ammonium sulfate is sometimes used to broaden the effective temperature range. NOx reduction levels of 70% (from inlet concentrations) are possible under carefully controlled conditions. However, 30-50% NOx reductions are more typically used in practice to maintain acceptable levels of reagent consumption and unreacted ammonia carryover. Unreacted ammonia (often called ammonia slip) can (1) represent additional pollutant emissions and (2) create ammonium sulfate compounds that deposit on downstream heat exchange surfaces and cause plugging, fouling, and corrosion problems.

c. Selective Catalytic Reduction (SCR): SCR systems remove NOx from flue gases by reaction with ammonia in the presence of a catalyst to produce molecular nitrogen ($N_2$) and water. Most SCR units can operate within a range of 450-840° F., but optimum performance occurs between 675 and 840° F. The minimum temperature varies and is based on fuel, flue gas specifications, and catalyst formulation. NOx control efficiencies of 70-90% can be consistently achieved. Like SNCR, these control efficiencies are dependent on inlet NOx concentrations, and are cumulative to NOx reductions from combustion modifications. Also, the same concerns for unreacted ammonia exist in SCR units.

d. Other NOx Control Technologies: Other technologies are being evaluated for their potential commercial application to address NOx control and acid rain legislation/regulations. Considerable activity is being devoted the development of a technology that effectively controls both nitrogen oxides and sulfur oxides, with high removal efficiencies and operational reliability. Most involve variations of reducing NOx with ammonia, similar to SNCR and SCR. As noted above, activated coke technology for the removal of SOx and NOx is particularly relevant to the present invention.

(4) Carbon Dioxide ($CO_2$) Control Fundamentals: Environmental concerns of global warming have only recently targeted carbon dioxide ($CO_2$) as a flue gas component that needs to be controlled. Consequently, control technologies for carbon dioxide are currently in various stages of development. Wet scrubbing and flue gas conversion to collectible particulates are being evaluated for low-level control methods. High-efficiency technologies include physical adsorption on activated media, chemical solvent stripping, cryogenic fractionation, membrane separation, and direct recovery from flue gas recirculation with $O_2/CO_2$ combustion. Unfortunately, the disposal of products from high-efficiency, non-regenerative control processes becomes prohibitive due to the high levels of $CO_2$ in the flue gas. Consequently, most of the technologies are regenerative producing a highly concentrated $CO_2$ waste stream. Different sequestering methods are being evaluated including deep ocean injection, oil well injection, and biological fixation.

a. Wet Scrubbing: Various types of reagents are being tried in conventional wet scrubbing systems. Limited information and data have been published to date.

b. Conversion to a Dry, Collectible Particulate: Another approach being pursued is the, conversion of $CO_2$ to a dry particulate upstream of a particulate control device. The alkaline reagents that convert sulfur oxides to dry particulates are not as effective for carbon dioxide. Carbon dioxide does compete with sulfur oxides for reactions with some SOx dry scrubber reagents to a limited extent, and minor reductions are achieved. However, carbon dioxide is more stable and is expected to require a much stronger reagent, such as ammonia, sodium hydroxide, and calcium hydroxide. At this point, concurrent conversion of both sulfur oxides and carbon dioxide to particulate does not appear likely due to a lack of reagent preference or selectivity for carbon dioxide. Different temperature windows, residence times, and reagents may be necessary. Consequently, conversion of carbon dioxide to dry particulates may require independent systems with different reagents, unless the fuel generates low levels of sulfur oxides.

c. Adsorption on Activated Media: The physical adsorption of $CO_2$ on activated carbon or zeolite systems is a surface phenomena in which a few layers of the adsorbed gas are held by weak surface forces. The capacity of an adsorbent for a given gas depends on the operating temperature and pressure. The key issue for commercial application of these systems is the surface area required per unit of mass or volume of adsorbed gas. However, these systems are simple; their operation and regeneration (pressure swing or temperature swing) can be energy-efficient.

(5) Air Toxics Control Fundamentals:

Prior to the Clean Air Act Amendments (CAAA) of 1990, EPA air toxics standards had been promulgated for only seven hazardous air pollutants. In the CAAA's Title III, EPA was required to promulgate control standards for over 189 air toxic substances. Consequently, control technologies for air toxics are currently in various stages of development. Adsorption on activated carbon, wet scrubbing, and flue gas conversion to collectible particulates are three primary classes of technologies being considered.

(6) Solid Waste Control Fundamentals:

Solid wastes from fossil fuel combustion systems was originally excluded from Subtitle C of the Resource Conservation & Recovery Act (RCRA) of 1976, and still requires clarification by U.S. federal regulations. In the meantime, high volume waste streams from power plants, such as scrubber sludge, flyash, and bottom ash are subject to different and highly variable disposal requirements from state and local environmental and health authorities. In addition, many landfills are required to use leachate collection systems with single or double linings and extensive monitoring wells. In some cases, stabilization of the solids is required.

a. FGD Wet Scrubber Sludge: In order to dispose of waste materials from wet collection systems, treatment methods are applied to ultimately produce a solid. Dewatering, stabilization, and fixation are common treatment methods that are designed to achieve waste volume reduction, stability, better handling, and/or liquid recovery for reuse. Dewatering techniques physically separates water from solids to increase solids content, and include settling ponds, thickeners, hydroclones, and vacuum filters. Stabilization further increases solids content of the waste by adding dry solids, such as flyash. Fixation involves the addition of an agent, such as lime, to produce a chemical reaction to bind free water and produce a dry product.

b. Dry Solid Wastes: Ultimate disposition of utility plant wastes (bottom ash, flyash, FGD residues, etc.) is by utilization or by disposal in landfills/impoundments. Utilization may be environmentally preferred and becomes more attractive as waste management costs increase. In some cases, bottom ash and boiler slag can be substituted for sand, gravel, blasting grit, roofing granules, and controlled fills. Flyash can also be utilized in the manufacture of Portland cement and concrete mixes, if it meets certain minimum quality specifications. In all utilization alternatives, the cost of transportation can be prohibitive. Disposal methods can be either wet or dry, depending on the physical condition of the waste materials. The trend is toward dry disposal because of smaller volumes, more options for site and material reclamation, and the developing interest in dry scrubbing. Dry disposal can use a simple method of landfill construction in which the waste is placed and compacted to form an artificial hill.

E. Environmental Control of the Present Invention

The present invention does not claim the prior art environmental control technologies separately, but provides improvements and novel combinations of these technologies in applications of the present invention. The different combinations of these technologies are somewhat involved and provide synergism and/or unappreciated advantages that are not suggested by the prior art.

In most cases, fuel switching to the premium "fuel-grade" petroleum coke of this invention provides the opportunity for substantial improvements in the control of particulates, sulfur oxides (SOx), nitrogen oxides (NOx), carbon dioxide ($CO_2$), air toxics, and opacity. In Table 2-B, uncontrolled pollutant emissions of upgraded petroleum cokes are compared to the emissions of various types of coal. The total quantity of undesirable flue gas components (e.g. SOx) is typically lower than coals', even with higher component concentration in the fuel (wt. % in pet coke vs. coal). That is, sulfur, nitrogen, and carbon contents of the upgraded coke are normally comparable or higher. Most of these potential reductions in uncontrolled pollutants are related to the significantly lower fuel rates and ash content of the upgraded petroleum coke. In particular, the dramatic reduction in ash particulates (>90%) creates tremendous excess capacity in the existing particulate control device. This excess capacity can be effectively used to collect other pollutants that have been converted to collectible particulates upstream of the PCD. Finally, none of these environmental improvements would be possible without the fuel properties of the new formulation of petroleum coke that allows utility boilers to burn up to 100% of this premium fuel.

(1) Conversion of Existing Particulate Control Devices:

The predominant environmental control feature in the present invention is the potential use of existing particulate control equipment for the control of sulfur oxides (SOx) and other undesirable flue gas components. Since petroleum coke typically has >90% less ash than most coals (i.e. 0.1-0.3% vs. 5-20%), a tremendous amount (90-95+%) of particulate control capacity in existing particulate control devices is made available by fuel switching (i.e. from coal to the upgraded petroleum coke). As such, existing particulate control devices (baghouses, ESPs, etc.) can be used for extensive removal of undesirable flue gas components by converting them to collectible particulates upstream of these devices.

The present invention can further increase the capacity of the existing particulate control device by substantially reducing fuel rates. That is, the upgraded petroleum coke has 10-200+% greater heating value than most coals, which translates into 10-50+% reduction in fuel rates to achieve the same heat release rate. The lower fuel rates and the associated reductions in air flow rates often provide significant reductions in flue gas flow rates. In an existing combustion system, any significant reduction in flue gas flow rate increases flue gas residence time, PCD capacity, and PCD control efficiency. These performance parameters are strongly related to the flue gas flow rate and velocities through the PCD collection media. For example, the ratio of ESP plate area to volumetric flue gas flow rate is a critical parameter in the Deutsch-Anderson Equation, which determines ESP capacity and control efficiency. Similarly, the air-to-cloth ratio (where air=flue gas flow in combustion sources) is a critical parameter in equations that determine fabric filter capacity and control efficiency. In this manner, the control efficiency in the existing PCD is increased, providing a greater capacity to control higher inlet loadings to the same particulate requirements for PCD outlet.

Each combustion system will have a different set of design conditions for converting the existing particulate control devices. The conversion of each system will depend on various design and operational parameters, but the optimal design and level of control can be established with typical engineering skills associated with the prior art of PCD technologies. Minor modifications may be necessary to maintain particulate collection efficiencies. The particulates coming into the existing PCDs may have substantially different properties than the particulates of the PCD's design basis. Consequently, modest modifications in design and/or operating conditions may be required. For example, flue gas conditioning or operational changes in existing ESPs may be appropriate to achieve more desirable resistivity characteristics, and maintain collection efficiencies.

(2) Flue Gas Conversion Technologies:

The present invention includes the integration of various "flue gas conversion technologies" to control undesirable flue gas components, and effectively use the excess particulate control capacity created by the present invention. For the sake of this discussion, "flue gas conversion technologies" refers to all technologies that convert gaseous or liquid compounds in the flue gas into chemical compounds (e.g. dry or wet particulates) that can be effectively collected by particulate control technologies (existing, new, or otherwise). Most of these technologies inject a chemical reagent (wet or dry) that reacts with the targeted flue gas component(s) and chemically converts them to compound(s) that are particulates at the PCD operating conditions. Consequently, this classification of environmental controls would include commercially available SOx controls: wet scrubbing, spray dry adsorption, and dry sorbent injection. The present invention provides novel use and improvements in these and other flue gas conversion technologies because of its unique ability to (1) improve the reagent activity and utilization efficiency, (2) provide the opportunity for reagent regeneration (and associated improvements), (3) increase the probability of salable by-products, and (4) promote the development of improved and new flue gas conversion technologies (FGCT).

a. Reagent Activity & Utilization Efficiency: The present invention provides less ash interference and better recycle options to increase the reagent activity and utilization efficiency in FGC processes. In many situations, the flyash from the combustion process interferes with the reactions of reagent and targeted flue gas component. The upgraded petroleum coke of the present invention has very low ash content, which substantially reduces interference and increases reagent activity. This much lower flyash also allows extensive recycling of conversion products, including unreacted reagents. For example, the prior art in SOx dry scrubber technology processes and recycles collected flyash into the reagent injection to increase reagent usage. However, high ash particulates of existing fuels limit the degree of recycling. The upgraded petroleum coke of the present invention has such low ash particulates that greater quantities of collected flyash (mostly FGCT products and unreacted reagents) can be effectively recycled. The degree of recycle can be limited by the capacity of the PCD, but recycle rates of 5-30+% are possible. The optimal recycle rate can be developed for each application. Both the reduced ash interference and the improved recycle capabilities are expected to significantly increase reagent utilization efficiencies and improve FGCT overall control efficiencies and costs.

b. Opportunity for Reagent Regeneration: The present invention provides the opportunity for regeneration of FGCT reagents, due to very low ash and other impurities in the collected flyash. That is, the collected flyash consists mostly of FGCT products (or spent reagent) and unreacted reagent. The collected flyash can be processed, and the spent reagent can be regenerated to substantially reduce the make-up FGC reagent rate and waste disposal required. The regeneration process can include, but should not be limited to, hydration of the collected flyash and subsequent precipitation of the undesired ions (i.e. sulfates, carbonates, etc.) for commercial use or disposal. Furthermore, the regeneration process would likely include a purge stream of <30% (in some cases <5%) to remove unacceptable levels of impurities from the system. This purge stream would be analogous to blow down streams in many boiler water and cooling water systems. In many cases, this purge stream will contain a high concentration of heavy metals, including vanadium. Various physical and/or chemical techniques can be used to extract and purify these metals for commercial use. In cases where slaked lime is used as the conversion reagent, the regeneration process can also greatly reduce the carbon dioxide generated in the reagent preparation process: limestone (calcium carbonate—$CaCO_4$) to lime (calcium oxide—CaO)+carbon dioxide ($CO_2$). Finally, the ability to continually regenerate reagents provides the opportunity for new or improved flue gas conversion processes through the use of exotic reagents; not considered previously due to costs. In this manner, the regeneration of conversion reagents can (1) substantially reduce reagent make-up and preparation costs (2) dramatically reduce flyash disposal costs, (3) create a resource for valuable metals, (4) reduce $CO_2$ emissions, and (5) provide the means to economically improve the flue gas conversion process via the use of more exotic reagents.

c. Salable By-Products: Whether or not the FGCT reagent is regenerated, the present invention increases the probability of producing salable by-products. The extremely low ash particulate levels create a collected flyash that is mostly FGCT reaction products with low impurities. As such, collected flyash from certain FGCTs can be used as raw materials for various products, instead of solid wastes requiring disposal. These products include, but are not limited to, gypsum wallboard and sulfuric acid.

d. Development of Improved and New Conversion Technologies: The present invention can promote novel improvements and development of many flue gas conversion technologies. Regeneration with existing reagents can be developed for improvements of the current sulfur oxides conversion technologies. Furthermore, all these unique abilities of the present invention (i.e. efficient reagent utilization, reagent regeneration, and salable by-products) contribute to the development of new flue gas conversion technologies for any undesirable flue gas components, including sulfur oxides, carbon dioxide, nitrogen oxides, and air toxics. The unique ability to regenerate conversion reagents, in particular, opens the door to more exotic reagents that are more reactive, selective, and/or costly to prepare. In the past, reagent selection has been limited to very inexpensive materials due to disposable nature (i.e. use once & throw away). With dramatically lower impurities in the system, regeneration using novel conversion reagents can be economically considered. That is, other alkaline metal compounds with more desirable reaction characteristics or by-products can be used without major economic consequences. For example, ammonia and very reactive hydroxide forms of magnesium, sodium, and/or calcium can be economically used as reagents in FGCTs to control carbon dioxide, nitrogen oxides, and/or air toxics. In addition, transportation costs for make-up reagent and waste disposal can be dramatically reduced and help offset other additional costs (e.g. regeneration system costs).

The integration of these flue gas conversion technologies is anticipated by the present invention. That is, part of the benefits of the present invention is to create excess particulate control capacity in existing combustion systems that can be used in conjunction with these technologies to achieve their objectives. In this manner, The present invention provides a novel combination of particulate control and flue gas conversion technologies, particularly in retrofit applications on existing combustion systems. These novel combined applications of existing environmental technology provide substantial incentives to replace existing solid fuels with the upgraded petroleum coke. However, each combination of particulate control and flue gas conversion technologies at existing combustion systems is a unique application. One skilled in the art of these technologies is capable of providing the appropriate design and operating modifications required to achieve the successful implementation of the desirable application of these combined air pollution control technologies.

F. Environmental Impacts of an Exemplary Embodiment

In an exemplary embodiment of the present invention, an existing utility boiler with a particulate control device is modified by fuel switching: existing coal to premium "fuel-grade" petroleum coke. The upgraded petroleum coke of the present invention can be fired as the primary fuel (up to 100%). Consequently, the very low ash particulate level generated from such a fuel switch unleashes >90% of the existing PCD's capacity to be used for flue gas conversion technologies (FGCT).

In this embodiment, two options are provided for the novel integration of existing FGCT for the control of sulfur oxides. Sulfur oxides control was chosen in this embodiment due to recent emphasis related to acid rain legislation. However, FGCT for other undesirable flue gas components can be implemented in a similar manner. Option 1 consists of the addition of retrofit reaction chamber(s) and reagent injection system(s) to convert sulfur oxides to dry particulates upstream of the existing particulate control device(s). Alternatively, Option 2 consists of the addition of dry sorbent injection systems into and/or downstream of the furnace section to convert sulfur oxides (or carbon dioxide) to dry particulates upstream of the existing particulate control device(s). An optimized combination of Options 1 and 2 can provide the desired SOx control system in many cases (See Optimal Environmental Control Embodiment).

As noted previously, all of these applications of flue gas conversion technology (including SOx controls) are novel and unlike any other commercial, retrofit applications. First, most flue gas conversion applications have substantially higher ash particulates in the flue gas. The ash particulates can interfere with the reactivity of the injected reagents, potentially decreasing SOx removal efficiencies. Secondly, previous utility retrofit applications have used existing PCDs that are still operating at >80% of capacity for ash collection and sacrifice particulate emission levels. In contrast, the existing PCDs in this application are operating at <10% of capacity for ash collection. This design basis provides the opportunity to achieve much higher SOx removal, while increasing (or maintaining) collection efficiency in the PCD. Consequently, particulate emissions from the stack are significantly less (or comparable). Finally, the very low ash particulates cause the particulates collected by the PCD to be predominantly spent reagent and unreacted reagent. The very low ash and chloride content in the collected particulates provides a greater ability to regenerate spent reagent (e.g. via hydration) and/or recycle unreacted reagent from the collected particulates. Consequently, substantially lower quantities of solids disposal (e.g. purge stream) and fresh reagents for make-up requirements are expected. Alternatively, the collected ash can have sufficient purity to be used in the production of sulfuric acid, gypsum wallboard, or other sulfate-based products. This alternative system design can also substantially reduce the solids disposal quantities. In conclusion, the combination of these factors makes this application unique, and produces greater operating efficiencies and more favorable economics.

The ultimate level of additional control for SOx and particulates will depend on (1) the efficiency of conversion of the sulfur oxides to particulates and (2) the efficiency of particulate collection. In most utility boilers, reductions of over 70% in both sulfur oxides and ash particulate emissions are expected.

(1) Particulate Impact:

The upgraded petroleum coke of the present invention normally has over 90% less ash particulate emissions than most coals for the same firing rate (See Table 2-B). This dramatic reduction in ash particulates is primarily due to a much lower ash content (0.1-1.0 wt. %). However, lower fuel rates (due to significantly higher heating values) can also contribute greatly to this reduction. The dramatic reduction in ash particulates unleashes >90% of the capacity in the existing particulate control device. This excess capacity can be used to collect other pollutants that have been converted to collectible particulates upstream of the PCD. In this manner, the fuel properties of the new formulation of petroleum coke provide the opportunity to burn 100% petroleum coke and use existing particulate control devices to reduce the emissions of other pollutants, such as sulfur oxides, nitrogen oxides, carbon dioxide, air toxics, etc.

In an exemplary embodiment, the overall particulate emissions from the stack will depend on the ability to maintain high collection efficiencies in the PCD. As noted above, the type and quantity of particulates will be different due to fuel switching and flue gas conversion technologies. For example, the converted salts from the SOx dry scrubbing are normally larger and easier to collect than ash particulates. Even though the ash particulates are decreased dramatically, some breakthrough of converted salts from flue gas conversion is expected. The quantity of breakthrough will depend on the degree of flue gas conversion, unreacted reagents, and the new collection efficiency. Besides the increase in collection efficiency due to lower flue gas flow rates, the products from SOx FGCT typically have characteristics that increase particulate collection efficiency. For example, the resistivity and drift velocity of calcium sulfate favor increased ESP collection efficiencies. Though the application of FGCTs and utilization of PCDs will vary substantially, the reduction in overall particulate emissions from the stack is still expected to be over 10%, in most cases. A significant reduction in PM-10 particulate (i.e. <10 microns) emissions is also expected.

(2) Sulfur Oxides Impact:

The predominant feature in this exemplary embodiment is the potential use of existing particulate control equipment for the control of sulfur oxides (SOx). Since petroleum coke typically has >90% less ash than most coals (0.1-0.3% vs. ~20%), a tremendous amount (90-95+%) of particulate control capacity in existing particulate control devices is made available by fuel switching (from coal to the upgraded petroleum coke). As such, the existing particulate control devices (baghouses, electrostatic precipitators, etc.) can be used for extensive SOx removal by converting the sulfur oxides to dry particulates upstream of these devices.

In Option 1 of the exemplary embodiment of this invention, retrofit reaction chamber(s) and reagent injection system(s) are added to convert sulfur oxides to dry particulates upstream of the existing particulate control device(s). As noted previously, 85-95% SOx removal has been demonstrated by past utility retrofits of SOx dry scrubber systems with substantially higher ash particulates in the flue gas. For reasons noted above, the SOx dry scrubber retrofit in the exemplary embodiment is expected to perform much better. Consequently, 90% SOx removal efficiency is expected to be a very conservative estimate for the potential reduction of SOx emissions from the upgraded petroleum coke and Option 1 SOx control of the exemplary embodiment.

In Option 2 of the exemplary embodiment, dry sorbent injection systems are added to convert sulfur oxides to dry particulates upstream of the existing particulate control device(s). As noted previously, 40-70% SOx removal has been demonstrated by past utility retrofits of SOx dry sorbent injection systems with substantially higher ash particulates in the flue gas. For reasons noted above, the dry sorbent injection retrofit in the exemplary embodiment (Option 2) is expected to perform much better. Consequently, 70% SOx removal efficiency is expected to be a very conservative estimate for the potential reduction of SOx emissions from the upgraded petroleum coke and Option 2 SOx control of the exemplary embodiment.

In the past, the presence of vanadium has caused concern of elevated dew points in the flue gas, due to its tendency to catalyze the conversion of sulfur dioxide to sulfur trioxide. In many situations, these elevated dew points can lead to increased cold-end corrosion. However, the elevated dew points can have positive impacts in the application of SOx flue gas conversion processes. That is, the elevated dew points can provide more favorable approach temperatures; improving collection efficiencies while reducing water injection requirements. This is particularly helpful in applications where the operating temperature of the existing PCD is above the flue gas dew point; reducing the need for flue gas reheat. In addition, tests have shown that SOx dry scrubbing techniques perform better on sulfur trioxide (vs. sulfur dioxide). Thus, the dry sorbent injection (Option 2), to some extent, can be particularly beneficial to convert sulfur trioxide to particulates in the convection section. In this manner, the presence of vanadium can be advantageous upstream of low-temperature heat exchange equipment. At the same time, the catalytic conversion of $SO_2$ to $SO_3$ is also expected to inhibit the formation of the highest oxidation level of vanadium; vanadium pentoxide ($V_2O_5$). This reduction of vanadium pentoxide further reduces associated ash problems. Finally, in facilities with electrostatic precipitators, the sulfur trioxide can also condition the flue gas and alter the resistivity characteristics to improve the ESP's collection efficiency. Consequently, certain levels of vanadium can improve the SOx control systems.

The overall reduction of sulfur oxides due to fuel switching and the retrofit flue gas conversion system is site specific and depends on several factors. First, the lower fuel rates of the upgraded petroleum coke can be sufficient to reduce SOx emission rates (Mlb/Hr. or Mlb/MMBtu). This can occur even in cases where the sulfur content (wt. %) of the upgraded petroleum coke exceeds the sulfur content of the coal being replaced. Secondly, the sulfur content of the upgraded petroleum coke can be lower than the sulfur content of the replaced fuel. For example, low-sulfur petroleum coke or desulfurized petroleum coke from hydrotreated coker feedstocks can have significantly less sulfur (wt. %). In these cases, the lower sulfur content, combined with lower fuel rates, contributes to even greater reductions in sulfur oxides. Finally, the retrofit of SOx dry scrubbing technology, in this exemplary embodiment, is expected to reduce the inlet SOx emission rates by 90% or more. If the alternative dry sorbent injection systems are used, the inlet SOx emission rates are expected to be reduced by up to 70%. In some cases, the lower fuel rate and the sulfur content of the upgraded petroleum coke are not sufficient to reduce the SOx emission rate of the replaced fuel. However, the combination of the lower fuel rate and the retrofit dry scrubbing can still produce substantially lower SOx emissions (relative to various coals), even when the coke sulfur content is much higher.

(3) Nitrogen Oxides Impact:

The upgraded petroleum coke of the present invention usually has significantly less fuel-bound nitrogen due to the combination of lower fuel rates and comparable nitrogen content, typically 0.5-1.5%. Thus, the fuel NOx is expected to be significantly less or at least similar. Also, the flame intensity (and temperature profile) of the upgraded coke is expected to be more uniform due to lower VCM content and levelized burning profile. This uniform temperature profile is expected to produce lower Thermal NOx than most coals. The more uniform fuel characteristics of the upgraded petroleum coke is also expected to reduce excess air requirements, which lowers oxygen availability and typically lowers both fuel NOx and thermal NOx. These and other combustion characteristics are also conducive for the development of lower generation of nitrogen oxides (NOx) emissions through Low NOx burner designs and other combustion modifications. Consequently, the upgraded petroleum coke of the present invention is expected to significantly decrease the nitrogen oxide emissions of most coals, via fuel switching and appropriate adjustments in Low NOx burner design and operation.

The application of SNCR, SCR, and/or FGCT for NOx is not anticipated in this exemplary embodiment. However, if regulations require additional NOx control, these technologies can be integrated into the control alternatives of the exemplary embodiment. The major concerns in the integration process are the control priorities among pollutants and the potential conflicts with other control technologies. That is, competitive or other undesirable reactions (e.g. formation of ammonium bisulfate) can be counterproductive in the combination of control technologies.

(4) Carbon Dioxide Impact:

Significant reductions in carbon dioxide emissions can be achieved by methods similar to those for sulfur oxides emissions. First, the carbon content of the upgraded petroleum coke can be lower than the carbon content of the replaced fuel, but not normally. Secondly, the lower fuel rates in most applications can cause lower carbon dioxide emission rates. This can occur even in cases where the carbon content (wt. %) exceeds the carbon content of the coal being replaced. As shown in Table 2-B, this occurs in almost every case. Finally, a retrofit, flue gas conversion system can be used for modest to moderate carbon dioxide control, as well. The combination of these factors will determine the overall reduction in carbon dioxide resulting from fuel switching and the retrofit, flue gas conversion system of the exemplary embodiment. The potential for reduction from the retrofit $CO_2$ flue gas conversion is the most uncertain at this time.

An exemplary embodiment can effectively be used for flue gas conversion of carbon dioxide, if and when the appropriate temperature, residence time, and reagents become better understood and available. As noted previously, flue gas conversion of carbon dioxide is more likely without concurrent scrubbing of sulfur oxides. Low-sulfur, petroleum coke, such as desulfurized coke, can effectively improve the opportunity for carbon dioxide conversion and collection. Table 2-A shows the desirable fuel properties of desulfurized coke relative to various types of coals. Alternatively, Option 2 dry sorbent injection system(s) can be used for sulfur oxides control and the Option 1 retrofit reaction chamber(s) and reagent injection system(s) can be used for the control of carbon dioxide. In this case, the excess capacity of the existing particulate control device can be the limiting factor. Additional PCD capacity can be added as part of the retrofit project to increase the carbon dioxide removal via flue gas conversion processes.

(5) Air Toxics Impact:

The regulations regarding the levels of control required for specific air toxics are still fairly unclear for utility boilers. In general, though, the upgraded petroleum coke of the present invention is expected to create less air toxic compounds, due to its much lower ash content. This assumes that the combustion process can achieve a high level of combustion efficiency and destroy any hydrocarbon, classified as an air toxic compound. Flue gas conversion technologies for air toxic compounds can also be integrated, as necessary. Similar to other FGCTs, the major concerns of integrating these processes are the control priorities among pollutants and the potential conflicts with other control technologies.

(6) Opacity Impact:

Opacity is an indication of the level of transparency in the flue gases exiting the smokestack or the plume after moisture dissipation. The level of opacity is primarily dependent on (1) particulate concentration, (2) particle size distribution, (3) sulfur trioxide concentration, and (4) moisture level. The use of upgraded coke in this embodiment with either Option 1 or 2 for SOx control is expected to significantly reduce the opacity level in most utility boilers, due to the reductions in particulate and sulfur trioxide concentrations in the flue gases, described above. The reduced moisture and hydrogen content of the upgraded petroleum coke (vs. most coals) can also contribute to lower opacity and steam plumes. Finally, significant reductions in particulates less than 10 microns can substantially improve the opacity.

(7) Solid Waste Impact:

As discussed previously, the upgraded petroleum coke of the present invention can dramatically reduce the quantity and quality of the solid wastes for disposal. The upgraded petroleum coke has such low ash particulates that greater quantities of collected flyash can be effectively recycled to increase reagent utilization efficiencies. The improved reagent utilization often creates greater proportions of the flyash as more stable compounds. For example, the fully oxidized, spent reagent in SOX FGCT (calcium sulfate) may be preferred for waste disposal (versus unreacted reagent or less oxidized forms). Furthermore, the extremely low ash particulate levels (i.e. low impurities) provide greater opportunity to use the collected flyash as raw materials for various products, instead of solid wastes, requiring disposal. These products include, but are not limited to, gypsum wallboard and sulfuric acid. In addition, the spent reagent can be regenerated to dramatically reduce the wastes requiring disposal. In this manner, flyash disposal and associated costs are significantly reduced.

(8) General Issues:

Finally, none of these environmental improvements would be possible without the fuel properties of the new formulation of petroleum coke that allows the utility boilers to burn up to 100% of this premium fuel. That is, the fuel properties of the upgraded petroleum coke provide self-sustained combustion. Without it, these environmental improvements would not be possible. The following case study provides just one example of the benefits that can be achieved with an exemplary embodiment of this invention.

G. Example 1

Utility Boiler with Conventional Particulate Control Device (PCD)

A power utility has a conventional, pulverized-coal fired, utility boiler that currently burns medium-sulfur, bituminous coal from central Ohio. The existing utility currently has a typical particulate control device with no sulfur oxide emissions control. Full replacement of this coal with a high-sulfur petroleum coke produced by the present invention would have the following results:

| Fuel Characteristics | Current Coal | Upgraded coke | Results |
|---|---|---|---|
| Basis = $1.0 \times 10^9$ Btu/Hr Heat Release Rate as Input | | | |
| VCM (% wt) | 40.0 | 16.0 | 60% Lower |
| Ash (% wt.) | 9.1 | 0.3 | 97% Lower |
| Moisture (% wt.) | 3.6 | 0.3 | 92% Lower |
| Sulfur (% wt) | 4.0 | 4.3 | 8% Higher |
| Heating Value (MBtu/lb) | 12.9 | 15.3 | 19% Higher |
| Fuel Rate (Mlb/Hr) | 77.8 | 65.4 | 16% Lower |
| Pollutant Emissions: Uncontrolled/Controlled | | | |
| Ash Particulates (lb/MMBtu or Mlb/Hr) | 7.1/0.4 | .2/.01 | 97% Lower |
| Sulfur Oxides (lb/MMBtu or Mlb/Hr) | 6.2/6.2 | 5.6/.6 | 90% Lower |
| Carbon Dioxide (lb/MMBtu or Mlb/Hr) | 238 | 210 | 12% Lower |

This example demonstrates major benefits from the application of the present invention. The upgraded petroleum coke has substantially lower ash and moisture contents, compared to the existing coal. These factors contribute greatly to (1) the ability to burn successfully with lower VCM and (2) a fuel heating value that is 19% higher. In turn, the higher heating value requires a 16% lower fuel rate to achieve the heat release rate basis of one billion Btu per hour in the boiler. As noted previously, this lower fuel rate and the softer sponge coke significantly reduce the load and wear on the fuel processing system, while increasing the pulverizer efficiency and improving combustion characteristics.

The ash particulate emissions (ash from the fuel) are 97% lower than the existing coal, due to the lower ash content and higher fuel heating value. In this manner, fuel switching to the upgraded coke unleashes 97% of the capacity in the existing particulate control device. This excess capacity can now be used for the control of sulfur oxides via retrofit flue gas conversion technology.

A SOx dry scrubber injection/reaction vessel (option 1) is added upstream of the existing particulate control device, along with any associated reagent preparation and control systems. This conversion of the existing particulate control device is assumed to achieve 90% reduction in sulfur oxides in this case. Consequently, the uncontrolled sulfur oxide emissions are reduced from 5.6 to 0.56 thousand pounds per hour. In this manner, the utility of switching fuels and converting the existing particulate control device to dry scrubbing represents 90% reduction in the coal's sulfur oxides emissions (i.e. <0.6 vs. 6.2 lb/MMBtu). This unexpected result is achieved even though the sulfur content (4.3%) of the upgraded petroleum coke is 8% higher than the sulfur level (4.0%) of the Ohio bituminous coal.

Alternatively, the dry sorbent injection systems (option 2) could be used for sulfur oxides control. In this case, the inlet SOx would be reduced by 70% (i.e. 5.6 to 1.7 Lb/MMBtu.). This outlet SOx represents a 73% reduction in sulfur oxides emissions from the bituminous coal. If this level of sulfur emissions is sufficient to meet environmental regulations, the retrofit addition of reaction chamber(s) and reagent injection system(s) is not necessary. In this case, the use of retrofit flue gas conversion technology for additional reductions of carbon dioxide is possible, but not likely, due to lack of sufficient capacity in the existing particulate control device. That is, the original ash particulate capacity less the required capacity for converted SOx (large ionic salts) may not leave sufficient capacity to make $CO_2$ control cost effective.

This example also illustrates significant reductions in pollutant emissions, based solely on fuel switching. The 16% lower fuel rate of the upgraded petroleum coke greatly contributes to lower environmental emissions of ash particulates, sulfur oxides, and carbon dioxide. The 97% reduction in ash particulates, noted above, was primarily due to lower fuel ash concentration. However, uncontrolled emissions of sulfur oxides and carbon dioxide are significantly reduced primarily due to the 16% lower fuel rate. That is, the sulfur content of the upgraded petroleum coke is 8% higher than the existing coal. Yet the upgraded petroleum coke has 10% lower uncontrolled SOx. Similarly, the upgraded petroleum coke has 5% higher carbon content (i.e. 87.5% vs. 83.3%). Yet the uncontrolled emissions of carbon dioxide is reduced by 12% due to fuel switching.

Other Embodiments & Ramifications

Other embodiments of the present invention may present alternative means to achieve at least some of the objectives of the present invention. Examples 2-5 are provided at the end of this discussion to illustrate some of these embodiments of the present invention.

1. Production of Premium Pet Coke: Modified Fluid Coking™ Process

Various operational changes in the Fluid Coking™ process can produce a premium fuel-grade coke, in a manner similar to the delayed coking discussion, above. Traditional Fluid Coking™ normally produces a fuel-grade petroleum coke with higher metals and sulfur content than delayed coke from the same feedstocks. Fluid coke, like shot coke, is spherical in shape (170 to 220 um), which makes it more difficult to grind. Its onion-like, laminated layers of coke cause a much higher density and hardness (HGI 30-40). As such, Fluid coke is even less desirable as a fuel, when compared to fuel-grade petroleum coke from the traditional delayed coking process. Substantially less volatile combustible material (4-8% VCM), much greater hardness, and much lower porosity are three primary reasons. However, U.S. Pat. No. 4,358,290 discusses the need to improve the combustion characteristics of fluid coke. It discloses technology to increase the level of volatile combustible material external to the coking process by blending the fluid coke with heavy petroleum liquid. For reasons discussed previously, leaving more VCM in the coke during the coking process can be more desirable.

A. Traditional Fluid Coking™; Process Description

Figure 4:
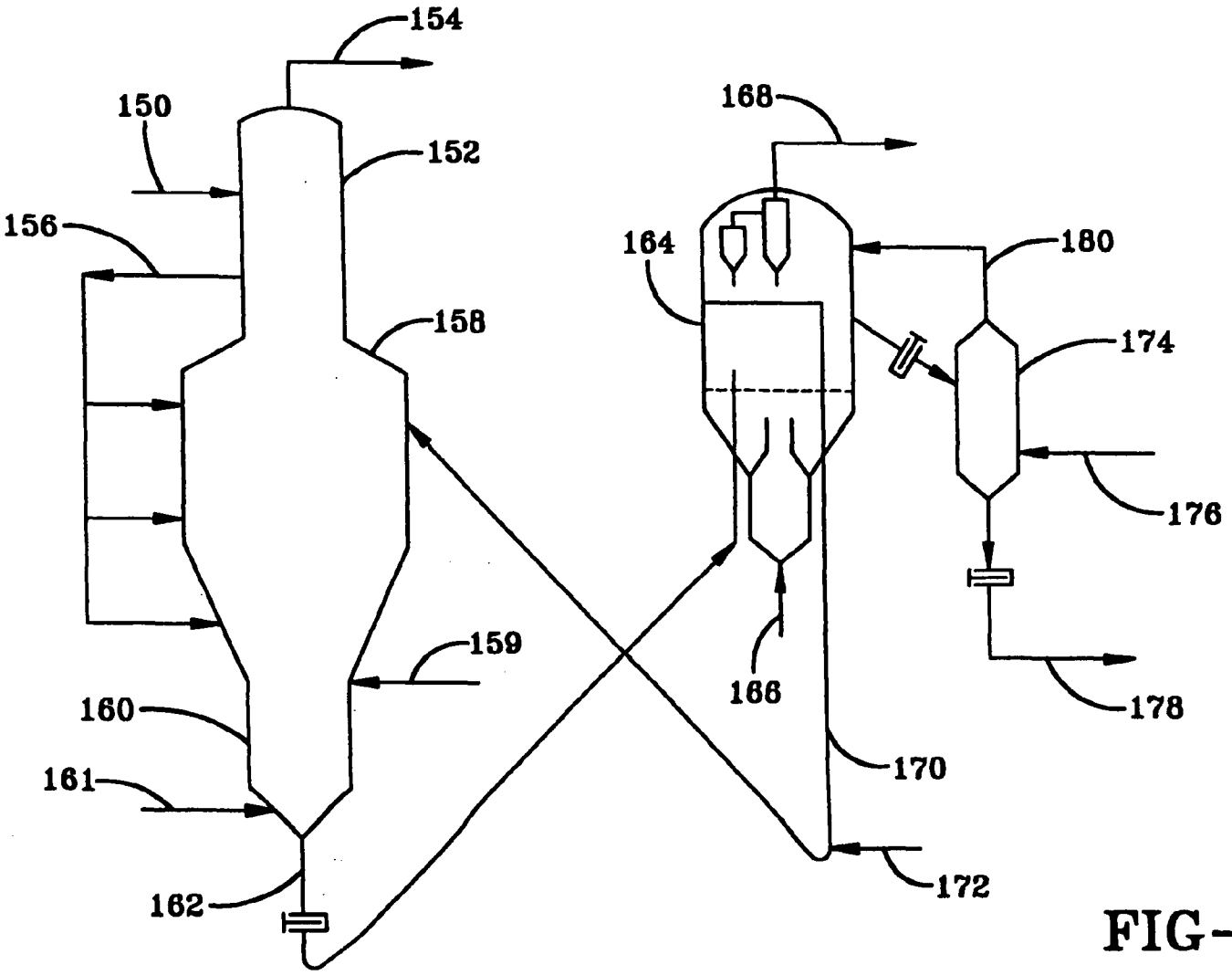
FIG. 4 shows a basic process flow diagram for key elements of a traditional Fluid Coking™ process.

FIG. 4 provides a basic process flow diagram for a typical Fluid Coking™ process. The Fluid Coking™ process equipment is essentially the same, but the operation, as discussed below, is substantially different. Fluid Coking™ is a continuous coking process that uses fluidized solids to further increase conversion of coking feedstocks to cracked liquids, and reduce volatile content of the product coke. Fluid Coking™ uses two major vessels, a reactor 158 and a burner 164.

In the reactor vessel 158, the coking feedstock blend 150 is typically introduced into the scrubber section 152, where it exchanges heat with the reactor overhead effluent vapors. Hydrocarbons that boil above 975° F. are condensed and recycled to the reactor with the coking feedstock blend. Lighter overhead compounds 154 are sent to conventional fractionation and light ends recovery (similar to the fractionation section of the delayed coker). The feed and recycle mixture 156 is sprayed into the reactor 158 onto a fluidized bed of hot, fine coke particles. The mixture vaporizes and cracks, forming a coke film (~5 um) on the particle surfaces. Since the heat for the endothermic cracking reactions is supplied locally by these hot particles, this permits the cracking and coking reactions to be conducted at higher temperatures of about 510° C.-565° C. or (950° F.-1050° F.) and shorter contact times (15-30 seconds) versus delayed coking. As the coke film thickens, the particles gain weight and sink to the bottom of the fluidized bed. High-pressure steam 159 is injected via attriters and break up the larger coke particles to maintain an average coke particle size (100-600 um), suitable for fluidization. The heavier coke continues through the stripping section 160, where it is stripped by additional fluidizing media 161 (typically steam). The stripped coke (or cold coke) 162 is then circulated from the reactor 158 to the burner 164.

In the burner, roughly 15-25% of the coke is burned with air 166 in order to provide the hot coke nuclei to contact the feed in the reactor vessel. This coke burn also satisfies the process heat requirements without the need for an external fuel supply. The burned coke produces a low heating value (20-40 Btu/scf) flue gas 168, which is normally burned in a CO Boiler or furnace. Part of the unburned coke (or hot coke) 170 is recirculated back to the reactor to begin the process all over again. A carrier media 172, such as steam, is injected to transport the hot coke to the reactor vessel. In some systems, seed particles (e.g. ground product coke) must be added to these hot coke particles to maintain a particle size distribution that is suitable for fluidization. The remaining product coke 178 must be removed from the system to keep the solids inventory constant. It contains most of the feedstock metals, and part of the sulfur and nitrogen. Coke is withdrawn from the burner and fed into the quench elutriator 174 where product coke (larger coke particles) 178 are removed and cooled with water 176. A mixture 180 of steam, residual combustion gases, and entrained coke fines are recycled back to the burner.

B. Process Control of the Prior Art

In traditional Fluid Coking™, the optimal operating conditions have evolved through the years, based on much experience and a better understanding of the process. Operating conditions have normally been set to maximize (or increase) the efficiency of feedstock conversion to cracked liquid products, including light and heavy coker gas oils. The quality of the byproduct petroleum coke is a relatively minor concern. In "fuel-grade" coke operations, this optimal operation detrimentally affects the fuel characteristics of the coke, particularly VCM content, crystalline structure, and additional contaminants.

As with delayed coking, the target operating conditions in a traditional fluid coker depend on the composition of the coker feedstocks, other refinery operations, and the particular coker's design. The desired coker products also depend greatly on the product specifications required by other process operations in the particular refinery. That is, downstream processing of the coker liquid products typically upgrades them to transportation fuel components. The target operating conditions are normally established by linear programming (LP) models that optimize the particular refinery's operations. These LP models typically use empirical data generated by a series of coker pilot plant studies. In turn, each pilot plant study is designed to simulate the particular coker design, and determine appropriate operating conditions for a particular coker feedstock blend and particular product specifications for the downstream processing requirements. The series of pilot plant studies are typically designed to produce empirical data for operating conditions with variations in feedstock blends and liquid product specification requirements. Consequently, the fluid coker designs and target operating conditions vary significantly among refineries.

In normal fluid coker operations, various operational variables are monitored and controlled to achieve the desired fluid coker operation. The primary operational variables that affect coke product quality in the fluid coker are the reactor temperature, reactor residence time, and reactor pressure. The reactor temperature is controlled by regulating (1) the temperature and quantity of coke recirculated from the burner to the reactor and (2) the feed temperature, to a limited extent. The temperature of the recirculated coke fines is controlled by the burner temperature. In turn, the burner temperature is controlled by the air rate to the burner. The reactor residence time (i.e. for cracking and coking reactions) is essentially the holdup time of fluidized coke particles in the reactor. Thus, the reactor residence time is controlled by regulating the flow and levels of fluidized coke particles in the reactor and burner. The reactor pressure normally floats on the gas compressor suction with commensurate pressure drop of the intermediate components. The burner pressure is set by the unit pressure balance required for proper coke circulation. It is normally controlled at a fixed differential pressure relative to the reactor. The following target control ranges are normally maintained in the fluid coker for these primary operating variables:

1. Reactor temperatures in the range of about 950° F. to about 1050° F.,
2. Reactor residence time in the range of 15-30 seconds
3. Reactor pressure in the range of about 0 psig to 100 psig: typically 0-5 psig,
4. Burner Temperature: typically 100-200° F. above the reactor temperature These traditional operating variables have primarily been used to control the quality of the cracked liquids and various yields of products, but not the respective quality of the byproduct petroleum coke.

C. Process Control of the Present Invention

The primary improvements of the present invention are modifications to the operating conditions of the Fluid Coking™ process, in a manner that is not suggested by prior art. In fact, these changes in operating conditions are contradictory to the teachings and current trends in the prior art. As noted previously, the operating conditions of the prior art give first priority to maximizing cracked liquid products. The operating conditions of the present invention give first priority to consistently increasing the volatile combustible material in the resulting petroleum coke to 13-50 wt. % VCM (preferably 15-30% VCM). Second priority is given to consistently provide a minimum-acceptable level of coke crystalline structure in the product coke. The third priority is THEN given to maximize coker throughput and/or the conversion of coker feedstock blend to cracked liquid products. However, changing the VCM content and crystalline structure in fluid coke is much more challenging, relative to delayed coke. The operating conditions required to achieve the objectives of the present invention were moderate, yet specific changes relative to the prior art.

As discussed previously, fluid coker operating conditions vary greatly among refineries, due to various coker feedstocks, coker designs, and other refinery operations. Therefore, specific operating conditions (i.e. absolute values) for various refinery applications are not possible for the present invention. However, specific changes relative to existing operating conditions provide specific methods of operational change to achieve the desired objectives.

(1) Increased Volatile Combustible Material (Vcm) in Fluid Coke:

In a manner similar to the delayed coking process, reduction in the process operating temperature will cause an increase of volatile combustible material in the resulting petroleum coke. That is, the reduction in process (or reactor) temperature will reduce the cracking and coking reactions, and thereby, leaving more unreacted coker feedstock and cracked liquids in the coke as volatile combustible material. However, the different mechanism of coking in the Fluid Coking™ process may require a more significant reduction in temperature to achieve the same level of VCM in the petroleum coke. In the Fluid Coking™ process, the temperature of the fluidized coke particles leaving the coke burner would be the primary temperature to reduce. Decreasing this temperature by 10-200° F. (preferably 10-80° F.) can increase the fluid coke VCM to the preferable range of 15-30%. Reduction of feed temperature and the operating temperature of the reactor would also play secondary roles in increasing the VCM on the petroleum coke. However, if the reactor temperature is too low, the fluid coker will bog down and lose fluidization. If the reactor temperature (in a particular fluid coker) approaches this bogging condition prior to achieving the desired VCM increase, other operational parameters can be modified to achieved the desired VCM. The reduction of coke stripping and the addition of oily sludges/substances or hazardous wastes in the final quench of the product coke can provide the additional VCM required.

The reduction of coke stripping at the base of the fluid coker reactor can also increase the product coke VCM. The reduced efficiency of the stripping section will leave more VCM on the cold coke circulated to the burner. In the burner, less coke (i.e. higher VCM coke) would be burned to provide the same heat requirements. Consequently, a greater yield of higher VCM product coke would be produced.

The addition of oily sludges (or other oily substances) or hazardous wastes in the final quench of the product coke can also provide the additional VCM required. Similar to the delayed-coke drum quenching process, the quenching of product (fluid) coke in the quench elutriator can be used to achieve the desirable VCM content. That is, oily sludges or other oily substances, such as used lubricating oils, can be added to the quench water to leave more VCM on the fluid coke product. Various types of hazardous wastes can be used as a raw material (vs. waste) in this modified process, instead of underground injection or less desirable disposal methods. However, environmental regulations may require a delisting process or other means of dealing with the hazardous waste requirements. This method can be effective in evenly distributing quench material throughout the coke, and provide various options regarding the quality of VCM content. This option is discussed further in other embodiments.

(2) Acceptable Fluid Coke Crystalline Structure:

Unfortunately, operational changes in the fluid coker will not significantly impact the crystalline structure of the product fluid coke. The fluid coke has onion-like, laminated layers of coke due to the nature of the Fluid Coking™ process. As such, the product fluid coke has the consistency of coarse sand (vs. sponge) with a much higher density and much lower porosity. Consequently, the high VCM coke can have limited utility and can be limited to applications where the current crystalline structure is acceptable. Also, this denser crystalline structure may require higher VCM quality and quantity versus sponge coke.

D. Low-Level Decontamination of Coker Feedstocks; Desalting Operations

As in the exemplary embodiment, the three-stage desalting operation will provide the simplest and best known approach to provide the low-level decontamination of the product fluid coke required for combustion applications. The low-level decontamination of the feedstocks will have similar effects in the fluid coker. The three-stage desalting operation will minimize (or substantially reduce) the sodium content of the fluid coke. This sodium reduction is expected to be sufficient to prevent the formation of undesirable sodium compounds in the combustion process. However, the reduction of vanadium and other metals may not be as effective. The Fluid Coking™ process tends to concentrate more of these materials in the product fluid coke.

2. Production of Premium "Fuel-Grade" Pet Coke: Additional Embodiments

Additional embodiments of the various means to produce a premium "fuel-grade" petroleum coke are described below. Any, all, or any combination of the embodiments, described above or below, can be used to achieve the objects of this invention. In any combination of the embodiments, the degree required may be less than specified here due to the combined effects.

A. Control of VCM in the Petroleum Coke; Additional Embodiments (1) Delayed Coking; Other Process Variables:

In the delayed coking process, other process parameters could also be modified to achieve the desired level of VCM on the petroleum coke. That is, operational control variables other than feed heater outlet temperatures may be modified to achieve the major objectives of the present invention and/or more optimal operation for a particular refinery. These other operational control variables may include, but should not be limited to, the coker feedstock blend, drum pressure, hat temperature, cycle time, recycle rate, and feed rate. Modifications to these operational variables may or may not accompany a decrease in the feed heater outlet temperature. Process variables that increase the thermal coking mechanism (such as feedstock modifications) would be preferable; increasing sponge coke as well as VCM. Coker feedstock pretreatment (e.g. hydrotreating) has also been noted to increase coke VCM, in certain situations. In addition, this embodiment anticipates (1) various combinations of process variable modifications and (2) different control priorities (for meeting various product specifications) that also achieve the major objectives and basic intent of the current invention.

(2) Fluid Coking™; Other Process Variables:

In a similar manner, other process parameters of the Fluid Coking™ process could also be modified to achieve the desired level of VCM on the petroleum coke. Operational control variables, other than Fluid Coking™ reactor temperature, may be modified to achieve the same object for more optimal operation for a particular refinery. These other operational control variables may include, but should not be limited to, the coker feedstock blend, feed rate, reactor pressure, reactor residence time, and recirculated coke particle size. Coker feedstock pretreatment (e.g. hydrotreating) can increase coke VCM, in certain situations. Modifications to these operational variables may or may not accompany a decrease in reactor temperature, recirculated coke fines temperature and/or feed temperature. In addition, this embodiment anticipates (1) various combinations of process variable modifications and (2) different control priorities (for meeting various product specifications) that also achieve the major objectives and basic intent of the current invention.

(3) Flexicoking™; Changes in Process Variables:

A case could be made for increasing the VCM and/or improving crystalline structure of the purge coke in Flexicoking™. Process changes would be similar to the process changes made in Fluid Coking™, due to their similar design basis. However, the additional coke devolatilizing in the Flexicoking™ process make the increased VCM more difficult. Furthermore, higher VCM coke would not likely have substantial utility, since Flexicoking™ consumes most of its coke internally in its gasifier.

(4) Reduced Stripping of Product Coke:

In another embodiment, less stripping of the product coke may provide part (or all) of the desired increase in the volatile combustible material in the petroleum coke. Reducing the steaming of the product coke will significantly decrease the liquid hydrocarbons removed from the coke, via vaporization and/or entrainment. Thus, the VCM content of the product coke is increased. Most of the VCM increase is expected to be cracked liquids with boiling temperatures <1000° F. This can effectively improve the quality as well as the quantity of VCM on the petroleum coke. This embodiment can be applicable to the coke stripping in delayed coking, Fluid Coking™, Flexicoking™, and other types of coking processes, available now or in the future. In delayed coking, an added benefit is the potential for a significant reduction in the decoking cycle. The elimination of the initial steam-cooling step in the decoking procedure could help decrease decoking cycle time by up to 3 hours.

(5) Injection of Oily Sludges/Fluids in Coke Quench:

In another embodiment, various oily sludges or other fluids containing hydrocarbon substances (e.g. used lubricating oils) can be used in the quench for the product coke to increase its VCM. The method of introducing the oily sludges/fluids may be similar to that described in U.S. Pat. No. 3,917,564 (Meyers; Nov. 4, 1975). However, the injection of hydrocarbons in the quench may continue until the coke temperature reached 250-300° F. (vs. 450° F.). This modified method would allow high quality VCMs (boiling ranges of 250-850° F. and heating values of 16-20,000 Btu/lb) to be evenly dispersed on the upgraded petroleum coke. Another improvement may also include the introduction of the oily sludges/fluids without the two initial steam cooling steps, to reduce decoking cycle time and leave more VCM on the petroleum coke. A further improvement would result from segregating the hydrocarbon substances by boiling ranges and inject them with the quench at the appropriate cooling stage to vaporize the water carrier, but not the hydrocarbon fluids. That is, an exemplary method may inject the water quench (without initial steam cooling) in stages that maintains coke temperatures below the boiling ranges of the segregated hydrocarbon substances it contains. In addition, the injection of the quench in the top of the drum (or other locations) may provide further advantage to condense escaping VCM vapors that are entrained in the steam or vaporized by localized hot spots in the coke drum. The optimization of these methods for particular refineries would maximize (or substantially increase) retention of these oily substances integrated in the upgraded petroleum coke.

Most of the VCM increase is expected to come from unreacted hydrocarbons. The degree of VCM from 1000° F.+ materials will depend on the type of sludges or oily substances. If oily substances are chosen to produce VCM <850° F., this embodiment can improve the quality as well as the quantity of the VCM. In addition, the resulting fuel-grade petroleum coke is expected to be less sensitive to the disposal of various sludges and oily substances, when compared to similar disposal methods for other grades of petroleum coke. However, certain sludges can add significant ash content and undesirable contaminants, such as sodium, to the product coke. This embodiment can be applicable to the coke quenching in delayed coking, Fluid Coking™, Flexicoking™ and other coking processes, available now or in the future.

(6) Injection of Oily Sludges/Fluids in Coking Process:

In another embodiment, various oily sludges or other fluids containing oily substances (e.g. used lubricating oils) can be introduced into other parts of the coking process (e.g. coker feedstocks) to increase the product coke VCM. The method of introducing the oily sludges/fluids may be similar to that described in U.S. Pat. No. 4,666,585 (Figgins & Grove; May 19, 1987). However, the oily sludges in this application would be segregated to give first priority to oily sludges that are predominantly hydrocarbons with boiling ranges exceeding 600-700° F. The introduction points in the delayed coking process should include, but not be limited to coker feedstock, fractionator, coke drum, and other streams prior to coking. Similarly, introduction points in the Fluid Coking process should include, but not be limited to, coker feedstock, feed heater, scrubber section, coker reactor, and other streams prior to coking.

Similar to coker feedstocks, the VCM increase is expected to come from unreacted materials and cracked liquids. The degree of VCM from 1000° F.+ materials will again depend on the type of sludges or oily substances. As above, the resulting fuel-grade petroleum coke is expected be less sensitive to the disposal of various sludges and used lubricating oil, when compared to similar disposal methods for other grades of petroleum coke. Similarly, certain sludges can add significant ash content and undesirable contaminants, such as sodium, to the product coke. This embodiment can be applicable to delayed coking, Fluid Coking™, Flexicoking™ and other coking processes, available now or in the future.

(7) Injection of Hazardous Wastes in Coking Process or Coke Quench:

Various types of hazardous wastes can be injected as a raw material or chemical feedstock (vs. waste) in this modified process. Selective use of hazardous wastes with desirable volatilization and combustion properties (e.g. predominantly hydrocarbons) can greatly improve the quality of the upgraded petroleum coke's VCM. At the same time, the hazardous wastes could be effectively used in this product, instead of underground injection or less desirable disposal methods. In some cases, the EPA delisting or other process may be required to address environmental regulations regarding hazardous wastes. In many cases, the concentration of the hazardous waste in the resulting coke would be sufficiently low to minimize (or greatly reduce) hazardous waste characteristics.

The addition of hazardous wastes in the coking reaction (via blending with coker feedstock or other injection points) can provide a cost-effective source of VCM for the resultant coke with limited reductions in cracked liquid production. The method of introducing the hazardous wastes in the delayed coking cycle may be similar to that described in U.S. Pat. No. 4,666,585 (Figgins & Grove; May 19, 1987). However, the hazardous wastes in this application may be segregated to give first priority to oily sludges that are predominantly hydrocarbons with boiling ranges exceeding 600-700° F. The introduction points in the delayed coking process should include, but not be limited to coker feedstock, fractionator, coke drum, and other streams prior to coking. Similarly, introduction points in the Fluid Coking process should include, but not be limited to, coker feedstock, feed heater, scrubber section, coker reactor, and other streams prior to coking.

Injection in the coke quench, however, may be preferable to increase the quantity of VCM with low boiling points (i.e. 250-850° F.), remaining with the coke (vs. overhead product as cracked liquid). Consequently, this higher quality VCM would enhance the ignition and combustion characteristics of the upgraded coke. Injection via coke quench can be effective in evenly distributing quench material throughout the coke. The method of introducing the hazardous wastes in the coke quench may be similar to that described in U.S. Pat. No. 3,917,564 (Meyers; Nov. 4, 1975). However, the injection of hazardous wastes in the quench would continue until the coke temperature reached 250-300° F. (vs. 450° F.). This modified method would allow high quality VCMs (boiling ranges of 250-850° F. and heating values of 16-20,000 Btu/lb) to be evenly dispersed on the upgraded petroleum coke. Another improvement may also include the introduction of the hazardous wastes without the two initial steam cooling steps, to reduce decoking cycle time and leave more VCM on the petroleum coke. A further improvement would result from segregating the hydrocarbon substances by boiling ranges and inject them with the quench at the appropriate cooling stage to vaporize the water carrier, but not the hydrocarbon fluids. That is, an exemplary method may inject the water quench (without initial steam cooling) in stages that maintains coke temperatures below the boiling ranges of the segregated hydrocarbon substances it contains. In addition, the injection of the quench in the top of the drum (or other locations) may provide further advantage to condense escaping VCM vapors that are entrained in the steam or vaporized by localized hot spots in the coke drum. The optimization of these methods for particular refineries would maximize (or substantially increase) retention of these oily substances integrated in the upgraded petroleum coke. Similar results are expected for many types of hazardous wastes.

(8) Combination of Embodiments to Achieve Desirable Burning Profile:

As noted previously, the end-users' VCM specification can be lowered by providing the optimal burning profile for his combustion system design. That is, the VCM increase can preferably be a combination of hydrocarbons with various boiling ranges. To a certain extent, the burning profile of the petroleum coke can be adjusted by a combination of the above embodiments. For example, most of the VCM increase can come from a decrease in heater outlet temperature and the addition of used lubricating oils to the coker feed, with most VCM >1000° F. materials. The remainder of the VCM could come from reduced steaming and using oily sludges in the quench, producing VCM with lower boiling ranges (e.g. 350-1000° F.). These lower boiling range VCM would improve flame initiation, stability, and intensity. Consequently, the types of volatile combustible materials could be varied to a reasonable degree, based on pilot studies for production and burning of petroleum coke. In this and similar approaches, the formulation of petroleum coke can be custom-made to match (to the extent possible and reasonable) the burning profile of the end-user's combustion system. In this manner, the end-user can optimize the operation of his combustion system without expensive design modifications to accommodate the fuel switch to petroleum coke. Consequently, this approach is conducive to achieving the lowest VCM required by the end-user's current combustion system.

(9) General Issues for Various Embodiments of Vcm Control:

As noted above, the use of less stripping and/or quench containing hydrocarbons can eliminate or reduce the need for additional VCM from the coker feedstock. However, the petroleum coke VCM must be able to endure the weathering (rain, snow, etc.) in transport and storage, and provide the VCM required by the end-user at its facility. That is, VCM from lighter hydrocarbons may be lost from the product coke, due to higher solubility and continual washing.

After the specific level and types of VCM required are determined for any given product coke, engineering factors will determine the optimal use for any of the above embodiments, separately or in combination, for a particular refinery. In any combination of the embodiments, the degree required may be less than specified here due to the combined effects. Finally, these concepts and embodiments may be applied to other types of coking processes, available now or in the future.

As noted previously, the main objective of the present invention is to achieve a petroleum coke with acceptable VCM, crystalline structure, and decontamination levels, preferably specified by the end-user. THEN, the conversion of coker feedstock blend to lighter liquid products is maximized. Optimization of all operating conditions and economic constraints via refinery LP computer models is anticipated. However, this model would likely include a petroleum coke product having the end-user specified VCM, crystalline structure, and decontamination levels as operational constraints.

B. Control of Petroleum Coke Crystalline Structure; Additional Embodiments (1) Other Coker Operating Variables:

In coking processes, other process parameters could also be modified to achieve the desired level of crystalline structure within the petroleum coke. Operational control variables other than drum and coke recirculation temperatures may be modified to achieve the same object or more optimal operation for a particular refinery. These other operational control variables would preferably increase the thermal coking mechanism and/or decrease the asphaltic coking mechanism to bring R-values down to an acceptable level. For delayed cokers, these other operational control variables may include, but not be limited to, the coker feedstock blend, fractionator pressure, hat temperature, cycle time, and feed rate. For Fluid Coking™, these other operational control variables may include, but not be limited to, the coker feedstock blend, solids circulation rate, fractionator pressure, and feed rate. Modifications to these operational variables may or may not accompany a decrease in the outlet temperatures of the respective feed heaters or other operating temperatures. Process variables that increase VCM while decreasing shot coke would be preferable.

(2) Coker Feedstock Modifications:

Coker feedstocks could also be modified to achieve the desired level of crystalline structure within the petroleum coke. That is, feedstock modifications can achieve the same object or more optimal operation for a particular refinery. These would preferably increase the thermal coking mechanism and/or decrease the asphaltic coking mechanism to bring R-values down to an acceptable level. Coker feedstock modifications could include, but not be limited to (1) dilution with fluids/feedstocks with less asphaltene and resins content, (2) the addition of highly aromatic feedstocks, such as FCCU slurry oil, and/or (3) coker feed pretreatment (e.g. hydrotreating or other desulfurization). This embodiment can be applicable to delayed coking, Fluid Coking™, Flexicoking™ and other coking processes, available now or in the future.

(3) Coker Additives:

Various chemical and/or biological agents could be added to the coking process to further help inhibit the formation of shot coke and/or promote the formation of desirable sponge coke. One such additive may inhibit the role certain contaminant particles play in the formation of shot coke. Also, U.S. Pat. No. 4,096,097 (Yan: Jun. 20, 1978) describes a method for inhibiting shot coke and promoting sponge coke formation for the production of an electrode grade petroleum coke having desired grindability qualities. This method comprises adding an effective amount of oxygen-containing, carbonaceous material (which tends to decompose at high temperatures) to the delayed coker and/or recycle/feed. The addition of oxygen-containing carbonaceous material, in combination with other features of the present invention, may further help eliminate or substantially reduce shot coke formation and promote sponge coke crystalline structure. Examples of the oxygen-containing carbonaceous material include, but are not limited to, sawdust, newspaper, alfalfa, wheat pulp, wood chips, wood fibers, wood particles, ground wood, wood flour, wood flakes, wood veneers, wood laminates, paper, cardboard, straw, cotton, rice hulls, coconut shells, peanut shells, plant fibers, bamboo fibers, palm fibers, kenaf, bagasse, sugar beet waste, coal (e.g., subbituminous coal), lignite, other cellulosic materials and wastes, other oxygen-containing carbonaceous materials, and other materials having similar characteristics. The carbonaceous material preferably has an oxygen content in the range of from about 5% to about 60% by weight. However, it should be recognized that carbonaceous materials having an oxygen content outside of this range may also be used in the present invention.

The inventor has also made the surprising discovery that the addition of other chemical agents, with or without an oxygen content in the range of from about 5 to about 60 wt. %, can further promote the production of sponge coke and eliminate or substantially reduce shot coke formation. While not wanting to be bound by any particular theory of operability, these other chemical agents tend to increase porosity by producing lighter gases (i.e., Molecular Weight <50) that rise through the coking mass in the petroleum coking process. This theory of operability is similar to foaming agents for plastics, such as polystyrene, and to the method of adding oxygen-containing carbonaceous materials to the delayed coker and/or recycle/feed. The production of these lighter gases can be caused by various mechanisms. These mechanisms include, but are not limited to, (1) the decomposition of the chemical agents at petroleum coking process conditions (e.g., thermal cracking) and (2) other chemical reactions in the coking process.

It should, however, be recognized that the current invention is not limited to adding carbonaceous chemicals and/or chemicals that contain about 5 to about 60% oxygen by weight. As noted above, the carbonaceous material and/or chemicals may have an oxygen content outside of this range and still promote the production of sponge coke and eliminate or substantially reduce shot coke formation. Furthermore, the lighter gases are not limited to those containing oxygen (e.g., $CO_2$, $H_2O$, etc.). In fact, for reasons described below, the preferred lighter gases released by the decomposition of the chemical agents may be hydrogen, methane, propane, and other light hydrocarbons. Finally, the chemical agents do not necessarily have to be carbonaceous materials.

That is, the chemical agents do not have to contain carbon (i.e., organic) as long as they meet certain criteria in their decomposition at the coking process conditions.

The chemical agents of the current invention may have unique and improved features over the oxygen-containing, carbonaceous materials. The exemplary chemical agents may have some or all the following characteristics:

1. Release (1) hydrogen, (2) light hydrocarbons ($C_3$—), (3) other light gases without oxygen, and/or (4) light gases with oxygen upon decomposition in the coking process conditions
   a. Promote high-porosity sponge coke (vs. shot coke): Increase porosity, improve carbon adsorption character, and improve grindability properties; Proposed mechanisms include, but are not limited to:
      1. The light gases, under pressure, pass through the coke mass creating voids in the developing petroleum coke crystalline structure: The petroleum coke pore size is partially related to the gas molecules' sizes. That is, smaller gas molecules lead to smaller pore sizes. Thus, preferable adsorption character can be effected by control of gas molecular size.
      2. Disturb crystal growth and prevent undesired coke formation, particularly shot coke
      3. Limit petroleum coke crystal size due to nuclei of certain agents, coupled with the proper aromatic-asphaltic ratio established via lower drum temperatures
   b. Quench the cracking/coking reactions via hydrogen reaction with free radicals to break these endothermic, chain reactions: prevents vapor overcracking and improves coker products, as well as decreases the coke yield and improves coke quality (see 1a: 2 & 3)
   c. Provide higher value coker off gas products: Hydrogen and light hydrocarbons (versus oxygen-containing gases such as $CO_2$, $H_2O$, etc.) pass through the coke and are used further
2. Tend to form valuable liquid hydrocarbon products from decomposition in the coking process conditions: vs. greater than 50% coke yields of oxygen-containing carbonaceous materials (wood, lignite, waste coals, etc.)
3. Inexpensive & readily available in refinery area (e.g., recycled or waste materials) Examples of the chemical agents include, but are not be limited to, various types of plastics, rubber, cardboard, and paper. Recycle or waste streams may be used. The chemical agent preferably has a particle size less than 100 mesh, and more preferably less than 50 mesh. However, it should be recognized that the chemical agent may have any particle size that enables it to provide desirable results. Alternatively, the chemical agent can be injected into the coking process in forms other than fine particulates. For example, the injected chemical agents can be liquid (e.g., melted plastics) and/or more than one phase (e.g., a 2-phase slurry). In addition, the chemical agent preferably does not have any inherent impurities that detract from the intended use of the end coke product.

Various types of plastics can often meet most, if not all, of the above criteria for the exemplary chemical agents in the current invention. For example, plastics or chemicals that may be used in the present invention include, but are not limited to, high density polyethylene (HDPE), low density polyethylene (LDPE), polypropylene, polystyrene, polyvinyl chloride (PVC), polyvinyl acetate, polyacrylonitrile, polyurethane, acrylonitrile butadiene styrene (ABS), various copolymers, and other plastics and chemicals having suitable characteristics. In this regard, it should be recognized that most plastics decompose at the coker operating conditions and release lighter gases (molecular weight less than 50) as well as more valuable liquid hydrocarbons ($C_{4+}$ with boiling points less than 850° F.). Depending on the specific plastic compounds, lighter gases would include, but are not limited to, hydrogen, methane, ethane, propane, ammonia, water, carbon dioxide, and carbon monoxide. The ability to use mixed plastics in the current invention provides a major advantage for recycling plastics. That is, the current barrier to recycling plastics (separating plastics by type) is effectively overcome. In addition, readily accessible hydrogen generated from certain plastics can be effectively used to quench excessive cracking and coking reactions in the coke mass and the vapor phase of the cracking products. That is, optimal amounts of hydrogen can be maintained to prevent (1) 'vapor overcracking' (i.e., excessive thermal cracking in the vapor phase) that yields lower value products, and (2) excessive coking of the desired 'cracked liquids' that yields additional petroleum coke of lower value (vs. 'cracked liquids'). The sources of the quench hydrogen include, but are not limited to, hydrogen gas, methane, ethane, propane, ammonia, water, and/or other chemical agent derivatives that have readily accessible hydrogen atoms. The quantity and quality of the hydrogen and other light gases generated from the plastics depends on (1) the types and quantities of various plastics, and (2) the design and operation of the petroleum coking process.

The optimal amount(s) and point(s) of injection for the chemical agent(s) of the current invention may vary with coker feedstocks and coker operating conditions. The amount of light gases (molecular weight <50) and accessible hydrogen generated by the decomposition of the chemical agent(s) is key to (1) improved petroleum coke crystalline structure and (2) the desired quenching of the excessive cracking and coking reactions. The accessible hydrogen is primarily, but not totally, responsible for the desirable quenching of excessive cracking and coking reactions. That is, the other light gases, the coke drum temperature decrease, and other operational changes of the current invention have quench effects, as well. While not wanting to be bound by any particular theory of operability, the quench hydrogen is expected to satisfy the electron structure sought by the free-radical chemical species, that are critical to these endothermic, chain reactions. Eliminating the recurring, free-radical compounds typically stops or quenches the cracking and coking reactions. Quenching the excessive coking reactions is one mechanism that disturbs coke crystal growth; limiting crystal size, increasing coke porosity, and decreasing coke yields. Thus, vapor overcracking and excessive coking can be effectively reduced. However, the point of the light gases' release in the coking process is also important to prevent premature quenching of the coking and cracking reactions. This premature quenching of cracking and coking reactions can essentially defeat the primary purpose of the coking unit: crack heavy hydrocarbon compounds into more usable and valuable hydrocarbons referred to as 'cracked liquids.' Thus, the optimal quantity, quality, and point of injection for the chemical agents of the current invention need to be determined (e.g., pilot plant studies) for each set of coker feedstocks and associated operating conditions. In general, the quantity of carbonaceous material(s) and/or chemical agent(s) may be about 0.5 to about 20 weight percent, and more preferably about 0.5 to 10 weight percent, of the feed. Standard engineering principles and practices can be employed by one skilled in the art to determine the optimal quantity, quality, and point(s) of injection for the appropriate chemical agent(s) of the current invention.

In light of the above considerations, the carbonaceous material(s) and/or the chemical agent(s) are preferably introduced into the feedstream in a delayed coking process prior to the coker heater and/or between the coker heater and the coking drums. For the same reasons, in a Fluid Coking™ process, the carbonaceous material(s) and/or the chemical agent(s) are preferably introduced into the feedstream prior to the feed heater and/or between the coker heater and the burner. As noted, there may be multiple points of injection. It should also be recognized that some of the carbonaceous material(s) and/or the chemical agent(s) can be injected into the feedstream entering the fractionator in a delayed coking process or entering the reactor in a Fluid Coking™ process depending on the coker feedstock and the coker operating conditions. Moreover, it should be recognized that the carbonaceous material(s) and/or the chemical agent(s) can be introduced at other points in the thermal cracking process depending on the coker feedstock and the coker operating conditions.

(4) Current Refinery Operation:

In some situations, the end-users combustion system is capable of handling the coke crystalline structure produced by the coker without additional modifications. For example, process modifications to achieve the higher VCM coke produce acceptable levels of shot coke (or coke crystalline structure) without further process modifications. Alternatively, refineries may have coker feedstocks (e.g. lighter crude blends) with sufficiently low asphaltenes and resins, that the production of sponge coke is already prevalent. In these cases, an increase in coke VCM in the coking process normally increases the coke porosity. As such, an increase in coke VCM alone can be sufficient to achieve an upgraded coke capable of self-combustion.

(5) General Issues for Control of Coke Crystalline Structure:

After the specific levels and types of crystalline structure required is determined for any given product coke, engineering factors will determine the optimal use for any of the above embodiments, separately or in combination. In any combination of the embodiments, the degree required may be less than specified here due to the combined effects. Again, these concepts and embodiments may be applied to delayed coking, Fluid Coking™, Flexicoking™ and other types of coking processes, available now or in the future.

C. Decontamination of Petroleum Coke; Additional Embodiments (1) Current Desalting Process with Improved Efficiency:

The conventional refinery desalting processes, currently in the refinery, can be modified to achieve the low-level decontamination required. One or two stage desalter systems can be improved to >95+% efficiency with sodium levels <5 ppm in the crude or vacuum distillation feedstock. In some cases, this level of decontamination can be sufficient.

(2) Other High-Efficiency Desalting Operations:

Filtration, catalytic, and other types of hydrocarbon desalting operations are in various stages of development. The present invention anticipates the integration of these new types of desalting operations. These other desalting technologies can provide sufficient decontamination, if a sodium specification of <15 ppm (preferably <5 ppm) in the coker feedstock is achieved.

(3) Coke Treatment within the Coking Process:

An additional embodiment for low-level decontamination of the petroleum coke can include coke treatment in the coking process. In the decoking cycle of the delayed coking process, the petroleum coke goes through steam stripping and quenching phases. During these phases, trace amounts of acid, caustic or other chemical additives could be added to the water to promote further reduction of contaminants. In a manner similar to the desalting process, the "water-washing" of the petroleum coke with steam and water would remove water-soluble compounds. The decrease in decoking cycle (created by the reduced drilling time of the softer coke) could be used for additional residence or treating time, if appropriate. A closed-loop water system with independent water treatment may also be desirable for this embodiment. In addition, the introduction of biological treatment of the petroleum coke can be included in this embodiment. Overall, this embodiment may be more desirable than enhanced crude oil desalting systems, due to the thermal decomposition of the coking process. That is, many of the complex organic structures containing the contaminants have been cracked, potentially exposing the contaminants for further treatment (e.g. reaction and entrainment). The combination of both embodiments may be very cost-effective. Similarly, the quench phase (and possibly the stripping phase) of the Fluid Coking™ process can also provide an opportunity for this embodiment of low-level decontamination.

(4) Coke Treatment after Coking Process:

Another embodiment of the present invention can provide decontamination of the petroleum coke after the coking process is complete. As noted above, many of the complex organic structures containing the contaminants have been cracked, in the coking process, potentially exposing the contaminants for further treatment. After the degree of required decontamination and the properties of the upgraded coke are known, normal engineering skills would be sufficient to develop various engineered solutions to treat the coke after the coking process. Options for this embodiment might include various physical, chemical, and/or biological treatments. Another option may also use the transportation and storage of the coke to increase treatment time. This option may require final treatment steps, rinsing, and water treatment systems at the coke user's facility.

(5) Coker Feedstock Dilution:

Another embodiment of the present invention would modify the coker feedstocks to reduce the concentration of contaminants in the final coke product. Coke-producing feedstocks with lower concentrations of the contaminants of concern would be added to the coker feed to dilute the concentration of contaminants in the petroleum coke product.

(6) Coker Feedstock Pretreatment:

Yet another embodiment of the present invention may include other types of coker feedstock pretreatment. From a technical perspective, the addition of a coker feed pretreatment system would likely be the most effective means of addressing the detrimental impacts of petroleum coke contaminants. However, this embodiment often is not economically optimal. The optimal coker feed treatment system would depend on the composition of the coker feedstocks and the needs of the petroleum coke user. After the degree of required decontamination and the impacts of feed treatment decontamination are known, various engineered solutions would be available to treat the coker feedstocks. This coker feed treatment system may or may not include more sophisticated demetallization and/or desulfurization technologies, described in the prior art. For example, hydrotreating or hydrodesulfurization of the coker feedstocks can decrease the sulfur content by 80-95%. If most of the sulfur is removed from the product coke in this manner, the excess capacity of in a utility boiler's existing particulate control device can be used for the collection of other gases (e.g. carbon dioxide) that are converted to collectible particulates.

Also, desulfurization of the coker feedstock may provide further advantage by increasing coke VCM and promoting sponge coke.

(7) Current Refinery Operation with No Further Decontamination:

Another embodiment of the present invention may include no treatment of any kind for decontamination of the coke. As noted previously, the effects of petroleum coke's high metals content in combustion and heat transfer equipment is not well understood or defined. The design and operation of the user's combustion system plays a major role in determining whether the current level of contaminants in the coke is acceptable or not. Therefore, some oil refineries, depending on the coker feedstock blend and coker operation, may be able to provide the upgraded petroleum coke without further coke decontamination.

(8) General Issues for Embodiments of Low-Level Decontamination:

After the specific level of required coke decontamination is determined for any given product coke, engineering will determine the optimal use for any of the above embodiments, separately or in combination. The combination of any of these embodiments may reduce the level of decontamination required by each embodiment, individually. Finally, these concepts and embodiments may be applied to other types of coking and desalting processes, available now or in the future.

3. Further Optimization of Delayed Coking Process

It has been further discovered that the preceding process modifications may be a subset of process modifications to optimize coker cracking and coking reactions. This discovery, an enhanced theory of operation, provides further insight into process mechanisms and chemical reactions of potential coker process modifications. As such, the coker process modifications, described previously, are discussed in a different light for clarification. In addition, coker process modifications are further discussed. These additional embodiments of coker process modifications are the primary focus of this section. However, previous embodiments of potential coker process modifications should not be limited by this discovery and its enhanced theory of operation.

A. Coker Process Modifications: Optimization of Cracking & Coking Reactions

This discovery has led to the optimization of coking and cracking reactions in both the liquid and vapor phases of the coking process. In the past, the coking process has been viewed as a complex mass of physical changes and various competing chemical reactions, primarily coking and cracking reactions. As described previously, the coking process has two major coking mechanisms: thermal coking and asphaltic coking. Thermal coking comprises endothermic chemical reactions: primarily condensation and polymerization of polycyclic aromatic hydrocarbons (PAHs). Asphaltic coking is an adiabatic physical change: essentially desolutation of asphaltenes and resins. The predominant cracking mechanism is noted to be free-radical, dehydrogenation. This endothermic, cracking reaction has several process steps. The initial steps involve the generation of free-radicals that seek electrons to stabilize their electron configurations and initiate cracking or the cleavage of chemical bonds, particularly carbon-to-carbon bonds. The coker operating conditions and chemical components of the coker feedstocks play major roles in determining which reactions are more favorable.

Traditionally, the coker feedstocks are heated to the highest practical temperature to maximize reactivity and drive the endothermic cracking and coking reactions to completion. In general, this approach has been viewed as the most expedient and efficient manner to achieve the primary objective for traditional delayed cokers: maximize the extraction of valuable cracked liquids from the heavy, coker feedstocks. In this manner, many cokers treat the residual petroleum coke as a by-product with little to no value. However, excessive cracking and coking reactions in the liquid and vapor phases can be suboptimal. Consequently, certain process mechanisms and operating conditions have been developed to favor desirable reactions over less desirable reactions. In this manner, the coker reactions are optimized.

In the liquid phase, the cracking reactions may generally be preferred over the coking reactions. In traditional coking processes, cracking the heavy hydrocarbon feedstocks into more valuable, light hydrocarbons is strongly preferable to any reactions that produce petroleum coke. However, it has been further discovered that certain heavy hydrocarbons in the coker feedstocks can be preferably left with the coke (vs. in the heavy coker gas oils or coker recycle). That is, a small fraction of the heavy hydrocarbons that traditionally ends up in the heavy coker gas oil can offer more value in improving the pet coke quality versus decreasing the coker gas oil qualities.

The primary coker feed components of concern are usually very heavy, polycyclic aromatic hydrocarbons (PAHs) that contain undesirable sulfur and metals. These heavy, polycyclic aromatic hydrocarbons are typically vapors in the coke drum between 770° F. and 925° F., usually 800-850° F. In traditional delayed coking processes, these heavy aromatics are either recycled to the heater inlet with fresh feed or retained in the heavy coker gas oil via a deeper cut point. If left in the coker gas oils, these compounds typically end up as (1) coke-on-catalyst in the downstream processing units (FCCU, hydrotreating, etc.), (2) by-products of downstream process(es) that are recycled as feed to the coker (e.g. FCCU slurry oil), and/or (3) cracked feed in high severity processing (e.g. hydrocracking). When cracked, the undesirable sulfur and metals in these compounds typically end up in the cracked finished products. Thus, these compounds are undesirable in downstream processing and are often overvalued by refinery Linear Program (LP) Computer Models (used to maximize refinery profitability via optimizing process operating conditions).

In contrast, these heavy, aromatic compounds can help increase the coker's propensity for high porosity, sponge coke and increase coke VCM content. Furthermore, these aromatic compounds typically contain lower concentrations of sulfur, nitrogen, and metals (e.g. vanadium & nickel) than the other coke components (asphaltenes and resins). Thus, the concentration of these undesirable elements is also incrementally reduced in the petroleum coke. In addition, these same heavy, aromatic compounds typically contain significantly higher concentrations of sulfur, nitrogen, and metals than other coker gas oils components. Thus, leaving these heavy aromatics in the pet coke (vs. in the coker gas oils) can incrementally reduce the concentration of these undesirable compounds in the coker gas oils. Since the gas oils are further processed (hydrocracking, FCCU, etc.) to produce transportation fuels, this may also provide an effective means to further reduce these contaminants (e.g. sulfur) in transportation fuels (e.g. diesel), regardless of the improvements in the pet coke qualities and value.

In the vapor phase, excessive cracking reactions can produce suboptimal product yields and cause limits in coker throughput capacity. In traditional coking processes, cracking reactions continue to occur in the high temperature vapors coming off the coke mass, until quenched by steam in the coke drum vapor line and/or the cold feed in the bottom of the fractionation tower. This continual cracking of the hydrocarbon vapors can detrimentally impact coker product yields. That is, this excessive cracking of hydrocarbon vapors (i.e. "vapor overcracking") converts high-value, cracked liquids (with 3 or more carbon atoms) to smaller molecules (primarily methane, ethane, & hydrogen) that can only practically be used as refinery fuel gas. This refinery fuel gas often has significantly lower value than the cracked liquid products. In fact, methane, ethane, and hydrogen typically account for over 75% of the dried coker gas (Lb-Moles/Hour) from the fractionation column. In addition, vapor overcracking increases the vapor loading of the fractionation system. That is, the cracking of hydrocarbon vapors to smaller compounds creates more molecules of various hydrocarbon vapors (including cracked liquids) and other gaseous components. This causes higher vapor flow rates (i.e. lb.-moles per hour) and pressure drops. Thus, vapor overcracking is normally undesirable due to (1) lower product yields of valuable hydrocarbons and (2) the excessive vapor loading of the coker fractionation system, which can bottleneck or limit the coker throughput capacity. Alternative coker process modifications have been developed to reduce undesirable vapor overcracking and further optimize coking processes.

(1) Clarification of Patent Objectives:

In view of this enhanced theory of operation, further clarification of the patent objectives is provided. As noted above, some of the patent objectives include (1) modification of the petroleum coke crystalline structure and (2) increasing the content of volatile combustion materials (VCMs) in the petroleum coke. Other patent objectives were also discussed, but clarification of these patent objectives is helpful in the following discussion regarding the new discovery.

Coker Operational Changes: Relative to Current Operation

- Current Operation Assumptions: VCM: 10-12 wt. %; Shot or Poor Sponge Coke
- Examples: Light, Sour Crude; Heavy, Sour Crude
- Modification of the Petroleum Coke Crystalline Structure: Further Definitions
  - Sponge Coke: Porous Sponge, Preferable; Dense Sponge, More Preferable; & Honeycomb, Most Preferable (Technically, But May Not Be Economically)
  - Non-Graphitizable Sponge preferable to Graphitizable Sponge Coke: Lower C/H Ratio, Increased Reactivity, & Improved Carbon Adsorption Character
  - Thermal vs. Asphaltic Coke: Further Definition of Heavy Aromatic Compounds
  - Increasing Coke VCM Content:
  - Types of VCMs: Integration in coke; condensed liquid vs. adsorption vs. cross-link, vs. condensation bonding (but not fully integrated; bond broken <1700° F.)
  - VCM Added via Coke Quench: Adsorbed in Coke; Higher Quality VCM
  - Thermal Coke Role in VCM content: Non-graphitizable coke; VCM <1700° F.

(2) Alternative Perspective of the Exemplary Embodiment:

Various process options have been discussed that modify coker operating conditions and/or procedures to achieve the desired modification of coke crystalline structure and higher coke VCM levels. However, decreasing the heater outlet temperature was described as the exemplary coker process modification in many applications. The lower coking temperature reduces both coking and cracking reactions, primarily in the liquid phase.

The types of chemical components in the coker feedstocks play a major role in determining which cracking and coking reactions decrease more significantly with the lower coker operating temperatures. In general, the hierarchy of cracking reactions usually occurs in the following order (most reactive to least reactive): paraffins>linear olefins>naphthenes>cyclic olefins>aromatics. The crackability also tends to increase with molecular weight (or boiling range). After removal of side chains, cracking of the very stable aromatic compounds apparently requires the highest heat of activation. In fact, basic aromatic ring structures (e.g. benzene) normally require temperatures higher than normal coker temperatures (or catalysts) to thermally crack the strong chemical bonds of these compounds. Thus, the lower molecular weight aromatics will often pass through the coker without further cracking. Usually, these lighter aromatics are either (1) cracked in downstream catalytic cracking processes or (2) become part of the finished product blendstocks without further cracking. Consequently, cracking of the heavier, polycyclic aromatics is normally the predominant type of cracking reaction affected by lower coker operating temperatures (i.e. lower heat available). As such, the very heavy aromatics will be the primary feed components that are less likely to crack at lower coker temperatures. Thus, these feed components tend to remain in the coke mass due to lower heater outlet temperatures.

In contrast, the endothermic coking reactions (i.e. condensation & polymerization) for these heavier aromatics generally require lower activation energies than their competing cracking reactions. Otherwise, the cracking of these heavy aromatics would preferentially occur at lower operating temperatures, instead of the predominant coking of these aromatics. Thus, the coking reactions of heavy aromatics are less affected by the lower heater outlet temperatures (vs. cracking reactions). In this manner, these heavy aromatics will preferentially coke at lower coker temperatures, as long as the temperature drops are not excessive. Thus, heavy aromatics (e.g. PAHs) that are not cracked, but coked via endothermic reactions (e.g. condensation and polymerization) and thermal coking. As such, the coking of these heavy aromatics (i.e. thermal coke) apparently decreases the ratio (R) of asphaltic to thermal coking sufficiently to form a porous, sponge coke. Also, heavy aromatics that are not cracked nor coked can provide low-quality VCMs in the pet coke. In this manner, some or all of the benefits of the present invention can be achieved by changing one independent operating variable: decreasing the coker heater outlet temperature by 5 to 50° F., preferably 5 to 25° F. (most preferably 5-15° F.) with a corresponding drop in coke drum outlet temperature of 5 to 80° F.; preferably 5 to 40° F. That is, the heater outlet temperature is reduced by 5 to 50° F. from the traditional coker operation that produces 8-12 wt. % VCM (Volatile Combustible Materials) for a specific coker feedstock and design, with other operating control variables held constant. Again, the reduction in coke drum vapor line temperature is not necessarily equal to the reduction in heater outlet temperature due to the changes in the types of endothermic reactions taking place in the coke drum. The relationship of reduction in heater outlet temperature, increase in coke VCM, change in coke crystalline structure, and coke drum vapor line temperature can vary substantially in significantly different coker feedstocks. Though this theory of operability can be helpful in understanding the proper operational changes, the current invention should not be bound by it.

Other benefits of decreasing the heater outlet temperature make it the predominant process modification of the exemplary embodiment. These potential benefits include, but are not limited to (1) improving properties of various fuels, (2) reducing fuel usage/costs, (3) reducing maintenance of heater section, (4) debottlenecking the coker heater section, and/or (5) improving overall coker product yields. First, U.S. EPA regulations are placing further limitations on the sulfur, metals, olefins, and aromatics contained in the finished fuel products. The lower coker temperature inhibits formation of olefins and aromatics in downstream products, while retaining more sulfur and metals of the heavy aromatics within the coke. This requires less severe hydrotreating or hydrocracking of coker intermediate product streams. Secondly, the reduction in heater outlet temperature not only reduces fuel usage and costs per barrel of unit feed, but can also reduce the overall fuel usage/costs. Thirdly, one of the primary sources of coker heater section maintenance is the coking of the heater tubes & associated tube failures. Lowering the heater outlet temperature can significantly reduce heater tube coking and the need for steam injection and periodic decoking (& associated down time). Fourthly, the reduction in coker heater outlet temperature and associated reductions in feed recycle normally reduces limits (debottlenecks) in the heater section and provides greater operational flexibility and higher heater capacity. Finally, the overall effect on coker product yields can provide more favorable coker profitability, in many cases.

The overall change in coker product yields can vary significantly among refineries due to (1) design & operation of various process units, (2) differences in integration of process units, (3) refinery crude slate, and (4) coker feedstocks. As the coker feedstocks increase in asphaltene and resin content, greater quantities of aromatics will generally be required to achieve the proper asphaltic coking to thermal coking ratio (R) for the desired porous, sponge coke. With some coker feedstocks, the minor reduction in heater outlet temperature does not significantly impact the coker product yields. In these cases, the increased value of the petroleum coke can more than offset any reductions in other coker products. For other feedstocks, the required reduction in heater outlet temperature (e.g. >15° F.) can detrimentally impact the coker operation and/or product yields (e.g. substantial loss of other compounds from the heavy coker gas oil). These coker feedstocks typically have low °API gravity (e.g. <10) and high Conradson Carbon residue (e.g. >16%). In many (but not all) cases, this situation may require other coker process modifications to achieve some or all of the advantages of the present invention and/or offset detrimental product yields for economic reasons. The °API gravity is common density property in the oil industry as determined by the following formula: °API=(141.5/specific gravity)–131.5. Conradson Carbon is an indication of the coke residue potential for crude oils or petroleum derivatives, and is determined experimentally via ASTM D189-52. Both °API and Conradson Carbon are common oil industry terminology.

(3) Additional Embodiments to Achieve Patent Objectives:

Various coker operational changes have been described that achieve (1) modified crystalline structure, (2) higher pet coke VCMs, and/or (3) other advantages of the current invention. These operational changes were discussed, recognizing that various combinations of other operational changes were possible. That is, the present invention is not limited to changes in heater outlet temperature, but includes other options. The following provides further detail about potential operating changes with respect to the heavy aromatics theory of operation. This alternative perspective also provides clarification of the exemplary methods.

The present invention contemplates any coker equipment and/or process modifications (or any combination thereof) that selectively encourages the retention of certain heavy hydrocarbons (primarily polycyclic aromatic hydrocarbons) in the coke mass to achieve some or all of the objectives such as: (1) modified coke crystalline structure (porous, sponge coke, preferably with greater carbon adsorption character) and (2) increased coke VCM content. The amount of heavy aromatics or other hydrocarbons that remain in the coke mass are primarily dependent on the local operating conditions; the coke drum, in particular. The primary local operating conditions that selectively retain the heavier aromatic hydrocarbons include: lower coke drum temperature, higher coke drum pressure, reduced cycle times, coker feed modifications, change in coker recycle rate, and potential catalyst additives. The selectivity of any process modifications can vary from refinery to refinery due to variability in coker design, operation, and feedstocks. The degree of selectivity for each coker equipment and/or process modifications can also vary and does not require high selectivity (e.g. >80%) to be sufficiently effective.

Various operational controls can be modified to achieve the desired retention of coker feed components in the coke mass and the other advantages of the present invention. The four primary independent control variables for the traditional delayed coker operation are (1) heater outlet temperature, (2) fractionator pressure, (3) fractionator hat temperature, and (4) residual carbon in the coker feedstocks. Other operational variables are directly or indirectly affected by (or dependent upon) changes in these control variables. For example, the amount of heavy aromatics or other hydrocarbons that remain in the coke mass are dependent on the local coke drum temperatures. As noted above, the heater outlet temperature indirectly affects the coke drum temperature, depending on the remaining degree of endothermic cracking and coking reactions. Increasing fractionator pressure is an alternative control that can increase coke drum pressure to achieve some or all of the advantages of the present invention. For given coker feedstocks, the fractionator hat temperature has a limited impact on the amount of heavy hydrocarbons left in the coke mass. That is, heavy aromatics leaving the coke drum go to either heavy gas oil or recycle, depending on fractionator hat temperature. Finally, as noted above, altering the coker feedstocks can also be used to achieve some or all of the advantages of the present invention.

a. Coke Drum Temperature: In the prior art, coke drum temperature (measured unquenched in overhead vapor line) is typically maintained at temperatures of >820° F. (preferably 830-870° F.) to achieve coke VCM content <12 wt. %. The current trend is to maximize coke drum temperature to heater and/or coke hardness limits. In contrast, the coke drum temperature can be reduced from current operation by 5-80° F. (preferably 5-40° F.) to achieve some or all of the advantages of the present invention by (1) reducing undesirable cracking and/or coking reactions and/or (2) condensing heavier hydrocarbons to remain in the coke drum until cracked or coked. That is, drum outlet temperatures of the current invention can range from 750 to 865° F. (preferably 770 to 825° F.). More importantly, however, for a particular coker and coker feed blend, the coke drum temperature is reduced by 5-80° F. (preferably 5-40° F.) from coke drum temperatures that achieve coke VCM content <12 wt. %. Reducing the heater outlet temperature can do either or both. Alternatively, chemically quenching the endothermic cracking and/or coking reactions can achieve the former. On the other hand, a thermal quench within the coke drum can have a net effect of doing either or both, as well. Finally, other methods that effect coke drum temperature (e.g. reduced insulation) can also produce some desired effects.

a1. Heater Outlet Temperature: As discussed previously, the reduction of the heater outlet temperature may be the desired operational change to achieve some or all of the advantages of the present invention. In many coker operations, a modest reduction in heater outlet temperature of 5-50° F. (preferably 5-25° F.) can be sufficient to achieve the desired coke drum temperature, its associated increase in VCM and the additional thermal coking required to produce a highly porous, sponge coke. However, in other coker applications, the reduction in heater outlet temperature required to achieve these benefits can be excessive. That is, technical and economic limitations in certain applications can be prohibitive in the sole use of reduced heater outlet temperature to achieve the advantages of the present invention. These limitations can include, but are not limited to, (1) excessive drop in cracking (e.g. napthene rings are difficult to crack at temperatures <900° F.), (2) insufficient heat available for coking reactions (e.g. significant pitch-like material vs. coke), and/or (3) significant detrimental impacts on yields of cracked liquids and associated profitability losses. In these situations, other coker process changes of this invention can be used in lieu of or in combination with a less severe reduction of heater outlet temperature.

a2. Coke Drum Chemical Quench: The benefits of injecting certain carbonaceous materials into the coker feedstock were briefly described earlier. When cracked, these carbonaceous materials generate low molecular weight compounds (e.g. carbon monoxide) that can alter the cracking and coking reactions in a manner that inhibits shot coke formation (i.e. encourages sponge coke). For example, certain plastics can produce free radical hydrogen that can potentially terminate cracking mechanisms downstream of the primary reaction zone and inhibit vapor overcracking. These free radicals can also assist in thermal coking mechanisms. Apparently, this chemical quench of the cracking reactions and the increased thermal coking reactivity can improve coke crystalline structure and potentially increase coke VCM. This type of chemical quench can be effectively added to the coker feed at rates of (0.1 to 20 wt. % of feed; preferably 0.1 to 8.0 wt. % of feed). In a similar manner, hydrogen can be injected downstream of the primary reaction zone with similar results. This other embodiment is discussed in more detail in the section on vapor overcracking.

a3. Coke Drum Thermal Quench: A thermal quench of 5-80° F. (preferably 5-40° F.) near the vapor exit of the coke drum (vs. vapor line quench) can be a desired method in some cases to achieve some or all of the benefits of the present invention. The primary intent of this thermal quench within the coke drum is an effective condensing of the heaviest vapors back into the coke drum. These heaviest vapors are typically heavy aromatics (e.g. PAHs) that undergo further coking or cracking with additional residence time in the coke drum, particularly at the end of the coking cycle. The selective condensation of the heaviest vapors (vs. lighter recycle vapors or heaviest heavy coker gas oil—HCGO components) can selectively promote some or all of the benefits of the present invention with the vapors of lowest value. Various quench media can be used, but cooled heavy coker gas oil (e.g. product or fractionator pump-around reflux system) may be suggested to mitigate vapor loading problems in the fractionator section. In this manner, a thermal quench can also be used to achieve some or all of the advantages of the present invention. Reduction of vapor overcracking may be an added benefit or additional intent for this thermal quench of vapors.

The quench media can be introduced into the coke drum via various mechanical devices. In some cases, the existing anti-foam injection system(s) can be modified to serve both purposes: antifoam and coke drum thermal quench. Existing anti-foam injection systems typically use a gas-oil carrier to convey a silicone antifoam, but are often positioned as far from the exit vapor line as possible to avoid silicone carryover. The existing anti-foam system could be modified to increase the gas oil flow rate and/or add other quench media to achieve the desired coke drum temperature. Other quench media can include, but may be limited to, coker gas oils, various fuel oils, and other chemical compounds that have desirable characteristics, but limited impacts on the coker drum and fractionator systems. Alternatively, additional or separate injection lances (1 to 8; preferably 1 to 4) can be mounted near the coke drum vapor exit(s). Examples of injection lances through bolted flanges are shown in FIGS. 6A-6D. The quench media injection lances 610*a*, 610*c* penetrate the coke drum 620*a*, 620*c* via reinforced flanges 630*a*, 630*c*. The reinforced flanges can be welded to the top of the coke drum, following proper ASME procedures to maintain pressure integrity. Likewise, the lances may be properly welded in the flange cover plates. The materials of construction for both injection lances and mounting flanges are sufficient to perform their functions in the coke drum operating environment. The angle of the flange mountings, the lance mountings, and lance spray nozzles may be designed to sufficiently cover the vapor disengagement zone of outage areas in each coke drum. That is, the quench media spray(s) of the lances preferably cover the entire vapor flow before exiting the coke drum via coke drum vapor line(s) 640*a*, 640*c*. Furthermore, the injection lances may not extend into the coke drum more than a predetermined distance, e.g., about 10-15 feet in a typical embodiment, to mitigate potential pluggage with coke. Also, the design preferably allows replacement with spare lance(s) during the decoking cycle should loss of flow occur. Other potential embodiments of the coking vapor quench are shown in FIGS. 6E to 6H. In these embodiments, the vapor quench occurs external to the coke drum 620*e*, 620*g* in the overhead vapor line 640*e*, 640*g* via injection lances 610*e*, 610*g*. These embodiments can use the force of gravity to convey to the condensed, heavy hydrocarbons back into the coke drum. However, these quench systems may not be preferred in many cases, due to their potential build-up in the vapor line, causing flow restrictions and/or undesirable pressure drops. Ones skilled in the art can develop other mechanical devices that would achieve effective thermal quench of vapors prior to exiting the coke drum and accomplish some or all of the process advantages of the present invention. The required flow rates of the chosen quench media can be readily determined by one skilled in the art via standard engineering procedures and heat balance calculation methods.

a4. Reduced Coke Drum Insulation: Reducing the degree of coke drum insulation can be used, to a certain degree, to reduce coke drum temperature. In particular, less insulation in the upper portion of the coke drums can contribute to the reduction in coke drum outlet temperature (i.e. unquenched vapor line temperature) without thermally quenching primary cracking and coking reactions in the lower drum. This option can contribute to the condensation of the heaviest vapor components (e.g. heavy aromatics) leaving the drum and help reduce vapor overcracking. However, this option can also cause localized phenomena with a more pronounced temperature gradient near the coke drum shell. This can cause undesirable variability (e.g. less control) in the cracking reactions and coke crystalline structure.

b. Coke Drum Pressure: In the prior art, the coke drum pressure is typically maintained between 15-30 psig. The current trend is to minimize coke drum pressure to reduce coke yield within the operational limits. In contrast, increasing the coke drum pressure by 3-30 psig (preferably 3-10 psig) is an effective method to condense the heaviest components (e.g. PAHs) of the vapors leaving the coke drum. That is, coke drum pressures of the current invention can range from 15-40 psig (preferably 20 to 30 psig). More importantly, however, for a particular coker and coker feed blend, the coke drum pressure is increased by 3-30 psig (preferably 3-10 psig) from coke drum pressures that achieve coke VCM content <12 wt. %. The simplest and most common method for increasing coke drum pressure is to increase the fractionator pressure by increasing backpressure at the wet gas compressor. However, capacity and other limitations can make other creative approaches to increase coke drum pressure more desirable, including various mechanisms to control and balance system pressures.

b1. Fractionator Pressure: Increasing the coker fractionator pressure usually increases the coke drum pressure. The higher drum pressure suppresses the vaporization of heavier components remaining after cracking and coking of coker feed or recycle. As such, less quantity of the high-boiling hydrocarbons, including heavy aromatics (e.g. PAHs), are transferred from the coke drum to the coke drum vapors and the coker fractionation column. In this manner, increasing the fractionator pressure generally leaves more of the heavier aromatics in the coke mass within the coke drum. Thus, increasing the coke drum pressure (via controlling the fractionator pressure) is an acceptable process modification to achieve the benefits of (1) modified coke crystalline structure and (2) increased coke VCMs. In some cases, this process modification may be preferred due to its simplicity. However, this alternative can cause compressor overloading, associated capacity limits, and/or some detriment to product yields. In some cases, other means could be logically employed to increase drum pressure with limited impact on the existing compressor system.

b2. Alternative Mechanisms to Increase Coke Drum Pressure: As noted above, creative alternative approaches can be used to increase control and/or balance system pressures to increase coke drum pressure. For example, the pressure drop between the coke drum and fractionator could be mechanically increased and controlled. By increasing heater outlet pressure (e.g. heater inlet pump(s) and/or injection steam pressure), coke drum pressure can be increased, to a certain extent, with less impact on the pressures of the fractionator and downstream equipment. A variety of mechanisms could be used for increasing and controlling pressure drop between the coke drum and fractionator. The partial coking of vapor lines already increases the pressure drop between coke drum and fractionator by as much as 8-10 psig. In a similar manner, a smooth transition orifice spool could be designed for insertion in the vapor line downstream of the quench zone. This static pressure drop control would change with vapor flow (i.e. velocity). Alternatively, a variable throat venturi, similar to those used in wet scrubber applications, could be developed to achieve better pressure drop control. However, potential pluggage or other problems are more likely with this type of device. One skilled in the art can develop a suitable solution that addresses the particular needs (risks vs. benefits) of the specific coker application.

c. Reduction in Cycle Time: In the prior art, coking cycle times typically range from 16-24 hours. The current trend is to minimize cycle times within equipment, operational, and coke quality (e.g. <12 wt. % VCM) constraints. In contrast, reducing coking cycle time by 2-12 hours (preferably 4-8 hours) can be effective in increasing coke VCM and potentially produce desirable modifications in coke crystalline structure. That is, coking cycle times of the current invention can range from 12 to 24 hours (preferably 12 to 16 hours). More importantly, however, for a particular coker and coker feed blend, the coker cycle time is reduced by 2 to 12 hours (preferably 4-8 hours) from coking cycle times that achieve coke VCM content <12 wt. %. Lower cycle times reduce the residence time of the cracking and coking reactions. As a result, the VCM content of the coke increases by approximately 1 wt. % for each 4-6 hours reduction in cycle time. Furthermore, an increase in thermal coke production can occur in coker operations, where the reduction in cycle time has more pronounced effect on cracking versus coking reactions. That is, the coking of heavy aromatics (e.g. PAHs) is more favorable than their respective cracking reactions. In this manner, a reduction in coking cycle time can be effective in achieving some or all of the benefits of the present invention such as: increased coke VCM and modified crystalline structure (porous sponge coke).

d. Feed Modifications: In the prior art, the coker feeds have gotten progressively worse. Heavier crudes have typically pushed delayed cokers to coking limits (e.g. coker & refinery bottlenecks). Consequently, the current trend is to minimize coker feeds of higher quality (e.g. reducing virgin gas oil content or increasing end points on virgin & heavy coker gas oils), increasing Conradson carbon of coker feeds >22. In contrast, various modifications to the coker feed (Conradson carbon <26; preferably <20) can be used as additional methods for achieving some or all of the advantages of the present invention. These modifications can take the form of modified crudes slates, coker feed blends, and/or coker feed additives. Modifications of the coker feed can integrate more aromatics (Aromatics with propensity to coke >40 wt. % of coke; preferably >60 wt. % of coke) in the coke mass. That is, the addition of coker feedstocks with higher aromatic contents will generally increase thermal coking and decrease the asphaltic coking to thermal coking ratio (R) in the coke drum. This increased thermal coking (endothermic) can also have a significant impact on the coke drum temperature. In this manner, coker feed modifications can produce the desired crystalline structure and potentially increase coke VCM content via heavy hydrocarbons not fully integrated in the coke. Coking limits can be mitigated by operational benefits of the current invention (e.g. decreased cycle times). The degree of feeds blend modification can readily be determined by one skilled in the art for a specific refinery/coker application, based on coker design (and coking limits), available coker feeds, relative impact on Conradson Carbon, and overall impact on coke quality.

d1. Modified Coker Feed Blends and Crude Slates: The current coker feed blend can be composed of different proportions of the same feedstocks to produce a blend with higher concentration of heavy aromatics. Alternatively, the current coker feed blend could be blended with other coker feedstocks (e.g. 1-50 wt. % of the total blend; preferably 3-10 wt. %) to produce a desired coke feed blend. These coker feedstocks would include, but should not be limited to, aromatic crude oils, thermal tars, coal tars, pyrolysis tars, coal tar pitch, heavy virgin gas oil (HVGO), furfural extracts, phenol extracts, and slurry oils (e.g. decanted oil from the FCCU). Other intermediate product, byproduct, or waste streams that contain a significant portion of aromatic compounds (e.g. >30 wt. %; preferably >50 wt. %) could also be used as coker feed blendstocks. In this manner, modification to the coker feedstocks can be an effective means to partially or fully achieve the benefits of the present invention. The same objective could also be achieved by increasing higher quality crudes in the crude blend: lighter, paraffinic, and/or aromatic. In addition, the heavy virgin gas oil (HVGO) can be added directly to the coker feed. However, lowering the cut point in the vacuum tower and leaving only the heaviest HVGO in the vacuum resid (i.e. coker feed) would be preferable. This vacuum distillation change has the added benefit of incrementally improving FCCU feed quality of the HVGO.

d2. Coker Feed Additives: As noted previously, certain carbonaceous compounds can be added to the coker feed to enhance the ability to achieve some or all of the advantages of the present invention. The breakdown of these carbonaceous materials apparently produces intermediate compounds that inhibit shot coke formation and favor thermal coking. These carbonaceous additives include, but should not be limited to, coal wastes, wood wastes, cardboard, paper, plastics, and rubber. These solid carbonaceous materials may be finely pulverized (>80 wt. %<100 mesh) and may, for example, be added to the coker heater feed via methods described in expired U.S. Pat. No. 4,096,097. Additional details, particularly for plastics and rubber, are provided later. (See Plastic/Rubber Addition to the Delayed Coker: Exemplary Embodiment).

e. Coker Recycle Rate: In prior art, coker recycle rates are typically maintained at 10-35 wt. %. The current trend is to minimize coker recycle within operational constraints (e.g. coke drum heat balance) to minimize coke yield. In contrast, modifying coker recycle rates can be effective in promoting thermal coke reactions and potentially increasing coke VCM. In the prior art, decreasing the coker recycle rate has been used to decrease coke yield by increasing the heavy components of the coke drum vapors drawn into the heavy coker gas oil. Conversely, increasing the recycle rate leaves these heavier components of the HCGO (e.g. heavy aromatics) in the recycle stream and increases yields of thermal coke. Alternatively, other operational methods of the current invention can preferably leave these heavier vapor components in the coke drum and reduce coker recycle rate. The resulting lower recycle rates can often provide sufficient heater and coke drum capacity to add coker feeds with significant aromatic content, which tend to increase thermal coke. Consequently, these three methods of modifying coker recycle rates may be used to achieve some or all of the benefits of the present invention.

e1. Feed Alternatives with Reduced Coker Recycle Rate: In the prior art, the coker recycle rate has often been reduced to decrease coke yield for a given feed. by increasing the fractionator hat temperature. The fractionator hat temperature is the temperature of the vapors rising to the gas oil drawoff tray in the fractionator. Increasing the hat temperature increases the gas oil end point, the upper end of its boiling range. This increases amounts of higher boiling components (e.g. 900° F. to 925° F.) in the heavy coker gas oil. The incorporation of these higher boiling point components into the heavy coker gas oil (HCGO) lowers the coker recycle rate. This reduction of coker recycle rate is limited by (1) acceptability of heavier HCGO components in downstream processing and (2) heat requirements of the coke drum to complete desirable cracking and coking reactions. In the latter, the additional heat carried by the heated recycle stream into the coke drum is often critical to provide sufficient heat for cracking and coking reactions. A heat balance around the coke drum reveals:

$$Q_{in}=(FF+R)\times avg\cdot Cp\times T_{in}=Q_{out}+Q_{cracking}+Q_{coking}+Q_{walls}+Q_{quench}$$

Where Q=associated heat values; FF=fresh feed; R=coker recycle rate; avg. Cp=average combined feed (i.e. FF+R) heat capacity at Tin; and Tin=coke drum inlet temperature. This simplified formula shows that significant reductions in coker recycle rates can have substantial effects on the heat available for cracking and coking reactions, if the heater outlet temperature remains constant. Thus, increases in heater outlet temperature are often implemented to offset any reductions coker recycle rate. Consequently, heater limitations and the feed's propensity to coke typically limit reductions in coker recycle rate in the prior art. However, reductions in coker recycle rate generally makes more heater feed capacity available. This feed capacity can be used for increased feed rate, if available. Alternatively, various coker feed alternatives (advocated earlier) can be added to the current feed to potentially increase thermal coke and coke VCM. Either or both of these alternatives can significantly increase the heat available in the coke drum and offset the loss of recycle rate. That is, even with lower heat capacities than the traditional recycle materials, these coker feed alternatives (e.g. plastics, rubber, etc.) can provide sufficient heat in many cases. Also, these coker feed alternatives often have less coking propensity and require less heat to be cracked to valuable cracked liquid products.

e2. Increased Coker Recycle Rate: Conversely, increasing the coker recycle rate by 3-30 wt. % (preferably 3-15 wt. %) can achieve some or all of the advantages of the present invention by increasing heavy aromatics and thermal coking in the coke mass. That is, coking recycle rates of the current invention can range from 5 to 50 wt. % (preferably 15 to 35 wt. %). More importantly, however, for a particular coker and coker feed blend, the coker recycle rate is increased by 3-30 wt. % (preferably 3-15 wt. %) from coker recycle rates that achieve coke VCM content <12 wt. %. Decreasing the fractionator hat temperature leaves the heavier components of the HCGO (e.g. PAHs) in the fractionator bottoms that are recycled with fresh feed to the coker heater. As such, decreasing the hat temperature increases the coker recycle rate. In this manner, the coker recycle goes through the heater and coke drums until it is either (1) converted to lower boiling range components that leave with the heavy coker gas oil (or other cracked products) or (2) integrated into the coke mass. Since this additional recycle tends to be primarily heavy aromatics, the increased coker recycle rate tends to increase thermal coking and potentially increase coke VCM, depending on the level of coke carbonization. In addition, the reductions of these heavier components in the HCGO make it a higher quality feed for downstream processing (e.g. FCCU). Increases in coker recycle rates of this manner are limited by heater capacity, coke drum capacity, and/or recycle stream's propensity to coke.

e3. Optimal Recycle Rate and HCGO Quality: Another process option may achieve some or all of the benefits of the present invention while decreasing coker recycle rate and improving HCGO quality. Other operational methods, previously advocated in the current invention via (e.g. lower drum temperature or higher coke drum pressure), can condense the heaviest components in the coke drum prior to reaching the fractionator. Thus, these heaviest components do not end up in either of the HCGO (higher quality) or the recycle stream (lower recycle rate). Again, it should be noted that these heaviest components of the coke drum vapors are significantly heavier than the heaviest components of the HCGO, as determined by the fractionator hat temperature. Thus, the limits of decreasing coker recycle rate are similar to decreasing coker recycle in the prior art: heat balance limitations. However, in this method of the current invention, there is greater operational flexibility: (1) lower recycle rates without lower HCGO quality (i.e. due to higher hat temperature), (2) higher HCGO quality (i.e. due to lower hat temperature) with constant recycle rates, or (3) other combinations of HCGO quality and recycle rates. Preferably, the condensation of the heaviest recycle components (e.g. PAHs) in the coke drum allows a decrease in hat temperature (3-40° F.; preferably 5 to 20° F.) to increase HCGO quality, while still reducing the recycle quantity with improved quality (e.g. less heater coking propensity). This reduced recycle rate provides (1) reduced heater severity (e.g. less fuel & less heater tube coking), (2) availability of more heater feed capacity and/or (3) various coker feed alternatives (advocated earlier) can be added without exceeding heater limits. In this manner, some or all of the benefits of the present invention can be achieved via a modest reduction in the heaviest components of the heavy coker gas oil. In addition, the coker recycle rate can be reduced while maintaining proper coke drum heat balance and improving HCGO quality. One skilled in the art can achieve optimal (1) condensation of heaviest recycle components, (2) HCGO quality, (3) recycle rate, and/or (4) feed additives via empirical studies (e.g. pilot plant) for specific coker design, feed blends, and operating objectives (e.g. LP Model). The primary operating variables would include (1) quenched coke drum temperature, (2) coke drum pressure, and (3) hat temperature.

f. Catalytic Additives: Finally, catalytic compounds can be added to the coker feed and/or the coke drum downstream of the primary reaction zone to enhance thermal coking reactions. These catalysts will allow the endothermic thermal coking reactions to take place with lower heat of activation and often at lower temperatures. Consequently, these thermal coking (condensation and polymerization) reactions can preferentially proceed versus endothermic cracking reactions that compete for available heat at a given drum temperature. For example, As noted above, various coker process modifications can be employed as alternatives to achieve some or all of the advantages of the present invention such as: (1) modified coke crystalline structure with greater carbon adsorption character and (2) increased coke VCM content. That is, lower coke drum temperature (via heater outlet temperature, and/or drum thermal quench), higher coke drum pressure (via fractionator pressure, feed pressure, controlled pressure drops, and/or other mechanism), coker feed modifications (via crude slate, coker feedstocks, and/or various feed additives), recycle rate (via hat temperature or reductions in heavy aromatic compounds left on coke vs. in recycle), and/or catalyst additives can effect the desired retention of certain hydrocarbons in the pet coke. Though each will work to a limited degree, their effectiveness will vary from refinery to refinery. As a result, any combination of these alternatives can be used to effectively achieve some or all of the advantages of the present invention. However, their effects may not necessarily be additive. In certain situations, the optimal value(s) of the operating variables may lie outside the ranges specified above due to the combined effects or anomalies of an atypical coker system. Thus, standard engineering principles and practices of those skilled in the art (including pilot plant studies) may be necessary to determine the optimal combination and their application for each refinery system.

In each specific coker application, one skilled in the art can achieve some or all of the invention benefits through the use of any one or combination of the process options described herein. The optimal combinations and degree of utilization of these process options can be determined by applying engineering principles & practices with this information and the proper characteristics of the coker design, operation (including history and objectives), and available coker feeds. Modest testing (e.g. laboratory and/or pilot plant) may be necessary to determine certain characteristics and operating effects for particular coker feeds. This is consistent with typical refinery practice for evaluating any significant change for coker operations.

B. Novel Process Modifications to Reduce Vapor Overcracking (1) Quench Cracking Reaction in Vapor Various means to quench the cracking reactions of the delayed coking process were briefly described earlier. One such mechanism was the introduction of certain plastics that released hydrogen, when cracked. The purpose of the following section is to describe other mechanisms that accomplish the same objective. The introduction of chemical agents that release hydrogen or other free-radical species (e.g. low-molecular weight) can terminate cracking reactions by satisfying the electron structure of intermediate free-radical species that are active in the cracking reaction mechanism due to their instability. Hydrogen may be the preferred free-radical because it may be more likely to terminate the reaction mechanism rather than initiate some additional cracking. These chemical agents should not be limited to plastics, and include rubber compounds, ammonium compounds, etc. These compounds tend to release hydrogen due to cracking of the chemical agent at the operating conditions of the coking process. The release of hydrogen in the primary cracking zone can prematurely terminate liquids cracking and be very detrimental to the primary objective of the coking process. Thus, the hydrogen is ideally released downstream of the primary cracking zone. Consequently, the primary mechanisms, presented here, inject chemical agents directly into the vapor phase above the surface of the semi-solid coke mass. There are various methods to introduce these chemical agents, but the an exemplary method would use a modified drill stem system. In addition, an exemplary embodiment for this vapor overcracking quench will be discussed in the following sections.

a. Chemical Quench: The injection of chemical agents to satisfy the electron structure of the reactive, intermediate free-radicals (e.g. chain reactions) is an effective way to stop the cracking reactions in the vapor phase. Chemical agents that serve this purpose would include hydrogen, acids, and other chemicals that act as electron donors or can be easily converted to free-radicals. Similar to plastics (discussed earlier), other chemical agents can be injected with the feed that release hydrogen (thermally or otherwise) downstream of the primary cracking zone. In this manner, the chemical agents indirectly provide hydrogen to satisfy the electron structure of the free radical(s). That is, these chemical agents effectively react with intermediate free-radicals and make them substantially less reactive. As a result, the cracking mechanism is terminated or quenched. Likewise, other chemical agents can release free radicals (other than hydrogen), which react with the vapor compounds to terminate or quench vapor overcracking. Similarly, these and other chemical agents can be added downstream of the primary cracking zone. These chemical agents either react directly or via an intermediate (e.g. free radical) to quench free-radicals and terminate cracking, preferably in the vapor phase.

b. Thermal Quench: The injection of various quench media can also be effective in reducing the vapor temperature and quenching the cracking reactions in the vapor phase. Quench media can include, but should not be limited to, water, steam, and liquid hydrocarbons (preferably with high boiling range and high heat of vaporization). The degree of quench media addition is typically determined by the desired cooling of vapors from 5 to 80 degrees Fahrenheit, preferably 5 to 40 degrees Fahrenheit. This level of cooling may be sufficient to thermally quench excessive vapor cracking reactions, as well as condense heavy hydrocarbon vapors that would otherwise exit the coke drum. Water may be preferred over steam to minimize water required (i.e. water vapor in the exiting process gas stream) via the cooling effect of the heat of vaporization of water. However, at high coke drum temperatures, careful design of the injection method may be required to avoid premature vaporization of the water (or other liquids) and expansion or pressure problems. Alternatively, high molecular weight, liquid hydrocarbons (e.g. coker gas oils) may be the preferred cooling medium due to their high heat of vaporization per pound mole and their tendency to remain a liquid at coke drum temperatures with higher pressures prior to injection into the coke drums. This temperature quench can have the added benefit of reducing the heavy hydrocarbon vapors (preferably aromatics) that are preferably kept in the coke mass (discussed previously in section: Coke Drum Thermal Quench). That is, these heavy aromatic vapors exiting the coke drum can be condensed in a manner similar to an increase in drum pressure or the thermal quench systems exemplified by FIGS. 6A-6H.

c. Injection Method: The injection of these chemical agents into the vapor phase of the coking cycle (vs. decoking cycle) in the coke drum can be accomplished by various methods. Ideally, this coke drum quench in the coking cycle would occur at the interface of the coke-foam and the product vapors. From a practical standpoint, the injection of the quench may have to occur in various levels of the coke drum with the means to clean the injection ports on a regular basis without coker unit shutdown. As a minimum, quench injection at the top of the coke drum in the outage area would be needed. This option was discussed in the Coke Drum Thermal Quench section, noted above (e.g. FIGS. 6A-6H). Conceivably, even the injection of quench media with the coker feed at the base of the coke drum would quench the coker and cracking reactions similar to a reduction in feed heater temperature. However, this injection method would quench cracking and coking reactions in both the liquid and vapor phases. This would be similar to visbreaking technology and can substantially change the coker product yield distribution.

Certain injection methods (e.g. minimum & preferred) can have beneficial side effects. Injection into the foam layer on top of the coke mass may also act as anti-foaming agents. That is, the injection of high-pressure hydrogen, gas oils, and/or steam can disperse bubbles via turbulence breaking liquid surface tension. Conceivably, additional anti-foaming agents could also be injected with the thermal and/or chemical quench media to achieve even less foam.

An exemplary method of injection would use a modification of the existing drill stem, which is currently used for hydraulically cutting the coke in the decoking cycle. A totally separate, modified drill stem would be most preferable. The drill stem design would be modified to allow injection of the chosen quench media (chemical and/or thermal). Depending on the media, drill stem modifications can include, but should not be limited to:

- Design: Size & mechanics determined by media type (e.g. phase) and flow requirements
- Spray Nozzle Design: Size & angle(s) determined by spray pattern to cover desired area
- Materials of Construction: Withstand coking cycle operating conditions; temperature, pressure, etc. (e.g. length limited due to torsional stresses in high operating temperatures)
  - Improvements in materials technologies (e.g. composites) can optimize design
- Drill Stem Cooling System: cooling media passing through drill stem to dissipate excess heat
  - For example, steam/$N_2$ flowing in annulus of concentric-pipe drill stem (e.g. split-ring)

This modified drill stem design can require advanced drill stem metallurgy to withstand operating conditions of the coking cycle. Also, the modified drill stem would require a special sealing apparatus to prevent leakage at the interface with the upper drum head at high pressures. Fortunately, the weight of the drill stem will counter the upward force of the pressure in the coke drum, and require lower forces to maneuver it vertically. Modern sensing technology and/or computer simulations, based on process inputs, can accurately control the distance between the drill stem and the top of the semi-liquid coke mass. As technology progresses in these areas (e.g. composite materials science, sealing, and coke level sensing technologies), the use of a modified drill stem will become increasingly advantageous.

The modified drill stem is employed by a system that is similar to the current decoking system. First, the modified drill stem would be maneuvered through its functions using the coke drum derrick. That is, the modified drill stem can be connected, lowered, raised, and rotated using similar mechanisms employed by the existing decoking drill stem system. Preferably, the modified drill stem does not require rotational motion to avoid undesirable, torsional stresses. The major difference, in this regard, will be the addition of the sealing mechanism with bolted flange cover. Secondly, modified drill stem connections to the media supply system (e.g. pump) would be similar to decoking drill stem connections to high-pressure water system.

Figure 7A:
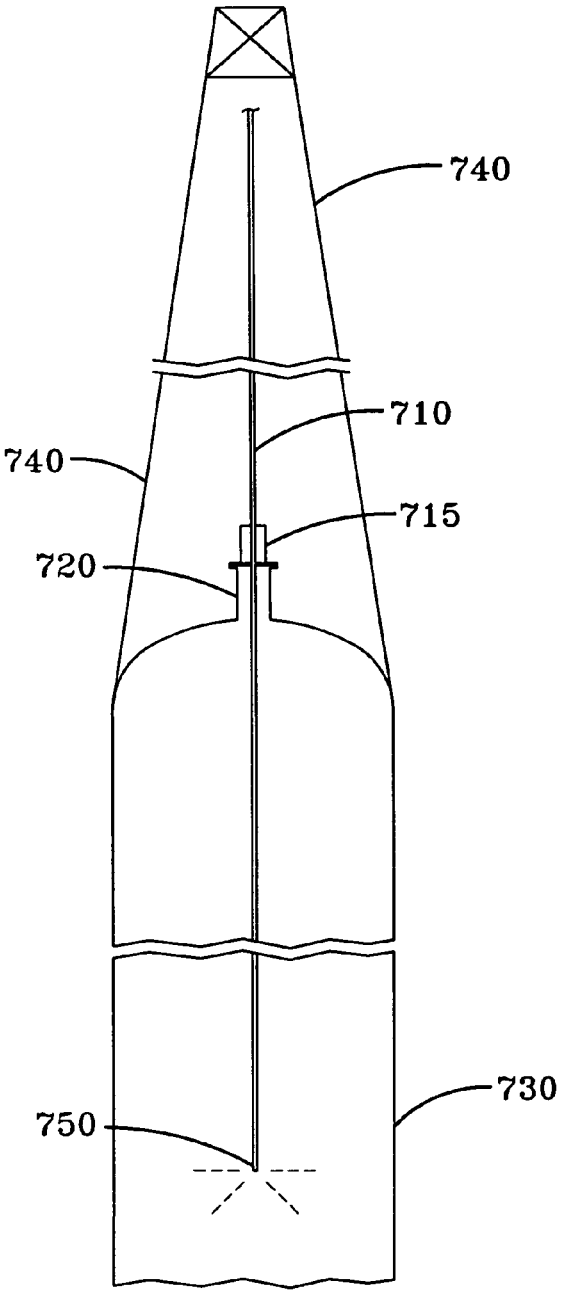
FIG. 7A shows a cross sectional view of a basic equipment diagram for a modified drill stem to inject media that thermally and/or chemically quenches excessive cracking reactions in the vapor phase during the coking cycle of the delayed coking process. This equipment may serve the purpose of quenching heavy vapors exiting the coke drum in a manner similar to the equipment in FIGS. 6A through 6H. The existing drill stem, coke drum derrick, and coke drum center flange have been modified for injection of certain agents in the coking cycle, while maintaining the ability to use the existing drill stem to cut coke from the drum in the decoking cycle.
Figure 7B:
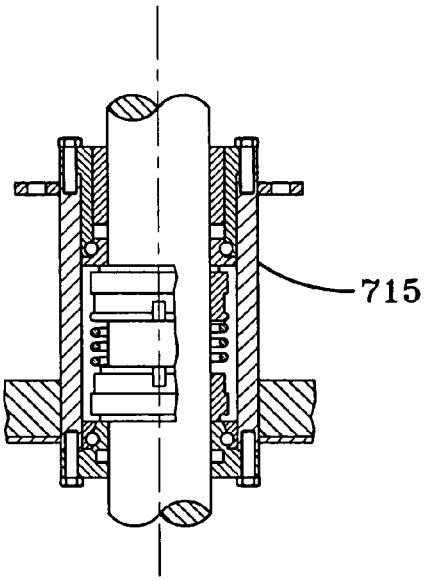
FIG. 7B shows a cross sectional view of an exemplary sealing mechanism (i.e., an internal double mechanical seal) for the modified head flange of FIG. 7A in this high-pressure operation.

An example of the modified drill stem system for a coke drum with a side draw vapor line is shown in FIGS. 7A-7B. In this equipment diagram, the modified drill stem 710 passes through a sealing apparatus 715 mounted on the cover of a reinforced flange 720 in the center of the coke drum. Normally, this may be the same flange used for the existing drill stem to drill out the coke in the decoking cycle. At the end of the decoking cycle, the existing coke drum derrick 740 is typically used to position the modified drill stem. Initially, the modified drill stem is normally retracted with sealing apparatus 715 welded to flange plate near the spray nozzle end. After the flange is properly bolted and the drum is pressure checked, the modified drill stem is lowered into the drum to its maximum extension. During this descent in the drum, the modified drill stem can be designed to provide additional benefit of moderating coke drum warmup (e.g. steam injection). As the coking cycle begins, pressurized quench media is injected into the coke drum above the coke mass via spray nozzle(s) 750. An automated control system, designed for each specific coker, would be used to assure that the modified drill stem would be moved vertically upward (i.e. retracted) at a rate that maintains at least a minimum distance (e.g., 0.5-20 feet, preferably 2-10 feet, more preferably 5-10 feet) above the coke mass, as the coke drum fills. This minimum distance can depend on the anti-foaming effect of the quench media. As noted previously, certain chemical additives in the quench media can increase the anti-foaming effect. The automated control system would preferably have fail-safe design modes and operational procedures to assure the modified drill stem does not get stuck. The high-pressure nozzles and rotational motion of the modified drill stem (e.g. similar to decoking drill stem) would be designed to optimize spray coverage of the cross-sectional area of the coke drum. Full spray coverage of the drum cross-sectional area is not necessary to achieve desirable results. That is, cooler temperatures near the drum walls and quench media diffusional effects will help the quench (chemical and/or thermal) as the vapors move upward in the coke drum. At the end of the coking cycle, the modified drill stem is fully retracted. After cooling and depressurizing the coke drum, the flange is unbolted and the existing drum derrick 740 is used to extract the modified drill stem. Maintenance of the modified drill stem system can be performed during the decoking cycle. Spare modified drill stem systems are recommended to allow sufficient maintenance time.

A critical element of this system is the sealing apparatus 715. An example of a potential sealing mechanism is also shown in more detail in FIG. 7B. This diagram shows a double mechanical seal used for sealing rotating shafts in high-pressure systems. Due to the high temperatures (e.g. extracting modified drill stem from hot coke drum), carbon and/or ceramic materials may be required for sealing faces. High temperature alloys may also be required for the metal components. The use of an inert, pressurized liquid or purge gas can be preferable to balance drum vapor pressures within the seal, and mitigate leakage into and/or out of the sealing apparatus. In addition, a specially designed cooling system for the sealing apparatus may be preferable to dissipate heat from retracting the modified drill stem from the hot coke drum. To a certain extent, the purge gas/liquid to balance pressure can also be used to dissipate heat, as well. One skilled in the art of sealing rotating shafts can develop a suitable sealing apparatus for each coker system. Improvements in sealing technologies can optimize the design required to achieve desired results.

In coke drums with center draw vapor lines, the vapor line connections would have to be modified to accommodate the modified drill stem during the coking cycle and subsequent exchange during the decoking cycle. One skilled in the art can design the appropriate vapor line modifications (e.g. special flanged spool) for each specific application. Similarly, ones skilled in the art can develop other mechanical devices that could achieve effective quench (chemical and/or thermal) of the vapor cracking reactions and accomplish the process advantages of the present invention.

(2) Exemplary Embodiment to Reduce Vapor Overcracking

A combination of both chemical quench and thermal quench is preferable. This combination quench can offer synergistic effects and maintain the desired results with a lower contribution required by each. In an exemplary embodiment, hydrogen gas and condensed coker gas oil may be injected via an exemplary injection method into the coke drum at the interface of the semi-solid coke mass, or a reasonable distance above it (e.g. above coke foam). The quantity of hydrogen addition will vary depending on coker feedstocks, designs, and coker operations, but should typically be in the range of 0.1 to 10 weight percent of the coker feed; preferably 0.1 to 1.0 wt. %. The quantity of coker gas oil will depend on the desired temperature reduction (5-80° F.; preferably 5-40° F.) and the coke drum and coker gas oil temperatures. These quench media can be injected in two separate streams. The cooled coker gas oil would flow through the center of a modified, drill stem with concentric-pipes. The cooled hydrogen gas would flow in the outer annulus to provide heat dissipation and insulation to prevent excessive vaporization of coker gas oil in the modified drill stem. The heating of the hydrogen would also increase the probability of hydrogen free-radicals, but higher pressures would need to be accommodated in the design (e.g. spray nozzle). Preferably, two parallel, flat spray patterns would emanate from the modified drill stem in all directions (i.e. hydrogen gas on top & coker gas oil liquid on bottom). The media flows & pressure and the spray nozzles' number and design will determine the spray coverage and angles. The spray angle 60 to 135 degrees (preferably 90° to 120°) from the vertical, modified drill stem. A spray angle slightly downward (from perpendicular to the modified drill stem) is preferable to compensate for upward vapor flow effects as the media extends further (radially) from the modified drill stem. One skilled in the art can make the necessary engineering calculations and design modifications to address the particular needs of each application of the current invention.

(3) Other Embodiments

The current invention contemplates other embodiments using an exemplary injection method to achieve the goals previously stated. This hydrogen free-radical quench can be less desirable, in some cases, due to excessive hydrogen requirements, that overload the fractionator and/or compressor systems. In some cases, the temperature quench can be the desired embodiment to achieve both (1) reductions in vapor overcracking and (2) condensation of heavy aromatics that would be preferably left in the coke, as noted above. These other embodiments include, but should not be limited to:

1. Hydrogen gas and liquid coker gas oil in a two-phase injection system (e.g. single-pipe stem)
2. Other combinations of thermal quench and chemical quench media (e.g. hydrogen/steam)
3. Thermal quench only: Liquid and/or gas quench media (e.g. coker gas oil and/or steam)
   Quantity of temperature quench media (e.g. gas oils, steam, and/or water) depends on the desired temperature drop required to form the desired porous, sponge coke.
4. Chemical quench only: Liquid or gas quench media (e.g. hydrogen and/or ammonia)
   Quantity of chemical quench media: 0.1 to 20 wt. % of coker feed; preferably 0.1 to 2.0%.

Furthermore, any one or combination of the above can be injected via injection methods other than the exemplary injection method. Conceivably, more than one modified drill stem can be active in the same coke drum and coking cycle. Modified drill stems (e.g. 2 to 8) can be implemented through a similar number of reinforced flanges in the top of the drum to achieve greater spray coverage of the drum's cross sectional area. This option may be preferable for some cokers, particularly for coke drums with an existing center-flange, vapor draw. One skilled in the art can use standard calculation and design procedures to develop the most practical design for each application of the current invention. The economic incentive for any of these options can be significantly reduced during periods of high fuel prices, particularly natural gas.

4. Further Optimization of Pet Coke's Fuel Properties and Combustion Characteristics Various options of the present invention can potentially simplify the core technology and provide additional process options. An exemplary mechanism of the core technology appears to be based on the following process steps:

1. Production of a modified petroleum coke with improved carbon adsorption characteristics
2. Use of the petroleum coke's carbon adsorption characteristics in and/or after the coker process to provide various process options that can optimize its fuel properties and combustion characteristics Though this two-step process is believed to describe the technical basis for the exemplary core technology, it should be recognized that the current invention is not limited to this. As discussed previously, the core technology may depend significantly on coker feedstocks and design parameters. As such, the core technology may deviate from this simplified approach.

A. Production of Petroleum Coke with Activated Carbon Characteristics

As previously discussed, various coker process variables affect petroleum coke crystalline structure. In addition, various means have been described to modify the coker process variables to improve the coke crystalline structure and increase VCM content. An exemplary embodiment provides process options to increase the production of sponge coke (vs. shot coke or shot coke/sponge coke mix). The sponge coke of the present invention tends to have higher porosity than traditional sponge coke. The higher porosity of the sponge coke crystalline structure of the present invention preferably provides one or more of the following additional benefits:

1. Within limits, greatly improves cutting from drum & pulverization (i.e. HGI>100).
2. Enhances adsorption quality of this form of activated carbon (i.e. modified petroleum coke).
3. Promotes chemical reactions with petroleum coke due to increased accessibility via porosity.

Consequently, the present invention provides additional options to produce a very high-porosity sponge coke that offers desirable adsorption characteristics, when properly activated. That is, the following process options can provide a petroleum coke crystalline structure with carbon adsorption characteristics, including high internal and external, high surface area, and large pore volume:

1. Modify coker process variables to consistently produce high-porosity, sponge coke; and/or
2. Inject certain chemical compounds to increase and/or control coke porosity characteristics.

Depending on the application, a higher degree of petroleum coke porosity may be the primary goal (versus VCM content). As a result, the same process variables may be modified to greatly improve or maximize internal porosity of the modified sponge coke, within certain technical limitations. For example, the coke drum temperature is still the primary process variable to affect the desired coke crystalline structure. If maximum internal porosity is desired, an exemplary embodiment may include the lowest drum temperature that consistently produces a solid petroleum coke with the highest porosity. That is, the drum temperature would remain sufficient to prevent unacceptable formation of sticky, pitch-like material and/or excessive VCM content (i.e., not technically or economically prohibitive). The addition of aromatic oils (e.g., FCCU slurry oils) may be desirable to further reduce this drum temperature and increase petroleum coke porosity.

Other chemical compounds can also be injected to increase and/or control petroleum coke porosity characteristics. Certain chemical compounds crack at coking temperatures and provide gaseous components that increase coke internal porosity. The probable mechanism(s) of this increased porosity may be (1) passage of gases under pressure rising through the solidifying petroleum coke and/or (2) altered coke crystal growth. Exemplary gaseous components not only produce increased porosity, but also allow significant control of pore sizes (i.e., micropores and mesopores) and volume in the resultant pet coke. Hydrogen, light hydrocarbons (butanes and lighter), and light, inert oxygen derivatives (CO2, H2O, etc.) may provide more desirable porosity characteristics, but other gases can be used, as well. Exemplary chemical compounds for injection include, but are not limited to, recycled plastics, hydrogen, wood wastes, low-rank coals, and steam. Solids may require fine pulverization (e.g. <100 mesh) prior to injection into the coker. Though several injection points are feasible, an exemplary point of injection is the recycle streams downstream of the fractionator. The quantity of injected compounds can be severely limited by coker pressure drop, fractionator design, and contaminant limitations in the traditional coker operation. However, the modified coker operation of the current invention typically debottlenecks existing operations, creating excess coker capacity to be used in this manner.

An exemplary embodiment for this first process step can include one or more of the following:

1. Minimum coke drum temperature that consistently produces solid pet coke w/o pitch-like material
2. Injection of recycled plastics, wood wastes, and/or hydrogen that optimize porosity characteristics As noted previously, desired process conditions may vary with (1) coker feedstocks, (2) coker design and operational constraints, and (3) product constraints. However, this minimum coke drum temperature may be lower in most cases, but may still be 750° F. to 850° F. Also, minor equipment modifications (e.g. new coke drum insulation) may be necessary to assure even temperature distributions across the coke drum. Ones skilled in the art of coking and adsorption media (particularly activated carbon) would be capable of determining the optimal design and operation for particular coker and combustion applications.

Other embodiments for this first process step include various other combinations of the coker process variables that (1) achieve the desired changes in coke crystalline structure and VCM content and (2) provide sufficient adsorption quality in the modified petroleum coke for optimizing fuel properties and combustion characteristics. Also, selecting and adding certain, low-cost cracking stocks (e.g. various industrial by-products and/or non-hazardous wastes) to the coker feed can be desirable to achieve higher VCM increases. Embodiments, other than the examples, may be desirable in some cases to optimize the technology relative to certain constraints (e.g. causing excessive VCM content and/or exceeding other coker design or operational parameters). For example, the other various embodiments of the present invention are still valid scenarios to create a premium petroleum coke with improved fuel properties and combustion characteristics.

The results of this first process step is the production of a modified petroleum coke with a high porosity sponge coke crystalline structure (vs. low porosity sponge coke or other crystalline forms). In addition, the lower severity coking operation will typically leave more VCM in the coke, from reduced cracking reactions. Depending on the coker feedstocks and design parameters, the modified petroleum coke can have modest to good adsorption qualities, and may increase VCM 3-10%. In some cases, the adsorption quality may be sufficient to justify uses in traditional activated carbon systems, with or without subsequent use as a fuel. In these cases, steam stripping the residual VCM content in the initial phases of the quench cycle can provide sufficient activation of the carbon adsorption surface. In the other cases, the modified petroleum coke provides a superior solid fuel that can be further optimized for most solid fuel combustion applications. In addition to the use of the premium petroleum coke of the present invention in utility boilers with pulverized coal (PC) burners, the premium petroleum coke provides benefits in other combustion applications, as well. Other combustion applications may include, but are not limited to (1) other solid fuel boilers (utilities, industries, IPPs, etc.) and (2) rotary kilns in the cement and hazardous waste industries.

This first process step provides benefits to the crude oil refinery similar to those discussed elsewhere in this application. The major benefits attributable to this first process step are:

1. Reduced Heater Severity: Lower Heater Outlet Temperatures (~50° F.-180° F. Lower)
   a. Reduced Fuel Consumption: MMBtu/Hr and Btu/Lb. Feed (~10-30+%)
   b. Greater Heater Capacity; Faster Drum Fill Rate: Reduce Hours Per Cycle (~2-6 Hours)
   c. Reduced Heater Spalling, Tube Failures, Unscheduled outages, & Equipment Maintenance
2. Reduced Fractionator Load: Higher Coke Production (Ton/MBbl Feed); ~5-10% Less Load
3. Increased Coker Capacity: 10-40+% Increase
   a. Reduced Cycle Times: 18-24 Hours Down to 12-16 Hours Per Cycle
      I. Coking Cycle: Faster Drum Fill Rates
      II. Quench: Eliminate "Big Steam" Strip and
      III. Coke Cutting Cycle: Reduce Cutting Time (HGI>100)
4. Improved Operation & Maintenance: Coker & Other Process Units: Less HGO; Better Quality
5. Increased Refinery Capacity: ~0-25% Due to Debottlenecking of Coker Capacity Limitations This first process step also provides benefits to the premium petroleum coke user. As noted earlier, this first process step dramatically changes the petroleum coke's crystalline structure. Traditional refinery coking methods produce a petroleum coke that has a dense, shot coke crystalline structure (e.g. consistency of marbles) or a shot coke/sponge coke blend with varying crystalline composition of densities averaging 50 to 60 lb/ft$^3$. On the other hand, the coker modifications of the present invention produce a less dense sponge coke with much greater porosity. This modified crystalline structure is much more conducive to efficient carbon burnout levels (e.g. >99%) without the need for long residence times in high temperature zones exceeding 1500° F. and/or restricted to refractory lined furnaces. In addition, the very porous, sponge-coke crystalline structure gives the petroleum coke of the present invention (1) adsorption characteristics for optimizing fuel properties and (2) desirable capabilities as activated carbon in adsorption applications.

Optimization of the technology of the present invention can be used to further control coke porosity for fuel and carbon adsorption applications. That is, the increased coker throughput capacity (discussed above) provides the ability to introduce chemical compounds with certain cracking and vaporization characteristics that tend to increase the amount of voids in the petroleum coke of the present invention. These chemical compounds may include, but are not limited to industrial by-products, non-hazardous wastes, or low cost products. Traditional coking processes normally cannot take advantage of this novel technique due to precious limits on coker feed throughput, relative to the refinery's crude throughput. In addition, these chemical compounds may not only increase porosity and improve carbon adsorption characteristics, but also potentially provide alternative sources of VCMs (versus loss of light ends from traditional coker feedstocks).

B. Uses of Activated Carbon Characteristics of Modified Petroleum Coke

The second major process step is the use of the modified petroleum coke's activated carbon characteristics to further optimize its fuel properties and combustion characteristics. Various process options have been discussed to optimize the fuel properties and combustion characteristics of the modified petroleum coke. The potential role of carbon adsorption characteristics (e.g., activated carbon) in these process options will now be discussed. Some of the fuel optimization process options may be external to the coker process (e.g. third-stage desalter). In contrast, other options may be initiated in the coking process (i.e. in-situ). In addition, several fuel optimization process options have been added.

The first major process step produces a modified petroleum coke with highly porous, sponge coke crystalline structure and carbon adsorption characteristics. This modified, premium petroleum coke provides physical and chemical properties to create the following process options in the coking process. These options can further optimize its fuel characteristics:

1. Modified Crystalline Structure: Very porous, sponge coke w/HGI>100; Adsorption quality
2. Addition of High Quality VCMs: 18-30 wt. %; Uniformly distributed with controlled quality
3. Ash Quality Improvement Options: Removal of troublesome metals; Mitigate ash fusion
4. Sulfur & Nitrogen Content Reduction Options: Various methods & degrees/incremental costs
5. Integration of SOx Sorbents: Scavenge coke sulfur; Uniformly distributed w/controlled quality
6. Integration of Oxygen Compounds: Options to reduce combustion air; Uniformly distributed
7. Optimal Use of Inherent Oxidation Catalysts: Maintain optimal levels & enhance metal catalysts
8. Optimal Use of Carbon Adsorption Character: Mercury & other air toxics; HCs & chlorine These reliably, controlled process options (available at various incremental costs) allow a user to optimize the fuel properties in a manner that maximizes benefits and/or minimizes equipment and operational modifications in the user's facilities. Hence, unlike most other fuels (e.g. coals), the petroleum coke of the present invention can be consistently produced with optimal fuel properties and combustion characteristics. The economic and technical limits of these fuel optimization process options (and their associated incremental costs) will depend on various factors, including (1) the crude oil refinery, (2) the relative size and design of its process units, (3) the crude blend, and (4) the coker feed blend. Discussions for each of these fuel optimization process options follow:

(1) Modified Crystalline Structure:

Most of the desired changes in coke crystalline structure can be achieved in the first major process step. However, the high internal porosity and pore volume of the modified petroleum coke allow chemical reactions on the internal surface of the coke to further change coke crystalline structure. For example, chemical binders may be added in to mitigate coke storage, handling, and pulverization issues, including friability, dust, and explosability. In most applications, these issues are not expected to be prohibitive. In addition, the timing and method of cutting this modified coke from the coke drum can physically alter the coke crystalline structure.

(2) Addition of High Quality VCMs:

An exemplary process of the present invention can provide the addition of volatile combustible materials (VCMs) in two distinct steps. The first step increases VCMs from the coker feed via operational changes (e.g. lower coke drum temperature) in the cracking/coking portion of the delayed coking process (i.e. the first major process step, described above). In the second step, VCMs are added to the coke during the quench cycle in a manner that uniformly distributes the VCMs throughout premium petroleum coke's porous crystalline structure. In both steps, various by-products and/or wastes can be selected and uniformly integrated (e.g. mixed in coker feed in step 1) to achieve the desired fuel properties at low costs. Alternatively, standard hydrocarbon products, such as No. 6 fuel oil, can also be used, but normally at a higher price. Collectively, the quantity, quality, and desired effects of how the volatile combustible materials are added to traditional coke can be controlled to reasonable specifications and consistency. In this manner, high quality VCMs can be added uniformly to the coke in sufficient quantity to dramatically improve flame initiation and carbon burnout.

In an exemplary embodiment, desirable VCMs (quality and quantity) can be added to the coke quench media, preferably water or other aqueous solutions. The carbon adsorption characteristics of the modified petroleum coke will provide sufficient adsorption of these VCMs (particularly non-polar VCMs) and uniformly distribute them within the coke's internal pores. The optimal timing, temperature, and rate for VCM/quench media addition will depend on the VCMs selected and the desired effect (e.g. VCM devolatilization in char burnout vs. combustion initiation). Other embodiments can include post coker treatment (e.g. rail cars) to allow additional time for other options to be completed in the coke drums during the regular coker cycle times. However, if the cycle time becomes a constraint in pursuing all of the desirable process options, coke drum additions may be preferable (e.g. add $3^{rd}$ coke drum in cycle). Coke drum additions can provide further petroleum coke treatment time before, after, or intermediate stages of quench to maintain desired temperatures for the specific treatment technology.

(3) Ash Quality Improvement Options:

Various process options can substantially improve combustion ash quality by reducing certain, troublesome metals in the petroleum coke. These metals can be reduced in various degrees by treatment of the refinery's crude oil blends, coker feeds, and/or the coke itself. The present invention options to remove these metals of concern in all of these treatment methods. First, treatment of the crude oil blends typically requires minor equipment and operational modifications to the existing crude oil desalting system(s). Secondly, partial or full treatment of the coker feeds can be achieved by various methods, including hydrotreating, hydrodesulfurization, demetallization, or third stage desalting. The desired option will depend on the characteristics of the refinery's crude blend, its various process units, and product slate. In many refineries, the addition of a third stage desalting unit (i.e. coker feed) can require (1) modest capital and operating costs and (2) a couple of years time to engineer and construct. All of the above pre-coker treatments also improve the operation and product quality for other refinery process units. Thus, the incremental costs attributed to the premium petroleum coke for these treatments may be minimal to modest.

In an exemplary process of the present invention, the modified pet coke can be treated to remove metals during (in-situ) or after the coking process (e.g. in rail cars). The high internal porosity of the modified petroleum coke and the pressurized flow of the quench media provides the opportunity to chemically treat and/or remove exposed metals of concern. Chemical products and/or by-products or wastes with chemically active components can be used to initiate and complete the desired reactions. The resulting compound (more polar & water soluble) can be washed and removed from the modified coke. For example, spent phenolic acid from the refinery's lube oil extraction unit may be added to the quench media for coke demetallization. This organic acid can react with undesirable metals exposed on the internal surface of the modified coke. Residual phenolic acid will add oxygen (discussed below). The optimal timing, temperature, and rate for reactants/quench media addition will depend on the metals reactive chemicals selected and the desired effects (e.g. metals removal vs. making chemically inert).

The combination of all these metals removal methods may not be required to achieve desired results. In fact, most applications may require only one or two treatment methods, at most. The various metal removal methods simply offer the flexibility of various options to optimize a given refinery and achieve the same goal at the lowest possible cost.

(4) Sulfur and Nitrogen Content Reduction Options:

Additional process changes can reduce the sulfur and nitrogen contents of the petroleum coke to various degrees with incremental increases in cost. As such, this modified petroleum coke can be obtained in regular or desulfurized grades.

The sulfur content can be reduced in various degrees by (1) changing the coker feed blend, (2) partial or full treatment of the coker feeds, and/or (3) treatment of the coke itself. Again, the technology of the present invention offers sulfur reduction options in the various treatment methods, particularly for treating the coke during or after the coking process. First, lower sulfur feeds in the coker feed blend can significantly reduce the sulfur content of the petroleum coke. Optimization of the technology (i.e. via increased coker throughput capacity discussed above) provides the ability to introduce industrial by-products, non-hazardous wastes, or low cost products with lower sulfur content. Traditional coking processes normally cannot take advantage of this novel technique due to precious limits on coker feed throughput, relative to refinery throughputs. Second, partial or full treatment of the coker feeds can be achieved by various methods, including hydrotreating and hydrodesulfurization. Finally, the treatment of the petroleum coke, during or after the coking process, can take many forms: solvent extraction, reaction with strong reducing agents, and/or hydrotreating.

In an exemplary process of the present invention, the modified petroleum coke can be treated to remove sulfur and/or nitrogen during (in-situ) or after the coking process (e.g. in rail cars). The high internal porosity of the modified petroleum coke and the pressurized flow of the quench media provides the opportunity to chemically treat and remove exposed sulfur and/or nitrogen. Chemical products and/or by-products or wastes with chemically active components can be used to initiate and complete the desired reactions. The resulting compound (more polar & water soluble) can be washed and removed from the modified coke. For in-situ desulfurization or denitrification in the coker process, the coke drums of a delayed coker may provide any one or any combination of the following desulfurization techniques: solvent extraction, reaction with strong reducing agents, hydrotreating, and/or biodesulfurization). For example, spent phenolic acid from the refinery's lube oil extraction unit can be used as a solvent in the coke quenching cycle to extract sulfur (and nitrogen) from the petroleum coke. This organic acid can react with sulfur (and nitrogen) exposed on the internal surface of the modified coke. Also, strong reducing agents, such as hydroxides of calcium, magnesium, sodium, and/or potassium, can be used in the coke quenching cycle to react with and remove sulfur from the coke. Hydrotreating is essentially the introduction of hydrogen at high temperatures to saturate the hydrocarbon compounds, replacing sulfur in complex chemical structures. This treatment can be used alone or in conjunction with other treatments to enhance their effectiveness. The use of hydrogen to increase the porosity of the modified coke (discussed above) provides intimate diffusion within the coke structure, normally the slow reaction step. The optimal timing, temperature, and rate for reactants/quench media addition will depend on the sulfur compounds/reactive chemicals selected and the desired techniques.

In all of these desulfurization methods, the non-thiophenic sulfur (i.e. ~20-30 wt. %) may be more easily removed. Thiophenic sulfur is not readily separated from its complex hydrocarbon compounds and generally requires higher temperatures (e.g. >600° F.) to break its relatively stable, chemical bonds. However, the cracking/coking portion of the coker process can be sufficient to convert complex, sulfur compounds to non-thiophenic forms. Consequently, a 20-30% reduction sulfur content can be readily achieved with relatively simple applications of these methods. Coke treatments during or after the coke quenching cycle provide greater sulfur removal potential. Any additional reductions of coke sulfur content can be much harder to achieve, with greater incremental costs (i.e. more money per ton of sulfur reduced).

(5) Integration of SOx Sorbents:

The technology of the present invention anticipates the need to achieve incremental reduction of sulfur oxides in the combustion and air pollution control systems. The ability to convert the existing particulate control device (PCD) into a sulfur oxides control is a major feature of the present invention. That is, the much lower ash content (>90 wt. % lower) of the petroleum coke of the present invention frees up available capacity in the existing PCD to collect sulfur oxides that are converted to dry particulates upstream of the PCD. Methods of injecting various dry sorbents (e.g. limestone, hydrated lime, sodium hydroxide, etc.) to the fuel and combustion products have been commercially proven. However, dry sorbents mixed in with the fuel typically are less effective due to sintering of its reactive crystalline structure in the high temperature zones of the furnace. Sorbents injected into the flue gas (at various points in the boiler or flue ducts) usually require high sorbent to sulfur molar ratios due to various factors. Three major factors, which prohibit the desired chemical reactions, are:

(1) Calcination process to convert injected dry sorbent to more reactive form (e.g. $CaCO_3$ to CaO)

(2) Bulk diffusion of gaseous sulfur oxides to the solid sorbent, and (3) Diffusion of sulfur oxides through sorbent pores and $CaSO_4$ layers (e.g. blocking pores).

An exemplary process of the present invention provides process options for uniformly adding SOx sorbents to the modified petroleum coke to alleviate these reaction constraints. Desirable SOx sorbents (quality and quantity) can be added to the coke quench media, preferably water or other aqueous solutions. The carbon adsorption characteristics of the modified petroleum coke will provide sufficient adsorption of these sorbents (particularly non-polar sorbents, such as Ca(OH)2) and uniformly distribute them within the coke's internal pores. The integration of the sorbent in the very porous petroleum coke of the present invention has several advantages. First, sintering of the reactive sorbent structure is dramatically reduced, since the calcination and crystallization of the reactive sorbent form does not occur until after the flame's high temperature zones. That is, the sorbent (integrated in the char) does not calcine until char burnout in the lower temperature zones of low NOx combustion modes. Secondly, the reaction limiting factors attributed to the sorbent calcination and crystallization steps are greatly reduced. These steps occur well ahead of the SOx reaction zone of optimal temperature. Thirdly, the sorbent is integrated in the very porous sponge crystalline structure of the coke, where most of the remaining sulfur is located. Consequently, the bulk diffusion reaction limits (Item 2, above) are substantially reduced due to relative close proximity of the high concentrations of SOx and high concentrations of reactive sorbents. Finally, the very fine pulverization of the highly-porous petroleum coke of the present invention (>90% through 200 mesh) can significantly reduce reaction limits caused by blockage and limited diffusion to reactive pore sites (Item 3, above). The very porous structure of finer particles creates greater reactive surface areas that are less restrictive. The optimal SOx sorbent concentration, timing, temperature, and injection rate for quench media addition will depend on the sorbents selected and the desired impacts.

Other embodiments can include use in combination with sulfur reduction options and post-coker treatments. The use of strong reducing agents, such as calcium hydroxide, for coke desulfurization will often leave residual reacted sulfur compounds (not washed away) and residual calcium sorbents. The residual calcium compounds will still be effective SOx sorbents: scavenging sulfur and converting to particulates for collection by the existing particulate control device. Post coker treatment (e.g. rail cars) can allow additional time for other options to be completed in the coke drums during the regular coker cycle times. However, if the cycle time becomes a constraint in pursuing all of the desirable process options, coke drum additions may be preferable (e.g. add 3$^{rd}$ coke drum in cycle).

(6) Options for Integration of Oxygen Compounds:

An exemplary process of the present invention provides process options for uniformly adding oxygen content to the modified petroleum coke to reduce combustion air requirements. Desirable oxygen-containing compounds (quality and quantity) can be selected and added to the coke quench media, preferably water or other aqueous solutions. The activated carbon characteristics of the modified petroleum coke can provide sufficient adsorption of these oxygen sources (particularly non-polar chemicals, such as phenols) and uniformly distribute them within the coke's internal pores. The type of oxygen sources can ultimately impact the fuel's combustion characteristics. Though practically all oxygen content of the fuel (except water) will be productive in reducing combustion air, some types of oxygen sources can be preferable to others. For example, oxygen compounds that are chemically bound in a heavier hydrocarbons can be more beneficial to burning the char and help reduce excess air levels as well as theoretical combustion air levels. That is, these compounds (unlike alcohols) will not readily volatilize at lower temperatures, and provide more effective oxidation of the char without higher excess air. Another example would be the injection of phenols for desulfurization (described above), and the residual, unreacted phenols providing added oxygen content.

(7) Optimal Use of Inherent Oxidation Catalysts:

The high metals content of petroleum coke is often believed to be a problem, particularly vanadium and nickel. Options to reduce the coke metals content can alleviate these concerns (discussed above). However, these metals can be advantageous as combustion catalysts in certain firing modes. Catalytic oxidation can be very effective in improving combustion in low temperature zones with low oxygen availability, conditions often associated with low NOx combustion. Also, Vanadium catalysts are often used in the presence of ammonia or other reagents to decompose or oxidize nitrous oxides to molecular nitrogen and oxygen. For example, low NOx combustion firing modes have dramatically increased the unburned carbon of many pulverized coal boilers. This not only substantially reduces boiler efficiency, but dramatically increases the carbon content of the ash, as well. Ash carbon contents >5% can turn ash reuse sales of about $15/Ton to ash disposal costs of about $20/Ton. In this situation, catalytic oxidation caused by the metals content of the petroleum coke of the present invention can be critical to economic viability. That is, leaving significant metals content in the petroleum coke of the present invention can be very helpful, particularly with a modest coke portion in coal/coke blend. In addition, the catalytic oxidation can improve NOx performance, while reducing the need for substoichiometric combustion with severely reducing (corrosive) atmospheres that increase tube failures.

A process of the present invention recognizes the potential benefits to (1) maintain optimal levels of certain metals (e.g. vanadium and nickel) and (2) enhance their oxidation catalyst characteristics. First, the optimal levels of the metals of concern can be determined for each combustion application. Once quantified, the demetallization processes, discussed above, can be adjusted to achieve the optimal levels (though possibly not independently). Secondly, the desirable oxidation catalyst characteristics can be further enhanced by chemical or physical treatment. That is, the high internal porosity of the modified petroleum coke and the pressurized flow of the quench media provides the opportunity to chemically and/or physically treat exposed oxidation catalysts. For example, chemical treatment may be used to activate the oxidation catalyst and make it more reactive.

(8) Optimal Use of Carbon Adsorption Characteristics:

As discussed previously, the first major process step produces a modified petroleum coke with carbon adsorption characteristics (i.e. high internal porosity and pore volume). Consequently, this modified petroleum coke can have the physical and chemical properties required for many carbon adsorption applications (e.g., activated carbon). The internal and external porosities can approach and exceed 60% and 35%, respectively. The pore size can range from 5-50 angstroms. Thus, the surface area of the petroleum coke of the present invention can approach and exceed 600 square meters per gram. These carbon adsorption characteristics compare favorably with those properties for activated carbon form other sources. As such, the modified petroleum coke can be useful in traditional activated carbon technologies, as well as carbon adsorption in combustion processes.

A process of the present invention can produce adsorption quality carbon, which can be used in traditional activated carbon technologies: water treatment, vapor recovery, adsorption of various hydrocarbons, metals and/or other toxics form gaseous or liquid streams. The adsorption properties of this modified petroleum coke can be enhanced by steam-stripping in the quench cycle in the carbon adsorption system or otherwise. After serving its useful life in carbon adsorption, this premium pet coke can be further used as fuel or activated carbon in combustion processes. In either case, treatment (e.g. one final regeneration step) may be necessary to sufficiently reduce or remove harmful contaminants (prior to combustion) to avoid undesirable air pollutants and/or ash constituents. Alternatively, this carbon adsorption coke can be further used as activated carbon in combustion processes.

Another process of the present invention produces modified petroleum coke with adsorbent characteristics (with or without steam activation) that can be effectively used for carbon adsorption in combustion processes. In a manner similar to steam activation, the combustion process itself can potentially activate the unburned coke char and promote carbon adsorption mechanisms in the flue gas. The relative quantity of this adsorption carbon from unburned premium petroleum coke can be adjusted by controlling the fuel blend, pulverization fineness, excess air, and/or other parameters of the combustion process. Alternatively, other activated carbon (e.g. see above paragraph) can be added to the fuel or the flue gas to provide higher concentration of activated carbon in the flue gas. In this manner, the unburned premium petroleum coke and/or used adsorption carbon from the present invention can adsorb mercury, dioxins, furans, other air toxics, and other undesirable pollutants from the flue gas, including carbon dioxide, SOx, and NOx. The presence of sulfur, available in the coke, can enhance the adsorption of mercury, a growing concern of power generation facilities. In this manner, the premium coke can achieve further reduction of environmental emissions from the combustion process.

5. Additional Methods to Increase Pet Coke Porosity & Adsorption Character

As noted previously, various methods can be used to modify the pet coke crystalline structure, preferably to a highly porous, sponge coke. This modified crystalline structure can improve the carbon adsorption characteristics of the petroleum coke. In these cases, various chemical agents can be uniformly added to the petroleum coke in its inner voids, based on carbon adsorption technology. In this manner, the modified crystalline structure of the petroleum coke can be used in various carbon adsorption applications and/or to further modify the coke's fuel properties, combustion characteristics, and/or other coke qualities. Additional methods (e.g. other embodiments) are described that improve the pet coke's internal porosity and carbon adsorption characteristics. The first two methods (i.e. coker operation/modified feed and plastics/rubber addition) provide further details of similar methods, described previously. The last three methods (i.e. coke hydroprocessing, coke extraction, and coke chemical activation) are additional embodiments that can achieve the intent and needs of the current invention.

It should also be noted that all of these methods could be used for purposes other than increasing pet coke porosity and enhancing adsorption characteristics. That is, these methods have additional benefits (e.g. wastes recycling) and can be used independent of their ability to increase coke porosity and improve pet coke adsorption characteristics. Thus, the present invention is not limited to their use to increase porosity, but also includes these methods for other purposes.

A. Carbon Adsorption Characteristics

Various porous materials demonstrate some degree of adsorption character. The internal pore structures of these solid materials (adsorbents) provide an internal surface where various chemical compounds (adsorbates) in a passing fluid can be held by Van der Waals and/or other molecular forces. In general, good adsorption character is defined by various measured parameters related to the internal pore structure of the adsorbent. These parameters provide relative comparisons that help screen potential adsorbents. However, the selection of the desired adsorbent depends on other factors associated with the adsorbate system characteristics. These selection processes usually involve case-by-case analyses.

The shapes and sizes of pores are an important factor in carbon adsorption technology. Pores are typically classified into three different size categories (as defined by IUPAC): micropores, mesopores, and macropores. Micropores have a diameter of <2 nm (nanometers). Mesopores have diameters between 2 and 50 nm. Macropores have diameters >50 nm. Micropores and mesopores primarily give porous carbon materials their adsorption capacities. These types of pores are often formed during the process of activation. Activation is basically further development of pores in low porous raw material by chemical reactions. Traditionally, 'physical' activation (i.e. oxidation with gases: steam, carbon dioxide, or air) and chemical activation (i.e. reaction with chemical agents prior to heat treatment) are two processes that give fundamentally different pore structures.

Various measured parameters of pore structure provide relative indications of adsorption performance. Three of the most common adsorption parameters are (1) internal porosity, (2) pore size distribution, and (3) internal surface area. Carbonaceous materials with very high porosity and large surface areas generally provide good adsorption qualities. Activated carbons are highly porous, carbonaceous materials that provide exceptional adsorption capabilities. One of the most widely used parameters to measure the effectiveness of pores in activated carbons is the total surface area or BET surface area. BET surface area uses a projection model and adsorption data to account for multi-layer adsorption effects. Most of the total surface area is found in the micropores. Typical data for an activated carbon are: >500 square meters per gram ($m^2/g$) in micropores, 10 to 100 $m^2/g$ in mesopores, and <10 $m^2/g$ in macropores.

These adsorption parameters are useful for general comparison of potential adsorption character among adsorbents and provide preliminary indication of relative adsorption performance. However, the desired adsorbent for a particular application depends on (1) the physical/chemical characteristics of the adsorbate, (2) the physical/chemical characteristics of the fluid system containing the adsorbate, and (3) concentration of the adsorbate in the fluid system. Consequently, the desired adsorbent is normally determined on a case-by-case basis. In many applications, only part of the total surface area is accessible for the molecules to be adsorbed. In these cases, molecules, which are to be adsorbed, are too large to fit into the micropores. For example, most liquid-phase applications require the adsorption of high molecular weight materials. Most of these larger compounds, by their size, are excluded from a large part of the micropore system. As such, a carbon with high number of mesopores is required, and a carbon with high total surface area of predominantly micropores provides no value. Ideally, the carbon should have a large number of pores, which are just slightly larger than the size of the molecules to be adsorbed. Smaller pores are inaccessible, and much larger pores provide relatively little surface area per unit volume. Consequently, the activated carbon industry characterizes their carbons by adsorption properties rather than pore structures.

In conclusion, carbon adsorption character is more of an art than science. Adsorption characteristics can vary considerably and are not absolute in terms of measured adsorption parameters. As such, it is difficult to specifically define adsorption character by specific ranges of analytical measurements of adsorption parameters. Instead, adsorption character is more appropriately dealt with on a case-by-case basis. That is, the best carbon adsorption character is highly dependent on the specific adsorbate(s) and conditions of a particular adsorption application. Therefore, the ranges of specifications for desired carbon adsorption character are provided as a guide for most situations. However, variance outside of these ranges can occur in some cases due to (1) coker feedstocks and operations, (2) characteristics of targeted adsorbate(s), (3) physical and chemical conditions of adsorption, and/or (4) other factors. Thus, the present invention is not limited to these specific ranges, but also includes variance from these ranges, wherein the spirit of the present invention and its advantages are maintained.

B. Improved Carbon Adsorption Character: Modified Operation and/or Feed

The porosity and adsorption characteristics of petroleum coke can vary substantially due to variations in the coker feedstocks, design, and operating conditions. As discussed previously, there are three basic types of pet coke crystalline structures from a delayed coking process: shot, sponge, and needle. These basic coke crystalline structures have substantially different porosity and adsorption characteristics. The porosity and adsorption character within these crystalline classifications and their associated transition zones can also vary considerably.

The shapes and sizes of the pores in the petroleum coke can play a major role in its carbon adsorption characteristics and capacities. Adsorption qualities of traditional activated carbons may not be necessary for pet coke fuel enhancements. However, pet coke with adsorption characteristics approaching this level can be desirable for fuel enhancements and/or other adsorption applications, if economically practical.

(1) Petroleum Coke Crystalline Growth:

Modifications of the pet coke crystalline structure have been previously discussed. The effects of coker design, feedstocks, and operating conditions were described relative to two coking mechanisms: asphaltic and thermal coking. The resulting three types of coke crystalline structure (shot, sponge, and needle) were also discussed. However, further discussion of the coker crystalline growth is appropriate to describe the pet coke's carbon adsorption characteristics. In these complex chemical structures, there is much debate about how and when the pet coke crystals form. It is not clear when the formation of the chemical bonds of petroleum coke ends and the formation of pet coke crystals begins. In general, both coking mechanisms and pet coke crystal growth occur sequentially in the coking and decoking cycles of the delayed coking process. The following theory of coke formation and crystalline growth is presented as a basis for understanding the methods described previously. However, the present invention should not be bound or limited by this theory of operability.

In the formation of shot coke, the asphaltic coking mechanism is predominant. In this case, the coker's cracking reactions cause conversions that shift the solvent properties of the oil mixture (e.g. the loss of aliphatic and napthenic chains), and disrupt the colloidal suspension of the asphaltenes and resins. As a result, the asphaltenes and resins are precipitated in a manner that forms a highly cross-linked structure of amorphous coke. This desolutation is primarily physical changes with limited alteration of chemical bonds (mostly cross-linking between asphaltenes, resins, and some aromatic compounds). The precipitated coke tends to form imperfect spherical balls, ranging in size from <0.25 inches to >10 inches. This amorphous coke crystalline structure is commonly called shot coke. At the higher temperatures of the coking cycle, the shot coke tends to remain in a two-phase, solid/liquid residue. The pressurized liquid/gas coker feed and the vapors from the cracking reactions flow upward through this coke mass. However, the shot coke structure is very dense, and does not allow the penetration or permeation by these gases. As such, these gases flow around the shot coke (e.g. channeling). Similarly, in the decoking cycle, the stripping steam and cooling media pass between the balls of shot coke. Consequently, shot coke maintains a very dense, amorphous coke structure with limited porosity, even after the cooling of the decoking cycle. Shot coke tends to have high impurities concentrations and high C/H ratios. Typically, this amorphous coke is undesirable for anode manufacture and coker operations (e.g. blockage of drainage in decoking cycle & safety).

In the formation of needle coke, the thermal coking mechanism is very predominant, with little to no asphaltic coking mechanism occurring. In this case, coke is typically made from highly aromatic coker feedstocks (e.g. thermal tars or decanted oils). As such, the concentration of asphaltenes and resins in the coker feed is very low. The thermal coking mechanisms cause the condensation and polymerization of the heavy hydrocarbons (mostly aromatics). Without the asphaltenes, resins, and their associated impurities, this needle coke crystalline structure is uniform, tightly packed, and rigid. In the coking cycle, the needle coke crystalline structure is initiated, but tends to remain in a two-phase, solid/liquid residue due to the higher temperatures. The pressurized coker feed liquid and cracked gases flow upward through channels between crystalline matrices in the semi-solid coke mass. In the decoking cycle, the thermal coking mechanism continues to a limited extent. The stripping steam and cooling media pass through matrix channels in the solidifying coke mass. By the end of the decoking cycle, the needle coke is normally cooled sufficiently to form a very crystalline solid that can be cut and extracted from the coke drums. Ultimately, the needle coke has numerous unidirectional pores that are very slender, elliptical, and largely interconnected. The thick coke walls surrounding the voids are fragile, and form needle-shaped pieces, when broken.

The formation of sponge coke can be described as an intermediate coke classification between shot and needle coke. The thermal coking mechanism is predominant, but the asphaltic coking mechanism occurs, as well. In this case, the ratio R (i.e. asphaltic coke to thermal coke) is sufficiently low, and the asphaltenes and resins mostly remain in solution. The thermal coking mechanism causes condensation and polymerization of the heavy hydrocarbons (e.g. aromatics), and some cross-linking to asphaltenes and resins. In this manner, the asphaltenes and resins are integrated in a complex coke crystalline structure, and apparently behave like impurities in the crystallization of a pure compound. That is, the polymerization and cross-linking of the heavy aromatics with the asphaltenes and resins tend to form a non-symmetric (i.e. less uniform) and flexible (less rigid) crystalline structure. In the coking cycle, the formation of sponge coke is initiated, though it still remains semi-solid at these higher temperatures. The pressurized coker feed liquid and gas vapors from the cracking reactions penetrate this crystalline structure as they flow upward through the coke mass, initiating the development of pores of various sizes. In the decoking cycle, the thermal coking mechanism continues to a limited extent. As the stripping steam passes through the semi-solid coke mass, more pores are created in the sponge coke. Additional pores are created in the sponge coke, as the cooling media (water and/or low pressure/temperature steam) pass through the solidifying coke mass. By the end of the decoking cycle, the sponge coke is normally cooled sufficiently to a solid form for cutting and extraction from the coke drums. Ultimately, the sponge coke has numerous pores that are random with limited interconnectedness. The coke walls vary in thickness. Even so, the sponge coke has significant porosity and carbon adsorption character, as evidenced by the removal of cracked liquids from the pet coke in the decoking cycle release via steam stripping. During calcination, lighter hydrocarbons have also been released at higher temperatures, even after steam stripping.

Transitions between these three types of coke crystalline structure are not clear-cut. That is, certain ranges of the ratio R (i.e. asphaltic coke to thermal coke) represent the transition zones between these crystalline structures. In these transitions zones, the overall pet coke qualities can be a hybrid (or intermediate) characteristics of the two basic cokes. For example, a pet coke in the transition zone between sponge coke and needle coke can take on properties of each or intermediate qualities. This transition coke can be a higher porosity, sponge coke with elliptical, unidirectional pores that are interconnected and highly permeable. This intermediate coke has crystals similar to honeycomb. On the other hand, localized phenomenon in these transition zones can override these general rules, and a combination of the two coke crystalline structures can form in the same coke drum. For example, a combination of shot coke and sponge coke can be produced. Likewise, a combination of sponge coke and needle coke can be produced.

As noted previously, these transition zones (or crossover points) between shot, sponge, and needle cokes are not well defined and are expected to vary with coker feedstocks. That is, the ratio R (asphaltic coke to thermal coke) is difficult to measure. For a given coker feed, ratio R can vary for different coker designs and operating conditions. Consequently, pilot plant data are usually desirable to determine the types of cokes and transitions zones derived from specific coker design, operating conditions, and coker feedstocks. This can be readily accomplished by one skilled in the art of delayed coking. Typical engineering methods can then be employed by one skilled in the art to achieve the methods described in the following sections.

The internal porosity of petroleum coke varies substantially. Shot coke, as its name implies, has the consistency of buck shot with very limited internal porosity (typically <10%). On the other hand, sponge coke, as its name implies, has the consistency of sponge or volcanic pumice with significantly greater internal porosity. The internal porosity of sponge coke can range from 15%-60+%, depending on coker feedstock characteristics, coker operating conditions, and coke VCM content. Traditional sponge coke with 8-12 wt. % VCM is on the lower end of this range. The modified coke of the current invention (13-25 wt. % VCM) usually has internal porosity on the upper end of this range. The internal porosity of froth coke from the coke/foam interface can be as high as 90%. In contrast, the internal porosity of activated carbons varies significantly between 30 and 85%, depending on the carbon source, carbonization process, and activation process. The internal porosity of petroleum coke normally achieves a maximum value when the asphaltic to thermal coking is sufficiently low to initiate the transition from sponge coke to needle coke. In this transition zone, honeycomb coke maintains a high internal porosity, but the distribution of pore size can favor larger pores and thus, undesirable for some adsorption applications. As the crystalline structure approaches needle coke, the internal porosity decreases to roughly 10-20%.

Distribution of pore sizes also varies considerably among the different types of pet coke crystalline structures. In shot coke, access to the very limited internal porosity is greatly inhibited by insufficient pores on the external surface, regardless of pore size distribution. The pore size distribution of traditional sponge coke tends to be predominantly macropores. However, the modified sponge coke of the current invention tends to have higher percentages of mesopores and micropores, particularly near the honeycomb coke transition zone. In contrast, the pore size distribution for commercial activated carbons varies considerably depending on carbon source, carbonization process, and activation process. For example, bituminous coals with steam activation typically have roughly equal distribution of micropores, mesopores, and macropores.

(2) Improvement of Pet Coke Carbon Adsorption Character:

Various methods to modify the coke crystalline structure have been presented that can promote greater carbon adsorption qualities. It has been further discovered that certain coker operations can produce certain types of coke crystalline structure that have more optimal pet coke adsorption characteristics. In addition, it has been discovered that the pore size and quantity can be controlled, to a limited degree, to improve the carbon adsorption characteristics of the sponge coke crystalline structure.

a. Optimal Pet Coke Crystalline Structure: Various coker process modifications can be used to produce pet coke crystalline structures that have more optimal carbon adsorption characteristics. The theory relating coke crystalline structure to the coking mechanism ratio R (asphaltic coke/thermal coke) can be useful to demonstrate this principle. For a given coker feed, certain ranges of the coking mechanism ratio can be achieved that produce pet coke crystalline structure with desired porosity and better carbon adsorption characteristics. Theoretically, a specific coking mechanism ratio are can be maintained for a given feed, and produce the type of pet coke crystalline structure that maximizes carbon adsorption characteristics (e.g. maximum micropores). For many coker feeds, this specific coking mechanism ratio R would fall in the transition zones between sponge coke and needle coke (e.g. honeycomb coke). However, due to economic constraints, the coking mechanism ratio can be preferably controlled to produce a sponge coke that has sufficient adsorption characteristics, but less than this maximum. This optimal level of carbon adsorption characteristics (previously described as higher porosity, sponge coke) will depend on various factors including, but not limited to, (1) size of materials to be adsorbed, (2) pet coke use & value, and (3) loss & value of alternative coker products. In this manner, the coke mechanism ratio can be theoretically used to control the porosity of the sponge coke, and its inherent carbon adsorption characteristics.

In practical applications of this theory, the actual measurement and determination of the optimal coke mechanism ratio R (asphaltic coke/thermal coke) are not necessary. As noted previously, a specific recipe for all refineries is impractical due to the nature of the delayed coking process and the major differences in coker feedstocks and process requirements among various refineries. However, one skilled in the art of delayed coking can determine the coker conditions required to achieve the pet coke crystalline structure with the optimal carbon adsorption characteristics. Coker pilot plant studies can empirically determine the required coker conditions without undue experimentation. This is standard practice in the refining industry. The determination of the optimal pet coke crystalline structure will require measurement of the carbon adsorption characteristics relative to the materials to be adsorbed. Also, effects on coker product yields and their impact on refinery profitability (LP models) will need to be taken into account on a case-by-case basis. Initially, the baseline must be established for a specific refinery's current operations. Incremental deviations from this baseline can be established for applicable operating parameters. In most cases, the basic understanding of feedstock characteristics and coker operating conditions that affect the coking mechanism ratio (asphaltic coke/thermal coke) should provide the foundation to fine tune coker conditions. As noted previously, the thermal coking mechanism is primarily dependent on the coker operating conditions, but also dependent on the aromatics concentration of the coker feedstocks. On the other hand, the asphaltic coking mechanism is primarily dependent on coker feedstock quality, and limited dependence on coker operating conditions. In this regard, the impacts of certain coker operating conditions and coker feedstock modifications are discussed further.

Certain coker operating conditions primarily affect the thermal coking mechanism, but have indirect effects on the asphaltic coking mechanism, as well. Modifications to coker operating conditions were previously discussed that modified the coke crystalline structure. Most of these coker modifications essentially favored the thermal coking mechanism, and decreased the coking mechanism ratio R (asphaltic coking/thermal coking). According to the theory of coking mechanism ratio, the previously prescribed modifications achieved a coking mechanism ratio that was primarily sponge coke, and preferably higher porosity, sponge coke (consistent with the theory's transition zone between sponge coke and needle coke). The concept of an optimal coking mechanism ratio is also consistent with achieving sufficient carbon adsorption to modify fuel properties, while maintaining favorable coker economics. The coker operating conditions of primary concern are (1) heater outlet temperature, (2) coke drum pressure, and (3) recycle rate. The direct and indirect effects of these coker operating conditions were described previously. The reductions in the heater outlet temperature reduced both endothermic coking and cracking reactions. However, its associated reduction in cracking reactions and drum temperature tend to increase the aromatic content in the drum. That is, the cracking of heavy aromatics is normally reduced first by lower temperatures. In most cases, low to moderate changes in heater outlet temperature has the overall effect of increasing thermal coking mechanism. In contrast, higher coke drum pressure and recycle rates tend to increase the thermal coking mechanism simply by increasing the aromatics concentration in the coke drum. These coker operation variables also indirectly affect the asphaltic coking mechanism to the extent that (1) they decrease aromatics content in the coke drum and/or (2) they increase the cracking reactions that destabilize the solvent properties of the oil mixtures. The effects of these operating variables are discussed previously in greater detail. In addition, the coking cycle quench of the vapor cracking reactions (the new independent coker operating variable also discussed earlier in the first section) can also affect the thermal coking mechanism by keeping more aromatics in the coke drum. In conclusion, the previously prescribed modifications to the coker operating conditions can be used to achieve the optimal coking mechanism ratio for given coker feedstock in a specific refinery. In this manner, the optimal coke crystalline structure for sufficient carbon adsorption characteristics can be maintained for desired use(s) and process options of the current invention.

Modifications to the coker feedstock can also be used to promote the desired carbon adsorption characteristics in the pet coke. The addition of oils (0.1-99 wt. %; preferably 10 to 50 wt. %) with high concentrations of aromatics (30-100 wt. %; preferably >50 wt. %) and low levels of asphaltenes & resins (0.1-15 wt. %; preferably <5 wt. %) can significantly decrease the coking mechanism ratio, and promote a higher porosity, sponge coke. For example, aromatic crudes, thermal tars, and coal tars can be added to the coker feedstock. This would enhance the thermal coking mechanism and decrease the coking mechanism ratio. In turn, this would likely increase the porosity of the pet coke and enhance its carbon adsorption characteristics. Likewise, FCCU slurry oils/decanted oils could be used in a similar manner. However, the amount of these highly aromatic FCCU oils recycled to the coker can be controlled by coker operations via reducing heavy aromatics in the coker gas oils. In this manner, the FCCU slurry oils/decanted oils can be productively used to upgrade all of the pet coke to higher quality and value. In contrast, small cokers, dedicated to the production of needle coke, have upgraded just these highly aromatic feedstocks alone.

In conclusion, the optimal crystalline structure of the base pet coke can very considerably and depends on many factors, which include but should not be limited to the following:

1. Coker design, operation, & feedstocks: Varies form refinery to refinery
2. Pet coke end-use: Fuel and/or carbon adsorption applications; Varies with application
3. Additional Coke Treatment: Additional pore development and pet coke additives As such, the adsorption characteristics of the optimal pet coke crystalline structure can vary greatly. The internal porosity of the optimal coke crystalline structure is expected to be in the range of 30 to 85 wt. %, preferably 50 to 65 wt. %. The pore size distribution of the optimal pet coke crystalline structure may be roughly equal distribution of macropores, mesopores, and micropores. In many applications, a higher distribution of micropores and mesopores is preferable (e.g. 50% micropores, 30% mesopores, and 20% macropores). However, greater distribution of macropores (e.g. 70% macropores, 20% micropores, and 10% mesopores) can be acceptable for carbon adsorption of some chemical agents for fuel enhancements. The internal surface area of the optimal pet coke crystalline structures can vary considerably. However, the optimal pet coke crystalline structure is expected to provide surface area of 100 to 1000 square meters per gram; preferably 600 to 1000 square meters per gram. In general, an exemplary pet coke crystalline structure has greater volumes of mesopores and micropores than traditional sponge coke. In many applications, the anisotropic microstructure of the honeycomb coke can be preferable due to its pore interconnectedness and lower pressure drop capability. In other applications, the isotropic microstructure of highly, porous sponge coke (immediately prior to the honeycomb coke transition zone) can be preferable due to less graphitizable nature and higher volumes of micropores. In still other applications, a hybrid microstructure of these two in the transition zone can be preferable for optimal qualities of both. In still other applications, a porous coke structure with thick walls and small pores (sometimes called dense sponge vs. porous sponge) can be preferable due to its higher density and distribution of micropores.

An optimal coke crystalline structure may not only increase porosity and carbon adsorption character, but can also increase its susceptibility for further development of pore structure (e.g. activation). With the exception of needle coke, the lowering of the coking mechanism ratio R (via changes in process conditions and/or coker feed changes) usually modifies the coke crystalline structure in a manner that increases crystal imperfections and/or changes thermoplastic character of the coke. In fuel-grade, sponge coke, high sulfur and high metals content already act as impurities in the crystalline structure, creating an isotropic structure with numerous pores due to its imperfect crystals. The addition of more VCMs (i.e. higher hydrogen content and/or lower carbon to hydrogen ratio) in the current invention further increases the degrees of crystal imperfections and associated porosity. These properties already make it less desirable as a graphitizable carbon, and hence its fuel-grade classification. These imperfections in the crystalline structure present more reactive sites for activation. For example, the additional VCMs and their associated hydrogen make the pet coke less graphitizable and more susceptible to hydrogenation reactions (i.e. reversible dehydrogenation reactions). In addition, the cross-linking of the VCMs into the crystalline structure can also significantly change the pet coke's thermoplastic character toward thermosetting character. In this manner, the pet coke behaves more like a char that doesn't go through a plastic stage with associated realignment of crystallites and loss of porosity at high temperatures. Similarly, the anode-grade, sponge coke can be altered via cross-linking of VCMs into the coke crystalline structure. However, the crystalline imperfections and the reduction of thermoplastic character are not as pronounced due to the lower sulfur and metals contents. With either high-porosity, sponge coke, these modified characteristics make the modified coke of the current invention more susceptible to further development of pore structure via activation by traditional and non-traditional methods.

b. Physical/Chemical Influences on Pore Development. If the pet coke crystalline structure is sponge coke or sufficiently close to sponge coke (i.e. vs. shot coke), certain chemical compounds can be added to the coker process and increase the pet coke porosity. These chemical agents EITHER are low molecular weight (MW) gases OR release low MW gases/vapors at the coke drum operating conditions (e.g. cracking reactions). The low MW gases/vapors would include, but should not be limited to, $H_2$, $H_2O$, $NH_3$, $CH_4$, NO, CO, $C_2H_6$, $CO_2$, $NO_2$, $C_3H_8$. These low MW gases/vapors can physically and/or chemically influence the development of pores in the solidifying coke mass during crystal growth. That is, the low MW gases/vapors passing upward through the solidifying coke mass affect the number, shapes, and sizes of the pores in the pet coke. Overall, these additional low MW gases tend to increase the quantity of micropores. Similarly, additional higher molecular weight, hydrocarbon vapors can generally increase the degree of mesopores, as well. In addition, the injected chemical compounds can physically or chemically alter crystal growth. The increased microporosity and total surface area improves the adsorption qualities of the pet coke, particularly for many gaseous adsorption applications. The increased mesoporosity improves the adsorption qualities of the pet coke, particularly for many liquid media adsorption applications. Furthermore, these injected chemical compounds can influence the chemical nature of the carbon surfaces, which effect its adsorption and chemisorption character. For example, oxygen, nitrogen, and halogen compounds can significantly alter the adsorption carbon character via the formation of surface groups and/or complexes. Thus, the addition of these chemical compounds can substantially modify and increase the carbon adsorption characteristics of the petroleum coke.

Various methods to introduce such chemical compounds were described earlier. The primary purposes of adding these materials to the coker feedstocks are to (1) enhance carbon adsorption characteristics of the petroleum coke, (2) enhance coker product yields, and/or (3) provide recycling of these waste materials without the need to sort by waste type, particularly plastics. The following methods are described with greater specificity regarding (1) injection methods, (2) control of pore number, sizes, & shapes, and (3) impacts on the coking/cracking reactions.

b1. Addition of Oxygen-Containing, Carbonaceous Compounds: Promote Sponge Coke (vs. Shot): The addition of oxygen-containing carbonaceous compounds (i.e. 5-60 wt. % oxygen) to the coker was discussed previously. This unique application to the delayed coker (1) produces high porosity, sponge coke (vs. shot coke), (2) enhances pet coke adsorption characteristics to improve fuel properties & combustion characteristics, and (3) modifies pet coke for fuel use. The key aspect of this method was the production of low molecular weight gases that contained oxygen (e.g. $H_2O$, CO, $CO_2$, $CH_4OH$) from the cracking of the added compounds under the coke drum operating conditions. These oxygen-containing, carbonaceous compounds would include, but should not be limited to, coals, coal wastes, wood, wood wastes, paper, and cardboard. In general, these chemical agents are pulverized to less than 50 mesh and added (e.g. pressurized feed slurry) to the coker feed, preferably the recycle stream before the fractionator, and/or most preferably in the combined stream after the fractionator. The quantity of chemical agents to achieve the desired effects can range from 0.1-20 wt. %; preferably 5-10 wt. %.

b2. Injection of Other Chemical Agents: Cracking Release of Low MW Gases: The current invention also described methods to add other chemical compounds (including carbonaceous materials without oxygen) to the delayed coking process that would achieve similar effects. These chemical compounds were either low-molecular weight gases or chemical compounds that released low MW gases/vapors into the coke mass. The low-molecular weight gases can be added to the bottom of the coke drum during the coking cycle (if inert in the cracking process) or at the start of the decoking cycle. The primary examples of these compounds are hydrogen gas (in the decoking cycle) and various plastics. In a similar manner, rubber compounds (e.g. scrap rubber) can be added to accomplish these objectives, as well. In general, these chemical agents are pulverized to less than 50 mesh and added (e.g. pressurized feed slurry) to the coker feed, preferably the recycle stream before the fractionator, and/or most preferably in the combined stream after the fractionator. The quantity of chemical agents to achieve the desired effects can range from 0.1-20 wt. %; preferably 5-10 wt. %. Though an alternative injection of plastics was described earlier, another exemplary embodiment for plastics/rubber injection is presented below.

b3. Direct Injection of Hydrogen or Fuel Gas into the Coke Mass after the Coking Cycle: Direct injection of hydrogen or refinery fuel gas into the coke mass after the coking cycle can greatly enhance the pet coke's carbon adsorption characteristics. Though hydrogen may be preferred due to its effectiveness, refinery fuel gas (e.g. coker off-gas), particularly with high hydrogen content, can achieve the desired results with less impact on the fractionator load limits (i.e. lb-mol/hr.) Hydrogen gas or fuel gas injection into the coke mass during the coking cycle can prematurely quench the cracking and coking reactions in the coke drum and defeat the purpose of the delayed coking process. However, injection of pressurized hydrogen gas or fuel gas into the solidifying coke mass after the coking cycle can greatly increase the quantity of mesopores and preferably micropores in the sponge coke. In addition, hydrogenation of various reactive hydrocarbons in the modified coke can occur to a limited degree. This hydrogenation step can produce additional cracked liquids and increase porosity. In general, hydrogen (of various purities) can be injected (e.g. with steam) into the bottom of the drum after the feed has been transferred to the other coke drum. The quantity of chemical agents to achieve the desired effects can range from 0.1-20 wt. %; preferably 1-5 wt. %.

C. Plastics/Rubber Addition to Coker: Exemplary Embodiment

Previously, methods were described to add plastics, paper, cardboard, wood wastes, and/or various other carbonaceous materials to the delayed coking process. The primary purposes of adding these materials to the coker feedstocks are to (1) enhance coker product yields, (2) enhance carbon adsorption characteristics of the petroleum coke, and/or (3) provide recycling of these waste materials without the need to sort by waste type, particularly plastics and rubber compounds. An exemplary embodiment for the injection of plastics/rubber has been further discovered, and discussed below. In addition, rubber products that have similar characteristics (i.e. desirable for the current invention) can also be recycled as coker feedstock (with or without other plastics). The addition of certain quantities of other carbonaceous materials (separately or in combination) in a similar manner can also be advantageous.

(1) Unique Use of Extruder/Injection Technologies:

An exemplary embodiment for the injection of plastics and/or rubber compounds into the delayed coking process includes a unique use of extruder and/or injection molding technologies. The primary purposes of this unique application of extruder technology are to (1) pulverize mixed plastics/rubber to a uniform size distribution, (2) gradually melt the plastics/rubber to prevent coking or excess vaporization, and (3) inject the melted plastic at high pressures and optimal temperatures to minimize vaporization and provide the motive force to properly inject the plastics/rubber into the coker feedstocks.

First, an appropriate pulverizer must be selected to pulverize various plastics/rubber of various shapes and sizes to pellet size or smaller (2 to 100 mesh; preferably 50 to 100 mesh), depending on extruder feed specification requirements. A conventional or commercially available vortex shredder and/or soft solids pulverizer with size classifiers can provide adequate pulverization. However, the chosen pulverization system must address concerns of high temperatures and potential plugging. One skilled in the art of solids handling and pulverization can select (or design) the pulverization system(s) to achieve these objectives.

Next, the proper extruder/injection system must be selected (and modified) or engineered to (1) gradually heat & melt the plastics/rubber, (2) pressurize the molten plastics/rubber, and (3) inject into the delayed coker, similar to rubber extrusion. Multiple extruders may be necessary to achieve the flow rate required for a given coker application. Gradually heating the plastics/rubber at controlled temperatures in a pressurized system is critical to prevent coking and limit vaporization. Preferably, the controlled temperature increases should not exceed 10 degrees Centigrade per minute. The maximum temperature at injection should be significantly below (5-30° F.; preferably 10-20° F.) (1) the coking temperatures of the plastics/rubber of concern, and/or (2) vaporization temperatures of >80% of the plastics/rubber, preferably >90%. The pressure of the extruder will depend on various factors, including (but not limited to) flow rate considerations, vaporization characteristics of the plastics/rubber, and pressure requirements of the delayed coker injection point. The temperature of the plastics/rubber at the point of injection may be significantly less than the temperature of the coker feedstock. Consequently, the heater outlet temperature must be adjusted to achieve the desired drum temperature after the plastics/rubber are added. Depending on coker process requirements and the quantities and properties of the plastics/rubber, one skilled in the art can make the appropriate modifications for each application via engineering calculations and minor tests, if necessary. In general, the various plastics and/or rubber compounds are pulverized and added to the extruder injection system. The molten plastics/rubber compounds are injected into the coker feed, the recycle stream before the fractionator, and/or most preferably in the combined stream after the fractionator. The quantity of recycled plastics and/or rubber compounds to achieve the desired effects can range from 0.1-30 wt. %; preferably 5-15 wt. %. Conceivably, other pulverized carbonaceous materials could be added to the extruder/injection system (e.g. plastics/paper slurry). However, the quantity of these materials would limited by the extruder injector design.

D. Coke Hydroprocessing in Coke Drums

As previously discussed, various coker process modifications can alter pet coke crystalline structure, preferably sponge coke with higher porosity and improved carbon adsorption characteristics. Additional coker process modifications have been discovered to improve pet coke properties via low-severity, hydroprocessing of the petroleum coke.

(1) Prior Art

Hydroprocessing of Petroleum Products

Hydrogenation, one of the oldest catalytic processes, is the primary component of a group of various petroleum upgrading processes, generally called hydroprocessing. Hydrocracking is a type of hydroprocessing that combines hydrogenation with catalytic cracking. Hydrotreating is another class of hydroprocessing technologies that selectively treat and remove certain impurities via catalytic hydrogenation. Hydroprocessing technologies for residuals typically use catalytic hydrogenation to remove impurities (similar to hydrotreating) followed by the combination of catalytic hydrogenation and catalytic cracking (similar to hydrocracking).

a. Prior Art; Hydrocracking of Gas Oils & Middle Distillates: The hydrocracking process was originally developed for upgrading petroleum feedstocks in the early 1930s. Hydrocracking combines catalytic cracking (e.g. scission of carbon-carbon single bonds) with catalytic hydrogenation (e.g. hydrogen addition to carbon-carbon double bonds). In this process, complementary reaction mechanisms occur; endothermic cracking provides olefins and aromatics for hydrogenation, while exothermic hydrogenation provides excess heat for cracking and temperature increases, if desirable.

Most hydrocracking catalysts normally consist of silica-alumina base impregnated with a rare earth metal (e.g. platinum, palladium, & nickel). The silica-alumina promotes cracking activity, while the rare earth promotes hydrogenation. Typically, the catalyst is selective with respect to less production of propane and lighter versus normal cracking processes. This catalyst selectivity reduces with age, producing more gas at the end of run, requiring higher temperatures to maintain conversion. The catalyst activity also decreases over time with the accumulation of coke and other deposits, requiring regeneration above certain threshold levels. The circulation of large quantities of hydrogen with the feedstock usually inhibits catalyst fouling. In addition, hydrocracking catalysts are susceptible to poisoning by metallic salts, oxygen, organic nitrogen and sulfur in the feedstocks. Consequently, the feedstocks are often hydrotreated either internally (i.e. guard reactor) or externally (see hydrotreating below) to remove sulfur, nitrogen, oxygen, and metals, while saturating feedstock olefins. Compositions of hydrocracking catalysts are normally tailored to the process, feeds, and desired products.

The hydrocracking process is typically a fixed-bed, regenerative process, with one or two stages of reactors. Each reactor normally has several beds of catalyst to allow injection of cold, recycled hydrogen for temperature control. Hydrogen-rich gas is usually mixed with the feed prior to the feed heater. The two-phase fluid from the heater outlet typically flows downward through the reactors. The hydrogen-rich gas in the reactor effluent is separated form the oil products and recycled with hydrogen makeup to be mixed with feed at the heater inlet. Operating conditions in the reactor(s) range from 500 to 800° F. and 1000 to 2000 psig. The temperature and pressure vary with the age & type of catalyst, the products desired, and the properties of the feedstocks. The primary operating variables are reactor temperature, reactor pressure, space velocity, and detrimental composition of the feed (i.e. contents of sulfur, oxygen, organic nitrogen, metals, & heavy polynuclear aromatics). The severity of the hydrocracking process is measured by the degree of conversion of the feed to lighter products. Typically, the net result of hydrocracking is 40 to 50 wt. % conversion of high boiling feedstocks to saturated cracked liquids with substantially lower boiling points (e.g. <400° F.). Hydrocracking also increases volumetric yields up to 125%.

b. Prior Art; Hydrotreating of Gas Oils & Middle Distillates: Hydrotreating refers to a class of hydroprocessing processes that catalytically stabilize petroleum products and/or remove objectionable components in products or feedstocks via catalytic hydrogenation. Stabilization usually involves converting unsaturated hydrocarbons (e.g. olefins and unstable, gum-forming diolefins) to paraffins. Objectionable components removed by hydrotreating include sulfur, nitrogen, oxygen, certain halides, trace metals, and aromatic compounds. Hydrotreating processes employed for removal of a specific component include hydrodesulfurization (HDS), hydrodenitrification (HDN), and hydrodemetallization (HDM). Hydrotreating processes are applied to a wide range of feedstocks, from naphtha to reduced crude. Unlike hydrocracking, the lower severity hydrotreating processes tend to inhibit cracking and to promote more selectivity.

Hydrotreating catalysts, particularly those for removal of a specific component, tend to be more sophisticated than hydrocracking catalysts. Cobalt and molybdenum oxides on alumina catalysts are generally used due to their high selectivity, resistance to poisons, and ease of regeneration. Cobalt-molybdenum catalysts are more selective to sulfur compounds. Nickel-molybdenum catalysts have higher hydrogenation activity. Thus, they are preferable for nitrogen removal and saturation of aromatic rings. Other types of hydrotreating catalysts include nickel oxide, nickel thiomolybdate, tungsten sulfides, nickel sulfides, and vanadium oxide. In many applications, the catalysts must be activated by converting the hydrogenation metals from the oxide to the sulfide form. Also, catalyst pore size is typically adjusted to improve and maintain catalyst activity throughout the run cycle between regenerations.

Similar to hydrocracking, the hydrotreating processes typically are a fixed-bed, regenerative process, but often have a single reactor stage. The oil feed is usually mixed with hydrogen-rich gas before being heated to the reactor inlet temperature: normally <800° F. to minimize cracking. As with hydrocracking, a hydrogen-rich gas is separated from the oil products and typically recycled with makeup hydrogen back to be mixed with feed at the heater inlet. Operating conditions in the reactor range from 600 to 800° F. and 100 to 3000 psig. The space velocity (LHSV) ranges from 1.5 to 8.0. The temperature, pressure, space velocity and hydrogen consumption vary with the age & type of catalyst, the desired feedstock improvements, and the properties of the feedstocks. Typically, hydrogen consumption is as follows:

- Sulfur Removal 70 scf/bbl of feed for each wt. % sulfur
- Nitrogen Removal 320 scf/bbl of feed for each wt. % nitrogen
- Oxygen Removal 180 scf/bbl of feed for each wt. % oxygen
- Aromatics/Olefins Reduction Stoichiometric amount based on relative types If operating conditions cause significant cracking, the hydrogen consumption increases rapidly. Actual hydrogen makeup requirements are 2 to 10 times the stoichiometric hydrogen required due to solubility loss in the oil products leaving the reactor and saturation of olefins produced by cracking. Hydrogen recycle is typically 2000 scf/bbl of feed to maintain sufficient hydrogen partial pressures. All reactions are exothermic. Depending on specific conditions, a temperature rise through the reactor of 5 to 20° F. usually occurs.

The primary operating variables of hydrotreating processes are reactor temperature, hydrogen partial pressure, and space velocity. Increasing temperature and hydrogen partial pressure increases desired component removal and hydrogen consumption. Increasing pressure also increases hydrogen saturation and reduces coke formation. Increasing space velocity reduces conversion, hydrogen consumption, and coke formation. The severity of the hydrotreating process is measured by the degree of conversion or removal of targeted feed components. Typically, the net result of many hydrotreating processes is the conversion of undesirable feed components to <10 wt. %. Furthermore, volumetric yields do not normally change to any significant degree, since the boiling points of the oil products are essentially the same as the feedstocks. That is, the boiling range of hydrotreated feedstocks does not change dramatically.

c. Prior Art; Hydroprocessing of Residuals: In the last 20 years, numerous hydroprocessing technologies have been developed to prepare residual feedstocks for cracking and coking units. Atmospheric distillation tower bottoms, often called atmospheric reduced crudes or ARCs, are the primary feedstocks. The primary purposes of these hydroprocessing technologies are to reduce the boiling range of the feedstocks and/or remove substantial amounts of impurities, including metals, sulfur, nitrogen, and high carbon-forming compounds. Many of these hydroprocessing technologies are capable of 25 to 65% feed conversion rates. Common industry terminology for classes of these hydroprocessing technologies also include hydroconversion, hydrorefining, and resid hydrodesulfurization (HDS). Trade names for specific processes include Residfining, ARDS, VRDS, H-Oil, and LC-fining.

In general, these hydroprocessing technologies have similar process flow schemes and employ various types of catalytic reactors: fixed-bed, ebullated bed, or expanded bed. The latter two refer to a catalyst bed fluidized by a combination of gases and/or liquids. Typically, a guard reactor is followed by a series of hydroprocessing reactors. The guard reactor normally reduces the metals content and the carbon-forming potential of the feed. The hydroprocessing reactors are operated to remove sulfur and nitrogen and crack the 1050° F.+ materials to lower boiling points. The reactors are designed for very low space velocities of 0.2 to 0.5 v/hr/v, limiting process flow rates. Operating conditions in the reactors vary, but are typically maintained with inlet temperatures between 800 and 850° F. and pressures in the range of 2000 to 3000 psig.

The catalysts in these hydroprocessing technologies can vary significantly among technologies and applications of the same technology. The guard reactor catalyst is typically a silica-alumina catalyst with large pore size (150-200 A°) and low loading of hydrogenation metals (e.g. cobalt and molybdenum). The catalysts for the other reactors are tailor-made for the feedstock and conversion level desired. These catalysts generally have a wide range of particle sizes, various catalytic metal loadings and types. Pore sizes usually range from 80 to 100 A°.

(2) Present Invention

Hydroprocessing of Petroleum Coke

In the context of the current invention, hydroprocessing of petroleum coke refers to any process that uses hydrogen and/or catalyst(s) at sufficient temperature and pressure to (1) reduce the quantity of coke via various types of hydrogenation and/or cracking of coke mass, (2) modify and/or improve coke crystalline structure & adsorption character, and/or (3) remove substantial amounts of impurities, including sulfur, nitrogen, metals, and high carbon-forming compounds. This hydroprocessing of the petroleum coke can be processes similar to hydrocracking, hydrotreating, and hydroprocessing of residuals in the prior art (described above).

Petroleum coke hydroprocessing can be done separately from the coking process, but preferably within the coking process. That is, hydrogen can be injected into coke drums at the beginning of decoking cycles to initiate hydroprocessing of the pet coke in the coke drums. In addition, the petroleum coke does not necessarily have to be the modified pet coke of the current invention. Though the modified pet coke can provide advantageous catalyst properties, other catalysts can be used instead or in addition. Preferably, this hydroprocessing can be done in the presence of inexpensive catalysts, if needed. A carrier fluid (liquid and/or gas) can also be used to improve reactivity and overall benefits. Primary purposes for coke hydroprocessing include:

1. Reduce overall process coke yield via cracking & hydrogenation of coke compounds,
2. Reduce sulfur, nitrogen, and/or metals (V, Ni, etc.) contents of petroleum coke,
3. Reduce coke yield & improve coke qualities via optimized coke formation,
4. Improve carbon adsorption character; approaching activated carbon, and/or
5. Provide additional hydrotreating/hydrocracking capacity for middle distillates.

High severity hydroprocessing of the prior art is not necessarily required to achieve these objectives due to (1) lower conversion requirements, (2) higher residence time, and (3) less liquid reactants. First, high conversion of the pet coke to cracked liquids is not necessary for successful pet coke hydroprocessing. Incremental improvements are normally sufficient to achieve desirable benefits in most refineries. That is, each ten-percent conversion in the coke hydroprocessing represents roughly 2.5 to 4.0% reductions in overall coke yield, depending on coker feed quality. Thus, <10-15 wt. % conversion (vs. 25-65+ wt. %) of coke mass to cracked liquids can be sufficient to justify coke hydroprocessing, particularly within the delayed coking process. However, greater conversions (e.g. 25-45%) can be more desirable to further reduce overall coke yield and produce pet coke with superior carbon adsorption with much higher value. On the other hand, too much conversion can be detrimental to the modified pet coke crystalline structure and suboptimal. Secondly, high reactivity (e.g. fast reaction rates or strong reaction kinetics) and high selectivity are not required for the pet coke hydroprocessing either. This is particularly true if a third coke drum is added to increase available coke cycle time and thus, hydroprocessing residence time. Thirdly, the system pressure requirements are typically less due to significantly less liquid character of the desired reactants. The mechanisms of hydrogen transfer with less liquid character can significantly reduce the required hydrogen partial pressure. Furthermore, the reduced liquid character of the reactants provides higher hydrogen partial pressure at the same system pressures. Consequently, coke hydroprocessing can normally be successful with lower quality catalysts and lower severity of operating conditions (e.g. much lower hydrogen partial pressure) versus hydroprocessing of the prior art (e.g. hydrotreating, hydrocracking, & hydroprocessing of residuals).

a. Reaction Vessels: The hydroprocessing of pet coke can be carried out in various types of reaction vessels. New or existing coke drums in traditional pairs of two can be sufficient reaction vessels for pet coke hydroprocessing. Alternatively, new reaction vessels separate form the delayed coking process can also be used. Preferably, new coke drums in series of three (vs. traditional pairs of 2) would provide additional advantages.

In some cases, existing or new coke drums in the current delayed coking process can be sufficient reaction vessels for pet coke hydroprocessing. The semi-continuous, delayed coking process normally has pairs of coke drums with 2 cycles (coking & decoking). These issues were briefly described in earlier sections. The coke mass in the coke drum at the end of the coking cycle is already at or above the desired temperature (500 to 850° F.; preferably 700 to 800° F.) for pet coke hydroprocessing. Hydrogen and catalyst can be added as needed, before, during, or after some initial coke cooling (if it is desirable). In addition, traditional coking cycles can be modified to provide sufficient time for some pet coke hydroprocessing. However, this option is often suboptimal due to current constraints in cycle times and equipment. Limited residence time for pet coke hydroprocessing can require faster reaction rates, limit pet coke hydroprocessing conversion, and reduce delayed coker throughputs. Faster reaction rates can require higher hydrogen partial (and process) pressures. The current coke drums are often pressure limited (e.g. 100 psig) due to current metallurgy, delayed coker thermal cycles, and typical design parameters (e.g. head seals). New coke drums can alleviate the pressure limitations, but have limited effect on time constraints.

In some cases, separate reaction vessels may be desirable to remove process pressure limitations and time constraints. These separate reaction vessels can be within or outside the current delayed coker process boundaries. In most applications, pet coke hydroprocessing reaction vessels, that are not integrated into the delayed coking process, are not usually practical due to excessive capital and operating costs. The design challenge and fuel costs are often prohibitive for cooling the coke, removing it from the coke drums, transferring to other reaction vessels, and reheating the pet coke. Consequently, this option is not advantageous in most cases.

In many applications of this technology, the addition of a 3rd coke drum with a third operating cycle may be the desired embodiment. The third coke drum in the series provides a third operating cycle in the delayed coker: coke treatment (or hydroprocessing) cycle. That is, pet coke hydroprocessing (and/or other treatment options described later) is integrated into the delayed coking process. This third coker cycle can allow substantially more residence time for the hydroprocessing reactions, potentially reducing the required operating severity for a desired hydroprocessing conversion. In addition, part of the cooling in the traditional decoking cycle can be integrated into the pet coke hydroprocessing cycle, reduce overall coker cycle time, and increase coker throughput capacity. For example, delayed coker cycles (coking, coke treatment, and decoking cycles) could be reduced to lowest practical cycle times: 12-14 hours each. New coke drums (with or without new materials technologies) and better mechanical seals can allow higher operating pressures even with thermal cycles, structural stresses, and consistent seal requirements. As discussed previously, new coke drums would also provide the opportunity to implement advanced design features, including (1) modified drill stem & top head seals for the addition of chemical and/or thermal quenching agents during the coking cycle to prevent vapors overcracking and (2) modified bottom head & skirting to remove coke in larger chunks for low-pressure drop applications of adsorption carbon (e.g. utility boilers).

Figure 8:
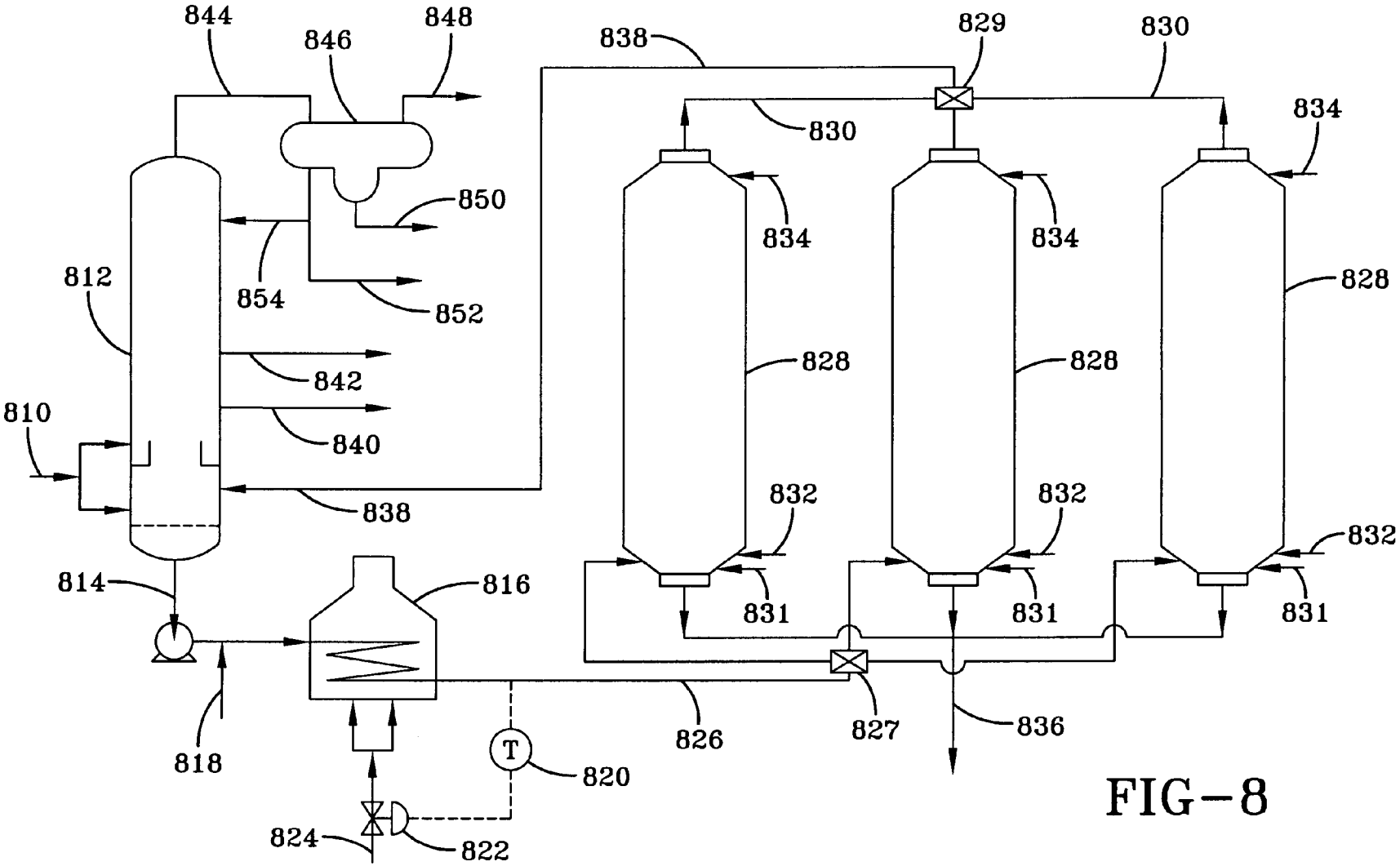
FIG. 8 shows an exemplary process flow diagram for a delayed coking system with three coke drums. This delayed coker has been modified to provide three process cycles: coking, coke treatment, and decoking cycles. The coke quench is completed during the last two cycles.

A basic process flow diagram for a delayed coker with three coke drums is shown in FIG. 8. The delayed coking process equipment for this embodiment of the present invention is similar to the prior art, with the addition of a third parallel coke drum. However, the operation, as discussed below, is substantially different. This embodiment of the current invention adds a third process cycle as well as a third parallel coke drum. The modified delayed coking is still a semi-continuous process, but has three parallel coke drums that alternate between coking, coke treatment, and decoking cycles. The coke quench is completed in the treatment and/or decoking cycles. That is, the coke quench can be partially completed at the end of the coke treatment cycle and finished at the beginning of the decoking cycle to minimize and/or optimize coker cycle times.

In the coking cycle, coker feedstock is heated and transferred to the coke drum until full. Hot residua feed 810 is introduced into the bottom of a coker fractionator 812, where it combines with condensed recycle. This mixture 814 is pumped through a coker heater 816, where the desired coking temperature (normally between 900° F. and 950° F.) is achieved, causing partial vaporization and mild cracking. Steam or boiler feedwater 818 is often injected into the heater tubes to prevent the coking of feed in the furnace. Typically, the heater outlet temperature is controlled by a temperature gauge 820 that sends a signal to a control valve 822 to regulate the amount of fuel 824 to the heater. A vapor-liquid mixture 826 exits the heater, and a 3-way control valve 827 diverts it to a coking drum 828. Sufficient residence time is provided in the coking drum to allow the thermal cracking and coking reactions to proceed. By design, the coking reactions are "delayed" until the heater charge reaches the coke drums. In this manner, the vapor-liquid mixture is thermally cracked in the drum to produce lighter hydrocarbons, which vaporize and exit the coke drum. A control valve mechanism 829 is used to direct the outflows of the respective coke drums and control system pressure (e.g. particularly during coke drum switching). The drum vapor line temperature 830 (i.e. temperature of the vapors leaving the coke drum) is the measured parameter used to represent the average drum temperature. Petroleum coke and some residuals (e.g. cracked hydrocarbons) remain in the coke drum. When the coking drum is sufficiently full of coke, the coking cycle ends. The heater outlet charge is then switched from the first coke drum to a parallel coke drum to initiate its coking cycle. Meanwhile, the treatment cycle begins in the first coke drum.

In the coke treatment cycle of the current invention, the petroleum coke undergoes one or more of the various treatment options (e.g. hydroprocessing, coke extraction, chemical activation, etc.). Coke quench can be initiated during the treatment cycle. Quench media (e.g. steam) can be used at the beginning of the treatment cycle to cool the coke drum to the optimal treatment temperature. Treatment agents (e.g. hydrogen & catalyst) can be injected into the drum at various injection locations 831, 832, and/or 834. After the coke treatment (e.g. coke hydroprocessing) is completed, additional quench can be achieved, if cycle time permits. As described below, quench media can be injected at various locations: 831, 832, and/or 834. After the treatment cycle is completed, the coke drum passes (e.g. sometimes directly) into the decoking cycle.

In the decoking cycle, the coke drum and its contents are further cooled, the coke is drilled from the drum, and the coking drum is prepared for the next coking cycle. Cooling the coke normally occurs in three distinct stages. In the first stage, the coke is cooled and stripped by steam or other stripping media 831 to economically maximize the removal of recoverable hydrocarbons entrained or otherwise remaining in the coke. This first stage is optional, its degree of use depending on the desired coke VCM content. In the second stage of cooling, water or other cooling media 832 is injected to reduce the drum temperature while avoiding thermal shock to the coke drum. Vaporized water from this cooling media further promotes the removal of additional vaporizable hydrocarbons. In the final cooling stage, the drum is quenched by water or other quenching media 834 to rapidly lower the drum temperatures to conditions favorable for safe coke removal. After the quenching is complete, the bottom and top heads of the drum are removed. The petroleum coke 836 is then cut, typically by hydraulic water jet, and removed from the drum. After coke removal, the drum-heads are replaced, the drum is preheated, and otherwise readied for the next coking cycle.

Lighter hydrocarbons 838 are vaporized, removed overhead from the coking drums (primarily in the coking cycle), and transferred to a coker fractionator 812, where they are separated and recovered. Coker heavy gas oil (HGO) 840 and coker light gas oil (LGO) 842 are drawn off the fractionator at the desired boiling temperature ranges: HGO: roughly 650-870° F.; LGO: roughly 400-650° F. The fractionator overhead stream, coker wet gas 844, goes to a separator 846, where it is separated into dry gas 848, water 850, and unstable naphtha 852. A reflux fraction 854 is often returned to the fractionator.

b. Theory of Operation: In general, hydroprocessing of petroleum coke combines hydrogenation and cracking reactions with or without catalytic activation. Overall, this hydroprocessing has complex reaction chemistry due to the complex nature of the chemical compounds and catalysts involved. That is, numerous complementary and competing chemical reactions take place in pet coke hydroprocessing. The primary reaction mechanisms in typical applications are described as part of a simplified theory of operation. However, this theory of operation may not accurately describe all applications, and should not limit the current invention. Hydrogenation and various cracking mechanisms (e.g. thermal, catalytic, & hydrogenolysis) are generally discussed, along with their interaction in this process. The impacts of key operational parameters (e.g. system temperature, catalyst activity, hydrogen partial pressure, and residence time) are also discussed.

At the end of the coking cycle in the delayed coking process, the petroleum coke is normally a semi-solid (or semi-liquid) coke mass. That is, much of the coke mass at temperatures of 800 to 900° F. and pressures >25 psig has solidified crystalline growth from thermal cracking in the absence of hydrogen. This pet coke crystalline growth is caused by various reactions: including dehydrogenation, condensation, oligomerization, aromatization, polymerization, and/or cross-linking of heavy compounds in the coking cycle. However, some materials remain a heavy, pitch-like liquid, until cooled further. These pitch-like materials are expected to be primarily asphaltenes with some resins and other heavy aromatics. These materials are usually solutized, but not yet chemically/physically attached to the coke crystalline structure. Higher coke crystalline contents (e.g. lower asphaltenes/resins to aromatics ratio) are more favorable for coke hydroprocessing due to greater adsorption and catalytic properties within its substantial levels of porous, solid coke at these conditions. At lower temperatures, a greater portion of coke mass can become solid crystals with more favorable adsorption and catalytic properties.

As noted previously, less graphitizable carbon structures are often more susceptible to hydrogenation reactions (i.e. reversible dehydrogenation reactions) than anode-grade, sponge coke. The degree of the non-graphitizable carbon character apparently depends on the degree of mesophase transition in the coking process. In turn, this degree of mesophase transition greatly depends on the chemical composition of the coker feedstocks and the coker operating conditions, particularly temperature profiles. The modified pet coke of the current invention (discussed previously) is the desired embodiment for this hydroprocessing treatment due to its less graphitizable character. However, a carbonaceous material with even less graphitizable character can be preferable under certain conditions. For example, a porous, carbonaceous material (e.g. semicoke) intermediate between mesophase pitch and a non-deformable green coke can be more susceptible to the hydrogenation reactions of this coke hydroprocessing. Conceivably, this embodiment would optimize coker feeds and operating conditions to obtain the carbonaceous material with the lowest carbon to hydrogen ratio (C/H), while maintaining a porous, crystalline structure (vs. pitch-like materials).

b1. Hydrogenation: The addition of hydrogen to this semi-solid, coke mass will normally initiate some degree of hydrogenation of olefinic, aromatic, and/or heterocyclic compounds in the coke mass. Hydrogenation is generally a class of reactions that breaks double bonds and saturates the reactant (e.g. multi-ring aromatics) with hydrogen. The hydrogenation reaction mechanism usually follows free-radical chain reactions, where free-radicals are highly reactive intermediates which have an unpaired electron. In hydrogenation, the free-radical is typically atomic hydrogen (vs. molecular hydrogen $H_2$). The porous pet coke in the semi-solid coke mass has a strong tendency to break molecular hydrogen into atomic hydrogen with an unpaired electron. That is, adsorption of hydrogen on the pet coke's internal surface catalytically promotes the breakdown of molecular hydrogen (bond energy: 103 kcal/mole) into hydrogen free-radicals. A similar reaction mechanism was discussed previously for the breakdown of molecular oxygen (bond energy: 117 kcal/mole) in the use of activated carbons or modified pet cokes as an oxidation catalyst. In this manner, hydrogen free-radicals are readily available and migrate on the surface of the pet coke, which is also the desired reactant in the hydrogenation. The degree of pet coke hydrogenation depends on various factors, including (1) coke mass composition, (2) catalyst activity, (3) temperature, (4) hydrogen partial pressure, and (5) residence time.

Residence time discussion: 0.5 to 12 hours vs. residence times usually <1.0 hour. Thus, reaction rate is not as critical as long as sufficient equilibrium driving force is present for reactions to occur. Excess hydrogen will tend to drive equilibrium in favor of hydrogenation.

The composition and reactivity of the semi-solid, coke mass can have substantial impact on the degree of pet coke hydrogenation. As noted above, the pet coke mass typically consists of polyaromatics, resins, and asphaltenes. As such, the primary focus of this discussion will be the hydrogenation of aromatic compounds. The resonance stabilization energy of most aromatic bonds renders them unbreakable at process temperatures <1100° F. until the aromatic character is destroyed by hydrogenation. Limited hydrogenation occurs in the delayed coking process due to lack of hydrogen and hydrogenation catalysts. As a result, these aromatic compounds are concentrated in the coke mass from dehydrogenation and coking reactions. In contrast, the hydroprocessing of pet coke promotes the hydrogenation and subsequent cracking of these polyaromatic compounds. The hydrogenation reaction is more thermodynamically favorable for compounds with greater number of rings and irregularity (e.g. less symmetry) in the aromatic clusters. That is, hydrogenation is favored in polyaromatics with lower average resonance energy per bond or weaker bonds. Thus, the asphaltenes and resins in the pitch-like materials are normally more likely to undergo hydrogenation than the polyaromatics in the crystallized coke due to weaker bonds, as evidenced by its more liquid character (e.g. lower melting point). If predominant hydrogenation of the asphaltenes and resins occurs with subsequent cracking, the lower asphaltenes/resins to aromatics ratio will create a more highly porous, sponge coke. Consequently, the coke mass catalyst activity will increase as the asphaltenes and resins are hydrogenated and cracked. Ultimately, the hydroprocessing of the pet coke will provide even better coke crystalline structure with greater adsorption character.

Since hydrogenation and dehydrogenation are reversible reactions, the excess concentrations of hydrogen and aromatic compounds in pet coke hydroprocessing tend to drive the reaction strongly in favor of hydrogenation.

Hydrogenation reactions are not too sensitive to temperature within the considered temperature ranges of pet coke hydroprocessing: 500-1000° F. (preferably 700-800° F.). Hydrogenation is an exothermic reaction, and equilibrium yields are favored by relatively low temperatures. However, reaction rates increase with temperature. Hydrogenation of polyaromatic compounds becomes a compromise between using low temperatures to achieve maximum reduction of aromatic content and high temperatures to provide high reaction rates and minimize catalyst charge per barrel of feed. Maximum aromatic reduction is normally achieved between 700° F. and 750° F. due to the interrelation of thermodynamic equilibrium and reaction rates. However, higher reaction rates and associated high temperatures are less important with ample residence time. Thus, lower temperatures can also provide desirable conversion levels with longer residence times. Furthermore, lower temperatures would solidify more of the coke mass, which can provide more favorable adsorption and catalytic characteristics. Thus, coke hydroprocessing objectives and the coke mass composition & physical condition play a significant role in determining the optimal temperature. In general, the optimum temperature, for a given pressure, is a function of the types of aromatic compounds in the coke mass, residence time, hydrogen concentration, and catalyst considerations (e.g. amount & cost).

Increasing the hydrogen partial pressure generally increases the degree of hydrogenation reactions. As discussed in the prior art, the reaction kinetics of hydrogenation reactions is more favorable with higher hydrogen partial pressure. In fact, hydrogen partial pressure is the most important parameter controlling traditional aromatic saturation. Traditional hydroprocessing (e.g. hydrocracking & hydrotreating) relies heavily on very high hydrogen partial pressures to create fast and effective transfer of hydrogen from the gas phase to the liquid phase of the reactants. That is, the high hydrogen partial pressure promotes hydrogen free-radicals in the liquid phase via various mechanisms, including hydrogen solubility, aromatic solvents and cycles of hydrogenation & dehydrogenation. In contrast, the hydroprocessing of pet coke behaves more like solid-gas phase reactions, more similar to adsorption processes. Molecular hydrogen is typically adsorbed by the porous coke in the coke mass and catalytically converted to hydrogen free-radicals. The carbon adsorption character (e.g. Van der Waal forces) of the pet coke mass allow the relatively unrestrained migration of hydrogen free-radicals. That is, hydrogen access to the polyaromatic compounds in the coke mass is less inhibited by excess liquid flow of feed in the prior art. In other words, the primary reactants (coke mass) in the hydroprocessing of pet coke are in a semi-solid state that does not fill the voids of the reaction vessel with a free flowing liquid. Hence, the hydrogen free-radical transfer mechanism of the pet coke hydroprocessing is substantially less dependent on the hydrogen partial pressure. Also, the hydrogen has a significantly higher molar concentration, since it is the primary fluid that causes the increased system pressure. Thus, the partial pressure of hydrogen required can be achieved at lower system pressures versus the prior art for hydroconversion processes. Furthermore, longer residence times in the current invention (discussed later) further reduce the need for fast hydrogen transfer mechanisms (vs. prior art), and require even less hydrogen partial pressure. Finally, the lower conversion requirements for acceptable operation also reduces the need for the high hydrogen partial pressures of the prior art. In many cases, the highest practical system pressure may be desired to increase hydrogen partial pressure, but not necessarily required to attain sufficient hydrogen transfer in pet coke hydroprocessing.

In many cases, the hydrogenation catalyst activity of the porous, sponge coke in the coke mass is sufficient to initiate hydrogenation of the asphaltenes, resins, and other polyaromatics in the coke mass. However, in some cases, other catalysts or additives with additional hydrogenation catalytic activity may be necessary to cause sufficient hydrogenation initially. The primary role of other catalysts or additives would be to enhance the formation and transfer of hydrogen free-radicals and inhibit dehydrogenation & coking reactions. Good hydrogenation catalysts tend to be acidic, and are susceptible to poisoning, particularly with nitrogen. A variety of transition metals (e.g. iron, nickel, cobalt, molybdenum, tin, & tungsten) provide favorable hydrogenation catalyst characteristics in this process environment. That is, these metals are reactive in the sulfide form, as well as the metallic state. Traditional hydrogenation catalysts (e.g. Co/Mo and Ni/Mo) can be technically feasible for pet coke hydroprocessing (e.g. can be impregnated on the coke), but would likely be too costly as a non-recoverable coke additive. More likely, iron compounds would be used as powdered or impregnated additives, due to their very low costs. For example, iron oxide will likely be converted in-situ to the sulfide form, and promote hydrogen transfer reactions. Iron sulfate is also an effective additive. In some cases, minor additions of iron sulfate may be desirable to initiate hydrogenation reactions, until sufficient sulfur is generated from the coke mass to react with predominate iron oxide additives. The injection of these catalyst/additives can be achieved by various means. For example, finely powdered additives can be added to the coke during the coking cycle or injected in to the coke with hydrogen or steam at the beginning of the pet coke hydroprocessing. In many cases, finely powdered additives can be preferably added via a cooling media, such as used lubricating oils or heavy gas oils, that vaporize (e.g. >700° F.) and distributes the additives in the coke mass in a fairly uniform manner.

Hydrogen circulation rates are typically 3-4 times the stoichiometric amount of hydrogen consumption. Hydrogen sulfide concentrations tend to inhibit hydrogenation of aromatic rings and ammonia tends to decrease hydrocracking conversion. Therefore, continual removal of ammonia and hydrogen sulfide via continual mass transfer away from coke mass reaction sites is preferable. For example, b2. Cracking Reactions: Various cracking reactions are complementary to the hydrogenation reactions. That is, the exothermic hydrogenation reactions (1) usually provide more than enough heat for the endothermic cracking reactions, and/or (2) produce intermediate compounds that are more readily cracked. In the latter, the resonance stabilization of many aromatic bonds renders them unbreakable at normal process temperatures (<1100° F.) until the aromatic character is destroyed by hydrogenation. That is, the hydrogenation reactions can lower the bond dissociation energies for easier cracking. On the other hand, the cracking reactions can (1) provide olefinic & aromatic intermediates for hydrogenation and/or (2) create access to heterocyclic compounds, deeply imbedded in the asphaltenes and resins of the coke mass. These heterocyclic compounds often contain undesirable impurities (e.g. S, N, & metals). The major types of cracking reactions in pet coke hydroprocessing include thermal cracking, catalytic cracking, and hydrogenolysis. As with hydrogenation, the cracking reactions are more likely for complex compounds with more aromatic rings, less symmetry, and some aliphatic character (e.g. bridges). Consequently, asphaltenes (solutized or otherwise) in the coke mass have a greater tendency (vs. aromatics and resins) to both hydrogenate and crack due to their higher molecular weights and composition.

As the exothermic hydrogenation reactions proceed, sufficient heat is generated to initiate additional thermal cracking. The net heat generated typically creates excess heat that raises the reactor temperature and accelerates the cracking reaction rates, until quenched or controlled (via cold hydrogen or other quench mechanisms). As explained in the prior art of delayed coking, the hierarchy of ease of thermal cracking is Paraffins>Linear Olefins>Napthenes>Cyclic Olefins>Aromatics. Again, resonance stabilization of many aromatic bonds renders them unbreakable at normal process temperatures (<1100° F.). Thus, the aromatic compounds still are not likely to be thermally cracked in the pet coke hydroprocessing (similar to delayed coking). However, thermal cracking can crack the cyclic olefins and napthenes, produced by hydrogenation of aromatic compounds, if temperatures are sufficient. Temperatures of 800-900+° F. would be required to thermally crack many of these compounds. As with delayed coking, process temperatures>800° F. can lead to dehydrogenation, coking, and vapor overcracking (i.e. light gases versus cracked liquids). Fortunately, the excess of hydrogen inhibits these undesirable reactions, even at higher thermal cracking temperatures. In addition, most of the coke-forming compounds have already become coke in the more severe delayed coking process. That is, additional coke formation in the pet coke hydroprocessing is not likely.

The addition of certain catalyst materials can lower the activation energies of the cracking reactions, reducing process temperature requirements and/or increasing cracking reactivity of more troublesome compounds. Heterogeneous catalysts bearing acid sites can accelerate the rate of cracking at a given temperature and/or improve the selectivity toward stable products. As with prior art hydrocracking, pet coke hydroprocessing combines hydrogenation and catalytic cracking via a bifunctional catalyst. However, unlike hydrocracking, the semi-solid, coke mass (i.e. porous coke crystals & pitch-like materials) acts as a cracking catalyst and has substantially less resistance to hydrogen diffusion and alignment of reactants (pitch-like materials) to the catalyst sites (porous coke crystals). Also, the hydrogen radical formation & transfer (e.g. migration) and reaction mechanism behaves more like gas-solid phase reactions in adsorption carbon. Consequently, catalytic cracking reactions can be normally achieved at lower hydrogen partial pressure (& system pressure) and/or lower temperatures. This is particularly true for applications where conversion requirements are lower and residence times are significantly higher. If greater catalyst activity is needed, additives can be impregnated on the base catalyst (i.e. porous coke crystals) via various mechanisms. In many cases, sufficient catalytic cracking can be achieved at temperatures of 500° F. to 950° F. (preferably 700° F. to 750° F.) and pressures of 15 to 2000 psig (preferably 15 to 100 psig). If more catalyst activity is needed for a given catalyst, increased temperatures and/or pressures can be effective. In any case, the catalyst formulation and operating conditions are normally optimized for each application, depending on coke mass composition and desired objectives. This approach is similar to hydrocracking of the prior art.

Another type of cracking reaction in pet coke hydroprocessing is hydrogenolysis; cleavage of bonds by hydrogen addition. In hydrogenolysis, radical hydrogen transfer reactions can provide an alternative mechanism for cracking strong bonds (e.g. C═C; thiophenic C—S), including degradation of aromatic groups. In the prior art, the transfer of free-radical hydrogen by an aromatic solvent can achieve this type of cracking. In addition, the migration of hydrogen radicals from the catalyst surfaces has also been noted to promote hydrogenolysis. Similar hydrogenolysis reaction pathways exist in the pet coke hydroprocessing. Hydrogenolysis reactions can be enhanced in pet coke hydroprocessing due to (1) less resistance to hydrogen radical transfer, (2) longer residence times, and/or (3) higher concentration of aromatic groups in the coke mass. Further enhancement of hydrogenolysis can be achieved at higher catalyst activity and/or higher hydrogen partial pressure.

b3. Conversion of Heteroatomic & Organometallic Compounds: As the asphaltenes and resins hydrogenate and crack, heteroatomic and organometallic compounds are normally exposed for further treatment. Hydrogenation of these compounds is more readily achieved than in the prior art. That is, the hydrogenation and subsequent cracking of aromatics in the pet coke hydroprocessing provide access and favorable reaction conditions to hydrogenate heteroatomic and organometallic compounds that have been traditionally inaccessible (deep within the organic structures of asphaltenes and resins). In this manner, sulfur, oxygen, and nitrogen in the heteroatomic compounds can be transformed to hydrogen sulfide, water, and ammonia, respectively. These gaseous compounds can then be removed from the pet coke mass and treated further. The metals in the organometallic compounds can be hydrogenated to yield metal sulfides that normally remain with the coke mass. The degrees of conversion for each type of compound will depend on various factors, including (1) pet coke mass composition, (2) degree of aromatic hydrogenation and subsequent cracking, (3) local hydrogenation catalyst activity and type, and (4) hydrogen availability at reaction sites (hydrogen partial pressure or otherwise). Conversion of many heteroatomic and organometallic compounds often enhances the ability to further hydrogenate and/or crack the products of these conversion reactions.

Exposed sulfur compounds are readily converted to hydrogen sulfide via hydrogenation and hydrogenolysis. Most of the non-thiophenic sulfur compounds, such as sulfides, thioethers, thiols, and mercaptans, are normally converted to hydrogen sulfide by thermal reactions in the coking cycle of the delayed coking process. The thiophenic sulfur is normally unaffected by thermal reactions, and typically requires catalytic hydrodesulfurization. In the pet coke hydroprocessing, thiophenic sulfur compounds and remaining non-thiophenic sulfur compounds are converted to primarily hydrogen sulfide and other non-thiophenic sulfur compounds. Both hydrogenation and hydrogenolysis mechanisms can effectively convert the thiophenic sulfur.

Similarly, exposed oxygen compounds are readily converted to water via hydrogenation. Aromatic hydroxyl and furan compounds are the predominant oxygen compounds remaining after the thermal reactions in the coking cycle of the delayed coking process. In the pet coke hydroprocessing, hydrogenation can readily convert these compounds to water, which can be subsequently removed from the process.

Exposed nitrogen compounds are much less reactive, but can be converted to ammonia via hydrogenation with the proper catalyst activity and operating conditions. The nitrogen compounds remaining in the coke mass are primarily two types: (1) non-basic derivatives of pyrrole (e.g. pyrroles, indoles, & carbazoles) and (2) basic derivatives of pyridine (e.g. pyridines, quinolines, & acridines). Catalysts containing nickel (Ni/Mo or Ni/Co/Mo) tend to promote hydrodenitrification, but hydrodesulfurization will occur also. However, unlike catalytic desulfurization, only the hydrogenation reaction mechanism is prominent in catalytic hydrodenitrification. The hydrogenation catalyst sites are more acidic than the hydrogenolysis catalyst sites, and hence tend to be poisoned by adsorption of the basic nitrogen compounds. Apparently, the synergistic effects of hydrogen sulfide from hydrodesulfurization and water from hydrodeoxification can further promote hydrodenitrification by increasing the catalyst acidity.

Hydrogenation of exposed organometallic compounds typically forms deposits of metal compounds on the catalyst(s). Metals occur in two basic organic forms: porphyrin metals and non-porphyrin metals. Porphyrin metals, which are chelated in porphyrin structures analogous to chlorophyll, have porphyrin rings, based on pyrrole groups which complex the metal atom. The non-porphyrin metals (e.g. metal naphthenates) are thought to be associated with the polar groups in asphaltenes. Metal removal typically occurs during both thermal and catalytic processing. However, removal is more complete when a catalyst provides much more effective hydrogen transfer. In pet coke hydroprocessing, the organometallic compounds, such as porphyrins and metal naphthenates, can decompose and transform to metal sulfides (e.g. nickel, iron, and vanadium sulfides) in a colloidal state with particle sizes ranging form 20 to 250 nm. These metal sulfides can enhance hydrogenation catalyst activity and increase hydrogen availability and reactivity. However, these metal sulfides (e.g. rod-like crystals of vanadium sulfide: $V_3S_4$) can accumulate and cover the catalyst surface and/or block macropores in the catalyst/support structure. Fortunately, the pet coke mass in the pet coke hydroprocessing normally has sufficient macropore structure in the porous, pet coke to accommodate high conversions of metals to metal sulfides. That is, the weight ratio of porous, pet coke to metals content of the coke mass is typically >100:1. As such, the accumulation of metal sulfides on the pet coke mass does not normally inhibit its catalytic activity, but enhances it.

c. Residence Time: The residence time of pet coke hydroprocessing reactions can vary considerably, depending upon the selection of reaction vessel(s) for each application. As discussed previously, the reaction vessel considerations provide three potential scenarios for the pet coke hydroprocessing: (1) coke drums (existing or new) in the traditional delayed coking configuration (i.e. 2 coke drums & 2 coking cycles), (2) existing/new coke drums in a modified configuration (i.e. 3 coke drums & 3 coking cycles), or (3) new reaction vessel(s) in a separate pet coke hydroprocessing unit.

If coke drums are used in the traditional delayed coking configuration. the residence time of pet coke hydroprocessing reactions can be limited: <15 minutes to >2 hours. The optimal residence time will depend on design and operating constraints of the existing delayed coking cycles, as well as the required time to achieve site-specific, pet coke hydroprocessing objectives. Equipment constraints, such as coke drum pressure limitations and coker subsystem bottlenecks can also influence sufficient residence time.

Residence time limits in the pet coke hydroprocessing can be dramatically loosened by the use of 3 coke drums (existing and/or new) in 3 coking cycles. In this reaction vessel scenario, the residence time can be as long as the existing coking cycle (e.g. 12-16 hours). However, lower residence time for pet coke hydroprocessing is more likely to allow (1) movement of traditional decoking cycle tasks to the pet coke hydroprocessing cycle and/or (2) additional distillate/gas oil hydrotreating capacity in the pet coke hydroprocessing cycle. In this case, the time for each cycle time can be reduced and increase coke feed throughput capacity.

The pet coke hydroprocessing residence time has few design limits, if new reaction vessel(s) is/are built for a separate pet coke hydroprocessing unit. However, the residence time impact on costs can be prohibitive in achieving an acceptable return on investment(s).

d. Catalysts: Unlike the hydroprocessing of the prior art, the petroleum coke is not only the process feed, but can also play a major role in the catalysis of the desired reactions. That is, the pet coke (1) behaves as a hydrogenation catalyst, (2) acts as a cracking catalyst, (3) provides surface area for catalyst impregnation, and/or (4) produces metal sulfide hydrogenation catalysts. The porous pet coke in the coke mass can also provide a bi-modal distribution of catalyst pores to enhance its catalytic cracking activity. In addition, the pet coke hydroprocessing conditions limit catalyst deactivation. In this manner, the porous pet coke in the coke mass provides bi-functional catalyst properties and deactivation resistance required for pet coke hydroprocessing.

The pet coke can perform the function of a hydrogenation catalyst. As discussed previously, sponge, pet coke with sufficient carbon adsorption character can adsorb oxygen molecules and break them down into reactive ion radicals. Similarly, this sponge coke can also adsorb hydrogen molecules and break them down into reactive ion radicals. This is particularly true for the highly porous sponge structure of the modified pet coke in the current invention. That is, the lower asphaltene/resin to aromatics ratio normally provides less liquid and more solidified, porous sponge coke in the coke mass.

The solidified, porous crystalline structure of the semi-solid coke mass can act as a cracking catalyst, too. In many ways, the large internal surface area of highly porous, sponge coke behaves like silica-alumina in its adsorption capabilities. The adsorption and breakdown of hydrogen molecules provides the rapid transfer of reactive hydrogen radicals to (1) catalyze thermal cracking reactions at lower activation energies and temperatures and (2) directly break strong bonds via hydrogenolysis. As pet coke hydroprocessing proceeds, the sponge coke portion of the coke mass increases, as well as its porosity, adsorption character, and catalytic activity. Thus, the catalytic cracking activity can normally accelerate.

The solidified, sponge coke portion of the coke mass provides porous surface area for: the impregnation of various catalyst enhancing compounds. If the pet coke does not provide sufficient catalytic activity to initiate sufficient hydrogenation and/or cracking, the porous sponge coke can be impregnated (or seeded) with finely divided, catalytic additives (e.g. Ni, Co, Mo, Fe). However, the recovery of these catalytic additives would be difficult and expensive. Therefore, less expensive catalytic additives, such as iron sulfate or iron oxide wastes, would be preferable. Furthermore, fine particles of silica-alumina can also be added to the coke mass to increase catalytic cracking activity, if needed. In addition, other additives can be used to enhance catalyst activity, such as increased acidity of the reaction sites. For example, acidity can be increased by substitution reactions increasing the concentration of alkaline earth metals, rare earth metals, or hydrogen.

The hydrogenation of heteroatomic and organometallic compounds can produce additional hydrogenation catalysts. As discussed previously, metal sulfides (i.e. sulfides of Ni, Fe, & V) can form from the chemical combination of sulfur and metals from hydrogenation of organic sulfur and metal compounds in the coke mass. These metal sulfides can be good hydrogenation catalysts to a limited extent. In excess, these metal sulfides can block catalyst pores and poison certain catalysts. However, the metal sulfides are limited by the concentration of the metals in the coke mass in this (semi-continuous or batch) process. Since the metals content of the coke mass is typically <0.2% by weight, the accumulation of metal sulfides is not normally sufficient to cause significant detrimental impacts. Thus, the net effect typically favors increased hydrogenation activity.

The pet coke hydroprocessing operating conditions limit catalyst deactivation by coke fouling and/or poisoning by nitrogen, oxygen, or metals. Catalysts in pet coke hydroprocessing are not as susceptible to coke fouling. Compounds having coke forming tendencies have already become coke in the coke mass. Therefore. not likely to foul catalyst with additional coke formation in the presence of hydrogen.

Figure 9:
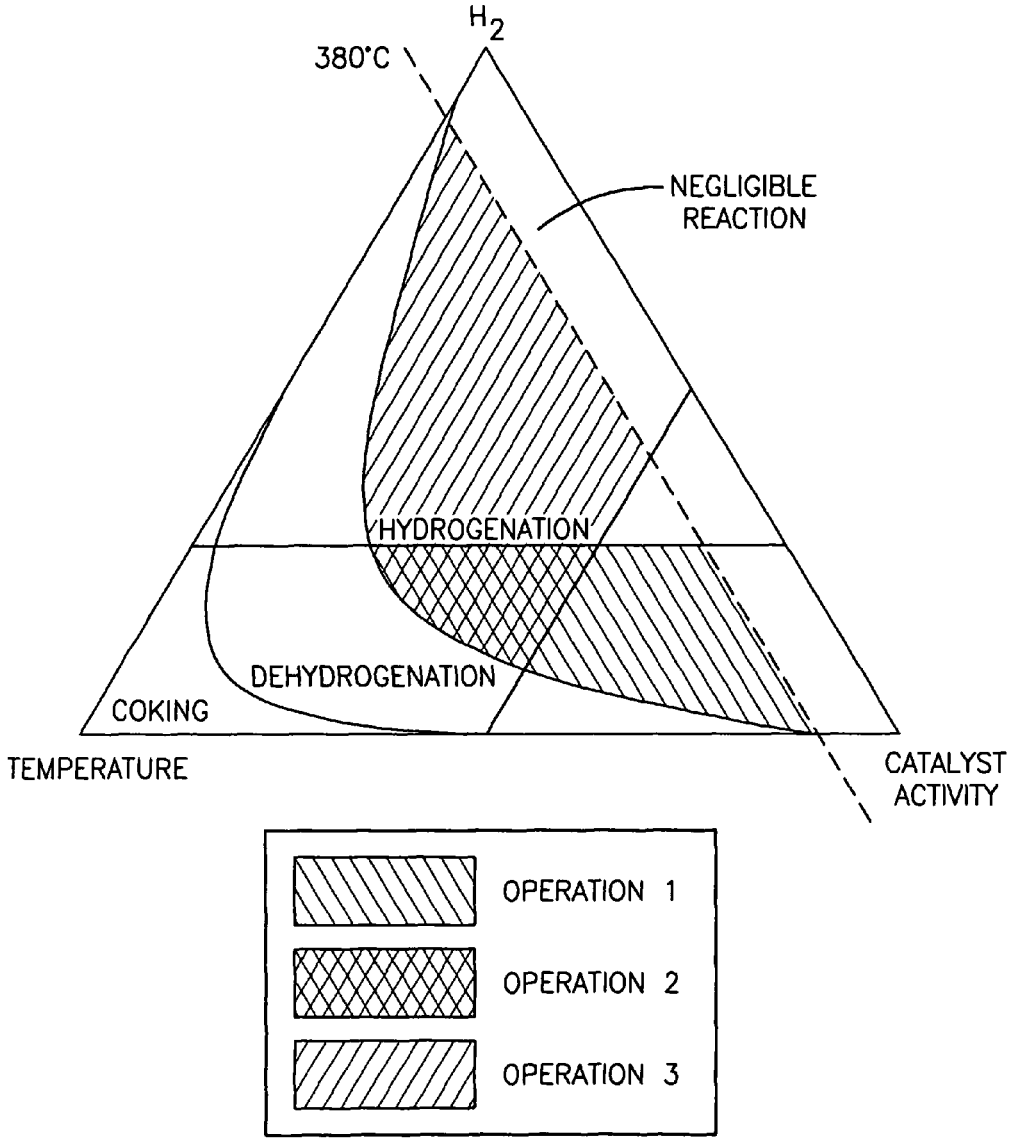
FIG. 9 shows an exemplary operating conditions diagram for petroleum coke hydroprocessing. Three zones of different operating approaches are demonstrated.

Bi-functional catalyst can be formulated to meet the site-specific objectives and constraints for each application of pet coke hydroprocessing.

e. Overall Process: Interaction of Various Reactions: In the pet coke hydroprocessing, a formidable combination of various reactions and chemical species usually occur simultaneously. These reactions potentially include (1) various types of hydrogenation reactions with aromatic compounds, olefins, and heterocyclic compounds (i.e. containing sulfur, oxygen, nitrogen, and/or various metals), (2) various types of cracking reactions: thermal, catalytic, and hydrogenolysis, and (3) various types of coke-forming reactions: dehydrogenation, condensation, aromatization, oligomerization, polymerization, and cross-linking. The complexity of reaction mechanisms is further complicated due to simultaneous thermal and catalytic reactions (cracking & otherwise). Consequently, selecting catalysts and operating conditions that enhance desirable reactions and/or inhibit undesirable reactions is critical to achieve objectives in each application of pet coke hydroprocessing. As discussed previously, other site-specific factors and constraints can have significant impacts on the optimization of pet coke hydroprocessing. These site-specific factors (and associated examples) include, but should not be limited to:

1. Coke Mass Composition and Physical Properties: SARA; hetero-contents; % solid, porosity
2. Reaction Vessel Constraints: Number; new/old; pressure limitations; residence time
3. Coke Product Specifications: Fuel requirements; adsorption carbon characteristics; other
4. Economic Constraints: Capital and operating costs, product values; acceptable conversion The basic interaction of process temperature, hydrogen availability, and catalyst activity are shown in the simplified diagram of FIG. 9. The points of the triangle represent the highest value for each variable, and the opposite side represents minor to negligible value for that same variable. In the delayed coking process, the process temperature (e.g. 850-925° F.) is near its highest practical value (i.e. lower left point of triangle), while catalyst activity and available hydrogen (e.g. partial pressure) are minor to negligible. Thus, the primary reactions of residual components are dehydrogenation and coking; forming the coke mass of concern in the pet coke hydroprocessing. As seen in this diagram, hydrogenation can be preferentially achieved by increasing the hydrogen availability (e.g. hydrogen partial pressure or otherwise) and catalyst activity, while decreasing temperature. If pressure limitations of the reaction vessel limit the hydrogen availability, then higher catalyst activity with lower process temperatures can maintain operation in the hydrogenation regime: Zone 1 Operating Conditions. If the coke drums are modified to remove pressure limits (e.g. new drums w/advanced metallurgy and proper thickness), the hydrogenation operating regime can be maintained with higher hydrogen availability and lower temperatures, in lieu of higher catalyst activity. These operating conditions are represented by Zone 3 in FIG. 9. The coke drums in many existing coker applications can have limited hydrogen availability (e.g. drum pressure limits) and catalytic activity (e.g. less ability to impregnate coke w/catalyst). In these cases, Zone 2 operating conditions may be preferred due to higher reliance on temperature versus hydrogen availability or catalyst activity. As noted previously, different feeds can result in different operating regimes (e.g. hydrogenation vs. dehydrogenation), even at identical operating conditions (i.e. temperature, hydrogen availability, & catalyst activity). Thus, this diagram has limited use for absolute values of the respective operating conditions, but provide their relative impacts on the hydrogenation operating regime. Consequently, pilot scale tests are often needed to refine operating conditions of this technology for a given feed. The preferable operating conditions would be in the hydrogenation operating regime, at a point where the overall process profitability is maximized, based on site-specific operating constraints.

The interactions between catalytic and thermal reactions with the various residual compounds can be very complex. Some of the reactions are reversible. Their reaction mechanisms and equilibrium can often be determined by the (1) specific compounds & impurities in feed, (2) quality & quantity of catalyst(s), and (3) various process conditions, including process temperature & hydrogen partial pressure. For example, polyaromatics, in the presence of hydrogen and catalyst(s), can undergo cycles of hydrogenation and dehydrogenation. Furthermore, cracking reactions would proceed via various free-radical reaction mechanisms, including abstraction of aliphatic, napthenic, and aromatic hydrogen atoms, along with hydrogenolysis. Catalyst activity for both hydrogenation and hydrogenolysis may depend greatly on the transfer of hydrogen radicals. Thus, interaction of hydrogenation and hydrogenolysis may be a key parameter that may be addressed on a case-by-case basis. A suggested way to look at optimization of the current technology to specific applications is FIG. 9.

Optimal pet coke hydroprocessing of the current invention would often inhibit coke-forming reactions and promote certain hydrogenation and cracking reactions. The hierarchy of desirable reactions for many applications of pet coke hydroprocessing likely includes:

1. Hydrogenation & cracking of asphaltenes & resins: Reduce coke yields; Better coke quality
2. Iterative hydrogenation/catalytic cracking of intermediates: Improve liquids yield; Inhibit gas
3. Hydrogenation/hydrogenolysis of sulfur compounds: Substantially improve coke quality
4. Hydrogenation of nitrogen compounds: Improve coke fuel quality; reduce catalyst poison
5. Hydrogenation of organometallic compounds: Enhance catalyst activity; limited coke effect
6. Hydrogenation of oxygen compounds: Reduces coke fuel quality; impacts adsorption quality In many of these cases, the desirability of the last three types of reactions is questionable. Fortunately, these three types of reactions are more difficult to achieve on a thermodynamic basis. Thus, the remaining discussion will focus on the first three types of reactions.

These complementary hydrogenation and cracking reactions proceed until the desired conversion of the coke mass is achieved: production of cracked components with lower boiling points and/or the removal of undesirable impurities, including sulfur and nitrogen. The gases generated (hydrocarbons w/B.P. <850° F., hydrogen sulfide, ammonia, and water) are released or withdrawn form the reaction vessel with excess hydrogen. Similar to hydroprocessing of the prior art, the gases are separated by high and low pressure flash separators: the hydrocarbons are sent to a fractionator system, while the overhead gases are passed through an amine stripper. The hydrogen rich gas is recycled and the rich amine solution goes to the sulfur plant for further processing. When the reactions are sufficiently complete, the reactor can be depressurized and quenched. After cooling to roughly 200° F., the coke can be safely removed from the reactor vessel.

Simultaneous hydrogenation and cracking of the coke mass are initiated and proceed with sufficient residence time to obtain the desired conversion. As the hydrogen enters the system, the very porous, solidified coke within the coke mass (and its increased adsorption character in this exemplary embodiment) convert the molecular hydrogen to free radical ions without catalyst additives. As discussed previously, the adsorption character of the coke mass and the solid-gas phase nature of coke hydroprocessing make the hydrogen free radicals readily available for migration to the reaction sites without excessive hydrogen partial pressure. The reaction sites are normally the surface of the reactants (e.g. asphaltenes, resins, & condensed aromatics). The high concentrations of both reactive molecules and hydrogen free radicals create driving forces for high degrees of complementary hydrogenation and cracking reactions. Normally, the hydrogenation and cracking reactions preferentially attack the weaker bonds of the asphaltenes and resins. Significant breakdown and removal of complex aromatic compounds (preferably asphaltenes and resins) from the coke mass create additional voids in the coke crystalline structure. The size of these voids range form <2 nanometers to >50 nanometers. As a result, additional micropores, mesopores and macropores. This is analogous to the removal of basal planes in the steam activation of carbonized carbons to produce high-quality activated carbons. Ample residence time of the exemplary embodiment allows lower operational temperatures that favor greater aromatic saturation.

In most cases, the resulting petroleum coke has significantly less mass, lower density, higher porosity, and greater carbon adsorption character. The cracking and hydrogenation of heavy compounds (preferably asphaltenes and resins) in the coke mass normally leaves additional voids in the coke mass. In turn, any further polymerization and cross-linking of the remaining coke mass often becomes more optimal due to a lower asphaltene/resins to aromatics ratio. After cooling, the pet coke typically has greater internal surface area, with significantly more micropores and mesopores. The increased carbon adsorption character can improve fuel properties via better adsorption of VCMs, sulfur reagents, etc. With sufficient cracking and hydrogenation of the coke mass, the resulting pet coke can also provide sufficient carbon adsorption character for treatment applications similar to traditional activated carbon.

Alternatively, additional hydrotreating of distillates can be achieved before quench and coke cooling, if sufficient time is allotted for semi-continuous process cycles (i.e. batch process). That is, distillates can be added with excess hydrogen while the temperature and pressure of the coke are still sufficient for hydroconversion (e.g. hydrotreating). The distillates can be recycled through the coke bed with excess hydrogen until sufficient hydroconversion has occurred. The types of distillates include, but should not be limited to various gas oils, middle distillates, and naphthas. Preferably, the distillates, such as coker gas oils, can come directly from the coke fractionation unit, eliminating the need for substantial heating to reaction temperatures. Depending on solvent action of the distillate, additional separation may be necessary in some cases to remove excess asphaltenes, resins, and heavy aromatics solutized from pet coke mass.

The above theory of operation generally applies to the hydroprocessing of pet coke. However, this theory of operation may not accurately describe all applications. Therefore, this theory of operation should not limit the current invention, and should be used as a guide for ones skilled in the art to modify this technology for specific applications.

In this manner, the hydroprocessing of pet coke can be generally achieved with the proper catalysts. As with other hydroprocessing technologies the catalysts are tailor-made for the feedstock (e.g. coke mass characteristics), process operating conditions, and conversion levels desired. One skilled in the art can make the necessary adjustments in catalyst (type, character, and quantity) and operating conditions, based on engineering calculations, and minor tests, if necessary.

(3) Exemplary Embodiment

Coke Hydroprocessing

In an exemplary embodiment, process options of the current invention are used to substantially decrease overall coke yield and produce a petroleum coke with adsorption characteristics approaching traditional activated carbons of high quality. A third coke drum is added to the traditional coke drum pairs of traditional prior art (i.e. groups of 3 vs. 2). A third coking cycle is also added. The three cycles become coking, coke hydroprocessing, and decoking. In the coking cycle, the adsorption character of the petroleum coke is substantially increased via process options of the current invention. In the coke hydroprocessing cycle, initial coke cooling is followed by simultaneous hydrogenation and cracking of the coke mass, which proceeds with sufficient residence time to obtain the desired conversion. The remaining hydroprocessing cycle time is used for further cooling of the petroleum coke with traditional coke quench media. In the decoking cycle, the coke quench is completed and traditional decoking cycle tasks (coke cutting, reheat, etc.) are accomplished.

Equipment modifications of delayed coking processes include, but should not be limited to:

1. Addition of a third coke drum; Preferably 3 new coke drums w/higher pressure limits
2. Hydrogen; addition/recycling system
3. Catalyst additives; storage & injection system
4. Associated piping, instrumentation, & controls The primary process modifications involve the addition of the third process cycle and the modifications & redistribution of process tasks. The primary purpose of the third process cycle is to provide sufficient residence time for the coke hydroprocessing step. By incorporating tasks of the traditional decoking cycle, this coke hydroprocessing cycle also allows potential increase in coker capacity via reduction in coking cycle time. That is, the heater section becomes the limiting factor in reducing cycle times. Though the overall coker cycle time increases, the cycle time to fill each coke drum can be reduced, increasing coker capacity. For example, a coker with current cycle time of 14 hours has an overall coker cycle of 28 hours. In contrast, the third coker process cycle can effectively reduce the individual cycle times to 12 hours, but extend the overall coker cycle to 36 hours. However, one coke drum (of the same size or larger) is filled every 12 hours, instead of 14 hours, increasing the coke capacity.

In the coking cycle, the adsorption character of the petroleum coke is typically increased to improve coke mass reactivity. This objective can be usually achieved by the use of previously discussed process options of the current invention. These process options include lower heater outlet temperature, lower recycle rate, higher drum pressure, and/or modified coker feed with higher aromatics content. In this manner, the ratio of asphaltenes/resins to aromatics is low enough to consistently produce highly porous sponge coke or honeycomb crystalline structure. These high porosity, coke crystalline structures provide sufficient solidification of coke mass and adsorption character to improve coke mass reactivity. In addition, the lower heater outlet temperature, lower recycle rates, and lower coke density (i.e. less coke per coking cycle) reduce the heater section limitations and increase coke drum fill rates. This allows potential reduction in coking cycle time (e.g. 12 hours) and increases in coker capacity.

In the coke hydroprocessing cycle, initial pet coke cooling, hydrogen/catalyst addition, pet coke hydroprocessing, and further pet coke cooling occur. The initial pet coke cooling provides (1) optimal reaction temperature, (2) increased coke mass solidification, and (3) the means to inject hydrogenation catalyst additives, if necessary. As noted previously, the optimal temperature and pressure depend on site-specific factors, including the coke mass composition & structure and hydroprocessing objectives. In many cases, the optimal temperature for coke hydroprocessing is normally 500 to 950° F. (preferably 700 to 800° F.) and pressures of 15 to 2000 psig (preferably 15 to 100 psig). Secondly, the lower temperature (vs. 800 to 850° F.) also increases the solidified coke content of the semi-solid coke mass. As discussed previously (i.e. theory of operation), the highly porous, solidified coke in the semi-solid, coke mass provides the carbon adsorption character that increases the availability of the hydrogen free radical ions in predominantly solid-gas phase reactions. Finally, the initial coke cooling can provide the means to add hydrogenation catalyst additives, such as iron oxides and/or iron sulfates. Traditional coke cooling media (e.g. steam, water, & sludges) can be used to attain the optimal temperature. Various catalyst additives can be injected with these media, particularly aqueous sludges, but other options may be preferable to achieve better control and more uniform distribution in the coke. One alternative would include the use of a coker fractionator slipstream to serve as both carrier fluid and cooling medium. This slipstream (e.g. light coker gas oil or heavy naphtha) would preferably vaporize at temperatures below the optimal hydroprocessing reaction temperature. The catalyst additive(s) (e.g. iron oxide waste sludges) would be mixed with carrier oil/distillate prior to injection. The vaporization of the carrier oil/distillate would provide the desired cooling (with better control than water expanding to steam) and leave the catalyst additives uniformly deposited on the pet coke surfaces. This would be similar to the deposition of SOx sorbents discussed later. The vaporized carrier oil/distillate would be recovered. One skilled in the art could readily design and implement such a system addressing site-specific needs and concerns. This initial coke cooling typically requires 2 to 3 hours of coke hydroprocessing cycle time.

Initial hydrogen addition can be injected with the cooling media, the bulk of the hydrogen is added after the optimal temperature is reached. As the hydrogen is added to the coke drum, the system pressure is allowed to increase to the practical pressure limits of the coke drums. For existing coke drums, this pressure limit is typically 80-100 psig. A circulation rate of excess hydrogen is established with 1.5 to 8 times (preferably 3-4 times) the hydrogen required for conversion. This excess hydrogen circulation provides the means to remove gaseous reaction products (e.g. hydrogen sulfide, ammonia, water, etc.) for further processing and recovery of vaporized hydrocarbons. The hydrogen is recovered and recycled. Based on experience in other hydroconversion processes, one skilled in the art can design and implement a hydrogen circulation and product recovery system, which addresses site-specific factors and concerns. Establishing hydrogen circulation and higher drum pressure can normally be achieved within 2 hours (preferably <1 hour) of cycle time.

Simultaneous hydrogenation and cracking of the coke mass are initiated and proceed with sufficient residence time to obtain the desired conversion. As the hydrogen enters the system, the very porous, solidified coke within the coke mass (and its increased adsorption character in this exemplary embodiment) convert the molecular hydrogen to free radical ions without catalyst additives. As discussed previously, the adsorption character of the coke mass and the solid-gas phase nature of coke hydroprocessing make the hydrogen free radicals readily available for migration to the reaction sites without excessive hydrogen partial pressure. The reaction sites are normally the surface of the reactants (e.g. asphaltenes, resins, & condensed aromatics). The high concentrations of both reactive molecules and hydrogen free radicals create driving forces for high degrees of complementary hydrogenation and cracking reactions. Normally, the hydrogenation and cracking reactions preferentially attack the weaker bonds of the asphaltenes and resins. Significant breakdown and removal of complex aromatic compounds (preferably asphaltenes and resins) from the coke mass create additional voids in the coke crystalline structure. The size of these voids range form <2 nanometers to >50 nanometers. As a result, additional micropores, mesopores and macropores are created. This is analogous to the removal of basal planes in the steam activation of carbonized carbons to produce high-quality activated carbons. Ample residence time of the exemplary embodiment allows lower operational temperatures that favor greater aromatic saturation. The third coke drum and third coker operational cycle of the exemplary embodiment provide ample residence time of at least 3-12; preferably 4-6 hours.

The remaining hydroprocessing cycle time is used for further cooling of the petroleum coke with traditional coke quench media. When the coke hydroprocessing has achieved the desired conversion level, the pet coke is steamed out and cooled further for cutting from the coke drum. Similar to delayed coking of the prior art, the petroleum coke is cooled to a temperature sufficiently low (e.g. 200° F.) to safely remove the pet coke form the coke drum. However, the remaining coke hydroprocessing cycle time (e.g. 2-3 hours) can be effectively used to reduce the rate of cooling and reduce thermal stress in the coke drums. As a result, all tasks of the coke hydroprocessing can be readily completed within a 12-hour cycle time.

In the decoking cycle, traditional decoking cycle tasks can be readily accomplished within a 16-hour (preferably 12-hour) cycle time with less thermal stress on the coke drums and less safety concerns. First, substantial cooling (e.g. 3-6 hours at reduced cooling rates) has already occurred in the coke hydroprocessing cycle. Consequently, coke cooling can often be completed within the first 2-3 hours. The next 6-8 hours are available for draining, unheading, decoking, head-up, and testing. The remaining cycle time (e.g. 2-3 hours) can be effectively used for warming up the drum at a lower rate, reducing thermal stresses in the coke drums. One skilled in the art of delayed coking can determine the optimal use of cycle time for the different tasks. The proper allocation of decoking cycle time can depend on site-specific factors, including various safety concerns, coke drum conditions, coke cutting design & controls, and coke transfer facilities.

The primary results of the exemplary embodiment include (1) substantial reduction in overall coke yields, (2) significant improvement in pet coke adsorption quality, (3) removal of coke impurities, and (4) higher coker capacity via reduction in cycle time of individual cycles, particularly coking cycle. The purpose and benefits of the exemplary embodiment can be illustrated by the following example. A delayed coker currently has a coke yield of 33% and coking cycle time of 16 hours. A fuel-grade, petroleum coke is produced with shot coke crystalline structure, 10% VCM, and an in-drum density of 0.98 g/cc. With an exemplary embodiment coking cycle of 12 hours, the modified operating conditions produce a highly porous coke with honeycomb crystalline structure to promote the coke hydroprocessing. This coke has an in-drum density of 0.86 g/cc and roughly 22% VCM. The coke yield is increased to approximately 37%. With a 25% hydroprocessing conversion, the overall coke yield is reduced to 28% and the modified petroleum coke is similar in quality to medium grades of traditional activated carbons. By increasing the hydroprocessing conversion to 35%, the overall coke yield is reduced to 24% and the modified pet coke approaches the quality of premium activated carbons. Obviously, the latter scenario is more desirable with an effective reduction in overall coke yield of 9 wt. % (i.e. 33%-24%), primarily conversion to cracked liquids during the coke hydroprocessing. In addition, the cycle times have been reduced to the lowest practical levels: 12 hours. Though the increase in coker capacity would appear to be 33% (i.e. 16/14), the change in coke densities reduces the weight of coke in each coking cycle by 14%. Thus, the net increase in coker capacity would be roughly 19%. Even if the coking cycle time can only be reduced by 2 hours, the higher drum fill rate can cover the change in coke densities and still increase coker capacity by 0.3%.

One skilled in the art can make proper equipment and operational modifications to achieve the desired objective at site-specific application of this technology. As discussed previously, the application of the current invention can vary due to site specific factors, including existing coker design and operation, coker feeds, coke mass composition, hydroprocessing objectives, and use(s) of the modified petroleum coke.

(4) Other Embodiments

Coke Hydroprocessing

1. This method can be performed without coke crystalline modification of the current invention. some cokers won't need (e.g. sweet crude refineries)
2. Lower coke hydroprocessing reaction temperature (e.g. 500-700° F.; preferably 600-700° F.): Hydrogenation reaction equilibrium favors low temp; residence time/reaction rate trade-offs
3. Reduce conversion; Maximize profitability: Adsorption coke higher value vs. cracked liquids
4. Reduce conversion for fuel grade pet coke applications: Boiler & MHD Technology
5. Use remaining cycle time for additional hydrotreating capacity: Gas oils, naphthas, etc.
6. Add other additives to improve catalyst activity;
7. New coke drums/reaction vessels designed for higher process and hydrogen partial pressures
   New alloy clad drums w/latest technology; repetitive seals & press effects/thermal cycles
8. Add other process options of current invention: Plastics/Rubber, Mod Drill Stem, etc.
   Coke Fuel Product: SOx sorbents, VCMs, oxygen, ionization chemicals
   Coke Adsorption product: Chemisorption, other adsorption enhancing additives
      Add oxygen, nitrogen, and/or halogen surface groups or complexes to enhance adsorption character & chemisorption properties for specific adsorption applications
      During this coke quench, chemisorption or other additives (e.g. sulfur) can be uniformly impregnated on the pet coke's adsorption carbon surface via process options of the current invention.
      Modified coke drum skirt to allow cutting of large honeycomb chunks: low Press D
9. Part of coke to MHD Cogeneration (e.g. on-site) & Remainder to adsorption uses
10. 2-Stage thermal process: 700-750° F. for aromatic saturation; then raise temperature for thermal/catalytic cracking to 800-900° F.: Alternate for prescribed periods of time in pet coke hydroprocessing cycle of modified delayed coking process.
11. Carrier fluids (liquid and/or gas) can also be preferable to improve reactivity and overall benefits; Use of various hydrocarbons for incremental hydrotreating/hydrocracking capacity in refinery w/low severity requirements; gas oils or FCCU slurry oil as carrier for H2 & Fe for hydrocracking in pet coke
12. Reduce overall process coke yield via cracking & hydrogenation of coke compounds
13. Reduce sulfur, nitrogen, and metals contents of the modified petroleum coke: H2: hydrotreat liquid/coke mass to remove any exposed S, N, and the metals before coke crystal growth
14. Reduce coke yield & improve coke qualities via optimized coke condensation: addition of hydrogen: promote stabilization of coke crystals
15. Improve carbon adsorption character; approaching activated carbon applications: H2: lowest molecular weight gas promotes micro-pores and mesopores; H2: stabilize coke crystals by saturating and help cross-linking; eliminate pitch like material, & promote crystal growth
16. Densities of Desired Activated carbon quality used as basis for degree of conversion or maximum conversion of pet coke and accept whatever quality of pet coke at end
17. Incremental hydroprocessing capacity and/or additional gas oil production from lower heater outlet temperature: excess gas oil can be pumped to the 3rd coke drum for hydrocracking coke in presence of hydrogen, iron, and gas oil
18. Variations among refineries due to trade-offs: technical & economical; One skilled in the prior art can . . .

(5) Overall Results

1. Operate coking cycle at lower temperatures to assure sufficiently porous, sponge coke
2. Reduce coking cycle time to limits of heater section: e.g. 12 hours
3. Cool coke to 600-750° F. with coker gas oil sidestream and add catalyst additive, if needed
4. If cycle time is sufficient (e.g., about 3-4 Hr.), additional hydrotreating capacity (e.g. coker gas oils)
5. Incorporate initial cooling in hydroprocessing cycle time (e.g., 3-4 Hr.)
6. Finish cooling in decoking cycle, integrating desired coke additives and properties
7. Reduce all cycle times to lowest practical levels: Increase coker capacity & liquid yields
8. Design pet coke magnetohydrodynamic cogeneration; Refinery power and steam production
9. Substantially increase refinery efficiency (e.g. >90%); Reduce $CO_2$ & global warming
10. Excess refinery gas to natural gas & plastics production;
11. Excess coke to carbon adsorption applications (not flooding market; moderate price)

E. Pet Coke Activation: Chemical Extraction

A method for activation of petroleum coke for use in carbon adsorption applications was discussed in coke hydroprocessing process of the current invention. Certain types of chemical extraction were discovered as an alternative method for pet coke activation. The methods of chemical extraction are briefly described below.

The chemical extraction methods that activate the pet coke target the removal of the asphaltenes and resins form the coke mass in the delayed coking process. Tetrahydrofuran (THF) or similar solvents can be used in the decoking cycle to extract the undesirable asphaltenes and resins. Asphaltenes and resins are normally soluble in THF, but most coke solids are not. Thus, washing or soaking the pet coke in liquid THF for a sufficient period of time can be effective in removing the asphaltenes and resins. The removal of the asphaltenes and resins creates voids of various sizes in the pet coke: macropores, mesopores, & micropores. The quality or grade of the adsorption carbon will be determined by the distribution of the pores in the resultant pet coke. This pore distribution can depend on various factors, including but not limited to (1) initial coke crystalline structure, (2) localized concentrations of asphaltenes/resins, (3) extent of physical & chemical attachment to coke structure, and (4) the degree of extraction.

An exemplary embodiment for this chemical extraction method would extract the asphaltenes and resins in the decoking cycle of the delayed coking process. In the decoking cycle, the coke mass is cooled to a temperature sufficiently low and/or pressure is increased sufficiently to maintain THF as a liquid. For example, the coke is traditionally cooled to 200° F. prior to draining, deheading, and cutting. The drum pressure may have to be maintained >30 psig to assure liquid THF (i.e. B.P=152° F. at 14.7 psig) during extraction. Once quench media is drained and the desired operating conditions are established, liquid THF is injected into the coke mass until the coke drum is full. After sufficient residence time to allow appropriate solvent activity the THF extract is drained. This step can be repeated, if necessary to achieve the desired degree of extraction. After the extraction is complete, the solvent extract is drained into a THF recovery system. After the THF extract is drained, the drum pressure is reduced and the remaining THF is vaporized. If needed, low-pressure steam is swept through the coke to remove any residual THF held by adsorption forces. Both the vaporized THF and steam are piped to the THF recovery system. In the THF recovery system, the liquid THF in the extract is vaporized in a flash separator at sufficiently low pressures. The design of the THF separator would provide means to readily remove the precipitated asphaltenes and resins. The vaporized THF is treated, if necessary, and recycled for the next drum of coke. Make-up THF is added, as needed.

Other embodiments of this chemical extraction method would include the following:

1. Other solvents that have preferable solvent properties, physical properties and/or costs; For example: 2-methyl-THF has a higher normal boiling point of 250° F.
2. This method of chemical extraction can be performed in vessels external to coking process.
3. This method of chemical extraction can be performed in a 3 drum coker with $3^{rd}$ cycle.
4. This method can be used in conjunction with coke hydroprocessing of the current invention.
5. This method can be performed without coke crystalline modification of the current invention.
6. Reduced pressure vaporization of the solvent can be used to further cool the pet coke.

F. Chemical Activation of Pet Coke for Carbon Adsorption

Methods for activation of petroleum coke for use in carbon adsorption applications were discussed in coke hydroprocessing and chemical extraction sections of the current invention. It has been further discovered that the pet coke can be chemically activated for use in carbon adsorption applications. The methods of chemical activation are briefly described below.

The prior art of traditional chemical activation for activated carbons uses various chemicals to develop pores in carbonaceous materials. Chemical activation normally involves the following mechanisms: (1) chemical decomposition of certain parts of the carbonaceous material (e.g. cellulosic content of peat or wood), and/or (2) chemical support that does not allow resulting char to shrink during carbonization. The result is a very porous carbon structure that is filled with activation agent. The activation agent is typically washed from the carbon and recycled. The two most common activation agents in commercial use are dehydrating agents: zinc chloride and phosphoric acid. Many other chemicals have been noted to activate carbonaceous materials, but only two others have been used commercially: sulfuric acid and potassium sulfide. A standard Oil process using anhydrous potassium hydroxide is operated on a semi-commercial scale.

In the past, petroleum coke has had limited success as a carbonaceous raw material for the production of activated adsorption carbon. However, the modified crystalline structure of the current invention provides a much better starting material than traditional petroleum coke. Chemical activation of the modified coke of the current invention can be performed within the coking unit or separately. Preferably, the chemical activation occurs in the decoking cycle of the delayed coking process. Essentially, the optimal activation chemical is added to the porous sponge (or honeycomb) coke until the existing voids are filled. Soaking the modified coke for sufficient residence time at sufficient temperature decomposes certain coke materials (preferably asphaltenes and resins), leaving additional voids or pores in the coke. The quantity and types of pores (i.e. macropores, mesopores, and/or micropores) can be controlled to a certain extent, producing low to medium quality adsorption carbons at lower costs. In some cases, additional porosity and adsorption quality can be achieved by leaving the activation agent in the pet coke, followed by further carbonization in the proper furnace (e.g. rotary kiln). However, the additional costs are often not justified.

An exemplary embodiment for chemical activation in the current invention uses molten anhydrous potassium hydroxide in the delayed coking unit. Preferably, the modified pet coke of the current invention is created in the coking cycle via optimization of the cracking and coking reactions. Using this very porous pet coke as the starting raw material helps (1) improve the effectiveness of the molten anhydrous potassium hydroxide and (2) provides better quality adsorption carbon products. At the beginning of the decoking cycle, the modified pet coke mass is a semi-solid at a temperature of about 750-850° F. and pressures of 15 to 50 psig. As discussed in coke hydroprocessing, the solidified portion of the coke mass demonstrates a significant degree of carbon adsorption character. Molten anhydrous potassium hydroxide (M.P.=680° F.) is added to the coke mass until the voids are essentially filled (or less depending on desired conversion levels). The quantity of potassium hydroxide in an exemplary embodiment may be 10 to 150 wt. % (preferably 40-80 wt. %) of the initial coke weight. After sufficient residence time 0.25 to 6 hours (preferably 0.5-2 hours), the potassium hydroxide (KOH) and reaction products are drained to the KOH recovery system. The residual KOH is stripped form the pet coke by steam and sent to the KOH recovery system. The KOH recovery system separates the potassium hydroxide from the reaction products and recycles the activation agent (KOH). The pet coke is further cooled and cut from the drums as described in the current invention.

Other embodiments of this chemical extraction method would include the following:

1. Treat modified pet coke with phosphoric acid and/or steam; 750-1110° F. in rotary kiln.
2. Pyrolysis oxidation of modified pet coke; followed by treatment with nitric acid.

3. Other activation agents with preferable chemical properties, physical properties, and/or costs.

6. Uses of Improved Pet Coke Adsorption Characteristics

The improved adsorption characteristics of the modified coke in the current invention provide greater opportunity to further enhance its fuel qualities and carbon adsorption properties. Various adsorption and impregnation techniques can uniformly add various chemical agents to the internal pores of the modified pet coke. These chemical agents can be used to (1) reduce sulfur oxide emissions from the pet coke combustion, (2) improve combustion characteristics of the modified pet coke, and (3) enhance carbon adsorption characteristics for use of the modified pet coke in various carbon adsorption and catalyst applications. These same adsorption and impregnation techniques could also be applied to unmodified pet coke (e.g. anode-grade sponge coke from sweeter crudes). However, the success of such applications can be limited due to less carbon adsorption character. In addition, these adsorption and impregnation techniques can also be applied to other porous, carbonaceous materials. Greater success (vs. unmodified pet coke) can be attainable, particularly with activated carbon materials or carbon-based catalysts.

A. Coke Adsorption and/or Impregnation with Sulfur Reagents

As noted earlier, certain chemical agents can be uniformly added to the petroleum coke to mitigate the problems associated with high sulfur levels in the modified petroleum coke. These impregnated chemical agents (e.g. sorbents) scavenge the coke sulfur in the combustion process and convert the sulfur to sulfur compounds, which are solid particulates at the flue gas temperature of particulate control devices (i.e. existing or otherwise). In this manner, the fuel's sulfur can be collected in innocuous sulfur compounds in the combustion systems' existing (or modified or new) particulate control device, instead of being emitted to the atmosphere as sulfur oxides (SOx). The conversion of sulfur oxides to particulates that are collectible in the existing particulate control device is similar to dry sorbent scrubbing technology (prior art). On the other hand, the integration of chemical agents, such as SOx sorbents, into the very porous crystalline structure of the modified coke is conceptually similar to the impregnation of activated carbon (prior art). However, this impregnation of the modified pet coke with sulfur reagents (present invention) is an unique process that provides additional utility and benefits, including higher sulfur removal efficiencies and/or more efficient sulfur reagent (e.g. SOx sorbent) utilization.

(1) Prior Art

Dry Scrubbing & Activated Carbon Impregnation a. Dry Sorbent Scrubbing: Various technologies have been developed to remove sulfur oxides (SOx) from combustion flue gases. The most common are wet and dry scrubbing technologies. Wet scrubbing technologies use liquids to absorb gaseous SOx and chemically convert them to compounds that can be physically removed from the flue gas. In contrast, dry scrubbing technologies use solids to adsorb the gaseous SOx and chemically convert them to particulate compounds that can be readily collected in particulate control devices. The adsorbing solids are commonly referred to as sorbents. Dry scrubbing technologies are further classified by the type of sorbent injection: solids (dry) or slurry (wet). The slurry injection is currently capable of higher SOx removal efficiencies, but requires higher reaction times at lower temperatures with higher capital and operating costs. Sorbent injection of dry solids is the scrubbing technology that is most similar to the present invention, and is discussed below in greater detail.

Various chemical compounds containing alkali metals and alkaline earth metals (Periodic Table Groups IA and IIA) have been used as dry sorbents to remove sulfur oxide emissions from the exhaust gas of combustion systems. Three primary types of dry sorbents are as follows:

1. Calcined Lime (CaO) convert SOx to $CaSO_4$ at temperatures of 1600-2300° F.
2. Hydrated Lime (Ca(OH) 2) converts $SO_2$ to Ca $SO_3$ at <1020° F. down to saturation.
3. Sodium Carbonates convert SOx to $Na_2SO_4$ at temperatures of 275-400° F.

Typically, the sulfur oxides (SOx) are first adsorbed and then chemically converted to chemical compounds. The sulfur-bearing compound is normally inorganic and a dry, particulate at the temperature of the particulate control device. Thus, the sulfur bearing particulate is collected and the sulfur oxide emissions are reduced. The overall reduction of sulfur oxide emissions is primarily dependent on (1) sorbent type and amount (i.e. sorbent stoichiometric ratios), (2) injection temperature and thermal profile of the combustion process, (3) sorbent calcine surface area, (4) sorbent particle size, (5) initial SOx level, and (6) associated reaction equilibrium and reaction kinetics, including associated limitations.

The following limitations often hinder favorable reaction kinetics (e.g. calcium sorbent):

1. Bulk diffusion of SOx to the sorbent particle (e.g. CaO)
2. Diffusion of SOx through the pores of sorbent (e.g. CaO)
3. Diffusion of SOx through the layer of converted sulfur compound (e.g. $CaSO_4$)
4. Filling of the small pores causing a decrease in reactive area
5. Buildup of converted sulfur compound (e.g. $CaSO_4$) at pore entrances causing pore closures
6. Loss of surface area due to sintering (i.e. high temperature exposure)
7. Reduced kinetic reaction rates at low temperatures Consequently, equilibrium is seldom achieved and greater stoichiometric ratios are required to overcome these limitations to achieve higher SOx removal efficiencies. Sorbent to sulfur ratios on the order of 1.5-2.0 are usually required to achieve SOx removal efficiencies >50%.

The point(s) of sorbent injection is also a major factor in determining SOx removal efficiency. As noted above, each type of sorbent has an ideal temperature window to react with the sulfur oxides (i.e. SOx). As such, injection of the sorbent upstream of this temperature window is necessary to allow ample mixing time and reaction time in these temperature zones. For example, calcined lime (CaO), derived from various possible sorbents, typically requires a temperature window about 1600 to 2300 degrees Fahrenheit (° F.). Thus, injection in the furnace is desirable. Injection temperatures typically range from 1800 to 2700° F. However, high flame temperatures, particularly at temperatures>2500° F., can sinter the sorbent's crystalline structure. Sintering normally decreases reactive sorbent surface area and access to it. In fact, mixing pulverized, calcium sorbents (e.g. limestone) with solid fuels has been tried with lower SOx removal effectiveness due to severe sintering in the high temperature flame zones. Consequently, a separate system is normally required to inject SOx sorbents downstream of the high-temperature, flame zones. Unfortunately, more than one injection point is often necessary to inject the sorbents into the proper temperature window for different boiler loads. That is, one injection point often has significantly different temperatures for different boiler loads, reducing sorbent effectiveness and average SOx removal.

b. Impregnation of Activated Carbon: Activated carbons have been impregnated with various organic or inorganic chemicals for three primary reasons:

(1) Optimization of Existing Properties of Activated Carbon: Catalytic oxidation of organic and inorganic compounds is one example of an existing property of activated carbon. Impregnation of the activated carbon with potassium iodide can promote additional/controlled oxidation and optimize this property. Other examples also exist.

(2) Synergism Between Activated Carbon and Impregnating Agent: Activated carbon and sulfur is one example of such synergistic effects of the sulfur impregnating agent for the efficient removal of mercury vapors from gases at low temperatures. Other types of synergism exist.

(3) Use of Activated Carbon as an Inert Carrier Material. The impregnation of phosphoric acid on activated carbon for ammonia removal is an example of activated carbon as an inert porous carrier material. In this case, the internal surface of the activated carbon adsorbs the ammonia at certain reaction sites. The weak Van der Waals forces of adsorption allow the ammonia molecules to migrate along the internal surface of the carbon to the phosphoric acid's reaction sites. The ammonia then reacts with the phosphoric acid to form ammonium phosphate. This two-step reaction mechanism is commonly referred to as chemisorption.

The manufacture of impregnated activated carbons is achieved by two basic methods: soaking impregnation or spray impregnation. Soaking impregnation consists of soaking an activated carbon of suitable quality with solutions of salts or other chemicals. In the spray impregnation, the suitable activated carbon is sprayed in a rotary kiln or in a fluidized bed under defined conditions. In either case, the wet, impregnated activated carbon needs to be dried in an appropriate drier (e.g. rotary kiln or fluidized bed drier). In some applications, the impregnating agents are present as hydroxides, carbonates, chromates, nitrates, or other complex ion forms. In these cases, the impregnating agent must be subjected to thermal treatment at temperatures of 300 to 400° F. to decompose the anions. After drying and/or other post-impregnation treatment steps, the desired impregnating agent remains on the internal surface of the activated carbon.

Limited and homogeneous distribution of the impregnating agents on the internal surface of an activated carbon is important. In addition, blocking of macropores, mesopores, and micropores should be avoided in order to keep the impregnation agent accessible for the adsorbed reactants. Though impregnation: agents are typically up to 30 wt. % of the impregnated activated carbon, the impregnating agent is predominantly distributed in the micropore system with minimal pore blockage in many types of successful impregnation. For example, activated carbon has been successfully impregnated with 15 wt. % sulfur with a fairly uniform distribution of sulfur in a monomolecular layer on the internal surface of the activated carbon. The impregnation only reduced the micropore system's surface area from 742 to 579 $m^2/g$. In this manner, the sulfur-impregnated activated carbon not only removes mercury via sulfur chemisorption, but also provides substantial adsorptive removal of other gas impurities. Similarly, other impregnated activated carbons can achieve limited, homogeneous distribution of up to 30 wt. % impregnating agent, predominantly in the micropore system, without plugging vital passage ways throughout the activated carbon's pore systems.

(2) Present Invention

Adsorption/Impregnation of Modified Pet Coke; Sulfur Reagents

Unlike the prior art, the present invention incorporates sulfur reagents (e.g. sorbents) in the fuel, providing superior performance and substantial advantages over the prior art. That is, the present invention can integrate these various types of reagents for sulfur removal within the porous crystalline structure of the modified petroleum coke. In so doing, any sulfur reagents are generally shielded from the high flame temperature (i.e. sintering) until the petroleum coke char is oxidized. In this manner, the desired reagent crystalline structure is maintained to achieve higher sulfur removal efficiencies and, in many cases, eliminate the need for a separate sorbent injection system. Furthermore, the monomolecular to di- or tri-molecular layers of sorbents are less prone to the detrimental effects of sintering due to less blockage of reactive sorbents with altered sorbent crystalline structure. At the same time, several of the reaction kinetic limitations of the prior art are substantially reduced to improve the sulfur removal efficiency and/or increase efficiencies of reagent utilization (i.e. lower stoichiometric ratios). The integration of these chemical reagents into the porous structure of the modified petroleum coke is the key. Similar to the soaking impregnation of activated carbon, the aqueous coke quench solution carries the desired reagents into the macropores, mesopores, and micropores of the pet coke in the quench cycle of the coking operation. This novel process of impregnating the highly porous, modified pet coke can be summarized in (1) selection of appropriate sulfur reagent(s), (2) preparation of the coke quench solution, (3) modification of quench cycle in coking operation, (4) impacts of pet coke pulverization, and (5) the performance of reagents in the combustion of the modified pet coke.

a. Selection of Appropriate Sulfur Reagents: The selection of optimal sulfur reagents (including traditional SOx sorbents of the prior art) for a particular application is dependent on many factors; primarily reactivity, selectivity, temperature sensitivity, resistance to sintering, solubility, and costs. As noted above, traditional SOx sorbents are generally selected from the class of inorganic compounds that contain alkali metals and/or alkaline earth metals (Periodic Table Groups IA and IIA). However, the present invention should not be limited to these compounds, but also include any other chemical compound that readily reacts with sulfur (with or without adsorption) and forms particulate compound(s) that is readily collected from the flue gas stream.

Evaluation of the optimal sulfur reagent can vary significantly for each combustion application. The sulfur reagents' reactivity, selectivity, temperature sensitivity, and resistance to sintering all relate to the reagent's ability to efficiently convert primarily sulfur to collectible compound(s). The reagent's effectiveness and desirability depend on the required sulfur removal and the temperature profile under various loads for the specific combustion system. In many cases, the sulfur reagent's resistance to sintering is not a major factor due to the coke char insulation of the reagent crystalline structure in the current invention. However, this mechanism of sintering prevention, can vary substantially in different combustion applications due to firebox/burner design and operation. That is, the need for timely coke char burnout in firebox hot zones (e.g. >2300° F.) and the required particle size distribution of the modified pet coke can make this more difficult to achieve in some cases. Consequently, the reagent's resistance to sintering can become a significant factor, considering this reagent injection in the fuel. However, as noted earlier, the detrimental sintering effects are substantially reduced form the prior art due to the relatively minor thickness (i.e. layers with <5 sorbent molecules thick; preferably 1 sorbent molecule thick) of the sorbents within the pet coke pores.

In addition, solubility characteristics and costs of different sulfur reagents can also vary significantly for each refinery coker application. The required solubility characteristics is dependent on the coker's coke quench characteristics and process requirements. The costs can vary significantly with the required quantity of reagent for desired sulfur removal and the required preparation of the coke quench solution. The delivered price of various reagents can vary, particularly in relation to reagent source proximity and types of transportation available.

Overall, the preference rank of sulfur reagents is generally the same among different applications. However, all of these factors can vary significantly for different applications, particularly cost. Consequently, these factors must be considered in each application, and the optimal sulfur reagent selected accordingly. One skilled in the art can evaluate these various factors to determine the optimal reagent for a particular application.

b. Preparation of Coke Quench Solution: The preparation of coker quench solution primarily involves the addition of the sulfur reagent of choice to the quench water of the coking cycle. The water solubility of the chosen reagent is a primary consideration. For example, sulfur reagents containing alkali metals (Periodic Table Group IA) are generally highly soluble in water. In contrast, sulfur reagents containing alkaline earth metals (Periodic Table Group IIA) usually have limited solubility in water. Ideally, the desired quantity of reagent (i.e. reagent/sulfur ratio) can be added to the modified pet coke via a sub-saturated, saturated, or supersaturated solution of the reagent in the quench water. Alternatively, a saturated solution of reagent with suspended reagent solids in the quench water can be used, as long as the reagent is pulverized to the smallest practical size distribution (e.g. 95%<4 microns) feasible.

The coker reagent/quench solution primarily depends on the required quantity of reagent to achieve the desired SOx removal, the reagent's solubility, and the quantity of quench solution required by coker process needs. In most cases, keeping the quantity of quench solution relatively constant is desirable. In some cases, however, increasing the quantity of quench solution may be desirable to decrease the required amount of suspended reagent solids in a saturated quench solution. One skilled in the art can readily determine the proper quantity of reagent based on desired reagent/sulfur ratios. Furthermore, one skilled in the art can determine the desired quantity of quench solution based on coker process requirements, reagent solubility, and process equipment capabilities. In cases using saturated solutions with suspended reagent solids, the reagent should be pulverized to the lowest practical size distribution (e.g. <4 microns; preferably <2 microns) to promote integration into mesopores and macropores and minimize plugging of pores. It should be noted that the quench solution in many cokers already contain sludges from other refinery processes without significant plugging problems. These sludges often contain suspended solids with solid particles >75 microns (or micrometers).

c. Modification of Coker Quench Cycle: The quench cycle of the coking operation provides the mechanism to impregnate the porous, modified pet coke with sulfur reagents. Whether saturated, supersaturated, sub-saturated, or saturated with suspended reagent solids, the quench solution is pumped through the solidifying coke mass in a manner that is very similar to the current quench cycle. This quenching process forces the quench solution under high pressure through the internal pores of the modified pet coke, and provides significant advantages over most methods used to impregnate activated carbon. However, some slight modifications may be necessary to accommodate any excessive suspended reagent solids and potential for plugging. One skilled in the art can determine the need for modifications of equipment or process parameters, based on equipment and process specifications.

As the quench solution passes through the hot, solidifying coke mass (temperatures>solution boiling point at process conditions), most of the water in the aqueous quench solution evaporates and leaves the desired reagent integrated in the pet cokes crystalline structure. Similar to crystallization from solutions, initial evaporation of the quench solution will create a supersaturated solution of the reagent. Nucleation (via coke crystals or otherwise) is expected to induce reagent crystal growth on the pet coke surface at a molecular scale (e.g. <2 nanometers). Similar to the impregnation of activated carbon, molecular layers of reagent can be uniformly deposited on a limited amount of internal surface area (predominantly micropores). These molecular layers are typically less than 5 reagent molecules thick (preferably 1 molecule thick). In this manner, the reagent can be deposited somewhat uniformly in the macropores, mesopores, and preferably micropores of the modified petroleum coke of the current invention. Again, by definition, these pores have the following rough diameter sizes: macropores >50 nm (nanometers); mesopores=2 to 50 nm; and micropores <2 nm.

A saturated solution (or slightly sub-saturated solution) of sulfur reagent should be continually used for further cooling and coke cutting. After the coke has cooled sufficiently and quench water evaporation no longer occurs (temperatures<solution boiling point at process conditions), the saturated (or sub-saturated) quench solution for further cooling avoids excessive leaching of the reagent from the internal surface of the coke (i.e. reagent solubility in non-saturated quench solution). For the same reason, a saturated solution (or slightly sub-saturated) should also be used for the cutting water that cuts the coke from the coke drum.

After cutting the coke from the drum, some of the reagents deposited on the macropore walls will become part of the external surface of the coke chunks (preferably diameter=6-24 inches). This potentially exposes these reagents to weathering during transport. The resistance to water flow through the internal pores at ambient, atmospheric conditions limits weathering effects to mostly the external surface. In contrast, most of the reagents deposited in micropores, mesopores, and some macropores will still be part of the internal surface of the coke chunks. The proportion of each will depend on the coke crystalline structure and the type/degree of coke cutting. That is, the internal surface area increases as the porosity of the sponge coke increases with predominantly micropores and mesopores. The greater the internal surface area, the greater the protection of the reagent from weathering and high flame temperatures (discussed later). This further emphasizes the utility of the process options of the current invention for increasing the pet coke porosity beyond traditional sponge coke porosity, if necessary.

d. Impacts of Pet Coke Pulverization: The pulverization of the modified pet coke can affect the reagent utilization. In many applications, the modified petroleum coke will normally be pulverized at the end-user's facility immediately prior to combustion. In these cases, additional reagent will normally be exposed to the flame zone on the external surface of the coke. The quantity of reagent exposed in this manner is primarily dependent on the pet coke crystalline structure and the type/degree of pulverization. As noted previously, the deposition of reagent is predominantly in the micropores in many cases (similar to impregnation of activated carbon). Also, the pet coke crystalline structure can be controlled, to a certain degree, by the process options of the current invention. The type and degree of pulverization depends on the pulverizers and combustion requirements at the end-user's facility. Again, as noted earlier, the detrimental sintering effects are substantially reduced form the prior art due to the relatively minor thickness (i.e. layers with <5 sorbent molecules thick; preferably 1 sorbent molecule thick) of the sorbents within the pet coke pores.

For example, pulverization can range from >60 to >95% passing through 200 mesh (i.e. <75 microns), depending on the particle size distribution required to complete combustion before the furnace exit. This depends on the combustor's design and operation, the fuel mix, and the combustion characteristics of the modified petroleum coke. During pulverization, some of the sulfur reagent may actually be separated from the modified pet coke, but most should remain with the fuel. In many cases, the molecular nature of the sulfur reagent will substantially reduce the impact of exposure to high flame temperatures in the combustion process. That is, the detrimental effects of sintering are greatly reduced because the amorphous crystalline layer of sintering limits access to only a few molecular layers, if at all. In contrast, sintering of larger particles (e.g. 1-40 microns) in the prior art can block a much higher percentage of internal reactive surfaces of the larger sorbent crystalline structures.

e. Performance of Reagents in the Combustion of the Modified Pet Coke: During the combustion of the modified pet coke, the sulfur reagents in the coke crystalline structure react with the fuel sulfur in a manner that normally increases the prior art's SOx reduction for a given sulfur reagent/sulfur ratio. The improved performance is attributed to a combination of factors, including (1) reduced sintering effects, (2) improved reaction mechanisms, and/or (3) reduced kinetic reaction limitations (vs. the dry sorbent scrubbing of the prior art).

As noted in the prior art discussion, sintering is a primary cause for the reduction of SOx removal and sorbent utilization efficiencies in the prior art. That is, sintering effectively changes the sorbent crystalline structure, reducing porosity and adsorption effectiveness. With the present invention, the impact of sintering is mitigated by the following primary mechanisms:

(1) Sulfur reagents can be effectively insulated from the hot flame by the shelter of the surrounding pet coke char (i.e. minimal thermal conductivity or high insulating properties of covalent bonded materials such as polymeric hydrocarbon structure of pet coke char). For most of the reagent on the internal pores of the char, this sintering protection is provided until downstream of the primary flame, where the pet coke char is oxidized and consumed at flue gas temperatures of 1600-2800° F., (preferably 2100-2300° F.). That is, the devolatilization and the primary flame zone typically occur in the first 0.01 to 0.10 seconds. In contrast, the char usually is oxidized and consumed after 1 to 2 seconds. and/or (2) The molecular nature of the sulfur reagent substantially reduces the detrimental effects of sintering. That is, access to many reactive sorbent molecules deep inside a large crystalline structure (1-40 microns) are inhibited by sintering in the prior art. In contrast, the molecular nature of the impregnated reagent of this invention (e.g. deposited in molecular layers <2 nanometers) severely limits the loss of access to reactive sulfur reagents due to sintering.

With limited impact from sintering, the reactive reagents are more effectively utilized in the conversion of fuel sulfur to sulfur compounds that are collectible in particulate control devices. Consequently, sulfur conversion will depend more heavily on the decomposition or breakdown rate of sulfur compounds within the coke.

The sulfur in the petroleum coke is primarily tied up as thiophenes in heavy hydrocarbons (e.g. aromatics, asphaltenes, and resins) of the coke char. As temperatures of the coke char exceed 1000° F., the heavy hydrocarbons thermally crack and release sulfur from tight chemical bonds. The resulting sulfur (or sulfur compound) tends to oxidize before the fixed carbon of the coke char. Thus, gaseous sulfur oxides are typically formed prior to the complete oxidation of the char. In addition, the thermal cracking and volatilization of the low-quality VCMs (i.e. boiling points >750° F.) in the modified coke of the current invention is expected to provide greater mass transfer in the internal pores and expose reagent layers on the pet coke's surface. Again, VCMs are Volatile Combustible Materials as defined by ASTM Method D 3175. As a result, sulfur adsorption and conversion can be achieved by various mechanisms, including:

(1) Oxidation of coke sulfur compounds to gaseous sulfur oxides that migrate to the adjacent reagent molecules. SOx adsorbed by reagent molecule and SOx chemically converted. Adsorption can take place either within or outside the pet coke particles or char.

(2) Similar to chemisorption associated with impregnated activated carbon, the gaseous sulfur oxides from oxidation of coke sulfur compounds are adsorbed by the coke crystalline structure and chemically converted by the sulfur reagent: via migration to reaction sites.

(3) Sulfur compounds (not in traditional oxide form) are released from the breakdown of the coke sulfur compounds. These sulfur compounds are adsorbed by the pet coke crystalline structure and chemically converted by the sulfur reagent. This mechanism is more likely with non-traditional reagents that react with non-oxide forms of sulfur. And/or (4) As the char of the modified coke is oxidized/consumed at temperatures of 1450-2000° F., unreacted reagent is released from the coke with substantially less sintering (vs. limestone or lime mixed with fuel). This unreacted reagent adsorbs and converts sulfur oxides (from coke or other fuels) in a manner similar to traditional dry sorbent injection of the prior art.

In this manner, the present invention not only reduces the impact of sintering on sulfur reagents in the furnace, but provides alternative mechanisms of adsorption and chemical conversion to achieve the desired SOx removal efficiencies.

The present invention also substantially reduces several of the kinetic reaction limitations for the sulfur sorbents described in the prior art: dry sorbent scrubbing:

(1) Bulk diffusion of SOx to the reagent as a reaction constraint is greatly reduced. The reactive sulfur reagents are contained in the pet coke crystalline structure, surrounded by or adjacent to the area of highest sulfur concentration: the pet coke itself. Regardless of the adsorption and chemical conversion mechanism, the sulfur and reagent are in close proximity.

(2) In general, sulfur reagents of this invention have substantially smaller particle size distribution (e.g. diameters <2 nanometers vs. <1-40 micrometers). Thus, kinetic reaction limitations 2.-5. (described in prior art: dry sorbent scrubbing) become far less significant. That is, the very small reagent particles substantially reduce the ratio of sulfur molecules adsorbed per reagent particle, mitigating concerns of sulfate layers and pore pluggage.

(3) Sulfur reagents of the current invention are activated and/or released in a reactive form well ahead of the desired temperature window for reagent adsorption and chemical conversion of sulfur compounds (e.g. sulfur oxides).

For a given application, the performance of the sulfur reagents (or sorbents) in the combustion of the modified pet coke is significantly improved due to any one, a combination, or all of these factors. Also, the performance of the sulfur reagents can be further optimized by controlling the pet coke char burnout and the availability of the sulfur reagents. In turn, the char burnout and availability of the sulfur reagent can be controlled, to a certain degree, by the coke particle size distribution, VCM quality, and VCM content of the modified pet coke. The current invention should not be limited by the foregoing theories of mechanisms and operability, but be used as the bases for optimizing the technology for different types of applications.

The process options to increase sponge coke porosity and VCMs beyond traditional sponge coke become more important to optimize the balance between improving combustion characteristics and achieving adequate SOx removal. In many cases, these features will remain congruent and work together. In other cases, however, these features of this invention need to be optimized to strike a realistic balance for the individual applications of this technology. Thus, the current invention should not be limited by the general theories exposed herein, but encompass the practical application of this technology to the individual circumstances of each situation. That is, the general theories can be used as a guide, but may not specifically apply to all applications. One skilled in the art can modify the coker process to optimize this technology for each application and remain in the spirit and intent of the current invention.

(3) Exemplary Embodiment

SOx Sorbent=Calcitic Hydrated Lime

In an exemplary embodiment, calcitic hydrate (alias calcitic hydrated lime, high calcium hydrated lime, or calcium hydroxide $Ca(OH)_2$) is impregnated on the porous pet coke. This exemplary embodiment can best be summarized by again reviewing (1) selection of desired sulfur reagent (e.g., calcitic hydrate), (2) preparation of the quench solution, (3) modification of quench cycle in the coking operation, (4) pulverization of the pet coke fuel, and (5) performance of the calcitic hydrate in the combustion of the modified pet coke.

a. Selection of Calcitic Hydrate as Sulfur Reagent: In general, calcitic hydrate may be selected as the most desirable sulfur reagent, primarily due to its low costs, reaction temperature window, high reactivity, and resistance to sintering. In this invention, reagents with alkaline earth metals (Periodic Table Group IA) may be preferable to reagents with alkali metals (Periodic Table Group IIA) due to higher reaction temperature windows (800-2600° F. vs. 250-350° F., respectively). That is, alkali metal reagents added to the modified pet coke may form less desirable compounds (e.g. sodium vanadates) prior to reaching the proper temperature window in the combustion system (i.e. downstream of the economizer). In contrast, the reagents with alkaline earth metals may be injected via the modified pet coke into their regions of greatest sulfur reactivity (furnace through economizer).

Calcium is generally the alkaline earth metal with the greatest sulfur reactivity and the lowest cost. Among the calcium reagents, hydrated limes (e.g. calcitic & dolomitic) have the highest SOx removal capabilities, primarily due to higher specific surface areas (10-21 $m^2/g$ vs. <6 $m^2/g$) than carbonate forms (e.g. limestone & dolomite). In furnace zones exceeding 2000° F., calcitic hydrate (i.e. $Ca(OH)_2$) derived from limestone generally calcines/dehydrates with a continual decrease in surface area; primarily due to sintering. With the reduced impact of sintering in this invention, the calcitic hydrate has SOx removal capabilities up to and sometimes exceeding 75% (vs. 60% in the prior art). In contrast, dolomitic hydrates ($Ca(OH)_2$ with MgO or $Mg(OH)_2$) calcine with a substantial increase in surface area in the prior art, and demonstrate higher SOx removal capabilities. As such, dolomitic hydrates have a greater resistance to sintering. With the current invention, dolomitic hydrates have SOx removal capabilities up to 90% (vs. 75% in the prior art). However, the magnesium in the dolomitic hydrates is usually chemically inert. Though it improves calcium utilization, the magnesium can detrimentally impact total ash loading, ash fouling characteristics, and ash reuse/disposal. In addition, dolomitic hydrates, particularly the often-preferred dihydrated form, has significantly higher costs (e.g. production & transportation). One skilled in the art can evaluate these various factors to determine the optimal reagent for a particular application. In general, though, calcitic hydrate may be selected as the desired reagent due to lower costs, related ash character & loading, solubility characteristics, and the mitigation of sintering effects offered by this invention. Consequently, the remaining discussion of the exemplary embodiment will examine the impregnation of calcitic hydrate on the pet coke.

b. Preparation of Coke Quench Solution: The preparation of coker quench solution involves adequate addition of calcitic hydrate to the quench water for the decoking cycle. This can be accomplished by various means, including (1) the direct addition of commercially available calcitic hydrate or (2) the addition of commercial calcitic lime (i.e. quick lime CaO) that partially or fully converts to the hydrated form. Commercial calcitic hydrate is normally prepared from hydration of calcitic lime with particle agglomeration before shipment. Generally, the calcitic hydrate is 72-74 wt. % calcium oxide (CaO) and 23-24 wt. % percent chemically combined water. Either approach can be accomplished on-site (i.e. at the coker) with additional equipment for storage, mixing, settling, etc. The latter approach, completed on-site, may generally be preferred due to lower costs, potential use of the high heat of solution, and the development of a finer crystalline structure. That is, the hydrated form of the second approach (e.g. without agglomeration) tends to have a crystalline form with finer particle size than typical commercial production of calcitic hydrate from quick lime. However, insufficient purity of calcitic hydrate (vs. a combination of calcitic hydrate and calcitic lime) is a potential drawback of the second approach. However, in some cases, this combination can be preferable, if the calcitic lime is uniformly deposited on the pet coke internal pores without the additional water of the hydrated form.

In either approach, the quench solution becomes a saturated or sub-saturated solution of calcitic hydrate (i.e. $Ca(OH)_2$) in water. The saturated solution is preferable (vs. suspended solids of pulverized calcitic hydrate) to maximize molecular deposition of calcitic hydrate in the mesopores, macropores and preferably micropores of the modified pet coke and to greatly reduce pluggage of any pores. The saturated quench solution can be used in the following cases: (1) low to medium coke sulfur levels (e.g. <4.0 wt. %), (2) low to medium SOx removal required (e.g. <50%), and/or (3) high water quench rates (e.g. >200 gallons/ton of coke). Items (1) and (2) relate to the mass of calcitic hydrate required (i.e. stoichiometric ratio of Ca/S required to achieve a desired SOx removal level). The Ca/S ratio of the current invention ranges from 0.1 to 4.0 (preferably 0.5 to 2.0) to achieve SOx removal levels up to and exceeding 75%. Item (3) refers to the quantity of quench water available to incorporate the required calcitic hydrate within solubility limits (i.e. saturated or sub-saturated solution). Since the current invention promotes increasing coke VCM, water quench rates can be increased by reducing quantities of steam at the beginning of the decoking cycle to strip out trapped hydrocarbon liquids and initiate coke cooling.

For example, a coker currently produces 1000 ton/day of pet coke with 4.0% sulfur. The utility boiler requires <50% reduction in the SOx of the pet coke portion of the coke/coal blend. If the Ca/S stoichiometric ratio required to achieve this level is 1.5, the daily amount of calcitic hydrate required in the pet coke is roughly 277,500 pounds ($1000\times2000\times0.04\times74/32\times1.5$). At atmospheric pressure, the solubility of calcitic hydrate in pure water is roughly 0.165 grams/cc at 20° C. and 0.077 g/cc at 100° C. This translates to approximately 1.4 lb./gallon and 0.6 lb./gallon, respectively. The saturated quench solution that is totally evaporated in the quench process deposits all of the calcitic hydrate in solution (i.e. 1.4 lb./gal.) on the internal pores of the modified coke. The saturated quench solution that finishes the coke cooling without evaporation will deposit additional calcitic hydrate (e.g. 0.8 lb./gal.=1.4-0.6) due to calcitic hydrate's lower solubility at the elevated temperature (~100° C.). If 80% of the saturated quench solution is evaporated in coke cooling, roughly 216,800 gallons (i.e. 173.4 Mgals. evaporated & 43.4 Mgals heated) of saturated quench solution would be required each day. If higher quench water rates are used for process needs (e.g. 200 gal/ton of coke vs. 173.4), the quench solution can be sub-saturated. In addition, the actual solubility for each application will need to consider the effects of process cooling requirements, process temperatures, process pressures, and local water conditions. If necessary, certain chemical agents can be added to the water to increase the solubility of the calcitic hydrate in water. One skilled in the art can make these adjustments in quench solution preparation for each coker application.

c. Modification of Coker Quench Cycle: In the coker quench cycle, the saturated solution of calcitic hydrate serves as the quench water and provides the mechanism to impregnate the porous, modified petroleum coke with calcitic hydrate. As noted previously, steam stripping (i.e. "steam out") may be reduced to keep more VCM on the coke and allow more water (vs. steam) for cooling the coke. In fact, the saturated calcitic hydrate solution is expected to have a significantly lower vapor pressure than the normal quench water. This can effectively elevate the vaporization temperature of the quench water: allowing earlier use of quench water (vs. steam) without causing excessive pressure buildup in the coke drums. As noted previously, the saturated quench solution is pumped through the solidifying coke mass in a manner that is very similar to the current quench cycle.

As the calcitic hydrate quench solution passes through the hot, solidifying coke mass (temperatures>solution boiling point at process conditions), most of the water in this aqueous quench solution evaporates and leaves the desired calcitic hydrate integrated in the pet cokes crystalline structure. That is, molecular layers of calcitic hydrate are deposited on the internal surface of the pet coke, preferably in micropores and mesopores. After the coke has cooled sufficiently (temperatures>solution boiling point at process conditions), evaporation of the quench solution stops. However, the saturated solution of the calcitic hydrate continues to deposit calcitic hydrate on the coke surface due to lower solubilities at elevated temperatures. In this manner, much of the calcitic hydrate is uniformly deposited on coke surface in layers <5 molecules thick (preferably 1 molecule thick). That is, the use of a saturated solution provides deposition at the molecular level (e.g. 0.5 to >10 nanometers). In contrast, larger crystalline particle sizes (e.g. 1 to 4 microns or 1000 to 4000 nm) are associated with suspended calcitic hydrate solids or the traditional addition of pulverized sorbent in the prior art. Thus, most of the calcitic hydrate reagent is deposited in the micropores and mesopores as well as the macropores. However, this invention should not be limited by this theory of operation.

While cutting the coke from the coke drums, a saturated solution of the calcitic hydrate should be used for cutting water. This avoids leaching of the calcitic hydrate from the internal surface of the coke due to calcitic hydrate solubility in a non-saturated cutting solution. After cutting from the drum, reagent may be exposed to weathering during shipment and storage. However, rainwater will primarily wash off reagent on exterior surface due to resistance to flow in the micropores and mesopores. Either weather protection or the addition of sufficient calcitic hydrate is needed to offset this potential problem.

d. Impacts of Pet Coke Pulverization: Pulverization of the modified petroleum coke can expose significant amounts of the calcitic hydrate to flame temperatures. In traditional sorbent injection of the prior art, high temperature exposure causes sintering of calcitic hydrate, that reduces SOx removal effectiveness. However, sintering is a phenomenon that primarily affects large crystal structures: reactive sorbent is sealed in the crystalline structure due to blockage of access via sintering. Sintering is not expected to be a major factor in the current invention due to the molecular nature of the calcitic hydrate. That is, amorphous crystalline change of the calcitic hydrate, which is one to several molecules thick, does not significantly affect access to unreacted reagent. Thus, sintering is expected to have substantially less impact on the calcitic hydrate exposed to flame temperatures as a molecular coating of the external coke surface in the current invention. However, this theory of operation should not hinder or limit the patentability of this current invention.

e. Performance of Calcitic Hydrate in the Combustion of the Modified Pet Coke: During the combustion of the modified pet coke, the impregnated calcitic hydrate transforms to a more reactive calcitic lime (CaO). Throughout the various stages of combustion, the modified pet coke of the current invention effectively (1) protects the lime's reactive surface area, (2) reduces the traditional kinetic reaction limitations of dry scrubbing in the prior art, and (3) provides an exemplary reaction environment with additional reaction mechanisms. As a result, the impregnated calcitic hydrate normally achieves a significantly higher reduction of sulfur oxides than dry scrubbing in the prior art for a given calcium/sulfur ratio.

In the initial stage of combustion, the modified pet coke of the current invention protects the impregnated calcitic hydrate from high flame temperatures, mitigating sintering effects. In a conventional pulverized coal burner, the pulverized pet coke, like coal, is pneumatically conveyed via primary combustion air through the coal nozzle of the burner into the hot furnace. In the first 0.01 seconds, the hot furnace temperatures vaporize inherent moisture and devolatilize the high quality VCMs (e.g. boiling point <750° F.) in the modified pet coke. These gases (i.e. steam and vaporized hydrocarbons), exiting the coke pores, tend to prevent diffusion of hot gases from the primary flame into the coke's internal pores. The devolatilized VCMs are oxidized in the first 0.10 seconds, burning in the primary flame zone. As noted previously, the current invention mitigates detrimental effects of sintering due to (1) protection from exposure to hot flame zones via surrounding coke char with good insulation properties and/or (2) molecular nature of the calcitic hydrate layer on the internal surfaces of the modified pet coke. The remainder of the petroleum coke is the pet coke char, including its polymeric crystalline structure (e.g. heavy aromatic hydrocarbons and fixed carbon), calcitic hydrate, sulfur, and minimal ash.

The pet coke char's rate of oxidation is a key factor in the adsorption and chemical conversion of pet coke sulfur. The pet coke char undergoes various reactions over the next 1-2 seconds. As expected, the char oxidation and higher temperatures predominantly initiate on the external surface and work inward. The char oxidation rates primarily depend on local temperature, oxygen diffusion, particle size, and char reactivity. As the local temperature of the internal coke char increases, furnace temperatures of combustion products (i.e. flue gas) decrease. The oxidation of pet coke char often occurs at local temperatures of 950-1600° F. The external surfaces of the pet coke char are closer to flue gas temperatures of 3000-3200° F. just after the primary flame. In many pulverized coal boilers, this flue gas temperature decreases to 1700-2000° F. at the superheater tubes. At the higher temperatures, mass transfer of oxygen to the coke char particle is normally the rate-controlling step, in most cases. Thus, oxidation of the pet coke char is minimal in the primary flame zone due to predominant oxygen consumption by vaporized VCMs. After this primary flame zone, char with larger particle size (>30 microns) and/or high mass-to-surface area heat up more slowly and oxidize less quickly. Also, larger char particles tend to lose mass before volume due to the formation and loss of carbon monoxide and carbon dioxide from internal pores. This phenomenon indicates oxygen diffusion into the internal pores prior to total oxidation of the external surface. In addition, activated carbons are capable of catalytic oxidation of organic and inorganic compounds. That is, the oxygen molecules are adsorbed on the activated carbon surface and broken into very reactive radicals. This oxygen activation by the activated carbon is the actual catalytic step. Similarly, the modified coke of the current invention, can adsorb and activate oxygen molecules. The resulting oxygen radicals will tend to react with the sulfur ions or compounds within the coke pores at a significantly lower temperature than traditional sulfur combustion. Consequently, the pet coke char's rate of oxidation can be effectively controlled by the pet coke's particle size distribution. This is usually controlled by the design and operation of the end-user's pulverization equipment. However, a larger coke particle size distribution can increase the amount of unburned carbon and decrease combustion efficiency. Therefore, a realistic balance must be achieved between the need to complete char oxidation before the furnace exit and the desire to maintain a conducive environment for SOx conversion and removal.

After the primary flame zone, the pet coke char provides a reaction environment that promotes the adsorption and conversion of the pet coke fuel sulfur. At temperatures of about 1070° F., the calcitic hydrate loses water and transforms to calcitic lime (alias calcium oxide: CaO) with more reactive crystalline structure. This delayed release of water and its evaporation are expected to help moderate local temperatures and further mitigate sintering effects. The fresh crystallization of calcium oxide mostly occurs prior to breakdown of sulfur compounds and the oxidation of the surrounding coke char. As temperatures of the coke char exceeds 1100° F., most of the heavy hydrocarbons thermally crack and release sulfur from tight chemical bonds. The resulting sulfur (or sulfur compound) tends to readily oxidize significantly before the fixed carbon, heavy hydrocarbons, or carbon monoxide from the pet coke char. Thus, gaseous sulfur oxides are typically formed sufficiently prior to the complete oxidation of the char. As a result, adsorption and conversion of sulfur (e.g. sulfur oxides to calcium sulfate) can preferably take place, while the calcium oxide is still in the protective environment of the pet coke char. As discussed previously, this reaction environment within the internal pores greatly reduces the kinetic reaction limitations of the prior art due to the close proximity of the reactants and the molecular nature of the calcium oxide. That is, diffusion of SOx to the calcium oxide particle, through its pores, and through any calcium sulfate layers are normally not reaction rate limiting steps due to their concentrated presence in the coke pores. Similarly, the prior art's blockage and filling lime pores by the calcium sulfate is less prohibitive. In addition, the thermal cracking and the volatilization of low quality VCMs (e.g. boiling point >750° F.) are expected to provide greater mass transfer in the internal pores and expose CaO layers on the modified coke's surface.

All four of the reaction mechanisms (described above) can apply in this exemplary embodiment. Reaction mechanisms 1, 2, and 4 will likely predominate with the following primary reaction step in each: (Note: reaction can use either sulfur dioxide or sulfur trioxide).

$$CaO+SO_2+\tfrac{1}{2}O_2=CaSO_4;\ \text{where } SO_3 \text{ can replace } (SO_2+\tfrac{1}{2}O_2)$$

The desired temperature window for sulfur adsorption and this chemical conversion of sulfur oxides to calcium sulfate is 1600° F.-2300° F. Fortunately, the oxidation of the coke char is expected to occur in a similar, but slightly higher range of local temperatures. In some cases, the temperature range may be significantly different, depending on char particle size and the furnace design and operation. In most cases, the adsorption and conversion of the sulfur compounds will occur near the outer boundary of coke char particle. That is, the diffusion of oxygen to the internal pores, as well as local temperatures will be greater near the exterior surface. Since oxygen diffusion will likely be limiting, the oxidation of the sulfur compounds, adsorption and conversion to calcium sulfate can take place before, during, or after complete oxidation of the adjacent coke structure. Preferably, the majority of the sulfur will be converted to a stable calcium sulfate form prior to local char oxidation. In traditional combustion of high sulfur coal, calcium sulfate is noted to be thermochemically unstable at temperatures>2300° F. This is apparently due to competing reactions in this reactive, high sulfur environment. However, if most of the pet coke sulfur is converted to calcium sulfate prior to complete coke char oxidation, the high sulfur environment will not likely exist outside the coke char, where furnace temperatures can exceed 2300° F. Similarly, the destabilizing environment will not likely exist when the pet coke is used as a blending fuel with low sulfur coals. In the worst case scenario, the calcium sulfate will be released into furnace temperatures>2300° F. (early stages of coke char oxidation or otherwise). In this worst case, the sulfur in the calcium sulfate will likely break apart and react with other compounds or remain as SOx. If it reacts to form another sulfur salt, it can likely be collected in the particulate control device. If it remains as SOx, unreacted lime (CaO) from oxidation of coke char near the furnace exit can react at temperatures 1600-2300° F. to form calcium sulfate by the same reaction mechanism as dry scrubbing of the prior art. In either event, removal of this sulfur can still occur with downstream particulate control.

As the char of the modified coke is oxidized and consumed, excess, unreacted lime (CaO) is released from the coke with substantially less sintering (vs. lime or limestone mixed with fuel). The excess of unreacted calcitic lime is reflected in the calcium/sulfur ratio, adjusted for the SOx removal achieved. As discussed previously, most oxidation of the petroleum coke char occurs at local temperatures of 950-1600° F. Coke char oxidation is initiated on the external surface in regions of high flue gas temperatures of ~3000° F. The coke char oxidation is normally completed in flue gas temperatures down to 1700° F. Thus, unreacted calcitic lime is released into flue gas temperatures in this whole temperature range (1700-3000° F.). Ideally, most of the unreacted lime is released between 1700° F. and 2600° F. This calcitic lime release from the oxidized coke char (analogous to flue gas injection) can be effective in control of unreacted SOx, either from the pet coke or other sources (e.g. blended coal). This release of unreacted lime can be controlled to some degree by the fuel properties and the combustion characteristics of the modified coke of the current invention. That is, the modified pet coke char would primarily complete burnout in a temperature zone that minimizes sintering, but provides access to adsorption of SOx sufficiently prior to the ideal temperature window for optimal reactions. In turn, char burnout and availability of the calcitic lime can be controlled, to a certain degree, by the coke particle size distribution, VCM quality, and VCM content of the modified pet coke. In this manner, the performance of the calcitic lime as the desired sulfur reagent is significantly improved. Its performance can be further optimized (to a certain extent) in the combustion of the modified pet coke via process options of the current invention.

Any unburned pet coke char can be used for adsorption of mercury and other air toxics in the flue gas downstream of the furnace. If pet coke char remains unoxidized, some sulfur ions in the internal pores are likely to be unoxidized, as well. These sulfur ions can react with mercury, which is adsorbed on the pet coke surface, to form mercury sulfide (HgS). Sulfur impregnated activated carbons, used for mercury removal, have similar types of chemisorption reaction mechanisms. In addition, remaining pet coke char can also have sufficient porosity and surface area to adsorb dioxins and other air toxics in the flue gas from the pet coke or other sources.

(4) Other Embodiments a. Supersaturated Solutions of Calcitic Hydrate: Another embodiment of the current invention is the use of a supersaturated solution of calcitic hydrate for coke quench water. This embodiment is desirable in cases where a saturated solution of calcitic hydrate is not sufficient to achieve the Ca/S ratios required for higher coke sulfur levels and/or higher sulfur removal requirements of a particular application.

Various means can be used to achieve a supersaturated quench solution of calcitic hydrate in water. The simplest means would include the use of chilled water to increase solubility of the calcitic hydrate ($Ca(OH)_2$) in water. Unlike most solutes, calcitic hydrate or calcium hydroxide has decreasing solubility characteristics as temperature increases. Thus, chilling the quench water increases the solubility and, hence, the quantity of calcitic hydrate totally dissolved in solution. As the temperature increases, the calcitic hydrate would remain in solution as long as there are no suspended particles that nucleate and precipitate the calcitic hydrate out of solution. Also, suspended calcitic hydrate cannot be available to remain in equilibrium with the solution. This supersaturated solution could then be used as coke quench in the coker quench cycle. As such, incremental amounts of calcitic hydrate would be deposited in the internal crystalline structure of the modified pet coke. The lower temperature limit (or upper solubility limit) for this approach is less than the freezing point of the pure solvent (i.e. water @ 32° F.) due to the freezing point depression of the solvent in solution.

Unfortunately, this supersaturated solution can be difficult to achieve on a consistent basis in a coker process environment. Impurities in the recycled coke quench water (e.g. other calcium compounds or suspended coke fines) can serve as nucleation to precipitate excess calcitic hydrate out of solution before reaching the coke drums as coke quench. In addition, the preparation of the supersaturated solution may not be practical, in many cases, due to other technical and economic considerations. Furthermore, the increase in solubility of the supersaturated solution may still not be sufficient to provide the desired calcitic hydrate, totally dissolved in the coke quench solution.

b. Saturated Solution of Calcitic Hydrate with Suspended Calcitic Hydrate Solids: An alternative embodiment to the saturated or supersaturated solution (calcitic hydrate in water) would be the use of a saturated solution with suspended solids of calcitic hydrate. Again, this embodiment is desirable in cases where a saturated or supersaturated solution of calcitic hydrate is not sufficient to achieve the Ca/S ratios required for higher coke sulfur levels and/or sulfur removal requirements of a particular application. In this embodiment, the calcitic hydrate would be preferably produced without the traditional agglomeration step and/or pulverized to the smallest practical particle size distribution: <4 microns and preferably 100%<1 micron. In many cases, most of the calcitic hydrate will still be deposited out of the saturated solution onto the internal surfaces of the modified coke's micropores and mesopores. The residual lime from solution and the suspended lime solids will be deposited on the macropores. That is, much of the suspended calcitic hydrate solids (1-4 micrometers) will not be small enough to be integrated into the micropores (diameter <2 nanometers) and mesopores (d=2-50 nanometers), but deposited in the macropores (d>50 nanometers). As noted earlier, cutting the coke from the drums and pulverization to a fineness of 70-95%<200 mesh (d=~74 micrometers) can cause significant portions of the calcitic hydrate deposited on the macropore walls to become part of the external surface of the coke particles. This potentially exposes these reagents to weathering during transport and high-temperature flame zones in the combustion process, respectively. The calcitic hydrate suspended solids deposited in the coke macropores are more likely to suffer detrimental sintering effects (vs. dissolved calcitic hydrate deposited from solution). This is primarily due to their larger particle size (vs. molecular layers <2 nanometers). In contrast, the rest of the calcitic hydrates deposited on the macropore walls will still be part of the internal surface of the coke particles after pulverization. The proportion of each will depend on the coke crystalline structure and the type/degree of coke cutting and pulverization. In any case, the Ca/S ratio will likely need to be increased to compensate for losses to weathering and sintering of some suspended solids of calcitic hydrate. In many cases, this will partially offset the improvements in reagent utilization for the desired SOx removal efficiency. One skilled in the art can readily make adjustments in Ca/S ratios to achieve the desired SOx removal efficiency for a particular application of this technology.

c. Various Solutions of Dolomitic Hydrates as Coke Quench: As noted above, dolomitic limes can be preferable sulfur reagents (e.g. sorbents) to calcitic limes in some cases. In certain applications, the impregnation with dolomitic hydrates ($Ca(OH)_2$ with MgO or $Mg(OH)_2$) is preferable to calcitic hydrate due to (1) greater resistance to sintering, and/or (2) higher sulfur reactivity. Either or both of these reasons can lead to higher sulfur removal capabilities. In these cases, proper consideration should be given to additional costs, higher ash loading in boiler/particulate control device(s), and magnesium impacts on ash fouling/reuse characteristics. In many applications, however, the higher SOx removal efficiencies can be more critical than these concerns. The impregnation of the modified pet coke with dolomitic hydrates may normally be similar to the exemplary embodiment (described above). Various solutions of dolomitic hydrates can be used as coke quench in the delayed coker quench cycle: saturated, sub-saturated, and saturated with suspended dolomitic hydrate solids.

The dolomitic hydrates have two primary forms: monohydrate and dihydrate. Both forms are made form dolomitic quicklime, which is derived from limestone containing 35 to 46 percent magnesium carbonate. The monohydrate (or atmospheric hydrated dolomite) has the hydrate of quick lime (CaO) with magnesium oxide: $Ca(OH)_2.MgO$. The monohydrate typically has the following chemical composition: 46-48 wt. % calcium oxide, 33-34 wt. % magnesium oxide and 15-17 wt. % chemically combined water. The dihydrate (or pressure hydrated dolomite) has the hydrated oxides of both calcium and magnesium: $Ca(OH)_2.Mg(OH)_2$. The dihydrate typically has the following composition: 40-42 wt. % calcium oxide, 29-30 wt. % magnesium oxide and 25-27 wt. % chemically combined water. The dihydrated form of dolomitic lime (i.e. $Ca(OH)_2.Mg(OH)_2$) is normally preferable over the monohydrate form due to generally higher specific surface area and smaller particle size distribution in conventional production. Both of these factors provide incremental SOx removal.

This embodiment using dolomitic hydrates can best be summarized by again reviewing (1) selection of dolomitic hydrates as desired sulfur reagent, (2) preparation of the coke quench solutions, (3) modification of quench cycle in the coking operation, (4) pulverization of pet coke fuel, and (5) performance of the reagent in the combustion of the modified pet coke.

c1. Selection of Dolomitic Hydrates as Sulfur Reagent: The primary differences between dolomitic hydrates and calcitic hydrates are resistance to sintering, reactivity, and solubility characteristics. First, sintering studies with furnace injection of the prior art have shown that calcitic hydrates can lose up to 50% of its BET surface area in furnace temperatures>2000° F. In contrast, dolomitic hydrates can increase up to 50% in surface area in similar prior art conditions. As such, dolomitic hydrates apparently have a much greater resistance to sintering. Secondly, the sulfur reactivity of the dolomitic hydrates is enhanced by the presence of the magnesium. Though it improves calcium utilization, magnesium is essentially chemically inert in the prior art furnace injection. Also, the unreacted magnesium can detrimentally impact ash fouling characteristics, total ash loading, and ash reuse/disposal. In the prior art, studies have shown that SOx removal on a mass basis (i.e. Lbs. SOx/Lbs. Sorbent) is similar for calcitic hydrate and dolomitic hydrates. However, prior art studies have also shown that dolomitic hydrates are capable of up to 75% SOx removal vs. up to 60% for calcitic hydrate. In addition, the dolomitic hydrates in the current invention will have additional reaction mechanisms to react with non-oxide forms of sulfur (discussed below). Finally, the solubility of dolomitic hydrates is slightly higher due to the weaker bonds of a less symmetrical crystalline structure (i.e. dolomitic hydrates as a solute). Unfortunately, the degree of unreacted magnesium can offset the ability to totally dissolve a greater mass of dolomitic hydrates.

c2. Preparation of Coke Quench Solutions With Dolomitic Hydrates: Overall, dolomitic hydrates have very similar physical and chemical properties as calcitic hydrate. As such, the above discussions regarding calcitic hydrate and its associated quench solutions generally apply to dolomitic hydrates, as well. The various coke quench solutions of dolomitic hydrates are discussed below, primarily noting any significant differences:

1. Saturated and Sub-Saturated Solutions of Either Dolomitic Hydrate: The solubility of dolomitic hydrates are generally higher than calcitic hydrate due to their weaker crystalline structures with the presence of both magnesium and calcium (i.e. vs. pure $Ca(OH)_2$ or pure $Mg(OH)_2$). This typically allows coke impregnation of greater mass for the dolomitic hydrates. In many cases, the increased reactivity of the magnesium in the current invention makes the higher solubility advantageous. In contrast, the unreactive nature of the magnesium with furnace injection of the prior art often negates this advantage. In addition, the decrease in water solubility associated with increasing temperature can be substantially lower in dolomitic hydrates (discussed in item 2.). Thus, less mass of dolomitic hydrates can be impregnated in the coke without evaporation of coke quench, in many cases.
2. Supersaturated Solution of Either Dolomitic Hydrate: Supersaturated solutions of dolomitic hydrates are more difficult to achieve than supersaturated solutions of calcitic hydrate. As discussed previously, calcium oxide (CaO) and calcium hydroxide ($Ca(OH)_2$) have an unusual solubility characteristic: lower water solubility with increasing temperature. In contrast, magnesium oxide (MgO) and magnesium hydroxide ($Mg(OH)_2$)

increase in water solubility with increasing temperature. Though some dolomitic hydrates contain equal moles of calcium and magnesium compounds, the degree of solubility increase for chilled water will be significantly less, and partially depend on the type and origin of the dolomitic hydrates. Thus, other means of creating a supersaturated solution would be required in many cases.

3. Saturated Dolomitic Hydrate Solution with Suspended Dolomitic Hydrate Solids: This approach is very similar to a saturated solution containing suspended calcitic hydrate solids. Conventional production of the dihydrate form has particle size of roughly 1.0-4.0 micrometers, which is similar to calcitic hydrate. However, conventional production of the monohydrate form typically has particle size of 14-20 micrometers. With either dolomitic hydrate, the size of the suspended particles should be as small as practical (preferably <1.0 micron) for the particular application.

c3. Modification of Coke Quench Cycle in the Coking Operation: The coke quench cycle is very similar to the description for calcitic hydrate. The primary difference is modifications to compensate for differences in solubility characteristics: water solubility at ambient temperatures and related temperature effects. One skilled in the art can make modifications in equipment and operations to address these concerns in particular applications of the current invention.

c4. Impacts of Pet Coke Fuel Pulverization: The pulverization impacts for pet coke with dolomitic hydrates are very similar to the pulverization description for the exemplary embodiment. The primary difference is dolomitic hydrates have greater resistance to sintering. Thus, the dolomitic hydrates left on the external surface of the fuel coke particles due to pulverization will maintain higher sulfur removal capabilities. Again, the dolomitic hydrates, that are deposited from dissolved solution (not suspended solids), have molecular layers that are less prone to sintering, even on the external surface of the pulverized coke particles. Though the coke char of the current invention offers protection from sintering, this resistance to sintering can be advantageous, particularly on the external surface of the pulverized coke particles. One skilled in the art can make modifications in equipment and operations to optimize these concerns in particular applications of the current invention.

c5. Performance of Dolomitic Hydrates in the Combustion of the Modified Pet Coke: The most important difference in the use of dolomitic hydrates versus calcitic hydrate is its potential for higher sulfur removal capabilities. The improved performance of dolomitic hydrates in the current invention is due to two primary factors: (1) magnesium and pet coke's roles in reducing detrimental sintering effects and (2) enhanced sulfur reactivity of magnesium.

Reduced sintering effects in the current invention can improve the sulfur removal performance of the dolomitic hydrates over their use in the prior art. As discussed earlier, the magnesium of the dolomitic hydrates substantially increases the calcium utilization in the prior art, primarily due to the much greater resistance to sintering. That is, furnace injection of the dolomitic hydrates has shown an increase in surface area up to 50% (vs. up to 50% reduction in BET surface area for calcitic hydrate). In the current invention, this phenomenon is expected to increase the surface area. Hence, SOx removal is higher for any dolomitic hydrates deposited from suspended solids. This can be particularly true for dolomitic hydrates on pores that become part of the external surface of the coke particles after pulverization. In addition, the molecular deposition from dissolved dolomitic hydrates is expected to also reduce impacts of sintering, as noted before. That is, the insulation properties of the modified pet coke offer sintering protection for dolomitic hydrates deposited in the internal pores. Consequently, the overall impact of the current invention is to further reduce the detrimental effects of sintering and further enhance the calcium utilization, in most cases.

The sulfur reactivity of magnesium can be substantially enhanced by the current invention in two ways: (1) improvement of magnesium reactivity with sulfur oxides and (2) promotion of magnesium reactivity with non-oxide forms of sulfur. First, the reaction of magnesium with sulfur oxides (SOx) in the prior art is apparently very limited due to the unstable nature of magnesium sulfate at the furnace injection temperatures (e.g. $MgSO_4$ decomposes at temperatures>2050° F.). The modified petroleum coke of the current invention can effectively insulate, to a certain extent, this desirable reaction from high temperature zones (i.e. >2000° F.). As the coke char increases in temperature to roughly >660° F., any magnesium hydroxide (i.e. hydrated magnesium oxide $Mg(OH)_2$) in the dolomitic dihydrate losses water; dehydrating to form magnesium oxide (MgO) crystals. As the coke char reaches temperatures>1000° F., the heavy organic compounds (i.e. aromatics, asphaltenes, & resins) in the polymeric coke structure start to thermally crack or break apart at a molecular level. These cracking reactions release carbonium ions and sulfur (or sulfur complex) ions in the vapor state. If oxygen is available at the coke surface, the sulfur ions readily oxidize to form sulfur oxides. The gaseous sulfur oxides can then migrate along the coke surface until converted by the calcium oxide and/or magnesium oxide. The modified pet coke can shield these reactants in its internal pores for sufficient time to form $MgSO_4$ and prevent exposure to temperatures above 2000° F. Unfortunately, high concentrations of oxygen are not generally available in the coke's inner pores at lower temperatures. Secondly, a high degree of unoxidized coke char downstream of 2000° F. flue gas temperatures is not desirable, in most cases, due to low combustion efficiency and other considerations. Therefore, magnesium reactivity with sulfur oxides is often improved (vs. prior art) by this reaction mechanism of the current invention, but only to a limited extent.

An alternative reaction mechanism of the current invention promotes magnesium reactivity with non-oxide forms of sulfur. Again, the heavy organic compounds (i.e. aromatics, asphaltenes, & resins) in the polymeric coke structure start to thermally crack at temperatures over 1000° F., and release carbonium ions and sulfur (or sulfur complex) ions in the vapor state. These very reactive carbonium and sulfur ions typically oxidize when oxygen is present. However, the internal pores and even some of the external surface of the coke char are not readily exposed to oxygen at the early stages of the char oxidation. These gaseous ions can migrate within the coke pore structure to the reaction sites of magnesium oxide. In the proper conditions at these high temperatures, the very reactive carbonium and sulfur ions can exchange ionic bonds oxidizing the carbonium ion and forming magnesium sulfide (MgS). Unlike calcium sulfide (CaS), magnesium sulfide is thermochemically stable at these temperatures and higher (i.e. decomposes at T>3632° F.). It is also a collectible particulate at these and lower temperatures. Chemisorption occurs, if the impregnated magnesium oxide reacts with the sulfur compounds adsorbed on the carbon surface (i.e. reaction mechanism 2. in the general discussion of the current invention). This reaction mechanism is analogous to gaseous mercury (Hg)

reacting with solid sulfur crystals impregnated on activated carbon at much lower temperatures. In this manner, part of the magnesium, which is essentially chemically inert in the prior art, becomes reactive in the current invention. The degree of sulfur reactivity depends on various factors, including the (1) local temperature, (2) types, reactivity, and diffusion of the carbonium & sulfur ions, and (3) length of time carbon char internal pores or surface remains without oxygen. These factors are influenced by the pet coke's composition, crystalline structure, and degree of pulverization. The design and operation of the furnace in the pet coke user's system also influence them. This reaction mechanism is not the only means by which magnesium's sulfur reactivity is increased in the current invention. As such, the present invention should not be limited by this theory of operability.

Another major benefit of using dolomitic hydrates is a substantial reduction of the detrimental effects of heavy metals (e.g. V & Ni) in the petroleum coke. The dolomitic hydrates mitigate superheater fouling, high temperature ash corrosion, and low temperature sulfuric acid corrosion. Dolomite is currently used as a combustion additive in heavy fuel oil firing to alleviate these problems. The reduction of fouling and high temperature corrosion is basically achieved by producing high melting point ash deposits, that can easily be removed by sootblowers or lances. Low temperature sulfuric acid corrosion is reduced by the formation of refractory sulfates by reaction with the sulfur trioxide ($SO_3$) gas in the flue gas stream. By removing the sulfur trioxide, the dew point of the flue gas is sufficiently reduced to protect the metal surfaces. Similar to the dolomitic hydrates, the dolomitic carbonates (i.e. dolomite) calcine into the oxides of magnesium and calcium, after heating in the primary flame zone (i.e. losing carbon dioxide vs. water). The sulfating ability of these oxides produces dry, collectible ash compounds (e.g. $CaSO_4$ & $MgSO_4$), and limit undesirable compounds of vanadium, nickel, and sulfur (e.g. vanadium pentoxide, sulfates of Ni, Na, & K; & various vanadates). In prior art practices, the magnesium oxides, as well as the calcium oxides, react with sulfur oxides to form sulfates. This occurs despite being injected with the fuel oil and exposed to the primary flame without protection from sintering effects. The amount of fuel additive is generally equal to the ash content of the fuel or 2-3 times the vanadium content. The latter is normally prescribed in situations, where high temperature corrosion is the primary concern. However, the amount of dolomitic hydrates impregnated on the petroleum coke in the current invention is normally in substantial excess of either amount. Therefore, the impregnated dolomitic hydrates should readily mitigate the detrimental effects of the heavy metals in the petroleum coke.

In conclusion, dolomitic hydrates can be the desired sulfur reagent in many applications of the current invention. The primary benefits of dolomitic hydrates include (1) increased sulfur reactivity, (2) increased solubility in water, (3) less sintering effects, and (4) proven ability to mitigate ash problems with heavy metals in fuel. These benefits are particularly advantageous in cases where magnesium is significantly more reactive than dolomitic sorbent injection of the prior art. The primary detriments of dolomitic hydrates include additional costs and potential negative effects of magnesium on ash quality and quantity. These factors need to be properly evaluated for each application of the current invention. One skilled in the art can make such evaluations and determine the most desired sulfur reagent. Appropriate process options of the current invention can be employed, based on performance requirements, engineering calculations, and tests, if necessary.

d. Mixture of Calcitic Hydrate and Dolomitic Hydrates: The sulfur reagent impregnated on the modified pet coke of the current invention can be optimized by various mixtures of calcitic hydrate and dolomitic hydrates. This alternative embodiment potentially offers the opportunity to optimize the physical & chemical properties and achieve the optimal sulfur reagent. In this manner the potential benefits can be maximized and/or the risks/detriments minimized. The preparation and use of such mixture would be very similar to the above discussions for the exemplary embodiment and the alternative embodiment for dolomitic hydrates.

e. Other Types of Reagents: Other types of sulfur reagents can be impregnated on the internal surface of the modified pet coke using the same methodology of the current invention. These sulfur reagents can react with various forms of sulfur (i.e. with and/or without sulfur oxides). Other sulfur reagents would include, but should not be limited to the following:

1. Other Alkaline Earth Metal Reagents: Limestone, dolomite, limes, magnesia, etc.
2. Alkali Metal Reagents: Potassium hydroxide, sodium hydroxide, potassium iodide, etc.
3. Other Sulfur Reagents: Transition element compounds, Nonmetal compounds, etc.

As noted previously, alkali metal reagents, particularly sodium reagents, have a tendency to form undesirable compounds (e.g. various sodium vanadates) before reaching the desired temperature window in the combustion system to react with sulfur oxides. However, the increased solubility may be very advantageous in cases where pet coke heavy metals are not a major problem. Also, sulfur reagents with certain solubility characteristics (e.g. like calcium hydroxide) can be used in quench water even without the evaporation of the water.

For each type of sulfur reagent, the stoichiometric ratios and reaction temperature windows in the combustion environment would need to be determined for the desired or optimal sulfur removal efficiencies. One skilled in the art can use this information to modify the methodology of the current invention to achieve the desired impregnation of the petroleum coke.

f. Combination of Sulfur Reagents: A combination of any of the above sulfur reagents, including calcitic and dolomitic hydrates, can be used to optimize physical and chemical properties for coke impregnation and sulfur conversion. For example, a combination of sulfur reagents could be used to overcome solubility limits that prevent the impregnation of sufficient amounts of a sulfur reagent in a reasonable quantity of quench water. For example, the combination of calcium hydroxides and potassium hydroxides could provide several advantages.

g. Combination of Impregnated Sulfur Reagent with Other Types of Sulfur Removal: In some applications of the current invention, the combination of impregnated sulfur reagent on the pet coke and other sulfur removal technologies may be desirable to optimize/maximize sulfur removal. That is, the combined sulfur removal technologies can provide additional or more optimal sulfur removal. Furthermore, other sorbent injection systems can enhance SOx removal sufficiently in cases where sufficient SOx removal is not possible due to high coke sulfur levels and/or ash loading limitations (i.e. beyond reach of soluble sorbents and sintered suspended solids). For example, calcitic hydrate in economizer at flue gas temperatures near 840 to 1020° F. can effectively supplement the sulfur removal from pet coke impregnated with sulfur reagent(s). In some cases, lime is already used on-site for other purposes (e.g. water treatment). Incremental costs of additional lime capacity and injection grid can be minimal due to reduced size of the required system. This solution, however, may limit boiler load fluctuations due to temperature sensitivity of injection zone for various boiler loads. Also, minimum impregnation of pet coke with dolomitic hydrates may be desirable to mitigate ash and corrosion problems associated with heavy metals in fuel. In this manner, a separate sorbent injection system can provide any additional SOx removal required.

h. Additives to Enhance Solubility Characteristics and/or Resistance to Sintering: Certain additives can be used to enhance solubility characteristics and/or resistance to sintering. Both these characteristics of the sulfur reagent(s) depend on the strength of the crystalline structure. For solubility, a weaker crystalline structure causes higher solubility in water. For resistance to sintering, a stronger crystalline structure at higher temperatures prevents sintering, which is essentially the partial collapse of the crystalline structure. Ideally, the crystalline structure of the sulfur reagent in the current invention is stronger as the temperature increases. That is, weaker crystals in cold water allow high solubility in coke quench water. At higher temperatures, the stronger crystalline structure decreases water solubility, which allows deposition of sulfur reagent even without quench water evaporation. The stronger crystalline structure at high temperatures also improves resistance to sintering significantly. Unlike most salts, calcitic hydrates have this physical property: lower water solubility at higher temperatures and some resistance to sintering. The magnesium in dolomitic hydrate apparently strengthens the crystalline structure(s) at higher temperatures. As a result, the water solubility at ambient temperatures is increased, the water solubility >200° F. is slightly lower, and the resistance to sintering is substantially improved. It should be noted that the dolomitic hydrate has a greater capacity for deposition from quench water that is either evaporated or not evaporated. In a similar manner, other additives can be used to enhance the solubility characteristics and resistance to sintering in other sulfur reagents of the current invention.

i. Soaking or Spraying Impregnation of Sulfur Reagent on the Pet Coke: Methods of impregnation similar to activated carbon impregnation can also be used for the modified pet coke of the current invention. The basic methods soaking and/or spraying methods can be used to impregnate sulfur reagent on the modified pet coke. Unfortunately, the impregnation will likely predominate near the exterior surface, due to lack of penetration into the internal pores. Consequently, the sintering protection offered by the pet coke char would be limited in many cases.

j. Impregnated Pet Coke in Staged Fuel Burners: The modified pet coke impregnated with sulfur reagent can be effectively used in staged burners that moderate temperature profiles and make sintering less detrimental. As discussed previously, low NOx combustion technologies tend to create less intense combustion that lengthens the primary flame zones and moderates flame temperatures. This tends to reduce sintering of the sulfur reagent. In addition, some low NOx combustion techniques employ staged fuel combustion to "reburn" the primary flame combustion products in a reducing atmosphere that reduces NOx. If solid fuels are used in the second stage (current burners to those yet to be designed), a modified pet coke of the current invention can be optimized for this service. Since the secondary fuel is not exposed to the high temperatures of the primary flame zone, the impregnated sulfur reagent would experience less sintering and require less sintering protection from the pet coke char. Consequently, the modified pet coke can be optimized via process options of the current invention to provide the reducing atmosphere to decrease NOx, complete combustion in the firebox, and still offer desired SOx removal. Examples: US DOE/B&W's Limestone Injection Multistage Burner (LIMB) or Reburn burners for Low NOx combustion, particularly in cyclone boilers.

k. Impregnated Pet Coke with High-Calcium Coals: Some coals (e.g. subbituminous) have high calcium concentrations due to inherent limestone deposits within the coal seams. If the modified pet coke of the current invention is blended with such coals, the calcium in these coals can react with the sulfur oxides to form collectible sulfates. However, as noted earlier, exposure of this calcium (e.g. CaO) to the primary flame can substantially reduce its effectiveness as a sulfur reagent due to sintering effects. If the calcium present in the coals is due to dolomite deposits within the coal seams, the sintering effects are probably reduced substantially. In either case, the calcium in the fuel blended with the pet coke can reduce the sulfur oxides to some degree. Thus, modifications to the impregnation (e.g. reduction in Ca/S stoichiometric ratio) and combustion characteristics (e.g. VCM quantity & quality) of the modified pet coke should reflect this effect on SOx removal. Depending on the blending proportions, this could eliminate the need for impregnation of sulfur reagent altogether in some cases.

B. Adsorption & Other Impregnation of Pet Coke Pores: Enhanced Fuel Qualities

The ability to use the carbon adsorption character of the modified coke to improve fuel properties was briefly described earlier in the current invention. Various hydrocarbons and other non-polar compounds are added to the modified coke via adsorption. Similar to the sulfur reagents, other chemical agents are added via impregnation. Both adsorption and impregnation are accomplished via the coke quench of the decoking cycle. The adsorption and impregnation of desirable compounds are discussed below in further detail.

(1) Addition of Volatile Combustible Materials (VCMs):

As described previously, the addition of volatile combustible materials (VCMs) to the modified pet coke can be advantageous in many applications of the current invention. Both the quality and quantity of VCMs are key factors in improving fuel character and performance.

The volatile matter or volatile content of a fuel is determined by ASTM Method D 3175. In this test method, all vaporized compounds when a fuel reaches 950+/−20° C. (1742+/−68° F.) for seven minutes are considered volatile content. These compounds normally include moisture, carbon monoxide, and various hydrocarbons. As such, the volatile content is composed of organic and inorganic compounds. On the other hand, Volatile Combustible Materials (VCMs) refers to these compounds that can be oxidized further in a combustion environment. Though VCMs can be inorganic (e.g. carbon monoxide), most VCMs are organic, hydrocarbon compounds with various degrees of hydrogen saturation.

For the current invention, Volatile Combustible Materials (VCMs) are classified by boiling points: high-quality: <750° F., medium quality: 750 to 950° F., and low-quality: >950° F. The high quality VCMs primarily help with initiating and sustaining combustion. The low quality VCMs primarily help with char burnout. The medium quality VCMs can help with either depending on the point of release in the combustion process and the degree of difficulty in oxidation. Consequently, VCM performance in the modified coke of the current invention depends on types of VCM compounds, costs, and physical & chemical properties. Cost vs. performance trade-offs need to be evaluated for each application. Ideally, waste streams of acceptable quality (e.g. used lubricating oils and certain hazardous wastes) are readily available.

The integration of VCMs on the pet coke in the current invention occurs in two key stages. First, VCMs (mostly low-quality) increase due to the coker process modifications that assure sponge coke and increase porosity. The quantity of this increased VCM depends on the severity of the process changes (described earlier). The VCM quality depends on the types of VCM compounds that become part of the modified pet coke crystalline structure. Secondly, VCMs can be added to the modified pet coke via the coke quench. The addition of VCMs normally involves (but not always) the improved carbon adsorption characteristics of the modified coke. Most, if not all, of the VCMs integrated on the modified pet coke are organic hydrocarbons that are fairly insoluble in water. After the pet coke has cooled sufficiently to prevent vaporization of the VCMs, the chosen VCMs can be injected into the coke quench water. The improved carbon adsorption properties of the modified coke cause effective adsorption of most VCMs on the internal surface area of the pet coke pores. As discussed earlier, the relative sizes of the VCM molecules and the modified coke's pores will determine adsorption effectiveness. In this manner, the quantity and quality of the VCMs can be controlled. Desirable VCMs that are somewhat soluble in water (e.g. alcohols, phenols) can still be integrated into the modified pet coke via a combination of carbon adsorption and solubility characteristics. For example, a fairly non-polar alcohol can be adsorbed, particularly if the quantity of alcohol is greater than saturation. However, polar VCMs that are very soluble in water can be more difficult to adsorb. If these VCMs have high boiling points, impregnation similar to sulfur reagents may be possible. Consequently, evaluation of the adsorption of low-cost VCMs can be required. One skilled in the art can readily evaluate availability, costs, and the properties of VCMs to determine the optimal VCMs to integrate on the pet coke for specific applications of the current invention.

(2) Addition of Ionizing Compounds:

The addition of ionizing compounds to the modified petroleum coke can be advantageous in certain combustion applications. Ionizing compounds can be selected from various chemical agents that increases the quantity and/or quality of ions in the high-temperature, combustion products (e.g. plasma). Alkali metals typically have the lowest ionization energies. Alkaline earth metals are the family of elements of next lowest ionization energies. As such, ionic compounds (e.g. oxides, hydroxides, carbonates, etc.) of alkali metals and akaline earth metals have many desirable characteristics of ionizing agents. Many of these ionizing compounds are the same compounds that are desirable for SOx sorbents. Likewise, the addition of these ionizing agents to fuel-grade petroleum coke has similar concerns to the addition of sulfur sorbents. That is, their undesirable ash compounds and solubility issues make the alkali metal compounds less desirable than the alkaline earth compounds in many cases. Consequently, the addition of calcitic hydrate is an exemplary embodiment for the addition of ionizing compounds, as well. The preference for this ionizing agent can be dependent on the combustion application and other pet coke properties. In addition, other embodiments for the addition of ionizing agents would include, but should not be limited to (1) other calcitic, dolomitic, potassium, and/or sodium compounds, (2) addition via coke quench solution (saturated, sub-saturated, supersaturated, and saturated with suspended solids), and/or (3) in combination with other chemical additives that enhance ionization.

As discussed previously, Magnetohydrodynamic (MHD) electric generation is a prime example of advantageous addition of ionizing agents to modified pet coke. MHD occurs when hot, partially ionized combustion gases (plasma) are expanded through a magnetic field. The hot gas can be produced in a ceramic coal combustor with temperatures approaching 5000° F. Even at these high gas temperatures, the available gas ionization normally needs to be increased significantly. Thus, MHD technology often requires the seeding of the hot plasma gas with ionizing compounds. Various types of ionizing compounds can be used, including calcitic hydrate. However, potassium hydroxide can be preferable due to ease of ionization, if potassium hydroxide solubility and resulting ash compounds are not prohibitive. In these cases, one skilled in the art can determine the proper quantity of potassium hydroxide desired and make adjustments to the type of coke quench solution (e.g. saturated).

Coal has been traditionally used as the preferred fuel in the research for MHD technology. The modified pet coke of the current invention offers many advantages over various coals for MHD technology. First, the modified pet coke has >90% less ash, >25-60% greater heating value, and substantially lower moisture content. These characteristics potentially provide higher flame temperatures, lower air/oxygen temperature requirements, and/or less ash problems in combustor and downstream heat exchange. Secondly, the pet coke can be readily pulverized to a finer particle size distribution to assure compact, intense, and efficient flame generation. Finally, VCMs, ionizing agents, and/or other desirable compounds (e.g. oxygen-containing) can be uniformly added to the modified coke of the current invention. That is, coke quench would provide the means to add ionizing agents in a manner similar to sulfur reagents. The quality and quantity of these potentially desirable compounds can be optimized, as well.

An exemplary embodiment of the current invention for MHD technology may include modified pet coke production from a sweet crude coker. Thus, the modified pet coke would have low-sulfur and low-metals contents to prevent downstream ash problems. Also, the modified pet coke would have a high porosity, crystalline structure that would allow very fine pulverization (>90% through 200 mesh). The quantity and quality of VCMs (via modified coker process conditions and/or coke quench addition) can be optimized to initiate and sustain combustion. The fine pulverization and optimal VCMs provide efficient combustion with a stable, compact flame. In addition, oxygen-containing compounds can be added to reduce the required air/oxygen stream, if desirable. Finally, potassium hydroxide or potassium iodide can be readily added as the ionizing agent via coke quench. That is, the solubility of either potassium compound is sufficient to uniformly deposit molecular layers via a saturated quench solution during the entire quench cycle. That is, the evaporated quench solution will leave the molecular layers on the internal pores of the modified pet coke. The non-evaporated quench would still be saturated to prevent uptake of the deposited potassium compound into an unsaturated quench solution. One skilled in the art can determine the proper quantity desired for the MHD application, and impregnate them on the pet coke via coke quench. The use of saturated, sub-saturated, super-saturated, or saturated with suspended solids is again similar to the exemplary embodiment for the addition of SOx sorbents.

(3) Addition of Oxygen-Containing Compounds:

Various types of oxygen compounds can be added to the modified pet coke to reduce excess air required and/or reduce impact of oxygen diffusion as a kinetic reaction limitation for various reactions (e.g. sulfur reagents). For either purpose, the oxygen compound, in general, will make the oxygen readily available to react with other species at higher temperatures. In other words, the oxygen compound will generally be an oxidizing agent. The type of oxygen compound can determine its role. For example, oxygen compounds that have boiling points <750° F. will likely volatilize in the primary flame zone. This can reduce excess air requirements for the primary flame zone and improve low NOx combustion. Secondly, an oxygen compound that has a boiling point >950° F. (e.g. large, phenolic compounds) can help char oxidation and reduce overall excess air requirements for complete combustion. Also, this type of oxygen compound can provide oxygen in the internal pores to promote earlier oxidation of sulfur. In turn, this can help promote desired SOx reaction mechanisms reaction with sulfur reagent(s).

As with VCMs, the addition of oxygen compounds can be accomplished with wither coke adsorption or impregnation via solubility characteristics. In either case, the oxygen compounds are integrated via the coke quench solution. Selection of the optimal oxygen compound depends on desired performance, availability, costs, and physical/chemical properties. One skilled in the art can determine optimal oxygen compound(s) to integrate on the pet coke for specific applications of the current invention.

(4) Optimization of Coke Fuel Catalyst Properties:

The ability to optimize the oxidation catalytic activity in the modified pet coke has been previously discussed. Combustion of the modified pet coke of the current invention can overcome problems of the traditional pet coke, while promoting better combustion via oxidation catalysts.

The 'heavy' transition metals (e.g. V, Ni, Fe, & Cu) in the fuel-grade coke of many refineries have been traditionally viewed as undesirable components. First, these transition metals, good oxidation catalysts, promote the oxidation of sulfur dioxide to sulfur trioxide. Without dry scrubbing, higher sulfur trioxide concentrations cause significantly higher flue gas dew points. The higher dew points cause lower combustion efficiency due to higher stack temperatures and/or cold-end corrosion due to condensing sulfuric acid. Secondly, these metals, particularly vanadium and nickel, tend to form ash compounds (e.g. NiSO4 & vanadates) that have low melting points. In the high temperature zones of the combustion system (e.g. boiler superheaters), these ash compounds become sticky, liquid materials that increase ash deposits and cause high temperature corrosion.

As long as these problems are addressed, the heavy metals can provide potential combustion improvements due to high oxidation catalyst activity. The high-temperature corrosion problems of traditional pet coke are partially due to char burnout near the furnace exit, raising superheater tube metal temperatures. The modified pet coke of the current invention mitigates this problem in several ways: (1) highly porous coke promotes finer particle size distribution (i.e. HGI>80), (2) Higher VCM quantity and quality, and (3) oxidation catalyst activity of highly porous coke. All of these factors promote char burnout before the superheater tubes, potentially at lower excess air. As discussed previously, the impregnated sulfur reagents of the current invention can effectively mitigate the formation of troublesome ash constituents and effectively remove sulfur trioxides as well as sulfur dioxide. Consequently, modified coke of the current invention can effectively mitigate the high-temperature corrosion, sticky ash deposition, and cold-end corrosion. Thus, the heavy metals can be effective oxidation catalysts without the problems of traditional pet coke.

The activated, heavy metals in many petroleum cokes can promote optimal combustion by catalyzing various oxidation reactions. As discussed previously, the adsorption character of the highly porous pet coke behaves as an oxidation catalyst in the coke char oxidation. As the coke char oxidizes, the heavy metals, primarily vanadium and nickel, are released from the heavy coke compounds (e.g. porphyrins). Development of their multivalent ions activates their high oxidation catalyst activity. That is, their various oxidation states provide the bases of their catalytic oxidation potential. These metal ions catalyze the coke char and sulfur oxidation at lower temperatures and/or lower excess air levels. Furthermore, the metal ions released in the initial char oxidation can catalyze oxidation of VCMs in the flue gas, as well. Overall, these catalysts create greater oxidation at lower temperatures and lower excess air levels, producing higher combustion efficiency and lower NOx emissions. Consequently, these metal oxidation catalysts can be particularly helpful in low NOx combustion modes.

Optimizing the catalytic activity of the modified pet coke's 'heavy' metals involves several factors. First, metals that are released in the early stages of combustion provide more benefits as oxidation catalysts in the combustion zone. That is, the longer residence time in the combustion zone may be desired. Thus, improved combustion of the modified coke can increase the oxidation catalyst activity, not only in coke char combustion, but in overall combustion, as well. Secondly, presence of certain types of chemicals (e.g. acids) can influence the oxidation states of the transition metals. Thus, the addition of certain chemicals can influence the strength of oxidation catalyst. Thirdly, the presence of certain metal compounds in the ash can catalyze oxidation reactions downstream of the furnace high-temperature zones. Thus, promotion of these metal compounds, to the extent possible, can potentially continue desirable oxidation reactions (e.g. char burnout) downstream of the furnace at lower temperatures. The optimal catalyst activity of the heavy metals in the modified coke will vary for each combustion system and its required operation, including heat transfer and environmental requirements. Consequently, the optimization of metals catalyst activity must evaluate the trade-offs of increased catalyst activity versus other impacts on the combustion system. One skilled in the art can properly evaluate these trade-offs and make the appropriate modifications to the factors, discussed above.

(5) Addition of Other Compounds:

Other types of chemical compounds can be added to further enhance the modified pet coke of the current invention. As noted earlier, inorganic and organic compounds can be added to the modified pet coke via the coke quench, either by adsorption or evaporative impregnation. That is, polar or ionic inorganic compounds can generally be added to the modified pet coke due to their solubility in the coke quench water. After quench water evaporation, the inorganic compound is normally left on the internal pores of the pet coke in molecular layers. Likewise, non-polar, organic compounds can be generally added to the modified pet coke via quench water. However, the deposition of this type of compound is normally due to the modified pet coke's improved carbon adsorption character. Thus, various compounds from either broad class can be effectively added to modified pet coke.

(6) General Issues for Impregnation of Modified Pet Coke:

The addition of any type of compounds to the modified coke requires evaluation in each application. Proper consideration needs to be given to the impacts of site-specific conditions, including local water conditions, ambient temperatures, and coke quench & recycle systems. In addition, there is considerable variation in the operating conditions and procedures at the various delayed coker installations. Pressure effects, temperature effects, and the impact of operational procedures must be properly evaluated. Finally, special consideration must be given to the combined effects, when adding more than one compound. For example, there can be chemical reactions between injected compounds or the presence of another type of VCM or reagent can affect solubility characteristics. One skilled in the art can make these evaluations via engineering calculations and minor testing, if needed. Any necessary modifications can then be made within the spirit and intentions of the current invention.

C. Adsorption & Impregnation of Pet Coke: Enhanced Coke Carbon Adsorption

The ability to use the carbon adsorption character of the modified coke in various activated carbon applications was noted earlier. As discussed previously, the adsorption characteristics (e.g. pore structure and internal surface area) determine adsorption capacities and potential applications. The adsorption character can be further enhanced by the addition of various chemical agents, based on the desired application and performance. Various hydrocarbons and other non-polar compounds can be added to the modified coke via adsorption. Similar to the sulfur reagents, other chemical agents can be added via impregnation. Both adsorption and impregnation are accomplished via the coke quench of the decoking cycle. The adsorption and impregnation of desirable compounds are discussed below in further detail.

(1) Addition of Sulfur Compounds:

In the prior art, elemental sulfur has been added to activated carbon to enhance mercury removal capabilities. Apparently, the elemental sulfur chemically reacts with mercury via chemisorption in various applications (e.g. coal boiler flue gas). The amount of sulfur impregnated in the internal pores of the activated carbon is 10-20 weight percent. The impregnation technique is apparently similar to other activated carbon impregnation. That is, soaking or spraying of elemental sulfur onto the surfaces of the activated carbon is completed before drying. Drying is often performed in rotary kiln, fluid bed, multiple hearth, or vertical furnaces. The sulfur-impregnated activated carbon is then used to remove mercury in various vapor-phase and liquid-phase applications. For example, sulfur-impregnated activated carbon is injected into combustion flue gas at lower temperatures (e.g. 350° F.) to remove mercury vapors.

In a similar manner, elemental sulfur can also be impregnated on the internal surface of the modified pet coke of the current invention to provide an alternative means of mercury removal. Elemental sulfur is another by-product of crude oil processing, and already exists in a liquid form at most refineries. Soaking or spraying of elemental sulfur (from the refinery or otherwise) can be used to impregnate the surfaces of the modified coke, as well. That is, the refinery elemental sulfur can be added to crushed pet coke of the current invention prior to drying in a suitable drier (e.g. rotary kiln, fluid bed, multiple hearth, or other drier).

Alternatively, the elemental sulfur could be added to the modified pet coke in the coke drum in a liquid or vapor form. The latter is preferable to prevent pluggage of pores and provide uniform deposition of molecular layers on the pet coke's internal surface area. The refinery's liquid sulfur can be pumped to the coker via heated lines at the maximum practical temperature from the Claus Unit reactors. That is, less cooling in the condensers after the catalytic converters may be desirable for better heat conservation. A special heater at the base of the coke drums can vaporize the elemental sulfurs at temperatures above 830° F. The ultimate temperature would be dependent on the pressure required to inject the sulfur into the coke drum at the end of the coking cycle. Prior to any steam out or cooling, the coke in the coke drum is maintained at temperatures near the boiling point of the elemental sulfur (e.g. 830-850° F.). The vaporized sulfur would then be injected into the bottom of the coke drum. Heater design would provide sufficient heat to prevent premature condensation of sulfur in the pet coke. After sufficient sulfur impregnation, the modified pet coke is cooled in the decoking cycle in the normal manner, preferably with minimal to no steam-out prior to adding coke quench. Ideally, the sulfur, which is mostly insoluble in water, would be cooled to solid form (<230° F.) without significant entrainment of sulfur in the quench water. Realistically, some solid sulfur will be entrained in the quench water, and may require special treatment before quench water recycling. Excess sulfur impregnation can be required to make up for sulfur entrained in the quench water.

Obviously, this sulfur-impregnated modified coke would not be used as a fuel, but for specific mercury removal applications (e.g. boiler flue gas). The amount of impregnated sulfur would depend on the existing sulfur content of the modified coke and its reactivity with mercury. In most cases, the existing coke sulfur (predominately thiophenic sulfur) is not expected to react significantly with mercury vapor, without combustion. Thus, the amount of impregnated elemental sulfur required for effective mercury removal is expected to be 5-25 wt. % (preferably 10-15 wt. %).

(2) Modified Coke with Other Chemisorption Agents:

Similarly, the modified coke of the current invention can be impregnated with other chemical agents that remove targeted chemical compounds via chemisorption. These chemical agents should include, but should not be limited to, iron oxide, manganese oxide, phosphoric acid, potassium carbonate, potassium iodide, potassium permanganate, silver, sulfur, sulfuric acid, triethylene diamine (TEDA), zinc oxide, and salts of chromium, copper, or silver.

As noted before, various hydrocarbons and other non-polar compounds can be added to the modified coke via adsorption. Similar to the sulfur reagents, other chemical agents can be added via impregnation. Both adsorption and evaporative impregnation are accomplished via the coke quench of the decoking cycle.

(3) Optimization of Catalyst Properties:

One of the primary uses of activated carbon is a catalyst or inert carrier material for catalytic agents. As discussed previously, activated carbon can perform well as an oxidation catalyst due to its ability to ionize molecular oxygen. In addition, activated carbon can provide a key role in catalytic reactions as an inert carrier material. Typically, the catalytic agents are added to the activated carbon via impregnation techniques described earlier.

Similarly, the modified coke of the current invention can be impregnated with various catalytic agents. These catalytic agents should include, but should not be limited to, transition metals, noble metals, mercury chloride, and zinc acetate. Again, various hydrocarbons and other non-polar compounds can be added to the modified coke via adsorption. Similar to the sulfur reagents, other chemical agents can be added via impregnation. Both adsorption and impregnation are accomplished via the coke quench of the decoking cycle.

D. Other Applications of Adsorption/Impregnation Techniques; Enhanced Fuel & Carbon Adsorption Qualities Processes and methods to improve the fuel properties, combustion characteristics, and other qualities of pet coke have been noted earlier in the current invention. This was accomplished by improving its carbon adsorption characteristics and using carbon adsorption technology to add certain desirable fuel components in the delayed coking process. These same processes and methods can be applied to other porous carbonaceous materials including (but not limited to) various coals, coal wastes, other cokes, and various activated carbons. For example, activated carbons that have served their useful lives in carbon adsorption systems can be converted to high quality, solid fuels for disposal in solid fuel combustion systems. That is, VCMs, SOx sorbents, oxygen content, oxidation catalysts, and other desirable fuel components can be uniformly integrated into the voids in these porous, carbonaceous materials. This can be accomplished by injecting these components into suitable carrier media (e.g. water or air) which passes through the activated carbons in the carbon adsorption bed or other vessel, after one last regeneration cycle. Modification of the surface groups (e.g. oxygen surface groups) on the activated carbon may be necessary to adsorb polar, inorganic compounds. One skilled in the art of carbon adsorption technology can make the appropriate adjustments in the prescribed processes and methods of the current invention to achieve the optimal levels of these desirable components to provide acceptable fuel characteristics.

The impregnation techniques of the current invention can also be used for impregnation of various chemical compounds in other carbonaceous materials with adsorption characteristics. That is, aqueous solutions in contact with other carbonaceous materials can provide the means to impregnate sufficient quantities of various chemical compounds. Theses chemical compounds include, but should not be limited to VCMs, sulfur reagents, oxygen compounds, ionizing compounds, and catalysts. Again, modification of the surface groups (e.g. oxygen surface groups) on the activated carbon may be necessary to adsorb polar, inorganic compounds.

For example, the activated carbon processes (e.g. rotary kiln) can use quench water to add molecular layers of various chemical compounds for improved adsorption, chemisorption, catalysis, etc. The same basic principles of the current invention apply to this process. Evaporation of saturated quench solution can leave desired solute on the surface of activated carbon. However, the deposits can be primarily on the external surface due to resistance to flow in the internal pores. If this type of impregnation is not sufficient, pressurized soaking with saturated or similar solutions prior to final drying may provide the needed deposition on internal pores.

Another example of processing carbonaceous materials with aqueous solutions is water washing of coals. In certain coals, the adsorption characteristics can be sufficient to adsorb various types of VCMs in the wash water aqueous solution. Modification of the washing process (e.g. aqueous solution through bed of crushed coal) can enhance the adsorption of VCMs. Similarly, sulfur reagents, oxygen compounds, and ionizing compounds can be added with the proper solubility characteristics (e.g. $Ca(OH)_2$: more soluble at lower temperatures).

7. Production of Premium Petroleum Coke: Optimized Fuel Embodiments

The various methods and embodiments of the present invention can also be used to optimize combustion characteristics for specific combustion applications. The following embodiment provides a means to produce an upgraded petroleum coke that not only achieves the basic objectives of this invention, but also optimizes fuel characteristics to replace existing solid fuels with the least (or lower) amount of equipment and operational modifications. As noted earlier, one fuel can be directly substituted for an existing fuel in a full-scale operation, if the burning characteristics are sufficiently similar. As such, the various techniques, used in this invention to create a premium petroleum coke, can be optimized in many cases to produce a direct replacement fuel for existing facilities. In this manner, a specific coker with certain design, feedstocks, and refinery operational constraints can be modified to produce a solid fuel with sufficiently similar combustion characteristics as the existing solid fuel at a specific combustion facility.

As discussed previously, various pilot-scale and laboratory tests can effectively evaluate the burning characteristics for various fuels. Smaller scale tests to optimize parameters are preferable to full scale operations for various reasons, including economics and safety. In the example for this embodiment, refinery pilot plant studies and modified B&W burning profile tests are used to optimize the burning characteristics of the upgraded petroleum coke. The B&W burning profile tests have been modified to incorporate differences in particle size distribution attributed to differences in the solid fuels' grinding characteristics. That is, a solid fuel with a higher Hardgrove Grindability Index (HGI) is softer. An equivalent pulverizer can grind these fuels to much finer particle size distributions with an equivalent grinding energy. For example, coals with HGIs of 50-70 are typically ground to 65-80% through 200-mesh (~74 microns). In contrast, the upgraded petroleum coke is expected to have HGIs of 90-120 and particle size distribution of 80-95% through 200-mesh at the same (or less) grinding energy.

Pilot plant studies can be designed to find the optimal combination of various techniques described in this invention to improve the fuel qualities of petroleum coke. The following procedure can provide an adequate means to optimize the petroleum coke fuel characteristics:

1. Optimize design and operational parameters for the refinery's desalting system (or system parameters in other embodiments) to produce acceptable levels of sodium in coker feeds & coke.
2. Optimize coker operating temperatures (or operating parameters of other embodiments, such as feedstock composition) to achieve desirable levels of sponge coke crystalline structure.
3. Compare modified B&W burning profiles of the two fuels to evaluate adjustments in the quantity and quality of coke VCMs needed to nearly match the burning profile of the existing fuel.
4. Optimize other coker operational parameters (e.g. oily substances in water quench) to adjust the quantity and quality of VCMs in the petroleum coke to obtain desirable combustion characteristics.

5. Repeat steps 3 and 4 until the critical burning characteristics of the upgraded petroleum coke are sufficiently similar to the burning characteristics of the existing fuel.
6. Reproduce optimal operating conditions in the refinery units to produce sufficient petroleum coke for a test burn in a pilot-scale combustion system.
7. Conduct test burn with upgraded coke and optimize combustion design and operational parameters. Modify burners or other equipment, as necessary, to achieve acceptable combustion characteristics.
8. Repeat steps 6 and 7 until evaluation of necessary equipment and operational modifications is satisfactory. Implement equipment and operational changes in the existing combustion facility.

FIG. 3 shows comparisons of burning profiles for existing coals and petroleum coke. As noted earlier, some characteristics in the burning profile are not necessarily desirable, such as the blips for excessive moisture and premature ignition. Other unobvious combustion characteristics (reflected in the burning profile's rate of release) are undesirable, including high ash content and low porosity char. Both of these hinder oxidation and the rate of release. Consequently, the critical combustion characteristics in the burning profile are (1) ignition temperatures, (2) combustion intensity (height of maximum release rate), (3) total heat liberated (area under the profile), and (4) temperature of oxidation termination. If these parameters are sufficiently similar, the upgraded petroleum coke can readily replace the existing fuel. The high char porosity, low ash content, low moisture and high HGI of the upgraded petroleum coke tend to shift the entire modified burning profile to the left with only modest to moderate additions of VCM. These properties of the upgraded petroleum coke are the primary reason that this fuel can have better combustion characteristics than most coals, even with significantly lower (or comparable) VCM content and/or quality.

In this manner, optimal levels of VCM quantity, coke crystalline structure, VCM quality, and coke decontamination can be determined. After these levels are derived, the various methods and embodiments of the present invention (with proper consideration of various engineering factors) can be used to optimize the upgraded petroleum coke for specific combustion applications. The optimized coker process control procedures (i.e. temperature controls, quench controls, etc.) via burning profile tests is analogous to other coker process controls that are determined by pilot plant tests.

In conclusion, the upgraded petroleum coke of the present invention can be readily optimized to provide sufficiently similar, critical combustion characteristics. In this manner, the upgraded petroleum coke can readily replace solid fuels in existing combustion facilities with limited modifications to current design and operation. Though the sulfur content does not significantly affect combustion characteristics, the optimization of upgraded petroleum coke that has been desulfurized would provide an even more ideal fuel replacement. That is, the use of desulfurized coker feedstocks in this optimization process can offer greater flexibility in the optimization of environmental controls.

8. Use of Premium Petroleum Coke: Conventional Boilers/Wet Scrubbers

Another embodiment of the present invention is the use of the upgraded petroleum coke in conventional, PC-fired utility boilers with traditional particulate control devices and wet scrubbing systems. The discussion of this embodiment includes a basic description of a conventional utility boiler system with traditional particulate control devices (electrostatic precipitators, baghouses, etc.), followed by a wet scrubbing system for the removal of sulfur oxides and/or particulates. The prior art has been modified with (1) a retrofit addition of the flue gas conversion reaction chamber(s) and injection system(s) and/or dry sorbent injection system(s). The primary difference from the exemplary embodiment is the presence of the wet scrubber. The superior fuel characteristics of the upgraded petroleum coke are essentially the same as the exemplary embodiment for the following subsystems: fuel processing, combustion, heat transfer, and heat exchange. The environmental controls section is similar, including the modification of the existing particulate control device to a flue gas conversion system. However, the wet scrubber provides additional flexibility in various options that can be used to optimize the levels of control for particulates, sulfur oxides, carbon dioxide and other undesirable flue gas components. For example, the operation of the wet scrubber can be used in combination with dry sorbent injection to increase overall SOx removal efficiencies.

Figure 5:
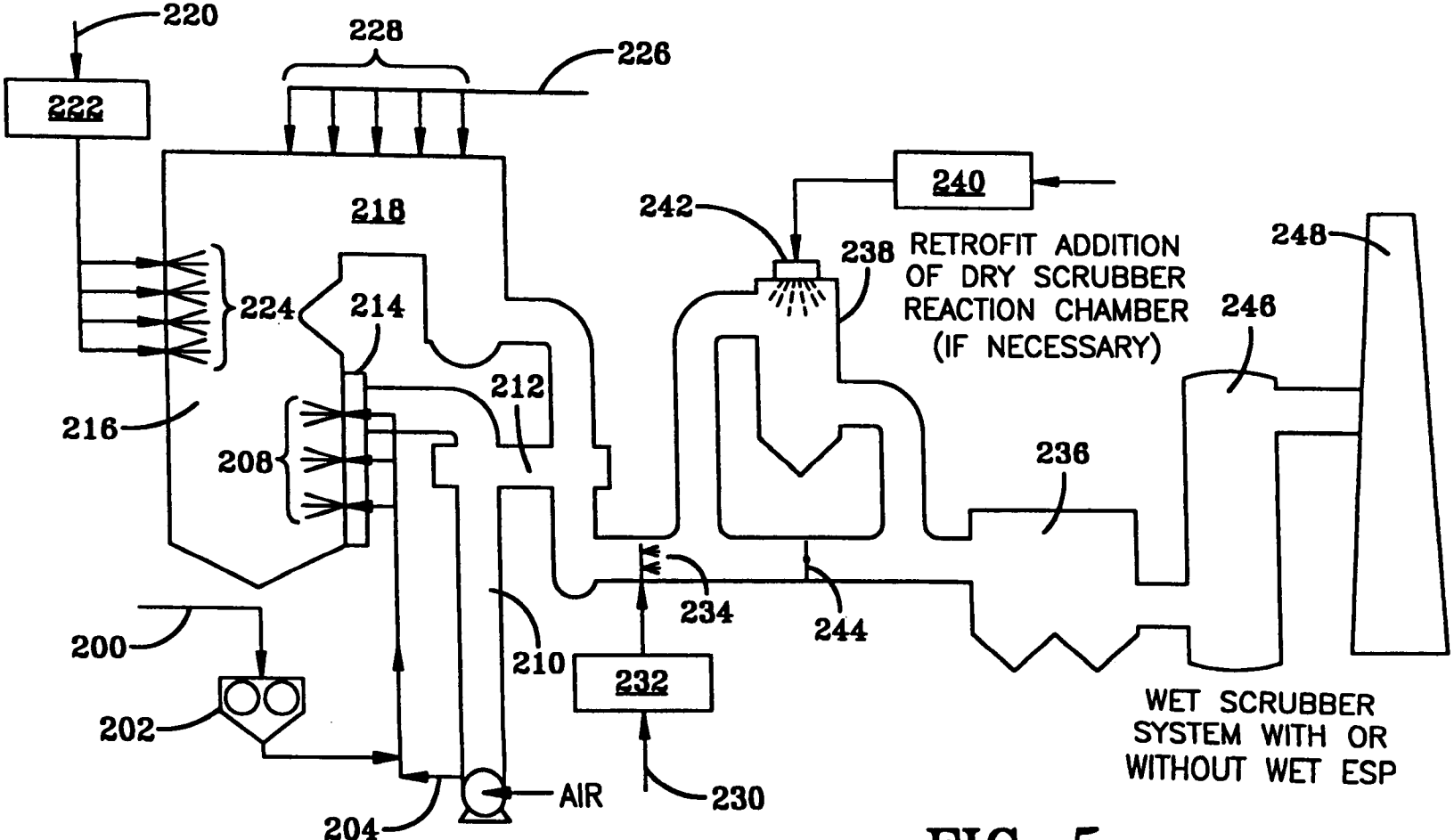
FIG. 5 shows a basic process flow diagram for a conventional, coal-fired utility boiler with a wet scrubber downstream of the traditional particulate control device (PCD): Baghouse, electrostatic precipitator (ESP), or other. The combustion system has been modified to include a reaction vessel(s) and/or reagent injection system(s) for control of undesirable flue gas components.
Figure 6A:
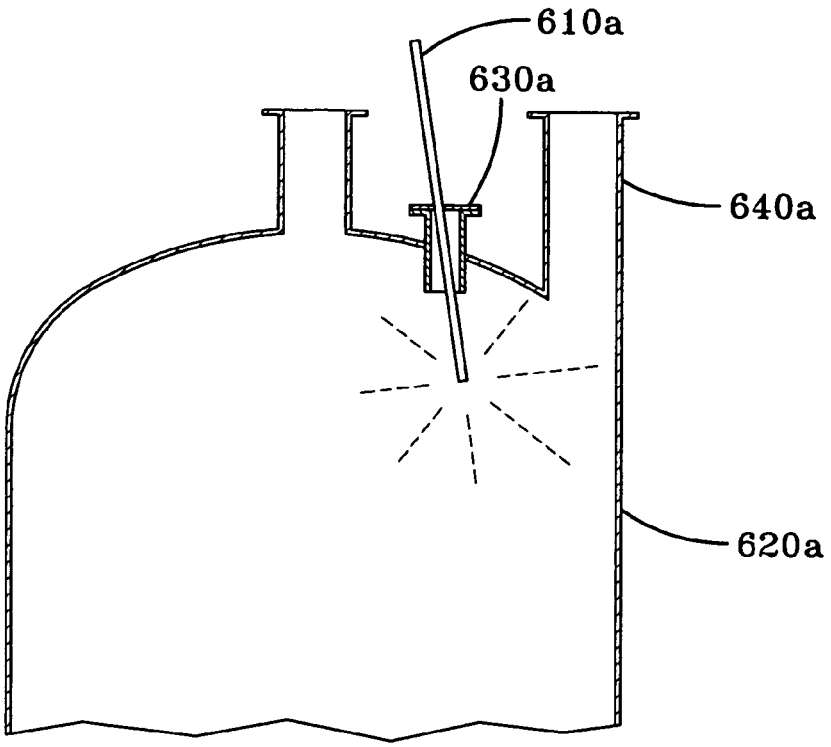
FIG. 6A shows a cross sectional view of an exemplary basic equipment diagram of a coke drum having a side-draw vapor line wherein the coke drum is adapted for injection of certain media to thermally quench the vapors exiting the coke drum during the coking cycle of the delayed coking process. The existing coke drum(s) have been modified with reinforced flanges for quench media lances that can be removed for maintenance, as needed.
Figure 6B:
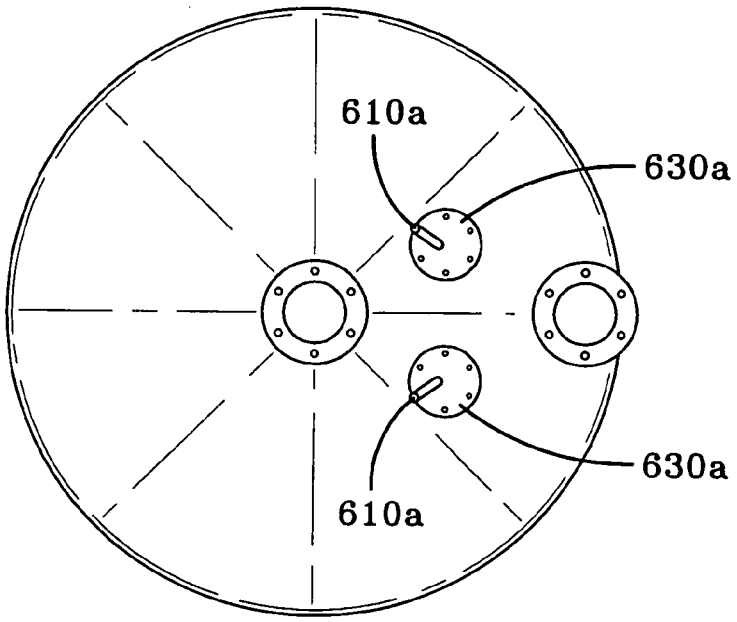
FIG. 6B shows a partial top plan view of the coke drum of FIG. 6A.
Figure 6C:
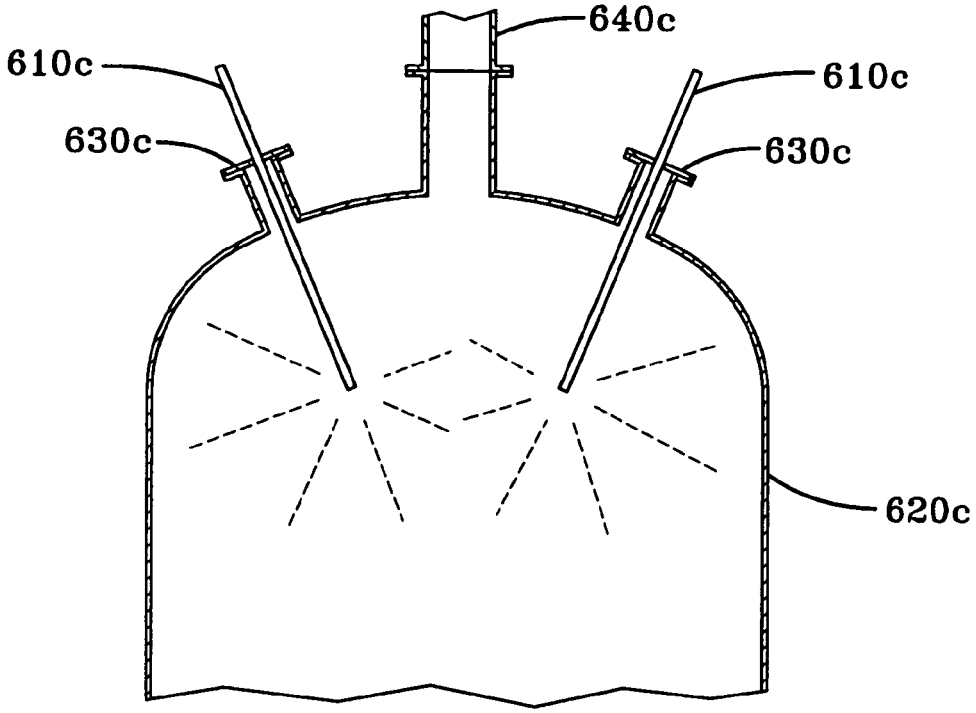
FIG. 6C shows a cross sectional view of an exemplary basic equipment diagram of a coke drum having a center-draw vapor line wherein the coke drum is adapted for injection of certain media to thermally quench the vapors exiting the coke drum during the coking cycle of the delayed coking process. The existing coke drum(s) have been modified with reinforced flanges for quench media lances that can be removed for maintenance, as needed.
Figure 6D:
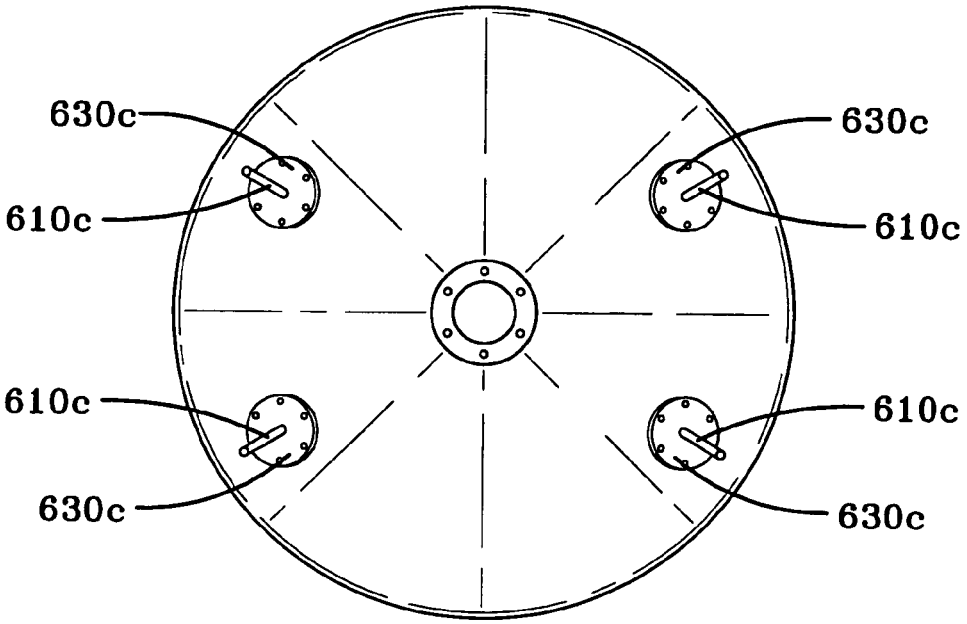
FIG. 6D shows a partial top plan view of the coke drum of FIG. 6C.
Figure 6E:
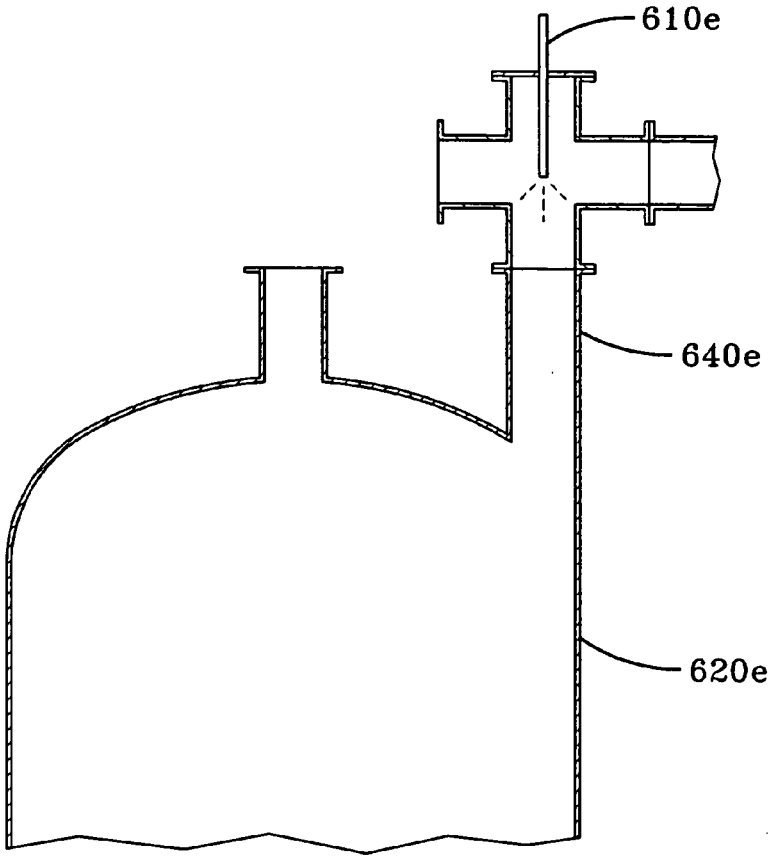
FIG. 6E shows a cross sectional view of an exemplary basic equipment diagram of a coke drum having a side-draw vapor line wherein the coke drum is adapted for injection of certain media via a vertical spray in the vapor line to thermally quench the vapors exiting the coke drum during the coking cycle of the delayed coking process.
Figure 6F:
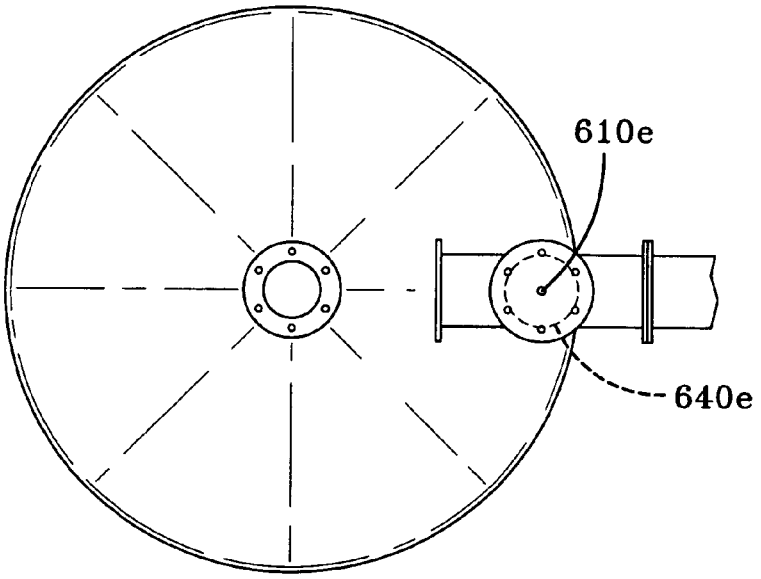
FIG. 6F shows a partial top plan view of the coke drum of FIG. 6E.
Figure 6G:
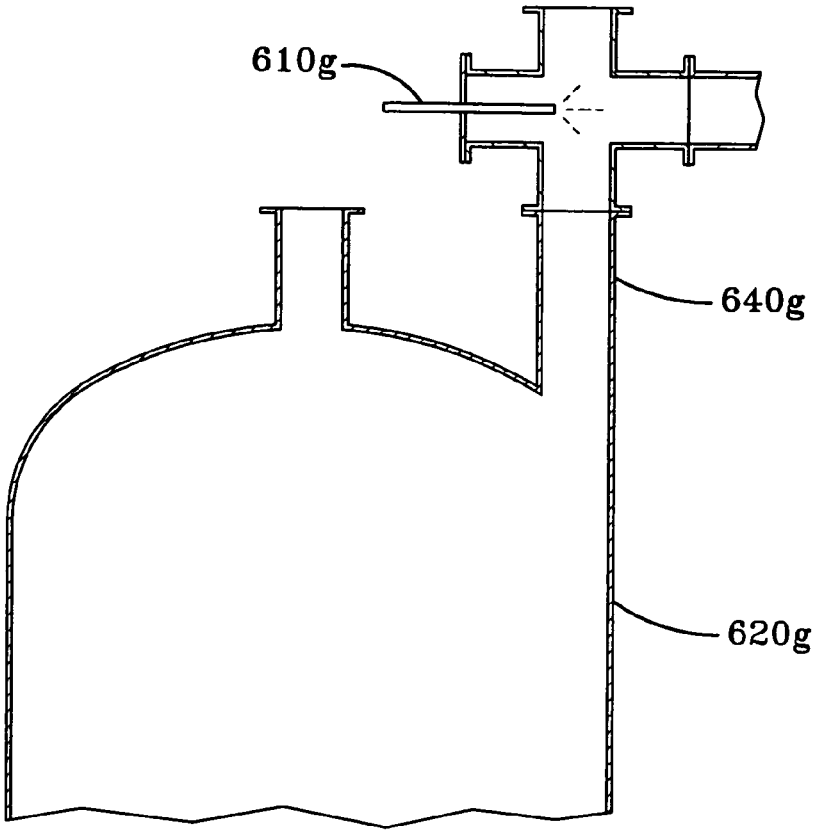
FIG. 6G shows a cross sectional view of an exemplary basic equipment diagram of a coke drum having a side-draw vapor line wherein the coke drum is adapted for injection of certain media via a horizontal spray in the vapor line to thermally quench the vapors exiting the coke drum during the coking cycle of the delayed coking process.
Figure 6H:
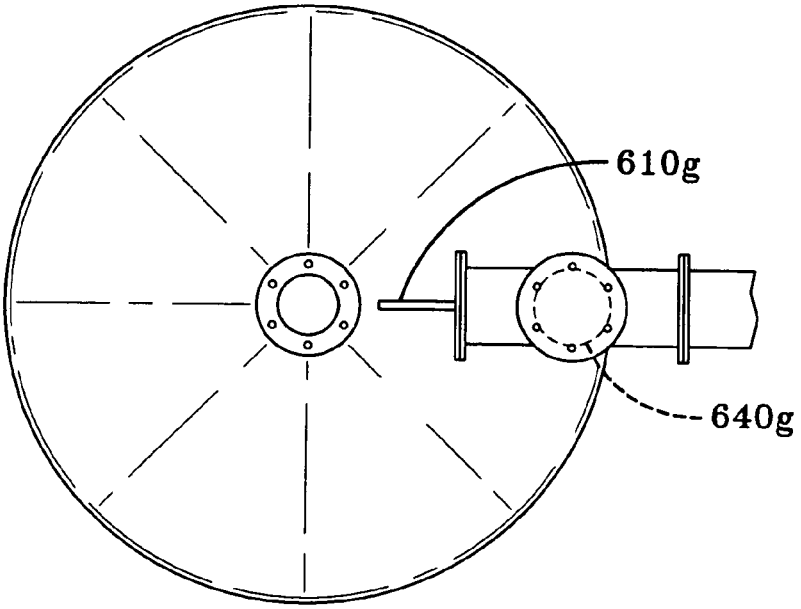
FIG. 6H shows a partial top plan view of the coke drum of FIG. 6G.

A. Conventional, PC Utility Boilers w/PCD & Wet Scrubber; Process Description In this embodiment of the invention, a conventional, pulverized-coal utility boiler with a traditional particulate control device is followed by a wet scrubbing system for the removal of sulfur oxides and/or particulates. The boiler and PCD systems are modified in a manner similar to the exemplary embodiment: conversion of sulfur oxides to dry particulates upstream of the existing particulate control device(s). Thus, the prior art has been modified to achieve this objective with Option 1: dry reagent injection system(s) and/or Option 2: a retrofit addition of flue gas conversion reaction chamber(s) and injection system(s). FIG. 5 shows a basic process flow diagram for this system burning a pulverized solid fuel as the primary fuel. Auxiliary fuel, such as natural gas or oil, is used for start-up, low-load, and upset operating conditions. The solid fuel 200 is introduced into the fuel processing system 202, where it is pulverized and classified to obtain the desired particle size distribution. A portion of combustion air (primary air) 204 is used to suspend and convey the solid fuel particles to horizontally-fired burners 208. Most of the combustion air (secondary air) 210 passes through an air preheater 212, where heat is transferred from the flue gas to the air. The heated combustion air (up to 600° F.) is distributed to the burners via an air plenum 214. The combustion air is mixed with the solid fuel in a turbulent zone with sufficient temperature and residence time to initiate and complete combustion in intense flames. The intense flames transfer heat to water-filled tubes in the high heat capacity furnace 216, primarily via radiant heat transfer. The resulting flue gas passes through the convection section 218 of the boiler, where heat is also transferred to water-filled tubes, primarily via convective heat transfer. At the entrance to the convection section 218, certain dry reagents can be mixed with the flue gas to convert undesirable flue gas components (e.g. sulfur oxides) to collectible particulates (this embodiment: option 1). The reagents 220 pass through a reagent preparation system 222 and are introduced into the flue gas via a reagent injection system 224. Steam or air 226 is normally injected through soot-blowing equipment 228 to keep convection tubes clean of ash deposits from the fuel and formed in the combustion process. The flue gas then passes through the air preheater 212, supplying heat to the combustion air.

The cooled flue gas then proceeds to the air pollution control section of the utility boiler system. At the exit of the air preheater, certain dry reagents can be mixed with the flue gas to convert undesirable flue gas components (e.g. sulfur oxides) to collectible particulates (this embodiment: option 1). The reagents 230 pass through a reagent preparation system 232 and are introduced into the flue gas via a reagent injection system 234. The existing particulate control device 236 (ESP, baghouse, etc.) has been retrofitted with the addition of a reaction chamber 238 for this embodiment: option 2. Certain reagents (e.g. lime slurry) can be prepared in a reagent preparation system 240. The reagent(s) is dispersed into the flue gas through a special injection system 242. Sufficient mixing and residence time is provided in the reaction chamber to convert most of the undesirable flue gas components (e.g. sulfur oxides) to collectible particulates. These particulates are then collected in the existing particulate control device (PCD) 236. A bypass damper 244 is installed in the original flue gas duct to bypass (100% open) the retrofit flue gas conversion system, when necessary. The flue gas exits the PCD and enters the wet scrubbing system 246. The wet scrubbing system 246 removes additional SOx and particulates. The clean flue gas then exits the stack 248.

B. Combustion Process of the Prior Art

The combustion process of the prior art for this embodiment is similar to the combustion process of the prior art in the exemplary embodiment.

C. Combustion Process of the Present Invention

The combustion process of the present invention for this embodiment may be similar to the combustion process of the present invention in the exemplary embodiment. However, the higher density and spherical shape of the modified fluid petroleum coke make it more difficult to burn than modified delayed coke. Consequently, certain parameters need to be adjusted to compensate for this undesirable characteristic. For example, a higher VCM specification (e.g. 20 wt. % VCM) can be necessary to achieve acceptable combustion characteristics.

D. Environmental Controls of the Prior Art

The environmental controls of the prior art for this embodiment may be similar to the environmental controls of the prior art in the exemplary embodiment. Traditional particulate control devices (PCDs) for conventional, coal-fired utility boilers include (but should not limited to) electrostatic precipitators (ESPs), various types of filtering systems, and wet scrubber systems. Various wet scrubber systems have evolved to control particulate and other emissions, including sulfur oxides. Wet scrubbing technologies range from simple flue gas scrubbing towers to high pressure drop, turbulent mixing devices with downstream separation. As discussed previously. The most common type of wet scrubbers used for U.S. utility boilers is low-pressure drop spray tower. This type of wet scrubber system is included in this embodiment, and was described previously. The present invention does not claim novel wet scrubbing technology, but provides a novel application of such technology that provides unexpected benefits and synergism. to optimize environmental controls associated with the combustion of petroleum coke. Therefore, further description of readily available wet scrubbing technologies was not deemed appropriate, at this time.

E. Environmental Controls of the Present Invention

The present invention does not claim the conventional environmental control technologies separately, but provides improvements and novel combinations of these technologies in applications of the present invention. The different combinations of these technologies are somewhat involved and provide synergism and/or unappreciated advantages that are not suggested by the prior art.

Similar to the exemplary embodiment, this embodiment describes the use of existing particulate control equipment for the control of sulfur oxides (SOx) and/or other undesirable flue gas components. As noted previously, fuel switching, from coal to the upgraded petroleum coke of this invention, will make available a tremendous amount of particulate control capacity in existing particulate control devices. Again, the existing particulate control devices-PCDs (baghouses, electrostatic precipitators, etc.) can be used for extensive removal of SOx and/or other undesirable flue gas components by converting them to collectible particulates upstream of PCDs.

The primary difference in the environmental controls of this embodiment (versus the earlier embodiments) is the presence of the existing wet scrubber system. The existing wet scrubber increases the number of environmental control options and operational flexibility. As the final environmental control system before the flue gas exits the stack, the wet scrubber has additional impacts on environmental emissions. The environmental controls of this embodiment (i.e. with the wet scrubber) are also applicable to upgraded petroleum coke from the delayed and other coking processes.

(1) Particulates Impact:

The particulates impact of this embodiment may be similar to the earlier embodiments. That is, the fuel switch from coal to modified fluid coke will decrease the ash particulate loading by >90%. However, the additional wet scrubber system in this embodiment can provide additional reduction of particulates but can also increase liquid entrainment in the flue gas that exits the stack. The degrees of additional particulate reduction and increase in liquid entrainment are expected to be minor. Both are dependent upon the design and operation of the wet scrubber system.

(2) Sulfur Oxides Impact:

The sulfur oxides impact of this embodiment may be similar to the exemplary embodiment. However, as noted above, the existing wet scrubber system provides more options to achieve high levels of sulfur oxides control. The existing wet scrubber also offers greater operational flexibility and reliability, if a combination of sulfur oxide controls is used.

In this embodiment, however, conversion of all the sulfur oxides upstream of the PCD may not be desirable to optimize the combined sulfur oxides removal. In other words, a certain portion of the total sulfur oxides may be left unconverted and be collected downstream of the particulate control device in the wet scrubbing system to maximize or optimize the overall SOx removal. Alternatively, all the sulfur oxides may be converted to particulates and collected in the existing particulate control device, avoiding the need for continuing the operation of the wet scrubber. In these cases, the additional sulfur removal may not be warranted, and the bypassing/shutdown of the wet scrubbing system can provide substantial savings in operating costs. Alternatively, the wet scrubber could then be converted to flue gas conversion technology for another undesirable flue gas component, such as $CO_2$.

In Option 1 of this embodiment, dry sorbent injection systems are added for additional control of sulfur oxides. As noted in the exemplary embodiment, this unique application of this flue gas conversion technology is expected to achieve 50-70% SOx removal efficiency, on a long-term basis. In this embodiment, however, the combination with the existing wet scrubber system increases the overall sulfur oxides removal. That is, the existing wet scrubber typically has the capability of reducing the SOx FGCT outlet emissions by 80-95+%. The actual removal efficiency of the wet scrubber can be reduced slightly due to the effects of lower SOx inlet concentrations. In conclusion, a combination of this unique flue gas conversion retrofit and wet scrubber is expected to achieve overall SOx removal efficiencies of 95-97% (e.g. 0.7+0.85(0.3)).

In Option 2 of this embodiment, retrofit reaction chamber(s) and reagent injection system(s) are added to convert sulfur oxides to dry particulates upstream of the existing particulate control device(s). Since the combination of Option 1 and the existing wet scrubber are expected to achieve such high SOx removal efficiencies (i.e. 95-97%), replacing Option 1 with Option 2 would usually not be cost effective. However, Option 2 can be effectively used, if shutting down or reducing the load of the existing wet scrubber is desirable. In this case, the combined SOx removal efficiency is expected to be the dry scrubber efficiency (e.g. 80-90%) plus the reduced efficiency of the existing wet scrubber multiplied by the remaining sulfur oxide emissions from the outlet of the dry scrubber system.

In both flue gas conversion options, minor modifications may be necessary to maintain particulate collection efficiencies. The particulates coming into the existing PCDs may have substantially different properties than the particulates of the PCD's design basis. Consequently, modifications in design and/or operating conditions may be required. For example, flue gas conditioning or operational changes may be appropriate to achieve desirable resistivity characteristics, and maintain collection efficiencies in existing electrostatic precipitators.

(3) Carbon Dioxide Impact:

The carbon dioxide impact of this embodiment may be similar to the exemplary embodiment. However, the wet scrubber system provides a greater opportunity to use the excess capacity of the existing particulate control device for the control of carbon dioxide, instead of sulfur oxides. In other words, the combination of the dry sorbent injection (option 1) and the wet scrubber should be sufficient SOx control to meet environmental regulations in most cases. Therefore, the retrofit addition of a flue gas conversion reactor/injection system (option 2) can be primarily used for carbon dioxide control. Alternatively, Option 2 can be used for SOx, and the wet scrubber could then be converted to flue gas conversion technology for carbon dioxide. This latter option would provide greater separation of technologies, and greater conversion selectivity.

(4) Nitrogen Oxides Impact:

The nitrogen oxides impact of this embodiment may be similar to the exemplary embodiment. However, the wet scrubber system can provide additional reduction of nitrogen oxides. The overall impact is expected to be relatively minor.

(5) Opacity Impact:

The opacity impact of this embodiment may be similar to the exemplary embodiment. However, the wet scrubber system can contribute greatly to increased opacity. That is, higher levels of liquid entrainment can induce the agglomeration of particulates and residual sulfur oxides, and increase opacity significantly over the exemplary embodiment. Substantial reductions in ash particulates and sulfur oxides, in many cases, will offset the opacity increase due to liquid entrainment. Consequently, the liquid entrainment remains predominantly water vapor (without impurities) and dissipates without visual obstruction when it leaves the stack.

(6) Solid Waste Impact:

The solid waste impact of this embodiment may be very similar to the exemplary embodiment. However, any solid waste (e.g. sludge) generated by the use of the wet scrubber system must be addressed. Lower utilization of the wet scrubber is expected to substantially reduce solid wastes from the wet scrubber. As noted earlier, reagent recycling or regeneration with Options 1 or 2 can substantially reduce the quantity and/or quality of the solid wastes for disposal. For most applications, the solid wastes are expected to be substantially less than the existing system. Even their worst case scenarios will often produce solid wastes no greater than the existing system.

F. Example 2

Utility Boiler with PCD and Conventional Wet Scrubber

A power utility has a conventional, pulverized-coal fired utility boiler that currently uses a high sulfur, bituminous coal (Illinois #6). This utility has a conventional particulate control device (PCD) followed by a wet scrubber, achieving ~90% removal efficiency for sulfur oxides. Full replacement of this coal with a high-sulfur, fluid (petroleum) coke produced by the present invention would have the following results:

| Fuel Characteristics | Current Coal | Upgraded coke | Results |
|---|---|---|---|
| Basis = $1.0 \times 10^9$ Btu/Hr Heat Release Rate as Input | | | |
| VCM (% wt) | 44.2 | 20.0 | 54% Lower |
| Ash (% wt.) | 10.8 | 0.3 | 97% Lower |
| Moisture (% wt.) | 17.6 | 3.8 | 78% Lower |
| Sulfur (% wt) | 4.3 | 5.2 | 21% Higher |
| Heating Value (Mbtu/lb) | 10.3 | 14.2 | 38% Higher |
| Fuel Rate (Mlb/Hr) | 97.0 | 70.4 | 27% Lower |
| Pollutant Emissions: Uncontrolled/Controlled | | | |
| Ash Particulates (lb/MMBtu or Mlb/Hr) | 10.5/.53 | .18/.01 | 98% Lower |
| Sulfur Oxides (lb/MMBtu or Mlb/Hr) | 8.4/.84 | 7.4/.15 | 82% Lower |
| Carbon Dioxide (lb/MMBtu or Mlb/Hr) | 245 | 214 | 13% Lower |

This example further demonstrates the beneficial application of the present invention. Again, the upgraded petroleum coke has substantially lower ash and moisture contents, compared to the existing coal. These factors contribute greatly to (1) the ability to burn successfully with lower VCM and (2) a fuel heating value that is 38% higher. In turn, the higher heating value requires a 27% lower fuel rate to achieve the heat release rate basis of one billion Btu per hour in the boiler. As noted previously, this lower fuel rate and the softer sponge coke significantly reduce the load and wear on the fuel processing system, while increasing pulverizer efficiency and improving combustion properties.

The ash particulate emissions (ash from the fuel) are 98% lower than the existing coal, due to the lower ash content and higher fuel heating value. Consequently, fuel switching to the upgraded coke unleashes 97% of the capacity in the existing particulate control device. This excess capacity can now be used for the control of sulfur oxides via retrofit FGC technology.

Dry sorbent injection systems (this embodiment: option 1) is added upstream of the existing particulate control device, along with any associated reagent preparation and control systems, for sulfur oxides control. In this case, the inlet SOx would be reduced by 70% (i.e. 7.4 to 2.2 Lb/MMBtu.). The existing wet scrubber can achieve an additional 80-90% removal (i.e. 2.2 to 0.33 Lb/MMBtu.). Thus, the combined control efficiency of the existing wet scrubber and the converted PCD would be >95% (e.g. 0.7+0.85(0.3)). In this manner, the utility of converting the existing particulate control device to dry sorbent injection represents 61% reduction in sulfur oxides (i.e. 0.33 vs. 0.84 lb/MMBtu). This unexpected result is achieved even though the sulfur content (5.2%) of the upgraded petroleum coke is 21% higher than the sulfur level (4.3%) of the Illinois bituminous coal. If this level of sulfur emissions is sufficient to meet environmental regulations, the retrofit addition of reaction chamber(s) and reagent injection system(s) is not necessary.

Alternatively, a SOx dry scrubber injection/reaction vessel (this embodiment: option 2) can be added upstream of the existing particulate control device, along with any associated reagent preparation and control systems. This conversion of the existing particulate control device is assumed to achieve 90% reduction in sulfur oxides in this case. Therefore, the uncontrolled sulfur oxide emissions are reduced from 7.4 to 0.74 thousand pounds per hour. If the wet scrubber is still operated, an additional 75-85+% removal (i.e. 0.74 to 0.15 Lb/MMBtu) can be achieved. Thus, the combined control efficiency of the existing wet scrubber and the converted PCD would be >98% (e.g. 0.9+0.8(0.1)). In this manner, the utility of converting the existing particulate control device to dry scrubbing represents over 82% reduction in sulfur oxides (i.e. 0.15 vs. 0.84 lb/MMBtu). This unexpected result is achieved even though the sulfur content (5.2%) of the upgraded petroleum coke is 21% higher than the sulfur level (4.3%) of the Illinois bituminous coal.

In this example, the effective use of retrofit FGCTs for additional reductions of carbon dioxide can be demonstrated. If option 1 is used for sulfur oxides control, a FGCT injection/reaction vessel can be added up stream of the existing PCD for additional carbon dioxide control. In this case, the level of additional carbon dioxide control is limited by (1) the conversion of carbon dioxide to particulates and (2) the remaining capacity of the existing PCD without exceeding environmental regulations for particulate emissions. Alternatively, additional particulate control capacity could be added as part of the retrofit project. As noted earlier, the performance and capacity of the existing PCD is not strictly on a mass weight basis, but depends on several factors, including particulate properties. If option 2 is used for sulfur oxide control, additional $CO_2$ control would likely be limited due to lack of selectivity of the FGCT reagent. In either case, the original ash particulate capacity less the required capacity for converted SOx (large ionic salts) may not leave sufficient capacity to make $CO_2$ control cost effective. However, an upgraded petroleum coke that has been desulfurized would offer even greater opportunities for additional $CO_2$ control. As noted previously, the wet scrubber could also be converted to flue gas conversion technology for carbon dioxide.

This example also illustrates significant reductions in pollutant emissions, based solely on fuel switching. The 27% lower fuel rate of the upgraded petroleum coke greatly contributes to lower environmental emissions of ash particulates, sulfur oxides, and carbon dioxide. The 98% reduction in ash particulates, noted above, was primarily due to lower fuel ash concentration. However, uncontrolled emissions of sulfur oxides and carbon dioxide are significantly reduced primarily due to the 27% lower fuel rate. That is, the sulfur content of the modified fluid coke is 21% higher than the existing coal. Yet the upgraded petroleum coke has 12% lower uncontrolled SOx. Similarly, the upgraded petroleum coke has 20% higher carbon content (i.e. 82.8% vs. 69.0%). Yet the uncontrolled emissions of carbon dioxide is reduced by 13% due to fuel switching. Similar results would be achieved by fuel switching to an upgraded petroleum coke from a delayed coking process.

Each utility boiler will have a different set of design conditions for converting the existing particulate control devices. Consequently, the degree of additional control needs to be determined on a case by case basis: including analyses of site-specific factors of the design and operation of the existing PCD. The conversion of each system will depend on various design and operational parameters. Engineering factors will determine the optimal design and level of control for SOx FGC technologies and wet scrubbing technologies. Again, the ultimate level of additional control for SOx and particulates will depend on (1) the efficiency of conversion of the sulfur oxides to particulates, (2) the efficiency of particulate collection, and (3) capacity limitations without exceeding environmental regulations for particulate emissions.

9. Use of Premium "Fuel-Grade" Petroleum Coke: Additional Embodiments

Additional embodiments are described below for the various means to effectively use the premium "fuel-grade" petroleum coke of the present invention. Any, all, or any combination of the embodiments, described above or below, could be used to achieve the objects of this invention. In any combination of the embodiments, the degree required can be less than specified here due to the combined effects.

A. Combustion or Other End-User Systems: Additional Embodiments (1) all Coal-Fired Boilers:

Further embodiments of the present invention would include the use of upgraded petroleum coke in all types of coal-fired boilers (new or existing) regardless of furnace design, burner orientation, or other design and operational parameters. These combustion systems would include, but should not be limited to, low heat capacity furnaces, cyclone furnaces, tangentially fired furnaces/burners, non-horizontal fired burners, etc.

(2) Other Combustion Applications:

Additional embodiments of the present invention would include all other facilities, where coals or petroleum cokes are currently used as fuels. The present invention should not be viewed as limited to coal-fired utility boilers, but rather may be applicable to all combustion applications, where the enhanced properties of the upgraded coke provide improvements, combustion and otherwise. These combustion applications may preferably include, but should not be limited to, industrial boilers, rotary kilns, cement kilns, process heaters, incinerators, and fluidized bed combustors. Also, the use of upgraded petroleum coke as a supplemental fuel for these and other applications is anticipated by the present invention, including biomass and/or waste combustion facilities.

(3) Coal/Coke Gasification:

In other embodiments, the present invention anticipates the use of the upgraded petroleum coke in various coal/coke gasification technologies. Coal gasification is a process that converts coal from a solid to a gaseous fuel (or chemical feedstock) through partial oxidation. Once the fuel (or chemical feedstock) is in the gaseous state, undesirable substances, such as sulfur compounds and ash, can be removed from the gas by established techniques. The net result is clean, transportable fuel (or chemical feedstock). Since coal/coke gasification is a type of combustion (i.e. partial oxidation vs. full oxidation), many of the same principles discussed in the present invention still apply. Consequently, many of the improved properties of the upgraded petroleum coke would be desirable for partial oxidation. For example, the ability to optimize and control the quantity/quality of the VCM and the coke crystalline structure can be very desirable for coke gasification. Also, the ability to decontaminate the coke in/prior to the coking process can substantially reduce the gas clean-up requirements. The dramatically lower levels of ash and sulfur in desulfurized petroleum coke of the present invention can significantly reduce the capital and operating costs of the gasification process. In this manner, the upgraded petroleum coke can effectively replace various coals and cokes, partially or fully, in these gasification technologies.

(4) Magnetohydrodynamic Electric Generation:

The upgraded petroleum coke can be extremely valuable as a premium fuel for magnetohydrodynamic or MHD electric generation. The MHD process is currently under development. Conceptually, MHD electric generation occurs when hot, partially ionized combustion gases (plasma) are expanded through a magnetic field. This hot gas is produced in a coal combustor at temperatures approaching 5000° F. In order to achieve these temperatures, the combustion air must be preheated above 3000° F. The gas ionization is increased by seeding the gas with an easily ionized material, such as potassium compounds. The spent seed compounds are treated and recycled for economic and environmental reasons. The major advantage of this technology is potential cycle efficiencies in excess of 60%, compared to conventional cycle efficiencies of 35-38%. Achieving such high operating temperatures can be accomplished more readily with the upgraded petroleum coke of the present invention. The upgraded petroleum coke has substantially higher heating value, lower ash, and lower moisture content versus most coals. Also, the crystalline structure of the upgraded petroleum coke has significantly higher porosity and can provide a finer fuel particle size distribution. Consequently, the upgraded coke can burn faster and cleaner, with minimal carbon residue. These properties potentially increase the maximum flame temperatures, as well. In addition, the quality and quantity of the VCM in the upgraded petroleum coke can be readily formulated and controlled to optimize combustion properties and prevent premature combustion with very hot preheated air. Furthermore, the lower ash content can provide economic advantage in (1) the recovery/recycle of the seed compounds, (2) erosion prevention, and (3) environmental controls. Finally, an upgraded petroleum coke that has been desulfurized and/or demetallized can provide further advantages in this combustion system and environmental controls.

(5) Non-Combustion Applications:

Additional embodiments include any process that (1) uses coal or petroleum coke for its physical and chemical properties (in addition to or regardless of its fuel value), and (2) is enhanced by the improvements of the upgraded petroleum coke of this invention. These end-user applications include, but should not be limited to, cement kilns, coal/coke liquefaction, coal/coke cleaning or any process that uses coal and/or coke as a raw material or chemical feedstock. The present invention anticipates that the chemical and physical properties (as well as the fuel properties and combustion characteristics) of the new formulation of petroleum coke will offer improved operations for these types of applications. In these applications, the modified physical and/or chemical properties may or may not be used in conjunction with the improved fuel properties and combustion characteristics.

B. Fuel Processing Improvements; Additional Embodiments (1) More than One Fuel Processing System:

In some cases, the petroleum coke end-user can have more than one fuel processing system. Site-specific design, operational, and/or other constraints may inhibit the fuel processing system benefits described in the exemplary embodiment. For example, the facility may already have or desire more than one fuel processing/management system. Similarly, certain refining operations and coking processes may not be capable of producing consistent fuels due to abnormal variations in operation and coker feedstocks. Thus, modified fuel processing systems may be required. In either case, the present invention still provides sufficient utility in these situations and should not be limited.

(2) Modifications to Lower Sponge Coke Specifications:

In some cases, the petroleum coke end-user can modify the design or operation of the existing fuel processing system to reduce the "minimum-acceptable" sponge coke specification. These modifications include (but should not be limited to) pulverizer type, capacity, number, and power usage characteristics. The present invention anticipates these changes in an effort to (1) improve the operation and reliability of the combustion system and/or (2) reduce the degree of changes in the coker process. These modifications can be more cost effective in certain situations.

C. Combustion Improvements; Additional Embodiments (1) Modifications to Lower VCM Specifications:

In some cases, the petroleum coke end-user can modify the design or operation of the existing combustion system to reduce the "minimum-acceptable" VCM specification. These modifications include (but should not be limited to) burner design, burner number, air controls/distribution, furnace configuration, and boiler operation. The present invention anticipates these changes in an effort to (1) improve the operation and reliability of the combustion system and/or (2) reduce the degree of changes in the coker process. These modifications can be more cost effective in certain situations.

(2) Modifications to Lower Sponge Coke Specifications:

In some cases, the petroleum coke end-user can modify the design and/or operation of the existing combustion system to reduce the "minimum-acceptable" sponge coke specification. These modifications include (but should not be limited to) burner design, burner number, air controls/distribution, furnace configuration, and boiler operation. The present invention anticipates these changes in an effort to (1) improve the operation and reliability of the combustion system and/or (2) reduce the degree of changes in the coker process. These modifications can be more cost effective in certain situations.

(3) Modifications to Avoid Coke Decontamination:

Another embodiment of the present invention would modify the combustion systems or operations of the petroleum coke user, and avoid the need for coke decontamination. Some combustion system modifications, including modified firing techniques, firebox temperature profiles, and combustion equipment design/operation can alleviate the detrimental effects of certain salts and metals.

(4) New Designs that Avoid Coke Decontamination:

Another embodiment of the present invention anticipates new designs for combustion systems with combustion, heat exchange, and air pollution control systems that are capable of handling the detrimental effects of the petroleum coke contaminants, including sulfur. Thus, the need for petroleum coke decontamination can be avoided.

D. Heat Exchange Improvements; Additional Embodiments (1) Modifications to Avoid Coke Decontamination:

Another embodiment of the present invention would modify the heat exchange equipment design or operation of the petroleum coke user's facility. Some modifications in heat exchange equipment design and/or operation can alleviate the detrimental effects of certain mineral deposits (e.g. salts and metals). These modifications include (but should not be limited to) better tube metallurgy, increased soot blowing frequency, heat transfer temperature profiles, and heat transfer equipment design/operation. These modifications, with or without the combustion system modifications, may reduce or eliminate the need for petroleum coke decontamination.

(2) No Coke Decontamination Required:

Another embodiment of the present invention would selectively use the upgraded petroleum coke in existing combustion, heat exchange and air pollution control systems that are currently capable of handling the detrimental effects of the petroleum coke contaminants without coke decontamination.

E. Environmental Controls; Additional Embodiments

The new formulation of petroleum coke can provide improved environmental benefits for a wide variety of solid-fuel applications, both existing and new. The predominant environmental control feature of the present invention is creating and converting excess capacity in the existing particulate control device. This excess capacity can be used for effective control of undesirable flue gas components by converting them to collectible particulates upstream of the existing particulate control device. The pollutants, which are controlled in this manner, would include (but not be limited to) sulfur oxides, nitrogen oxides, carbon dioxide, metals, and air toxics. Other pollutants, defined now or in the future, could also be controlled in this fashion. The new formulation of petroleum coke makes this unique retrofit control possible. In addition, the environmental issues for all embodiments are applicable regardless of the source of the upgraded petroleum coke (e.g. delayed coking & fluid coking).

(1) Other Flue Gas Conversion Technologies:

Various types of technologies can be used for the conversion of gases or liquids to collectible particulates (dry or wet) upstream of the existing particulate control devices. The exemplary and secondary embodiments discussed the novel application of several proven, flue gas conversion technologies that convert sulfur oxides to dry particulates. These embodiments also noted developing technologies for the conversion of carbon dioxide to collectible particulates. The present invention anticipates further development of these and other technologies to convert SOx and $CO_2$. These technologies may include different reagents, reagent preparation, and reagent injection systems. The present invention also anticipates the development of other technologies for the conversion of nitrogen oxides, air toxics, and other pollutants. The conversion of air toxics, such as heavy metal vapors (e.g. mercury), is an area of great potential in the future.

(2) Existing Dry Scrubber:

Another embodiment of the present invention is solid-fuel combustion systems with an existing dry scrubbing system, new or otherwise. An existing dry scrubber can be modified to use existing particulate control capacity for additional control of undesirable flue gas components, particularly sulfur oxides. The reagent injection and subsequent reaction zones would need to be modified to provide for (1) greater injection rates, (2) adequate mixing, and (3) comparable residence time. The optimal application of these technologies for site-specific situations can be determined through evaluation of the engineering factors involved.

(3) Desulfurization and/or Demetallization of the UPGRADED COKE:

Another embodiment of the present invention that would improve environmental emissions is the desulfurization and/or demetallization of the upgraded petroleum coke. As noted above, there are various methods to decontaminate the new formulation of petroleum coke. Any method that decreases the sulfur content will decrease the sulfur oxides emissions. In turn, this can make any excess capacity in the existing particulate control devices (including wet scrubbers) available for other types of environmental control (e.g. flue gas conversion of $CO_2$). Similarly, any demetallization can decrease the emissions of metals, particularly those that exit the combustion process in vapor form (e.g. mercury and vanadium oxides). EXAMPLE 4 demonstrates the effective use of desulfurized petroleum coke. Note its impact on the sulfur oxides emissions and the increased ability to use excess PCD capacity for carbon dioxide control. In addition, desulfurization and/or demetallization of the upgraded petroleum coke can alleviate the need for high efficiency desalting. As discussed previously, very low levels of sodium are not as critical, if sulfur and vanadium levels are sufficiently low. Furthermore, certain types of desulfurization and/or demetallization of upgraded coke can produce very low levels of sodium without extensive desalting. In either case, very low sodium levels are still preferable, unless their achievement becomes incompatible with other objectives.

(4) No Change in the Existing Environmental Control System(S):

Another embodiment of the present invention would selectively use the upgraded petroleum coke in existing combustion/air pollution control systems (e.g. ESP & wet scrubber) that are currently capable of handling the level of sulfur in the upgraded petroleum coke of the present invention. Many environmental regulations have pollution control limits for sulfur oxides, written in pounds per million Btu heat release of the fuel. Consequently, petroleum coke with a higher concentration of sulfur can be substituted for a coal with lower sulfur concentration without exceeding the regulatory limits. EXAMPLES 1-4 demonstrate this aspect of the present invention. The sulfur content of the upgraded petroleum coke is equal to or greater than the coals' sulfur contents. Yet the uncontrolled SOx emissions from the upgraded petroleum coke are less. This alternative is possible due to the 15-25% higher heat content of petroleum coke compared to most coals (e.g., 13-15,00 Btu/lb vs. 10.5-13,000 Btu/lb for bituminous coal) and its subsequent lower fuel rate.

(5) Recycling of Flue Gas Conversion Reagents:

Another embodiment of the present invention would include extensive recycling of unreacted reagents in the FGCT systems, that convert flue gas components to collectible particulates. Prior art of SOx dry scrubber technology currently recycles collected flyash into the reagent injection to increase reagent usage. However, high ash particulates of existing fuels limit the degree of recycling. The upgraded petroleum coke of the present invention has such low ash particulates that greater quantities of collected flyash can be effectively recycled to increase reagent utilization efficiencies. Increased reagent utilization efficiencies would increase the SOx control efficiency and reduce the solid wastes requiring disposal. In a similar manner, the present invention can improve other flue gas conversion technologies, as well.

(6) Regeneration of Flue Gas Conversion Reagents:

Another embodiment of the present invention involves the regeneration of spent reagent in flue gas conversion technologies. This regeneration can substantially reduce the make-up reagent and waste disposal required. The regeneration process can include, but should not be limited to, hydration of the collected flyash and subsequent precipitation of the undesired ions (i.e. sulfates, carbonates, etc.). In cases where slaked lime is used as the conversion reagent, the regeneration process can greatly reduce the carbon dioxide generated in the reagent preparation process: limestone (calcium carbonate—$CaCO_4$) to lime (calcium oxide—CaO). Furthermore, the regeneration process would likely include a purge stream to remove unacceptable levels of impurities from the system. This purge stream would be analogous to blow down streams in many boiler water and cooling water systems. In many cases, this purge stream will contain a high concentration of heavy metals, including vanadium. Various physical and/or chemical techniques can be used to extract and purify these metals for commercial use. Finally, the ability to continually regenerate reagents provides the opportunity to improve the flue gas conversion process through the use of exotic reagents; not considered previously due to costs. In this manner, the regeneration of conversion reagents can (1) substantially reduce reagent and flyash disposal costs, (2) reduce $CO_2$ emissions, (3) create a resource for valuable metals, and (4) provide the means to economically improve the flue gas conversion process via the use of more exotic reagents.

(7) Salable by-Products from FGC Technologies:

Another embodiment of the present invention improves the quality of flue gas conversion products to provide salable by-products and substantially reduce the solid wastes requiring disposal. The extremely low ash particulate levels (i.e. low impurities) provide greater opportunity to use the collected flyash as raw materials for various products, instead of solid waste requiring disposal. These products include, but are not limited to, gypsum wallboard and sulfuric acid.

(8) Collection of Carbon Dioxide Generated in Reagent Preparation:

Another embodiment of the present invention anticipates the development of carbon dioxide collection systems for the $CO_2$ released as a gas in the reagent preparation systems for flue gas conversion technologies. For example, most SOx dry scrubber systems convert calcium carbonate to calcium oxide and carbon dioxide, that currently goes directly to the atmosphere. The $CO_2$ collection technologies can include (but should not be limited to) activated carbon adsorbtion with pressure swing regeneration. The upgraded petroleum coke of the present invention has many desirable properties (e.g. high porosity, high HGI, etc.) for use as the activated carbon in this $CO_2$ collection process. That is, upgraded petroleum coke can be readily altered to be effectively used in this carbon adsorption application. The activated coke eventually loses activation after numerous cycles of use and regeneration. The deactivated coke can then be blended into the coke fuel and subsequently burned in the combustion system.

(9) Integration of Activated Coke Removal Technologies:

Combined control of SOx and NOx emissions has been commercially achieved in Germany and Japan using sorbent beds of activated coke or activated char in the flue gas stream. The activated coke/char can adsorb $SO_2$ and catalyze the reduction of NOx to nitrogen gas by ammonia injection. $SO_2$ removals of 90-99+% and NOx removals of 50-80+% have been reported for low- to medium-sulfur systems. An additional advantage of this system is noted to be the adsorbtion of air toxics and carbon dioxide to a limited extent. High coke consumption and high moisture content are noted to be potential problems, particularly in high-sulfur applications. The present invention anticipates effective integration of this technology. Similar to the previous embodiment, the upgraded coke of the present invention has many desirable characteristics of the activated carbon. In many cases, the upgraded coke can be readily modified to be effectively used as the activated coke. Again, the coke loses activation after numerous cycles of use and regeneration. Apparently, this occurs more quickly in the high-sulfur applications. Deactivated coke can then be blended into coke fuel and subsequently burned in the combustion system.

In a similar manner, the upgraded coke of the present invention can be used for activated carbon technologies for the removal of air toxics (e.g. mercury), carbon dioxide, or other undesirable flue gas components. The activated carbon technologies for these components system can be integrated (1) fully into the SOx/NOx activated coke system (to the extent possible), (2) share auxiliary systems, or (3) work independently with or without the SOx/NOx activated coke system. In any case, deactivated coke can be blended into the coke fuel and subsequently burned in the combustion system.

F. Example 3

Low-Sulfur Lignite Coal vs. Medium Sulfur Coke with Dry Sorbent Injection

Another power utility has a conventional, pulverized-coal fired utility boiler that currently burns a low-sulfur, lignite coal from Texas. The existing utility has a large-capacity, particulate control device with no sulfur oxides control. Full replacement of this coal with a medium-sulfur, petroleum coke produced by the present invention would have the following results:

| Fuel Characteristics | Current Coal | Upgraded coke | Results |
|---|---|---|---|
| Basis = 1.0 × $10^9$ Btu/Hr Heat Release Rate as Input | | | |
| VCM (% wt) | 31.5 | 16.0 | 49% Lower |
| Ash (% wt.) | 50.4 | 0.3 | 99+% Lower |
| Moisture (% wt.) | 34.1 | 0.3 | 99+% Lower |
| Sulfur (% wt) | 1.0 | 2.5 | 150% Higher |
| Heating Value (Mbtu/lb) | 3.9 | 15.3 | 290% Higher |
| Fuel Rate (Mlb/Hr) | 254 | 65.4 | 74% Lower |
| Pollutant Emissions: Uncontrolled/Controlled | | | |
| Ash Particulates (lb/MMBtu or Mlb/Hr) | 128/6.4 | 0.2/.01 | 99+% Lower |
| Sulfur Oxides (lb/MMBtu or Mlb/Hr) | 5.1 | 3.2/.96 | 37/81% Lower |
| Carbon Dioxide (lb/MMBtu or Mlb/Hr) | 315 | 210/150 | 33/52% Lower |

This example further demonstrates the beneficial application of the present invention. Again, the upgraded petroleum coke has substantially lower ash and moisture contents, compared to the existing coal. These factors contribute greatly to (1) the ability to burn successfully with lower VCM and (2) a fuel heating value that is 290% higher. In turn, the higher heating value requires a 74% lower fuel rate to achieve the heat release rate basis of one billion Btu per hour in the boiler. As noted previously, this lower fuel rate and the softer sponge coke substantially reduce the load and wear on the fuel processing system, while increasing the pulverizer efficiency and improving combustion characteristics.

The ash particulate emissions (ash from the fuel) are >99+% lower than the existing coal, due to the lower ash content and higher fuel heating value. Consequently, fuel switching to the upgraded coke unleashes >99% of the capacity in the large, existing particulate control device. Part of this excess capacity can now be used for the control of sulfur oxides via retrofit SOx FGC technology.

In this example, dry sorbent injection into the combustion system with the excess capacity of the existing PCD is sufficient to achieve the desirable sulfur oxides control. Dry sorbent is injected in the firebox and downstream of the air preheater to achieve 70% SOx removal. Therefore, the uncontrolled sulfur oxide emissions are reduced from 3.2 to 0.96 thousand pounds per hour. In this manner, the utility of converting the existing particulate control device to dry sorbent injection represents 81% reduction in sulfur oxides (i.e. <0.96 vs. 5.1 lb/MMBtu). This unexpected result is achieved even though the sulfur content (2.5%) of the upgraded petroleum coke is only 150% higher than the sulfur level (1.0%) of the Texas lignite coal.

In this example, carbon dioxide is reduced by the lower fuel rate and new flue gas conversion technologies (FGCT). The 74% lower fuel rate alone reduces the carbon dioxide emissions by 32%. FGCT processes convert carbon dioxide to dry solid particulates that can be collected in the conventional particulate control device. The retrofit deployment of FGC technology can be limited by the excess capacity in the existing PCD. However, the remaining part of the excess capacity is expected to provide further reductions of carbon dioxide; at least 60 Mlb/Hr. In this case, the additional $CO_2$ control from FGCT increases the combined reduction to >50%.

This example also demonstrates that the beneficial application of the present invention does not necessarily require the conversion of existing particulate control devices. Based solely on fuel switching, (74% lower fuel rate and the >99% lower ash content of the upgraded petroleum) substantially lower environmental emissions of ash particulates, sulfur oxides, and carbon dioxide are achieved. Ash particulates are reduced by 99%. The uncontrolled SOx emissions are 37% lower, even though the sulfur content of the upgraded petroleum coke is 150% higher. Similarly, the uncontrolled carbon dioxide emissions are reduced by 32%, even though the carbon content of the upgraded petroleum coke is 163% higher (i.e. 88.8% vs. 33.8%). All of these pollutant emission reductions are achieved without conversion of the existing PCD. They come solely from switching fuel to the new formulation of petroleum coke of the present invention.

G. Example 4

Low Sulfur Western Coal vs. Desulfurized Petroleum Coke

Another utility has a conventional, coal-fired utility boiler that currently uses a very low sulfur, sub-bituminous coal from Montana. This utility has a typical particulate control device (PCD) with no sulfur oxides emission control. Full replacement of this coal with a desulfurized (85%) petroleum coke produced by the present invention would have the following results:

| Fuel Characteristics | Current Coal | Upgraded coke | Results |
|---|---|---|---|
| Basis = 1.0 × $10^9$ Btu/Hr Heat Release Rate as Input | | | |
| VCM (% wt) | 40.8 | 16.0 | 61% Lower |
| Ash (% wt.) | 5.2 | 0.3 | 94% Lower |
| Moisture (% wt.) | 23.4 | 0.3 | 99% Lower |
| Sulfur (% wt) | 0.44 | 0.65 | 48% Higher |
| Heating Value (Mbtu/lb) | 9.5 | 15.3 | 61% Higher |
| Fuel Rate (Mlb/Hr) | 105 | 65.4 | 38% Lower |
| Pollutant Emissions: Uncontrolled/Controlled | | | |
| Ash Particulates (lb/MMBtu or Mlb/Hr) | 5.5/.3 | 0.2/.01 | 97% Lower |
| Sulfur Oxides (lb/MMBtu or Mlb/Hr) | 0.92 | 0.85 | 8% Lower |
| Carbon Dioxide (lb/MMBtu or Mlb/Hr) | 277 | 210/190 | 23/31% Lower |

This example further demonstrates the beneficial application of the present invention. Again, the upgraded petroleum coke has substantially lower ash and moisture contents, compared to the existing coal. These factors contribute greatly to (1) the ability to burn successfully with lower VCM and (2) a fuel heating value that is 61% higher. In turn, the higher heating value requires a 37% lower fuel rate to achieve the heat release rate basis of one billion Btu per hour in the boiler. As noted previously, this lower fuel rate and the softer sponge coke substantially reduce the load and wear on the fuel processing system, while increasing the pulverizer efficiency and improving combustion characteristics.

In this example, the desulfurized petroleum coke of the present invention is sufficient to achieve very low sulfur oxide emissions (<1.25 lb/MMBtu). In fact, the desulfurized coke achieves 8% lower emissions (i.e. 0.85 vs. 0.92 lb/MMBtu) than this very low sulfur, western coal, even though the desulfurized coke has 50% higher sulfur content.

Consequently, the excess capacity created in the particulate control is available for other undesirable flue gas components via FGC technologies.

Carbon dioxide FGC technologies with the excess capacity of the existing PCD are expected to provide increased reductions in carbon dioxide. The ash particulate emissions (ash from the fuel) are >97% lower than the existing coal, due to the lower ash content and higher fuel heating value. Consequently, fuel switching to the upgraded coke unleashes >97% of the capacity in the existing particulate control device. This excess capacity can now be used for the control of carbon dioxide via retrofit FGC technology. Carbon dioxide FGCT reagent(s) injection/reaction vessel is added upstream of the existing particulate control device, along with any associated reagent preparation and control systems. The retrofit of this technology can be limited by the excess capacity in the existing PCD. However, the excess capacity is expected to provide further reductions of carbon dioxide; at least 20 Mlb/Hr or 7%. In this case, the combined effect of fuel switching and carbon dioxide FGCT is 30+% reduction in $CO_2$ (190 vs. 275 Mlb/hr).

The desulfurized coke can be used to make most of the excess PCD capacity (created from fuel switching) available for uses other than SOx control. As shown in Example 3, greater reductions of $CO_2$ can be expected from retrofit FGC technology, if the current coal has higher ash content and lower heating values. In this manner, additional benefits from switching to desulfurized, premium "fuel-grade" petroleum coke can be achieved in those applications.

H. Example 5

Mixture of Existing Coal & Ungraded Petroleum Coke w/Dry Sorbent Injection

Another power utility has a conventional, pulverized-coal fired utility boiler that currently burns a medium-sulfur, bituminous coal from western Pennsylvania (i.e. Pittsburgh #8). The existing utility currently has a typical particulate control device with no sulfur oxide emissions control. Replacement of half of this coal (i.e. 50% by weight) with a high-sulfur petroleum coke produced by the present invention would have the following results:

| Fuel Characteristics | Current Coal | 50/50 Coal/Coke | Results |
|---|---|---|---|
| Basis = $1.0 \times 10^9$ Btu/Hr Heat Release Rate as Input | | | |
| VCM (% wt) | 40.2 | 28.1 | 32% Lower |
| Ash (% wt.) | 9.1 | 4.7 | 48% Lower |
| Moisture (% wt.) | 5.2 | 2.8 | 46% Lower |
| Sulfur (% wt) | 2.3 | 3.3 | 43% Higher |
| Heating Value (Mbtu/lb) | 12.5 | 13.9 | 11% Higher |
| Fuel Rate (Mlb/Hr) | 79.7 | 72.6 | 9% Lower |
| Pollutant Emissions: Uncontrolled/Controlled | | | |
| Ash Particulates (lb/MMBtu or Mlb/Hr) | 7.3/0.7 | 3.8/0.4 | 43% Lower |
| Sulfur Oxides (lb/MMBtu or Mlb/Hr) | 3.7/3.7 | 4.7/1.4 | 62% Lower |
| Carbon Dioxide (lb/MMBtu or Mlb/Hr) | 216 | 210 | 3% Lower |

This example further demonstrates the beneficial application of the present invention. The 50%/50% mixture of the existing coal and upgraded petroleum coke has significantly lower ash and moisture contents, compared to the existing coal. These factors contribute greatly to (1) the ability to burn successfully with lower VCM and (2) a fuel heating value that is 11% higher. In turn, the higher heating value requires a 9% lower fuel rate to achieve the heat release rate basis of one billion Btu per hour in the boiler. As noted previously, this lower fuel rate and the softer sponge coke substantially reduce the load and wear on the fuel processing system, while increasing the pulverizer efficiency and improving combustion characteristics.

The ash particulate emissions (ash from the fuel) are >43% lower than the existing coal, due to the lower ash content and higher fuel heating value. Consequently, fuel switching to the upgraded coke unleashes >43% of the capacity in the existing particulate control device. This excess capacity can now be used for the control of undesirable flue gas components via FGC technology.

In this example, dry sorbent injection into the combustion system with the excess capacity of the existing PCD is sufficient to achieve the desirable sulfur oxides control. Dry sorbent is injected in the firebox and downstream of the air preheater to achieve 70% SOx removal. Therefore, the uncontrolled sulfur oxide emissions are reduced from 4.7 to 1.4 thousand pounds per hour. In this manner, the utility of converting the existing particulate control device to dry sorbent injection SOx FGCT represents 62% reduction in sulfur oxides (i.e. 1.4 vs. 3.2 lb/MMBtu). This unexpected result is achieved even though the sulfur content (3.3 wt. %) of the coal/coke mixture is 43% higher than the sulfur level (2.3%) of the existing coal.

10. Use of Premium "Fuel-Grade" Pet Coke: Optimized Environmental Embodiment

The various methods and embodiments of the present invention, used to control environmental emissions, can also be used to optimize the overall environmental controls for specific combustion applications. In this manner, an existing combustion facility can be modified to produce the optimal combination of environmental controls to meet or exceed environmental regulations. The following embodiment provides a means (1) to produce an upgraded petroleum coke that not only achieves the basic objectives of this invention, but (2) to also optimize the various environmental control options for various undesirable flue gas components and solid wastes.

As noted earlier, the upgraded petroleum coke of the present invention has unique combustion characteristics that provides for novel combinations of environmental control technologies. That is, much lower ash particulates and lower fuel rates of the upgraded petroleum coke creates tremendous capacity in the existing particulate control device to use for the collection of various undesirable flue gas components. However, the undesirable flue gas components must be converted to collectible particulates (dry, wet, or otherwise) upstream of the existing particulate control device (PCD). Consequently, the level of control for each undesirable flue gas component will depend on several factors: (1) Net availability of PCD capacity, (2) Effectiveness of conversion to collectible particulates, (3) Characteristics of conversion reagents: Selectivity, reactivity, chemical complexity, etc, and (4) Reaction characteristics: temperature, residence time, and mixing requirements. The selectivity of the conversion reagent is a key aspect, when trying to control specific undesirable flue gas components. Otherwise, the reagent will be wasted on components that are not intended for conversion to collectible particulates (e.g. carbon dioxide versus sulfur oxides).

Pilot plant studies can be designed to determine the appropriate combination of various techniques described in this invention to optimize the control of various undesirable flue gas components. The following procedure can provide an adequate means to optimize the novel combinations of environmental controls of the present invention in an existing combustion facility:

1. Create PCD Capacity; Reduction in Ash Particulates and Fuel Rate Due to Fuel Switching:
   a. Analyze PCD capacity created: PCD design and operating parameters
      Calculate increase in collection area/flue gas ratio; due to decrease in flue gas flow rate
      Determine available capacity, based on differences in particulate collection characteristics
   b. Evaluate potential for particulate conversion technologies w/o exceeding particulate regulations
2. Control of Undesirable Flue Gas Components: SOx, NOx, Carbon Dioxide, Air Toxics, Metals, etc.
   a. Determine level of control required for each undesirable flue gas component
   b. Prioritize undesirable flue gas components (e.g. SOx, $CO_2$, NOx, air toxics, etc.)
   c. Evaluate control options for each undesirable flue gas component
      Fuel replacement only: Lower fuel rate and better combustion characteristics
      Reagent injection in the furnace and/or downstream heat exchange
      Retrofit reaction chamber with reagent injection and mixing systems
      Coker feedstock decontamination and/or treatment(s) of upgraded petroleum coke
      Combination of above and/or other control options
   d. Integrate all possible control combinations into various control scenarios
   e. Optimize various control scenarios to achieve control objectives at lowest cost This optimization process is unique for each specific combustion facility, and can become quite complex and time-consuming. First of all, the process must take into account many site-specific factors, including (1) design and operation of the existing combustion facility and particulate control devices and (2) characteristics of the existing fuel and the replacement upgraded petroleum coke fuel. Secondly, the optimization process must carefully consider the relative impacts of the individual control systems on each other, when combined in a control scenario. For example, the reagents to convert undesirable flue gas components to collectible particulates may interfere with each other. Alternatively, they can create undesirable compounds (e.g. ammonium bisulfate from reagent ammonia) that can foul, plug, or corrode downstream system components. Finally, the mix of various collectible particulates (e.g. calcium sulfates, ammonium bicarbonates, etc.) can inhibit the effective use of reagent (flyash) recycling/regeneration to improve reagent utilization and reduce solid waste disposal. Some of these principles are illustrated in the following embodiment of maximum environmental protection.

The embodiment of maximum environmental protection would likely include desulfurization and demetallization of the upgraded petroleum coke and convert excess particulate control capacity in the existing system for additional removal of various undesirable flue gas components.

1. Sulfur Oxides (SOx): Though most of the sulfur (e.g. >85%) would be removed in the hydrodesulfurization of the coker feedstocks, additional control of sulfur oxides can be completed by injection of reagents in the furnace and downstream heat exchange. In this manner, 50-70% of the remaining SOx could be converted to collectible particulates, or >93% total reduction.
2. Carbon Dioxide ($CO_2$): In this embodiment, $CO_2$ is given second priority for available PCD capacity. Carbon dioxide would likely be converted to collectible particulates via retrofit reaction chamber(s) with reagent injection and mixing systems. Reaction efficiency and available PCD capacity would primarily limit the level of $CO_2$ removal. Additional PCD capacity could be added as part of the retrofit project. Regeneration and recycle of conversion reagents would likely broaden $CO_2$ conversion options and improve economic viability.
3. Air Toxics: Most of the air toxic emissions associated with combustion processes are related to the heavy metals (e.g. mercury, vanadium, nickel, etc.) in the fuel. These air toxics could also be converted to collectible particulates, as long as their conversion reagents are compatible and do not interfere with the conversion reagents for the SOx and $CO_2$. However, the hydrodesulfurization of coker feedstock will also decrease the metals content of the coke. Consequently, the consumption of available PCD capacity for air toxics removal is not expected to be significant.
4. Nitrogen Oxides (NOx): The nitrogen content of petroleum coke is normally reduced by the hydrodesulfurization of the coker feed. Nitrogen oxides are further reduced by the lower fuel rates of the petroleum coke. Furthermore, the dramatically lower ash, which is responsible for more uniform and stable flame, makes the upgraded petroleum coke more susceptible to Low NOx burner designs for lower emissions of nitrogen oxides (NOx). The remaining NOx could also be converted to collectible particulates, but selective noncatalytic reduction (SNCR) may be preferred and more effective. SNCR technologies convert NOx to molecular nitrogen via ammonia injection into the furnace at about 1400-1800° F. However, excess ammonia needs to be minimized to avoid conversion of SOx to ammonium bisulfate, which deposits on downstream heat exchange In conclusion, the present invention provides various mechanisms of environmental protection, if needed, far beyond what can be achieved with most coals. As noted above, the present invention provides several embodiments to address the concerns of environmental protection and compliance. The optimization of these methods and embodiments can create a variety of control scenarios to address the specific needs (compliance, economic, etc.) of a particular combustion facility, existing or otherwise.

11

Other Embodiments

General Issues

Finally, an additional embodiment of the present invention may be any combination of the above embodiments. Engineering factors will determine the optimal application for any of the above embodiments, separately or in combination. In any combination of the embodiments, the degree required may be less than specified here due to the combined effects. Again, these concepts and embodiments may be applied to delayed coking, Fluid Coking™, Flexicoking™ and other types of coking processes, available now or in the future.

In view of the foregoing disclosure, it may be within the ability of one skilled in the relevant fields to make alterations to and substitutions in the present invention, without departing from the spirit of the invention as reflected in the appended claims.

CONCLUSION

Thus the production and use of the premium "fuel-grade" petroleum coke, in the manner described in the present invention, provides a superior solid fuel for conventional, coal-fired utility boilers and various other solid-fuel combustion applications. The environmental controls of the present invention also provide unique technology applications with superior control capabilities.

While the above description contains many specificities, these should not be construed as limitations on the scope of the invention, but rather as an exemplification of the embodiments thereof. For example, other possible variations of the invention include those brought about through the substitution of equivalent components or process steps. Accordingly, the scope of the invention should be determined not by the embodiments illustrated, but by the appended claims and their legal equivalents, the appended claims hereby being incorporated herein by reference.

What is claimed is:

1. A process of producing petroleum coke, said process comprising the steps:

(a) obtaining a coke precursor material derived from carbonaceous origin;

(b) subjecting said coke precursor material to a delayed coking process, said delayed coking process performed for sufficient time and at sufficient temperature and under sufficient pressure so as to promote the production of porous sponge petroleum coke; and (c) adding at least one chemical compound of predetermined quality and predetermined quantity to said porous sponge coke in a coke quenching portion of said delayed coking process within a coke drum pressure vessel, wherein said quenching is conducted at a temperature less than 510 degrees Centigrade;

whereby said at least one chemical compound substantially improves the fuel properties, combustion characteristics, ash characteristics, or environmental impacts of said coke when used in a combustion process.

2. A process according to claim 1 wherein said coke precursor material is derived from crude oil, coal, shale oil, or tar sands.

3. A process according to claim 1 wherein said coke is comprised of said sponge coke in an amount in the range of from about 40 to 100% by weight.

4. A process according to claim 1 wherein volatile combustible materials (VCMs) are present in said sponge coke in an amount in the range of from about 13% to about 50% by weight.

5. A process according to claim 1 wherein said at least one chemical compound is selected from the group consisting of chemical adsorbents, sulfur sorbents, hydrocarbon compounds, oxygen-containing compounds, ionizing agents, and any combination thereof.

6. A process according to claim 5 wherein said sulfur sorbents are selected from the group consisting of hydrated lime, limestone, hydrated dolomitic lime, calcium compounds, magnesium compounds, sodium compounds, potassium compounds, alkali metal compounds, alkaline earth compounds, and any combination thereof.

7. A process according to claim 1 wherein said coke precursor material is subjected to an efficient desalting process prior to step (b) and sodium levels are reduced to less than about 15 ppm by weight.

8. A coke made in accordance with a process according to claim 1.

9. A process of making petroleum coke, said process comprising:

(a) providing a coke feed comprising a material derived from carbonaceous origin;

(b) subjecting said coke feed to a delayed coking process, said delayed coking process incorporating a process means to promote the production of petroleum coke having increased porosity and improved adsorption characteristics; and (c) adding at least one chemical compound of predetermined quality and predetermined quantity to said coke in a coke quenching portion of said delayed coking process within a coke drum pressure vessel, said quenching conducted at a temperature less than 510 degrees Centigrade, wherein the increased porosity and improved adsorption characteristics aid in the addition of said at least one chemical compound.

10. A process according to claim 9 wherein said material derived from carbonaceous origin is derived from the group consisting of crude oil, coal, tar sands, and shale oil.

11. A process according to claim 9 wherein said coke is comprised of sponge coke in an amount in the range of from about 40 to 100% by weight.

12. A process according to claim 9 wherein volatile combustible materials (VCMs) are present in said coke in an amount in the range of from about 13% to about 50% by weight.

13. A process according to claim 9 wherein said process means is selected from the group consisting of increasing thermal process quench in said coke drum pressure vessel, lowering heater outlet temperature, increasing coking vessel pressure, adding at least one additive to said coke feed, and any combination thereof.

14. A process according to claim 9 wherein said process means changes the crystalline structure of said coke.

15. A process according to claim 9 wherein said coke has sufficient porosity and sufficient physical and chemical properties to provide low to medium grades of adsorption quality carbon.

16. A process according to claim 9 wherein said coke has a surface area of about 600 square meters per gram or greater.

17. A process according to claim 9 wherein said at least one chemical compound is selected from the group consisting of chemical adsorbents, sulfur sorbents, hydrocarbon compounds, oxygen-containing compounds, ionizing agents, and any combination thereof.

18. A process according to claim 17 wherein said sulfur sorbents are selected from the group consisting of hydrated lime, limestone, hydrated dolomitic lime, calcium compounds, magnesium compounds, sodium compounds, potassium compounds, alkali metal compounds, alkaline earth compounds, and any combination thereof.

19. A process according to claim 17 wherein adding at least one predetermined hydrocarbon compound to a coke quench media promotes an increase of the VCM content of said coke to within the range of from about 13% to about 50% by weight.

* * * * *